US012782007B2

(12) United States Patent
Christie et al.

(10) Patent No.: US 12,782,007 B2
(45) Date of Patent: Nov. 3, 2026

(54) GEOTHERMAL ENERGY SYSTEM

(71) Applicant: Stoic Transitional Resources Inc., Calgary (CA)

(72) Inventors: Grant John Christie, Calgary (CA); Philip A. Keele, Calgary (CA); Joseph Tarrant, Calgary (CA)

(73) Assignee: Stoic Transitional Resources Inc., Calgary (CA)

( * ) Notice: Subject to any disclaimer, the term of this patent is extended or adjusted under 35 U.S.C. 154(b) by 0 days.

(21) Appl. No.: 19/299,192

(22) Filed: Aug. 13, 2025

(65) Prior Publication Data

US 2025/0377137 A1 Dec. 11, 2025

Related U.S. Application Data

(63) Continuation-in-part of application No. 19/172,478, filed on Apr. 7, 2025, which is a continuation-in-part of application No. 18/908,701, filed on Oct. 7, 2024.

(60) Provisional application No. 63/543,021, filed on Oct. 6, 2023.

(51) Int. Cl.

| | |
|---|---|
| ***F24T 10/17*** | (2018.01) |
| ***F24T 10/20*** | (2018.01) |
| ***F24T 50/00*** | (2018.01) |
| *F24T 10/00* | (2018.01) |

(52) U.S. Cl.

CPC ..... *F24T 10/17* (2018.05); *F24T 10/20* (2018.05); *F24T 50/00* (2018.05); *F24T 2010/56* (2018.05)

(58) Field of Classification Search

CPC ..... F24T 10/17; F24T 10/20; F24T 2010/56; F24T 50/00; Y02E 10/10

See application file for complete search history.

(56) References Cited

U.S. PATENT DOCUMENTS 3,805,885 A * 4/1974 Van Huisen ..... F24T 10/20 165/45
3,857,244 A 12/1974 Faucette
3,874,174 A * 4/1975 Greene ..... F24T 10/20 165/45

(Continued)

FOREIGN PATENT DOCUMENTS

CN 112065521 A 12/2020
CN 113091335 A 7/2021

(Continued)

OTHER PUBLICATIONS

Gascuel, et al., "Design and optimization of deep coaxial borehole heat exchangers for cold sedimentary basins", Geothermics, vol. 105, 2022.

(Continued)

*Primary Examiner* — Tho V Duong

(74) *Attorney, Agent, or Firm* — Peacock Law P.C.; Marco H. Santamaria; Laura Ingersol

(57) ABSTRACT

A system for geothermal heating, the system comprising a forced geothermal circuit in communication with a well bore; a gyroid heat exchanger, the gyroid heat exchanger in communication with a closed loop working fluid circuit; and a production casing. A method of optimizing energy recovery from a geothermal well comprising selecting a well bore gyroid heat exchanger depth; and adjusting an annulus liquid level.

17 Claims, 81 Drawing Sheets

(56) References Cited

U.S. PATENT DOCUMENTS

| | | | | |
|---|---|---|---|---|
| 4,043,129 | A * | 8/1977 | McCabe | F03G 4/074 60/641.2 |
| 4,112,745 | A | 9/1978 | Mccabe et al. | |
| 4,201,060 | A * | 5/1980 | Outmans | F24T 10/30 165/45 |
| 4,220,202 | A * | 9/1980 | Aladiev | E21B 43/24 166/57 |
| 4,223,729 | A | 9/1980 | Foster | |
| 4,492,083 | A | 1/1985 | Mccabe et al. | |
| 6,142,215 | A | 11/2000 | Paulsen et al. | |
| 7,011,154 | B2 | 3/2006 | Maher et al. | |
| 9,541,309 | B2 | 1/2017 | Colwell | |
| 11,441,394 | B1 | 9/2022 | Joshi et al. | |
| 11,585,330 | B1 | 2/2023 | David | |
| 11,708,818 | B1 | 7/2023 | Cook et al. | |
| 12,048,115 | B2 | 7/2024 | Cairone, Jr. | |
| 12,305,467 | B2 | 5/2025 | Randolph | |
| 12,385,673 | B1 | 8/2025 | Nielson | |
| 2006/0196668 | A1 | 9/2006 | Burge et al. | |
| 2010/0272515 | A1 | 10/2010 | Curlett | |
| 2012/0001429 | A1 | 1/2012 | Saar et al. | |
| 2013/0043678 | A1 | 2/2013 | Saar et al. | |
| 2015/0122453 | A1 | 5/2015 | Colwell | |
| 2015/0300327 | A1 | 10/2015 | Sweatman et al. | |
| 2020/0033070 | A1 | 1/2020 | Vlahinos et al. | |
| 2021/0025623 | A1 | 1/2021 | Holtzman | |
| 2021/0062682 | A1 | 3/2021 | Higgins et al. | |
| 2022/0018577 | A1 | 1/2022 | Randolph | |
| 2022/0082091 | A1 * | 3/2022 | Lu | F01K 13/02 |
| 2022/0349286 | A1 | 11/2022 | Bowdon et al. | |
| 2022/0373230 | A1 | 11/2022 | Chorn et al. | |
| 2023/0242399 | A1 | 8/2023 | Al-Qasim et al. | |
| 2023/0313652 | A1 | 10/2023 | Benson et al. | |
| 2024/0167461 | A1 | 5/2024 | Hogg | |
| 2024/0318872 | A1 | 9/2024 | Vestavik | |
| 2025/0116430 | A1 | 4/2025 | Christie et al. | |
| 2025/0198662 | A1 | 6/2025 | Daprocida | |
| 2025/0257907 | A1 | 8/2025 | Christie et al. | |
| 2025/0362059 | A1 | 11/2025 | Christie et al. | |
| 2026/0153273 | A1 | 6/2026 | Symons et al. | |

FOREIGN PATENT DOCUMENTS

| | | | | |
|---|---|---|---|---|
| DE | 102020108518 | A1 * | 9/2021 | B33Y 80/00 |
| FR | 3099237 | A1 | 1/2021 | |
| JP | 572943 | | 1/1982 | |
| JP | 57002943 | | 1/1982 | |
| JP | 2020112277 | A | 7/2020 | |
| JP | 7153978 | B1 | 10/2022 | |
| WO | WO-2012066403 | A1 * | 5/2012 | F24T 10/20 |
| WO | 2018112610 | A1 | 6/2018 | |
| WO | 2019157341 | A1 | 8/2019 | |
| WO | 2022198336 | A1 | 9/2022 | |
| WO | 2022269305 | A1 | 12/2022 | |
| WO | 2023177871 | A1 | 9/2023 | |
| WO | 2025074160 | A1 | 4/2025 | |
| WO | 2026120477 | A1 | 6/2026 | |

OTHER PUBLICATIONS

Mukhina, et al., "Enhanced Oil Recovery Method Selection for Shale Oil Based on Numerical Simulations", ACS Omega vol. 6, 2021, 23731-23741.

Akhmadullin, et al., "Design and Analysis of Electric Power Production Unit for Low Enthalpy Geothermal Reservoir Applications", International Journal of Earth, Energy and Environmental Sciences, vol. 8, No. 6, section II, Fig. 2, 2014, 448-454.

Alimonti, et al., "The wellbore heat exchangers: A technical review", Renewable Energy, vol. 123, Fig. 6-8, 2018, 353-381.

* cited by examiner

GEOTHERMAL ENERGY SYSTEM

CROSS-REFERENCE TO RELATED APPLICATIONS

This application is a Continuation in Part application that claims priority to and the benefit of U.S. patent application Ser. No. 19/172,478, entitled "Geothermal Energy System", filed on Apr. 7, 2025, which is a Continuation in Part application that claims priority to and the benefit of the filing of U.S. patent application Ser. No. 18/908,701, entitled "Geothermal Energy System", filed on Oct. 7, 2024, which claims priority to and the benefit of the filing of U.S. Provisional Patent Application No. 63/543,021 entitled "Geothermal Energy System", filed on Oct. 6, 2023 and the specification and claims thereof are incorporated herein by reference.

BACKGROUND OF THE INVENTION

Field of the Invention (Technical Field)

Embodiments of the present invention relate to a system and method for producing geothermal energy preferably using a closed loop system.

Background

Current binary geothermal processes recover energy by producing hot subterranean water to the surface and flashing it to steam to drive a turbine, for electricity, or to heat a utility thermal medium. The higher the mass flow and temperature of the steam produced the more energy that can be extracted. By extracting energy, the produced steam is condensed and the resulting water stream is returned to the aquifer at a lower temperature. The injected water stream eventually migrates back to the production well bore through the reservoir gathering geothermal energy in the process. This process extracts latent heat from the rock matrix between the injector and producer wells along with the enthalpy from the surrounding aquifer fluid.

Along with the produced steam in the binary process, greenhouse gases ("GHG") are also produced and are invariably vented to the atmosphere in this process. These systems also face challenges from the deposition of minerals as the aquifer water flashes to steam resulting in plugging of the reservoir rock, well bore, and surface facilities. In addition, the flashing and condensing process conditions result in high rates of corrosion within the facility.

Traditional binary geothermal systems produce hot water from deep geological layers that convert to steam at the surface as the pressure is reduced. A common use for the steam produced is to drive a turbine and produce electricity or to provide direct utility heat. The resulting condensed steam is cooled before being re-injected. However, during this process, significant quantities of $CO_2$ and other harmful gases are produced. These gases are unable to be condensed and are often vented. Typical gas emission quantities from open geothermal systems vary from 75 kilograms per megawatt hours ("kg/MWh") up to 1300 kg/MWh depending on the geological zone being produced. Furthermore, in producing the geothermal steam, silicates and other scale forming minerals are created in the reservoir or within the associated wells and facilities. Scale buildup significantly impacts the productivity and operating cost of any open geothermal system. The scale buildup leads to additional drilling cost to extend wells to new unplugged zones, and to higher maintenance costs for the surface facilities.

An alternative to the binary process in the art is the closed loop geothermal system. This comprises a well bore, a closed loop heat medium circuit, and a well bore heat exchanger ("WBHX") at the base of the well to collect geothermal heat from the reservoir. These systems aim to avoid the production of GHG and mitigate mineral deposition in the reservoir by avoiding flashing of the aquifer water. However, closed loop systems tend to recover an order of magnitude less energy than binary processes based on current designs.

The primary factor governing energy recovery in closed loop systems is the rate of heat transfer from the surrounding rock matrix to the WBHX. In closed systems, there are two heat transfer mechanisms that govern energy recovery, conduction and natural convection. These mechanisms are highly-dependent on the porosity, permeability, saturation, and temperature of the geothermal reservoir. Industry approaches to maximize energy recovery with closed loop systems focus on location selection, with high subsurface temperatures, permeability, and water saturation. In addition, closed loop systems look to maximize the surface area of the WBHX by increasing the well bore diameter or by applying multi laterals to increase the number of legs. These constraints limit the number of viable locations for geothermal energy recovery and the amount of energy that can be recovered from any given system. In addition, the relatively small reservoir foot print of the WBHX, when compared to binary production and injector wells, limits the potential rock volume available for latent heat recovery, thus further limiting the energy recovery potential.

Closed loop geothermal systems offer significant benefits over traditional open hole or dry steam systems. The basic principle is that a heat transfer fluid is circulated in a closed loop from the surface to the target geothermal zone where it heats up before being returned to the surface. The resulting hot heat transfer fluid is then used to produce electricity or provide utility heat. These designs do not produce carbon dioxide or other potentially environmentally harmful gases. They significantly reduce the impact from silicate and mineral plugging in the reservoir and eliminate scale buildup within surface equipment, reducing operating costs.

Closed loop geothermal energy systems rely on recovering stored latent heat energy from the immediately surrounding reservoir rock as well as from continual heat transfer from the surrounding rock matrix. The heat transfer is delivered by a combination of conduction and convection mechanisms. The latent heat recovery and heat transfer performance are affected by several factors, including rock composition, fluid saturation, porosity, and permeability. The main driver for heat transfer from convection is determined by the permeability, porosity and the degree of saturation of the rock matrix. The main heat transfer mechanism for closed loop geothermal systems is from thermal conduction. The equation describing the heat transfer is shown in Equation ("Eq.") (1).

$$Q_{cond} = \frac{2\pi(T_2 - T_1)}{\frac{k}{hr_2}\ln\left(\frac{r_2}{r_1}\right)} \tag{1}$$

Wherein:

$Q_{cond}$ is the enthalpy from conduction in watts ("W");

k is the average thermal conductivity in watts per meters Kelvin ("W/m·K");

h is the overall heat transfer coefficient in watts per meters squared Kelvin ("W/m²·K");

$T_1$ is the Well Bore Heat Exchanger ("WBHX") temperature in Kelvin ("K");

$T_2$ is the Reservoir Temperature (K); $r_2$ is the effective infinite radius of the heat effected zone around the geothermal well; and $r_1$ is the radius of the WBHX.

Based on Eq. (1), for a system in equilibrium between thermal conduction and convection, it can be shown that $r_2$ for the heat effected zone can be approximated by Eq. (2):

$$r_2 = \frac{k}{h} \tag{2}$$

Heat transfer via conduction is driven by the average thermal conductivity of the rock, determined by chemical composition, saturation, and porosity of the rock, the radius of the WBHX, and the temperature differential between the reservoir and the WBHX. Conductivity for typical reservoir rocks can vary from as low as 0.5 W/m·K up to 10 W/m·K while the heat transfer coefficient can vary from <50 milliwatts per meters squared Kelvin ("mW/m²·K") for tight low permeability zones, with permeability less than 10 millidarcy ("mD"), to over 2000 mW/m²·K for 1000 mD course sandstone. These values play a significant role in determining the performance of a closed loop geothermal system.

While heat conduction is mainly determined by the physical parameters of the reservoir rock, convection heat transfer involves more dynamic parameters. The rate of heat transfer via convection is described by Equations 3 to 8.

$$Qconv = h \cdot A' \cdot (T_2 - T_1) \tag{3}$$

$$h = \frac{Nu \cdot k}{r_1} \tag{4}$$

$$Nu = 0.989 Re^{0.33} Pr^{0.33} \tag{5}$$

$$Re = \frac{U \cdot r_1}{\nu} \tag{6}$$

$$Pr = \frac{\mu \cdot Cp_f}{k} \tag{7}$$

$$U = \frac{2\pi \cdot K \cdot L_w (P_2 - P_1)}{\mu \cdot \phi \cdot \ln\left(\frac{r_2}{r_1}\right) A} \tag{8}$$

Wherein:

A' is the surface area of the WBHX in meters squared ("m²");

Nu is the Nusselt number for low flow conditions where Reynolds number ("Re")<0.4;

Re is the Reynolds number;

Pr is the Prandtl number;

U is the Darcy velocity of fluid passing through a course medium in meters per second ("m/sec");

A is the cross sectional flow path area simplified to $r_1$ times well lateral length (m²);

k is the course medium permeability factor (m²);

$P_2$ is the reservoir pressure in Pascals ("Pa");

$P_1$ is the pressure at WBHX (Pa);

μ is the dynamic viscosity of the reservoir fluid in Newton seconds per meter squared ("Ns/m²");

u is the kinematic viscosity of the reservoir fluid in meters squared per second ("m²/s");

L is the distance between $r_1$ and $r_2$ for close circuit designs and $r_1$ and FGC wellbore for FGC design in meters ("m");

$L_w$ is the effective well lateral length (m); and

ϕ is the rock porosity percentage.

In currently deployed closed loop geothermal systems the heat transfer is dominated by conductive heat transfer mechanisms. Convection heat transfer contributes between 3% to 10% of the total recovered heat at the WBHX depending on the reservoir permeability. The lower the permeability the lower the contribution from convection heat transfer. Conductive heat transfer relies on induced fluid movement, expressed as U in Eq. 6, for the calculation of the fluid Reynolds number. However, with current closed loop geothermal systems, the only driving force for fluid movement in the reservoir, absent of a mobile aquifer, is from an induced buoyancy effect caused by cooling the reservoir fluid adjacent to the WBHX. While reducing the WBHX temperature increases the heat transfer rate, for both conductive and convective mechanisms, this approach results in lower inlet temperatures to surface facilities for heat extraction. Lower surface inlet temperatures result in a reduced overall efficiency of the geothermal system. While optimization is required to balance the rate of heat extraction, surface inlet temperature, energy recovery efficiency, and the ultimate life of the geothermal system, the solution space is limited.

Over time the total available energy that can be recovered from a geothermal system is the sum of the latent heat and the heat transferred to the WBHX as mentioned above. The equation governing the available heat recovery from latent heat is as follows:

$$Q_{total} = Q_{latent} + Q_{Conv} + Q_{cond} \tag{9}$$

$$Q_{latent} = m_r \cdot Cp_r \cdot \frac{(T_2 - T_1)}{2} \tag{10}$$

$$m_r = \pi \cdot (r_2^2 - r_1^2) \cdot Lw \cdot (1 - \phi) \tag{11}$$

Wherein:

$Q_{total}$ is the total energy available for geothermal extraction (W);

$Q_{latent}$ is the energy from the stored latent heat energy within the thermal extraction zone (W);

$m_r$ is the rock mass within the thermal extraction zone in kilograms ("kg"); and $Cp_r$ is the thermal heat capacity of the reservoir rock in watts per kilogram Kelvin ("W/kg·K").

The primary drivers governing the recoverable heat from stored latent heat energy in the reservoir are determined by the temperature drop between the WBHX and $r_2$ and the total rock volume that experiences the resulting thermal gradient (the heat-affected zone). The sum energy production over the life of the geothermal well is made up from a combination of latent, conduction, and convection heat energy. However, once the thermal gradient in the reservoir reaches a radial distance of $r_2$ from the WBHX, the available energy, and/or the heat transfer fluid surface temperature, will decline due to an increase in thermal resistance over the available conductive capacity of the reservoir to supply heat.

As the permeability of the reservoir increases, reservoir fluid becomes more mobile to transport heat energy. Consequently, the convection heat transfer coefficient h also increases for the system. As described in equation (2) as h is increased, $r_2$ for the closed loop systems decreases.

Consequently, closed loop systems in high permeability reservoirs have less latent heat available for extraction over the life of the well. Wells in high permeability reservoirs will produce at a higher energy output due to the high h value as predicted by Eq. 3, however, the production rate will reach a point of decline faster. A mobile aquifer in the reservoir can largely mitigate a reduced heat effected zone, however, aquifer mobility is not easily predicted and can vary significantly based on geology. The requirement for a mobile aquifer to sustain production becomes another limiting factor for locating viable sites for closed loop technology.

Closed loop geothermal technologies look to overcome the limitations of heat transfer from the reservoir rock by primarily increasing the total area of the casing exposed to the rock matrix to collect the energy. These approaches result in longer or larger casing designs or designs that incorporate multi lateral well construction to increase the total area. Alternatively, technologies look to optimize their energy production by adjusting the target depth for geothermal energy extraction. The deeper the geothermal system is installed the higher the temperature and the greater the available thermal gradient to drive heat transfer. However, the deeper the target layer the less permeable the rock matrix becomes, quickly diminishing the benefits of higher temperature.

Closed loop geothermal technologies Operators do not reverse the flow direction of closed loop system because vacuum insulated tubing ("VIT") would have to be used outside casing of the loop. Operators do not use vacuum insulated tubing and instead use normal casing because it is cheaper and comes in larger sizes. Operators would still need VIT for the inner core to keep the cold fluid from cross exchanging with the hot fluid. VIT tubing does not exist come in large enough sizes to be used as the outer casing. Therefore, operators would lose more net heat and experienced reduce throughput performance if the flow direction was reversed. The cost of operating a closed loop system with a reverse flow direction would also be highly cost prohibitive. Operators also do not use oil and gas packer systems to achieve a reverse flow because reverse flow would be difficult to implement and still maintain a pipe-in-pipe structure.

This geothermal heating system of the present invention provides an economic optimization opportunity between drilling cost, surface facility cost for power production, and total recoverable energy. Generally, the shallower the target zone, the lower the drilling costs and the higher the permeability. However, while the higher permeability allows for higher heat transfer, the lower recovery temperatures drive the surface facility costs up, rapidly overwhelming the benefits of reduced drilling costs on shallower targets. Conversely, deeper targets will yield a higher temperature and reduce the cost for power generation facilities. However, the lower permeability at depth and higher well costs undermine the benefits of higher temperature.

The geothermal heating system of the present invention overcomes the limitations of the prior art by incorporating a recirculation circuit into a WBHX to activate reservoir fluid to transport cooled reservoir fluid away from the WBHX and transport fresh reservoir fluid to the WBHX.

BRIEF SUMMARY OF THE INVENTION

Embodiments of the present invention relate to a system for geothermal heating, the system comprising: a forced geothermal circuit in communication with a well bore; a gyroid heat exchanger; the gyroid heat exchanger in communication with a closed loop working fluid circuit; and a production casing. In another embodiment, the closed-loop working fluid circuit comprises an annulus. In another embodiment, the closed-loop working fluid circuit comprises insulated tubing. In another embodiment, the system further comprises a pump. In another embodiment, the pump is an electric submersible pump.

In another embodiment, the system further comprises a working fluid. In another embodiment, the working fluid is pressurized. In another embodiment, the working fluid comprises a liquid phase. In another embodiment, the working fluid comprises a mixed-phase. In another embodiment, the working fluid comprises a dry phase. In another embodiment, the working fluid comprises a single phase.

In another embodiment, the system further comprises a multilateral channel. In another embodiment, the system further comprises a polished bore receptacle. In another embodiment, the system further comprises a flow diverter. In another embodiment, the system further comprises a triply periodic minimal surface lattice. In another embodiment, the triply periodic minimal surface lattice comprises a flow baffling. In another embodiment, the working fluid has a high enthalpy density.

A method of optimizing energy recovery from a geothermal well comprising: selecting a well bore gyroid heat exchanger depth; and adjusting an annulus liquid level. In another embodiment, the method further comprises matching a working fluid operating pressure to a static head. In another embodiment, the method further comprises controlling a boiling point of a working fluid.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, show one or more embodiments of the present invention and, together with the description, serve to explain the principles of the invention. The drawings are only for the purpose of illustrating one or more embodiments of the invention and are not to be construed as limiting the invention. In the drawings.

DETAILED DESCRIPTION OF THE INVENTION

Figure 1:
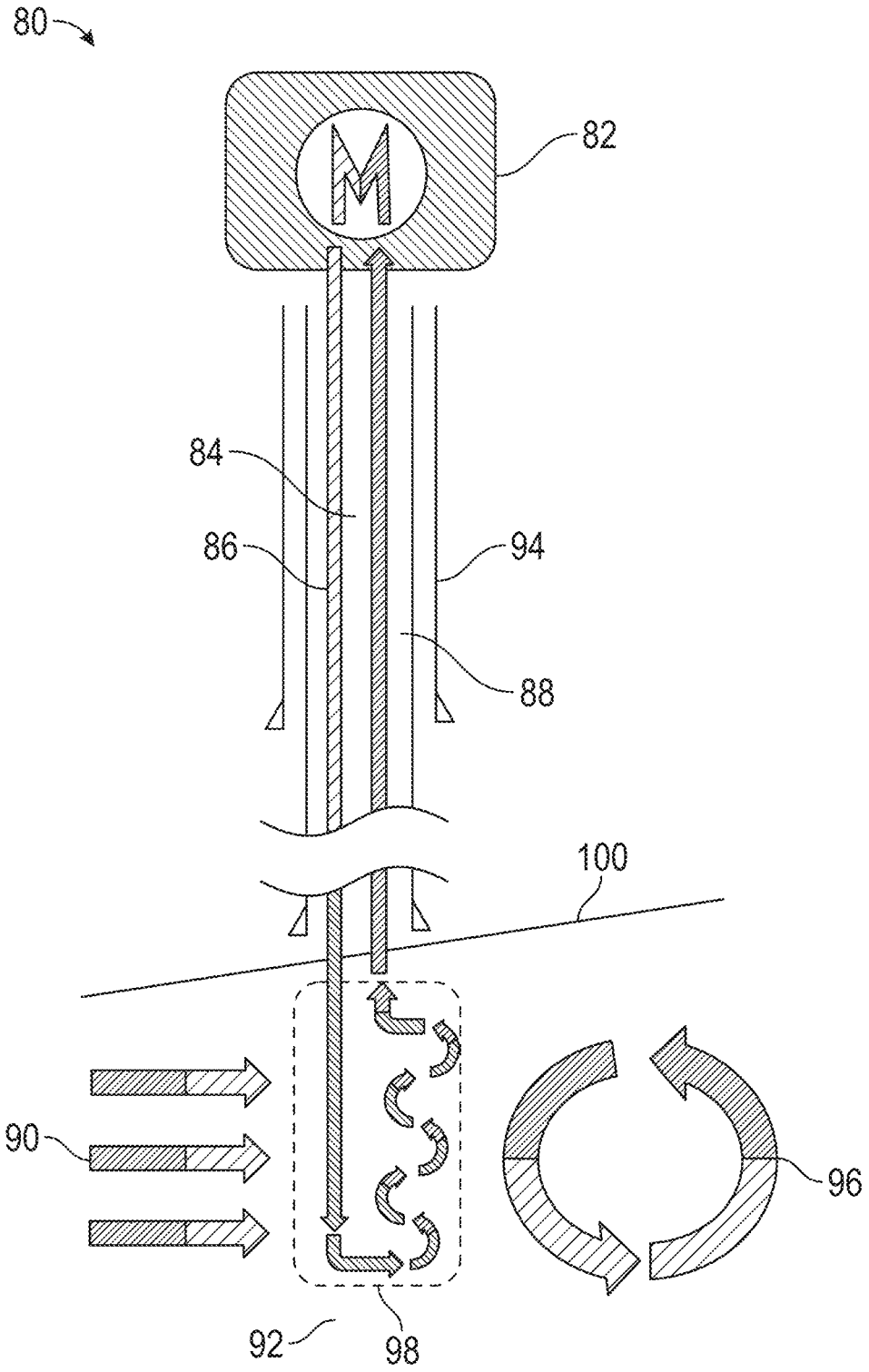
FIG. 1 (Prior Art)
FIG. 1 is a diagram showing a closed loop geothermal system known in the art.

Embodiments of the present invention relate to a geothermal heating system comprising a forced geothermal circuit ("FGC") and well bore heat exchanger. The FGC may comprise a closed loop system.

The term "well bore" as used herein means a hole in the ground to extract minerals from a mineral reservoir or generate geothermal heat.

The term "heat exchanger" as used herein means an apparatus to extract geothermal heat.

The term "closed loop system" as used herein means a geothermal heat generating system wherein a heat transfer fluid, e.g., circulation fluid, and/or thermal transfer fluid, is circulated in a closed loop from the surface to the target geothermal zone where the fluid heats up before being returned to the surface.

The terms "mineral" or "minerals" as used herein mean oil; bitumen; natural gas; oil sands; hydrocarbon; aqueous solution comprising a hydrocarbon; produced water; viscous heterogenous mixture; rock; stone; clay; metal, including but not limited to, a rare earth element, a base metal, a precious metal, a platinum group metal, or a combination thereof; sand; radioactive element; or a material or combination thereof.

The terms "fluid" or "fluids" as used herein means any liquid, aqueous solution, gas, or combination thereof.

Embodiments of the present invention may address the issues of limited energy recovery and viable locations for closed loop systems. The FGC may be used in combination with a closed loop geothermal WBHX to force circulation of the surrounding reservoir fluid between the WBHX and the surrounding matrix. An additional proximate well bore may be drilled or a sidetrack leg may be drilled proximate to an existing geothermal. A pumping mechanism may be used to circulate fluid between the FGC well and/or sidetrack and the immediate annulus space around the WBHX to increase and/or improve the reservoir heat extraction surface area; the overall heat transfer coefficient; the temperature of the fluid contacting the WBHX; the effective rock volume available for latent heat energy recovery; or a combination thereof. The rate of heat recovery, compared to an equivalent closed loop system, may be increased by at least about 200%, about 200% to 1,200%, about 300% to about 1,100%, about 400% to about 1,000%, about 500% to about 900%, about 600% to about 800%, or about 1,200%. The FGC may improve the economics for a new or existing mineral location and may apply closed loop geothermal energy production towards new applications.

The geothermal heating system of the present invention may enhance the performance of existing geothermal energy recovery systems; reduce GHG; increase energy recovery; increase the geothermal well operating temperature at surface; or a combination thereof relative to other heating systems. Heated aqueous solution generated by the geothermal heating system may be used to enhance oil recovery water flood schemes and improve oil and gas recovery efficiency. The geothermal heating system may provide hot water for injection into shallow wells and mobilizing in situ oil while leaving fines and other particulates in place, thereby replacing mining operations for oil sands production.

The geothermal heating system may convert existing oil and gas wells in low permeability geological zones to geothermal energy production and extract hydrocarbons from tight reservoirs and shale. Hydrocarbons can be extracted from the surrounding matrix while simultaneously recovering geothermal energy by circulating a hydrocarbon leaching geothermal fluid in the FGC.

The geothermal heating system may produce hydrogen by combining hydrocarbon extraction and geothermal power generation from a closed loop FGC. The geothermal heating system may produce emission-free petrochemical products and carbon based materials combining hydrocarbon extraction and geothermal power generation from a closed loop FGC.

The geothermal heating system may reduced the overall pressure drop and energy requirements of the surface loop as the fluid no longer is required to go to the toe of the well. The surface loop surface pump may be downsized or eliminated to allow fluid density differences to drive the surface loop.

The geothermal heating system allows closed loop geothermal systems to increase their heat recovery to at least match and exceed binary system well performance. Geothermal heating system may be retrofit to existing oil and gas wells to allow them to become economically viable as there is no side track required to form the FGC.

Smaller bottom hole casing size requirements may allow the FGC to be applied to oil and gas wells, in addition to geothermal wells, and take advantage of depleted and oil and gas reservoirs.

Table 1 below shows exemplary geothermal well characteristics. The table shows low, baseline, and high measurements for a geothermal well.

TABLE 1

| | LOW | BASELINE | HIGH |
|---|---|---|---|
| Enthalpy, kilojoules/kilogram (kJ/kg) | <800 | 1,200 | >2,700 |
| Reservoir Temperature, degrees Celsius (° C.) | <180 | 200 | >230 |
| Reservoir Pressure, bar | Steam-Dominated Reservoir | 50 | Liquid-Dominated Reservoir >100 |
| Production Liner Diameter, inches | 7 | 9 and 5/2 | 10 and 3/4 |
| Feed Zone Depth and/or Location, meters | <1,000 | 1,400 | >2,000 |
| Feed Zone Permeability, millidarcy | 1 | 60 | 200 |
| Well Bottom (TD), meters | 1,500 | 2,000 | 3,000 |

Turning now to the figures, FIG. 1 shows an existing closed loop geothermal system 80 comprising heat exchanger 82, thermal circulation system 84, well bore 94, and bottom hole heat exchanger 98. Thermal circulation system 84 is disposed in well bore 94 and comprises conduits for transporting heated and non-heated fluid. Bottom hole heat exchanger 98 is disposed in geothermal reservoir rock matrix 92 below surface 100 and is in contact with an aquifer fluid. Non-heated fluid 86 flows through thermal circulation system 84 disposed in well bore 94 and enters bottom hole heat exchanger 98. Reservoir heat 90 is transferred to fluid disposed in bottom hole heat exchanger 98. Reservoir heat is transferred to the fluid disposed in bottom hole heat exchanger 98 via convection cycle 96 produced by the aquifer fluid.

Figure 2:
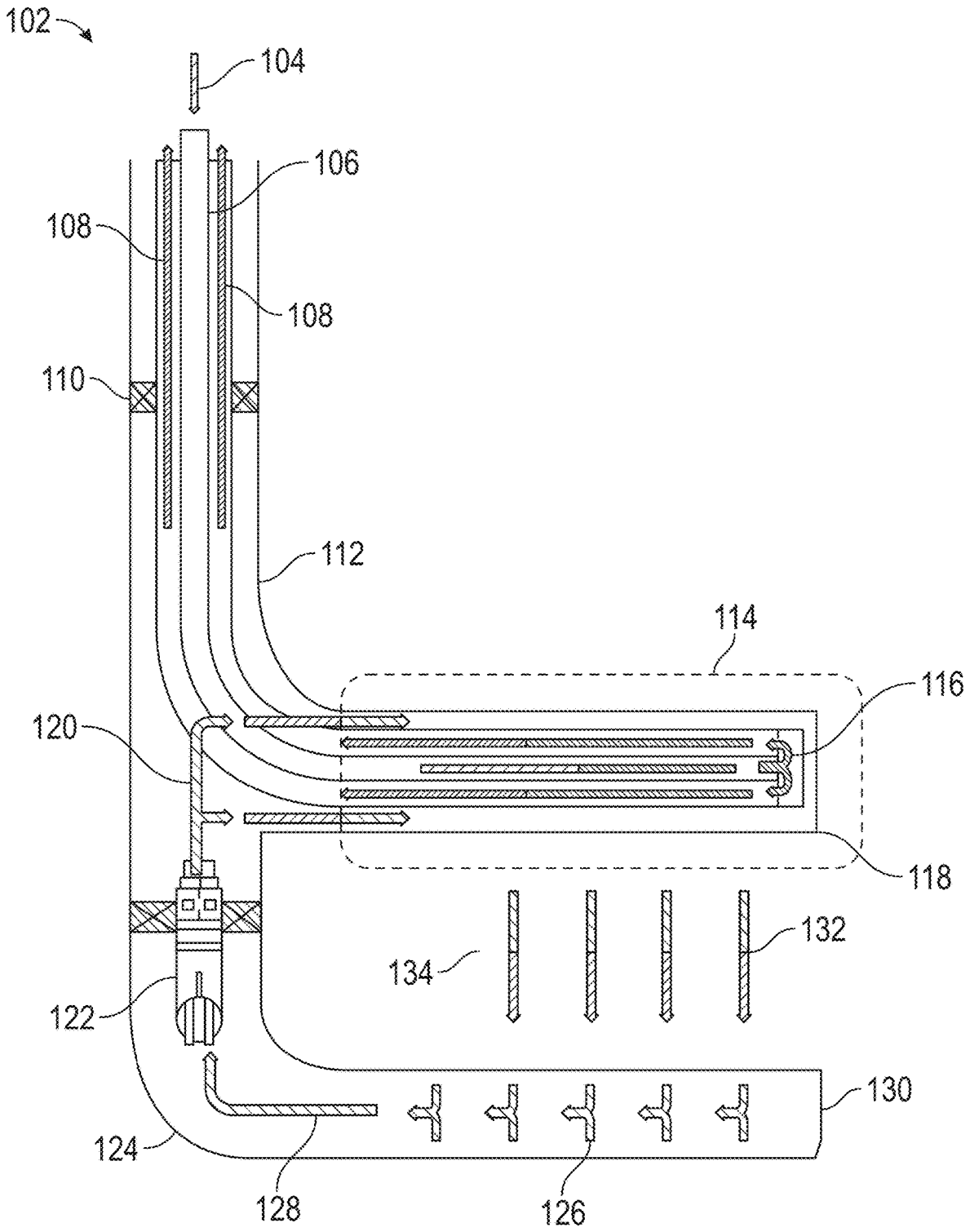
FIG. 2 is a diagram showing a geothermal heating system comprising a sidetrack, according to an embodiment of the present invention.

FIG. 2 shows geothermal heating system comprising sidetrack 102 comprising thermal circulation system 106, vertical geothermal well bore 110, pump 122, sidetrack 124, sidetrack bore hole 130, WBHX 114 comprising heat exchanger 116, and WBHX well bore 112. Pump 122 may comprise an electric submersible pump ("ESP"). Thermal circulation system 106 is disposed within vertical geothermal well bore 110. High-permeability reservoir rock 134 is disposed between sidetrack bore hole 130 and WBHX 114. Fluid 104 enters thermal circulation system 106 and flows into heat exchanger 116 of WBHX 114. Heated fluid stream 108 flows out of heat exchanger 116 to the surface via thermal circulation system 106. Hot reservoir fluid from pump 122 enters anulus space 118 to increase the temperature of fluid 104. Circulated reservoir fluid 132 flows out of anulus space 118, passes through high-permeability reservoir rock 134, and enters sidetrack bore hole 130 where it mixes with non-circulated reservoir fluid 126. Mixed reservoir fluid 128 then enters pump 122, which exits as fluid flow 120.

Figure 3:
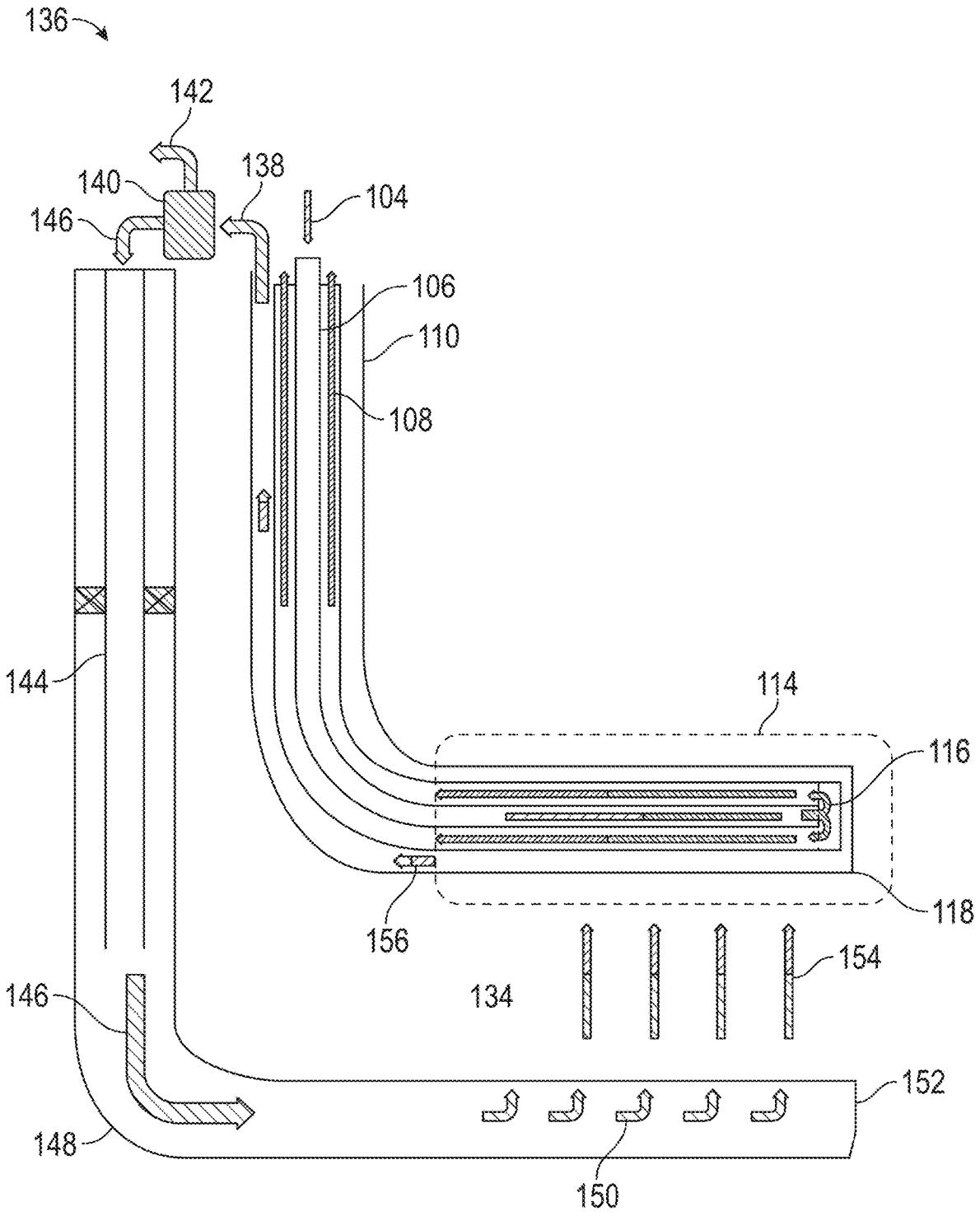
FIG. 3 is a diagram showing a geothermal heating system comprising a proximate wellbore, according to an embodiment of the present invention.

FIG. 3 shows geothermal heating system comprising a proximate wellbore 136 comprising thermal circulation system 106, vertical geothermal well bore 110, proximate well bore 144, matching kickoff segment 148, bore hole 152, WBHX 114 comprising heat exchanger 116, separation and pumping module 140, and WBHX wellbore leg 156. Thermal circulation system 106 is disposed within vertical geothermal well bore 110. High-permeability reservoir rock 134 is disposed between bore hole 152 and WBHX 114. Fluid 104 enters thermal circulation system 106 and flows into comprising heat exchanger 116 of WBHX 114. Circulation fluid 154 flows through high-permeability reservoir rock 134 and enters annulus space 118 to increase the temperature of fluid 104. Heated circulation fluid 154 contacts and captures minerals sequestered in high-permeability reservoir rock 134 while flowing through high-permeability reservoir rock 134. Heated fluid stream 108 flows out of heat exchanger 116 to the surface via thermal circulation system 106. Mineral-containing circulation fluid 138 passes through thermal circulation system 106 and enters separation and pumping module 140. Separation and pumping module 140 separates circulation fluid 138 into minerals 142 and purified circulation fluid 146. Purified circulation fluid 146 flows through proximate well bore 144 and matching kickoff segment 148, and enters bore hole 152. Purified circulation fluid 146 flows out of bore hole 152 along path 150.

Figure 4:
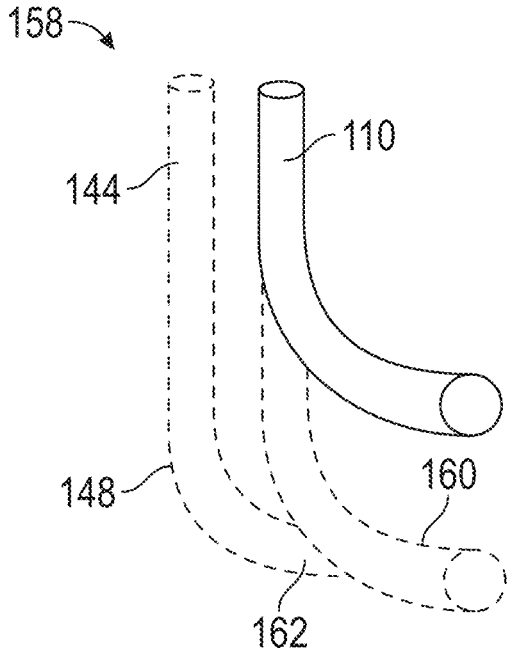
FIG. 4 is a diagram showing well bore configurations, according to an embodiment of the present invention.

FIG. 4 shows well bore configurations 158 comprising vertical geothermal well bore 110, proximate well bore 144, matching kickoff segment 148, sidetrack 160, leg intersection 162. Vertical geothermal well bore 110 is in communication with sidetrack 160. Proximate well bore 144 is disposed beside vertical geothermal well bore 110 comprising matching kickoff segment 148. Optionally, matching kickoff segment 148 may be in communication with sidetrack 160.

Figure 5:
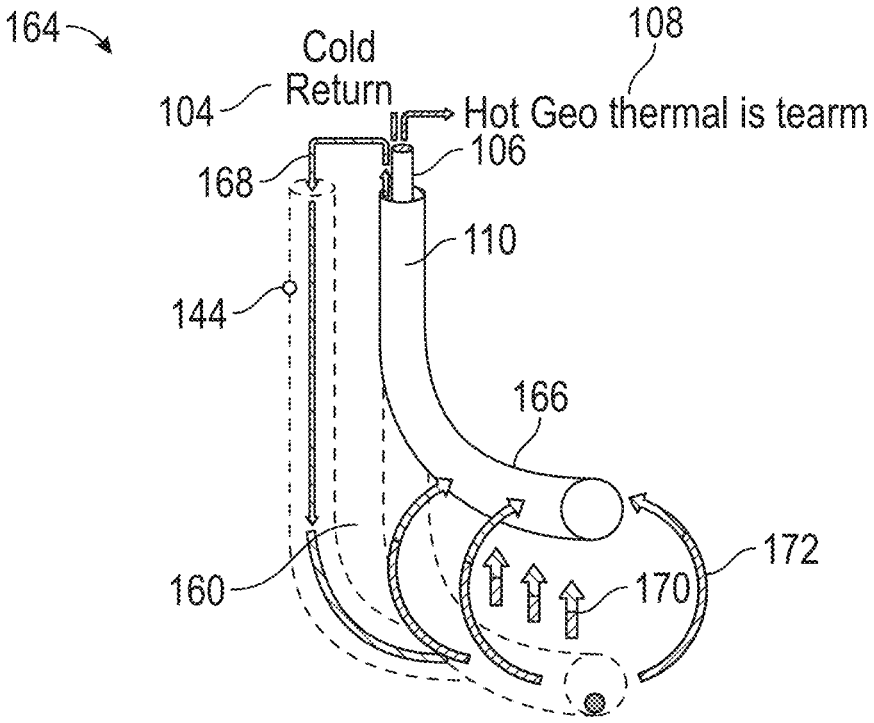
FIG. 5 is a diagram showing a well bore configuration with fluid flow path, according to an embodiment of the present invention.

FIG. 5 shows well bore configuration with fluid flow path 164 comprising thermal circulation system 106, vertical geothermal well bore 110, proximate well bore 144, and well bore 166. Optionally, well bore configuration with fluid flow path 164 may comprise sidetrack 160 instead of proximate well bore 144. Circulation fluid 168 may flow in a co-current or counter-current direction and recirculates between vertical geothermal well bore 110 and proximate well bore 144 or sidetrack 160. Circulation fluid 168 flows from sidetrack 160 to vertical geothermal well bore 110 according to paths 170 and 172. Fluid 104 enters thermal circulation system 106, absorbs heat from circulation fluid 168 and exits thermal circulation system 106 as heated fluid stream 108.

Figure 6A:
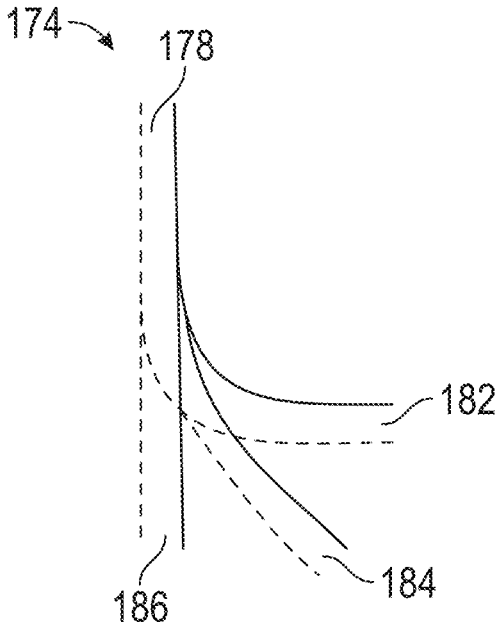
FIGS. 6A and 6B are diagrams showing spatial configuration for a geothermal heating system, according to an embodiment of the present invention.
Figure 6B:
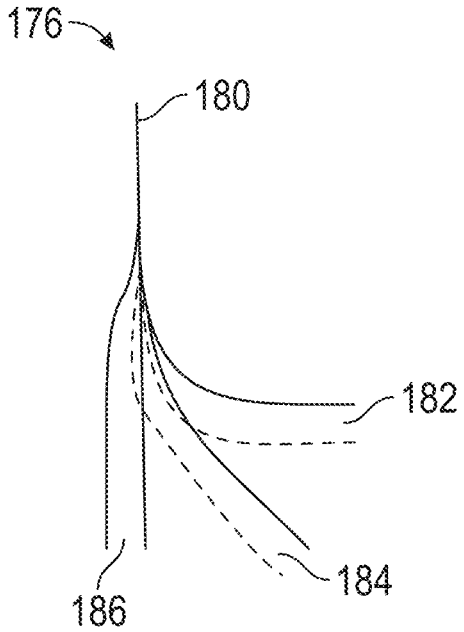

FIGS. 6A and 6B show spatial configurations 174 and 176 for a geothermal heating system of the present invention. Spatial configuration 174 shows proximate well configuration 178 that may be oriented into horizontal well configuration 182, deviated well configuration 184, or vertical well configuration 186. Spatial configuration 176 shows sidetrack well configuration 180 that may be oriented into horizontal well configuration 182, deviated well configuration 184, or vertical well configuration 186.

Figure 7:
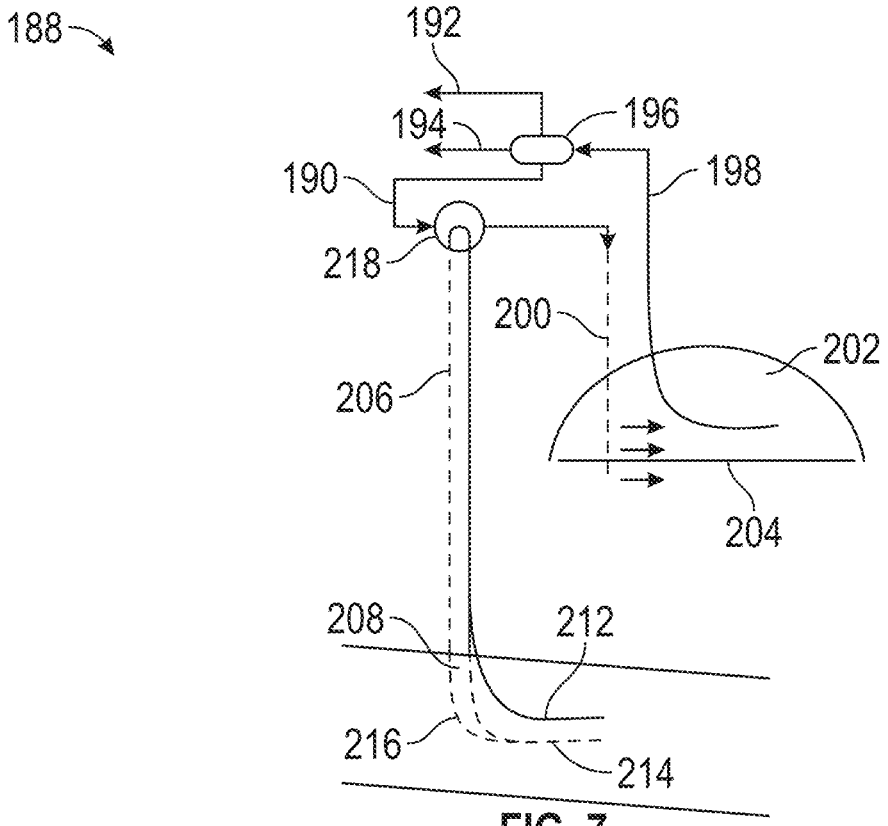
FIG. 7 is a diagram showing a geothermal heating system configured for oil and gas recovery, according to an embodiment of the present invention.

FIG. 7 shows geothermal heating system configured for oil and gas recovery 188 comprising surface separation module 196, oil and natural gas production well 198, injection well 200, FGC well bore 206, WBHX 212, and FGC injection leg 214, and heat exchanger 218. Oil and natural gas production well 198 is at least partially disposed into existing oil and gas reservoir 202. FGC well bore 206, WBHX 212, and FGC injection leg 214 are partially disposed into reservoir for geothermal energy recovery 216. FGC well bore 206 may comprise proximate well bore 208 or sidetrack 210. Heat exchanger 218 receives heated circulation fluid generated by FGC well bore 206 and WBHX 212. Heated circulation fluid flows into injection well 200 and is injected into existing oil and gas reservoir 202 and is dispersed according to path 204. Heated circulation fluid contacts and mixes with oil and/or natural gas in existing oil and gas reservoir 202 and the mixture flows through oil and natural gas production well 198 and into surface separation module 196. Surface separation module 196 separates the mixture comprising the circulation fluid and oil and/or natural gas into circulation fluid 190, natural gas 192, and hydrocarbons 194. Circulation fluid 190 then flows into heat exchanger 218 and is returned to FGC well bore 206.

Figure 8:
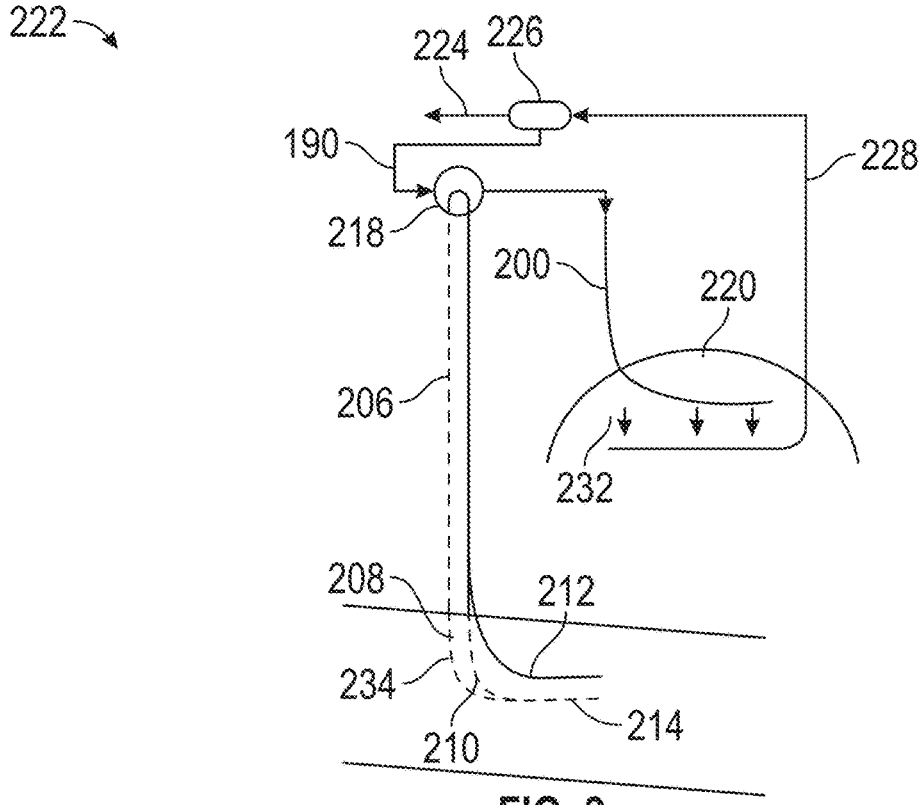
FIG. 8 is a diagram showing a geothermal heating system configured for oil sand production, according to an embodiment of the present invention.

FIG. 8 shows geothermal heating system configured for oil sands production 222 comprising surface separation module 226, bitumen horizontal production well 228, geothermal hot water injection well 230, FGC well bore 206, WBHX 212, FGC injection leg 214, and heat exchanger 218. Bitumen horizontal production well 228 is at least partially disposed into existing in situ shallow bitumen resource 220. FGC well bore 206, WBHX 212, and FGC injection leg 214 are partially disposed into reservoir for geothermal energy and/or mineral recovery 234. FGC well bore 206 may comprise proximate well bore 208 or sidetrack 210. Heat exchanger 218 receives heated circulation fluid generated by FGC well bore 206 and WBHX 212. Heated circulation fluid contacts and mixes with bitumen in existing in situ shallow bitumen resource 220. Injected hot water 232 mobilizes in situ bitumen-retaining sand and fines in existing in situ shallow bitumen resource 220. Heated circulation fluid contacts and mixes with bitumen in in situ shallow bitumen resource 220 and the mixture flows through bitumen horizontal production well 228 and into surface separation module 226. Surface separation module 226 separates the mixture comprising bitumen 224 and circulation fluid 190. Circulation fluid 190 then flows into heat exchanger 218 and is returned to FGC well bore 206.

Figure 9:
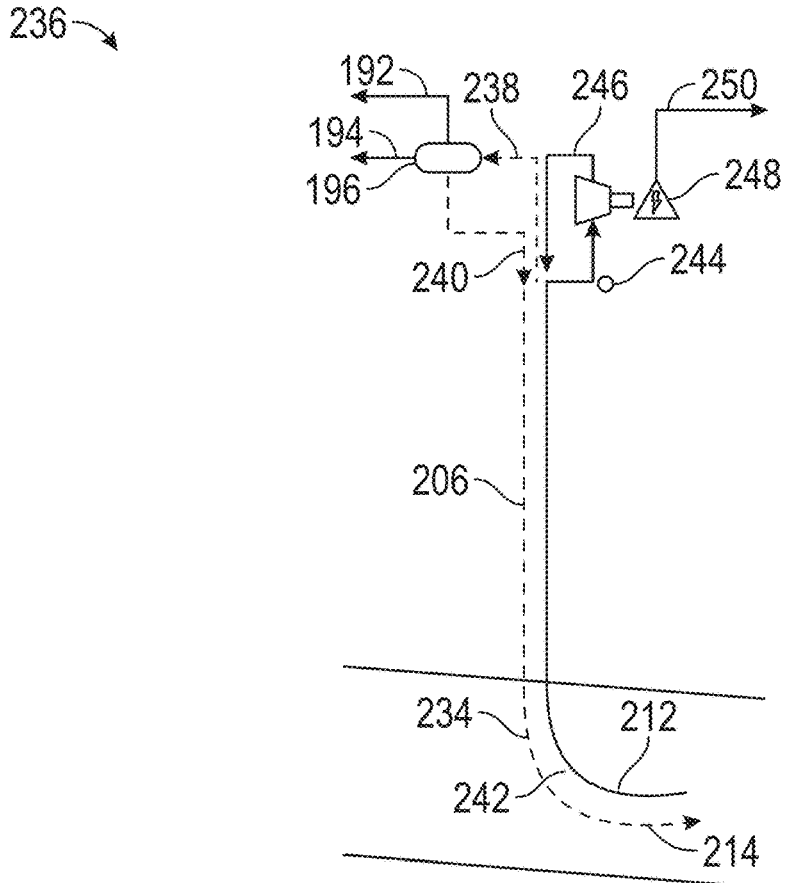
FIG. 9 is a diagram showing a geothermal heating system converted from an oil and natural gas well, according to an embodiment of the present invention.

FIG. 9 shows geothermal heating system converted from an oil and natural gas well 236 comprising FGC well bore 206, WBHX 212, FGC injection leg 214, surface separation module 196, and geothermal energy conversion module 248. FGC well bore 206, WBHX 212, and FGC injection leg 214 are at least partially disposed into reservoir for geothermal and/or mineral recovery 234. Geothermal energy conversion module 248 receives and separates geothermal closed loop hot heat transfer fluid 244 into energy 250 and geothermal closed loop cold heat transfer fluid 246. Geothermal closed loop cold heat transfer fluid 246 is returned to WBHX 212. FGC thermal transfer fluid 238 exits WBHX 212 and enters surface separation module 196. FGC thermal transfer fluid 238 comprises hydrocarbons. Surface separation module 196 separates FGC thermal transfer fluid 238 comprising hydrocarbons into FGC thermal transfer injection fluid 240, natural gas 192, and hydrocarbons 194. FGC thermal transfer injection fluid 240 enters FGC well bore 206 and into FGC injection leg 214. FGC thermal transfer injection fluid 240 enters stimulated rock zone 242 between FGC injection leg 214 and WBHX 212.

Figure 10:
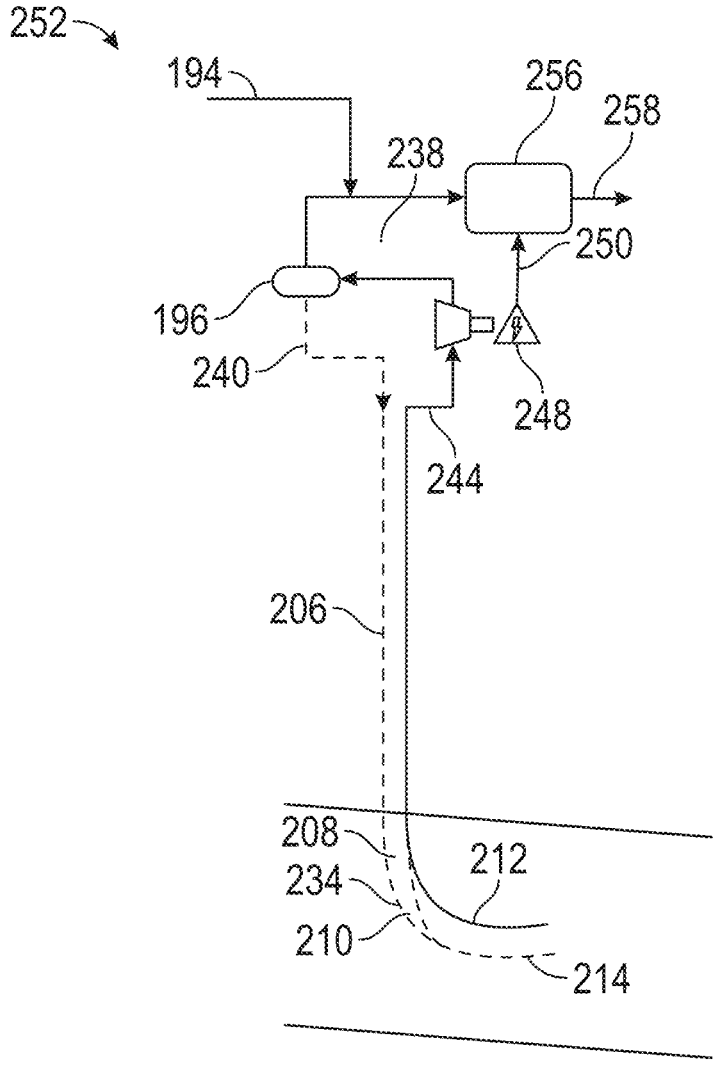
FIG. 10 is a diagram showing a geothermal heating system configured for green hydrogen production, according to an embodiment of the present invention.

FIG. 10 shows geothermal heating system configured for green hydrogen production 252 comprising FGC well bore 206, WBHX 212, FGC injection leg 214, geothermal energy conversion module 248, hydrocarbon conversion module 256, surface separation module 196. FGC well bore 206, WBHX 212, and FGC injection leg 214 are at least partially disposed into reservoir for geothermal and/or mineral recovery 234. FGC well bore 206 may comprise proximate well bore 208 or sidetrack 210. Geothermal energy conversion module 248 receives and separates geothermal closed loop hot heat transfer fluid 244 into energy 250 and FGC thermal transfer fluid 238. FGC thermal transfer fluid 238 comprises hydrocarbons. FGC thermal transfer fluid 238 exits geothermal energy conversion module 248 and enters surface separation module 196. Surface separation module 196 separates FGC thermal transfer fluid 238 into FGC thermal transfer injection fluid 240 and hydrocarbons 194. FGC thermal transfer injection fluid 240 enters FGC well bore 206. Hydrocarbon conversion module 256 receives energy 250 and hydrocarbons 194 to produce hydrogen and/or petrochemical products 258.

Figure 11A:
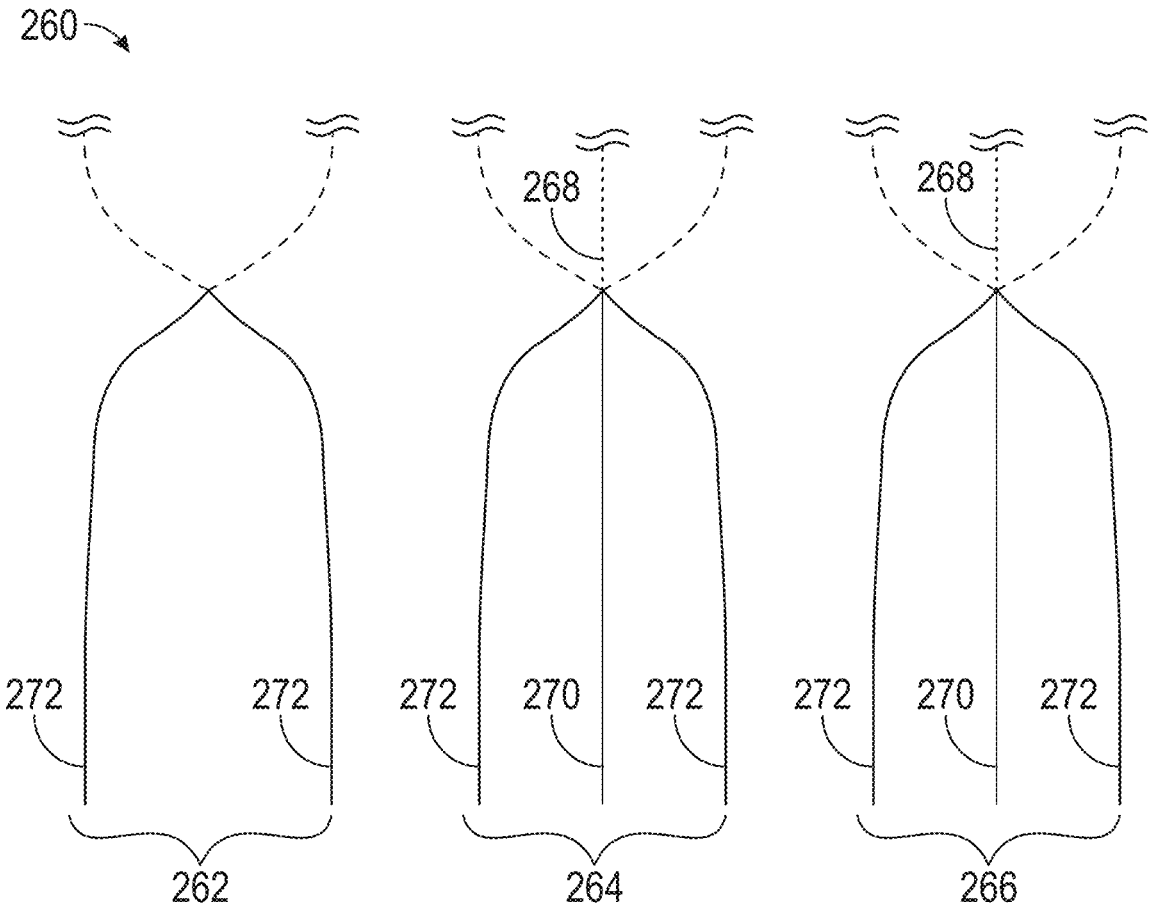
FIGS. 11A and 11B are diagrams showing field layouts for a geothermal heating system, according to an embodiment of the present invention.
Figure 11B:
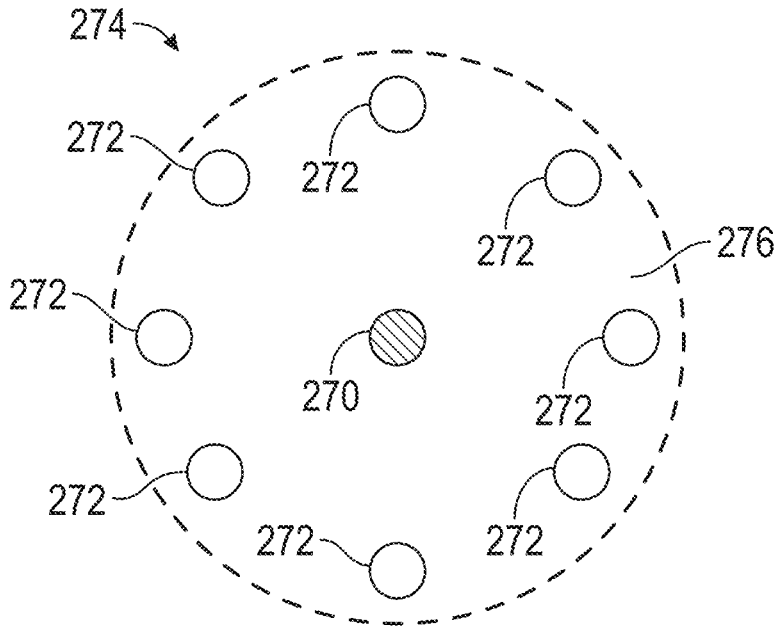

FIGS. 11A and 11B show field layouts 260 and 274 for a geothermal heating system. Individual layouts 262, 264, and 266 comprise WBHX well bores 270, FGC well bores 272, and sidetracks 268. Individual layout 262 comprises WBHX well bore 270 disposed proximate to FGC well bore 272. Individual layout 264 comprises WBHX well bores 270 disposed around FGC well bore 272. Sidetrack 268 mirrors FGC well bore to expand the available area for thermal energy extraction. Individual layout 266 comprises FGC well bores 272 disposed around WBHX well bore 270. Sidetrack 268 mirrors WBHX well bore 270 to expand the available area for thermal energy extraction.

Field layout 274 comprises WBHX well bore 270, FGC well bores 272, and stimulated zone 276. Stimulated zone 276 is a fractured, stimulated, and/or permeable zone around WBHX well bore 270 to allow FGC fluid circulation. FGC well bores 272 are disposed around WBHX well bore 270. WBHX well bore 270 and FGC well bores 272 are disposed within stimulated zone 276.

Figure 12:
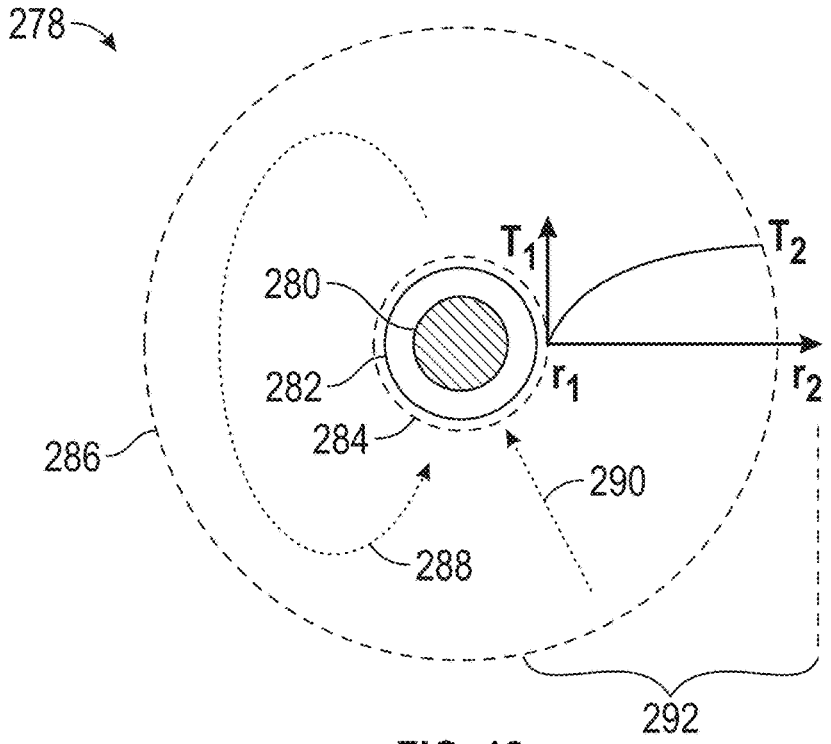
FIG. 12 is a diagram showing the structural and thermodynamic elements for a WBHX, according to an embodiment of the present invention.

FIG. 12 shows structural and thermodynamic elements for WBHX 278. WBHX 278 comprises inner casing 280, outer casing 282, well bore casing and open hole boundary 284. Boundary 286 is the effective maximum boundary for heater transfer based on k/h. Path 288 is the natural convection path of reservoir fluid. The orientation of path 288 is dependent on well bore orientation. Path 290 is the path of conduction heat transfer to WBHX 278. Profile 292 is the reservoir thermal profile from $r_1$, $r_2$ to $r_\infty$, the reservoir temperature.

Figure 13:
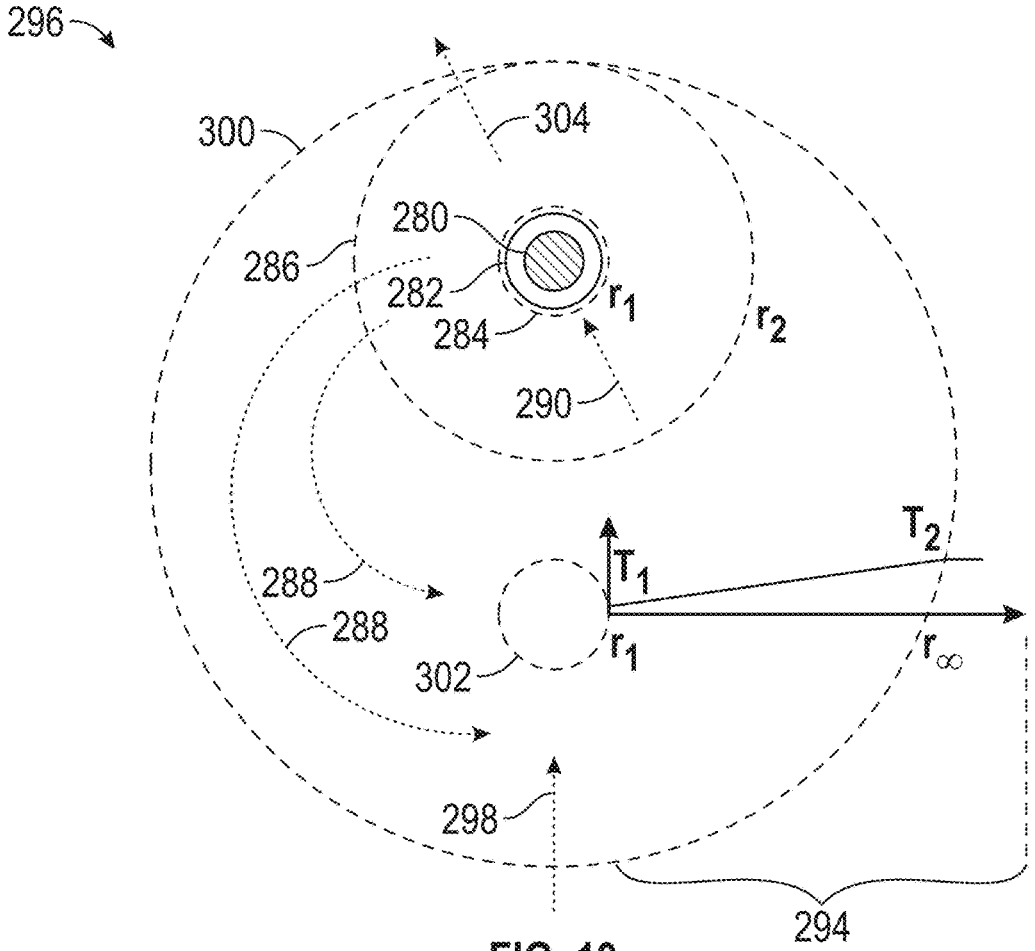
FIG. 13 is a diagram showing structural and thermodynamic elements for a geothermal heating system, according to an embodiment of the present invention

FIG. 13 shows structural and thermodynamic elements for geothermal heating system 296. Geothermal heating system 296 comprises inner casing 280, outer casing 282, well bore casing and open hole boundary 284, and FGC proximate or sidetrack well bore 302. Boundary 286 is the effective maximum boundary for heater transfer based on k/h. Boundary 300 is the effective flow path ($r_\infty$) of the FGC. Paths 288 are the forced convection paths for FGC circulated reservoir fluid. Path 290 is the path of conduction heat transfer to WBHX 278. Profile 294 is the reservoir thermal profile from $r_1$, $r_2$ to $r_\infty$, the reservoir temperature. Path 298 is the path of the aquifer fluid migration into the FGC. Path 304 is the path of forced convection fluid out of the FGC.

Figure 14:
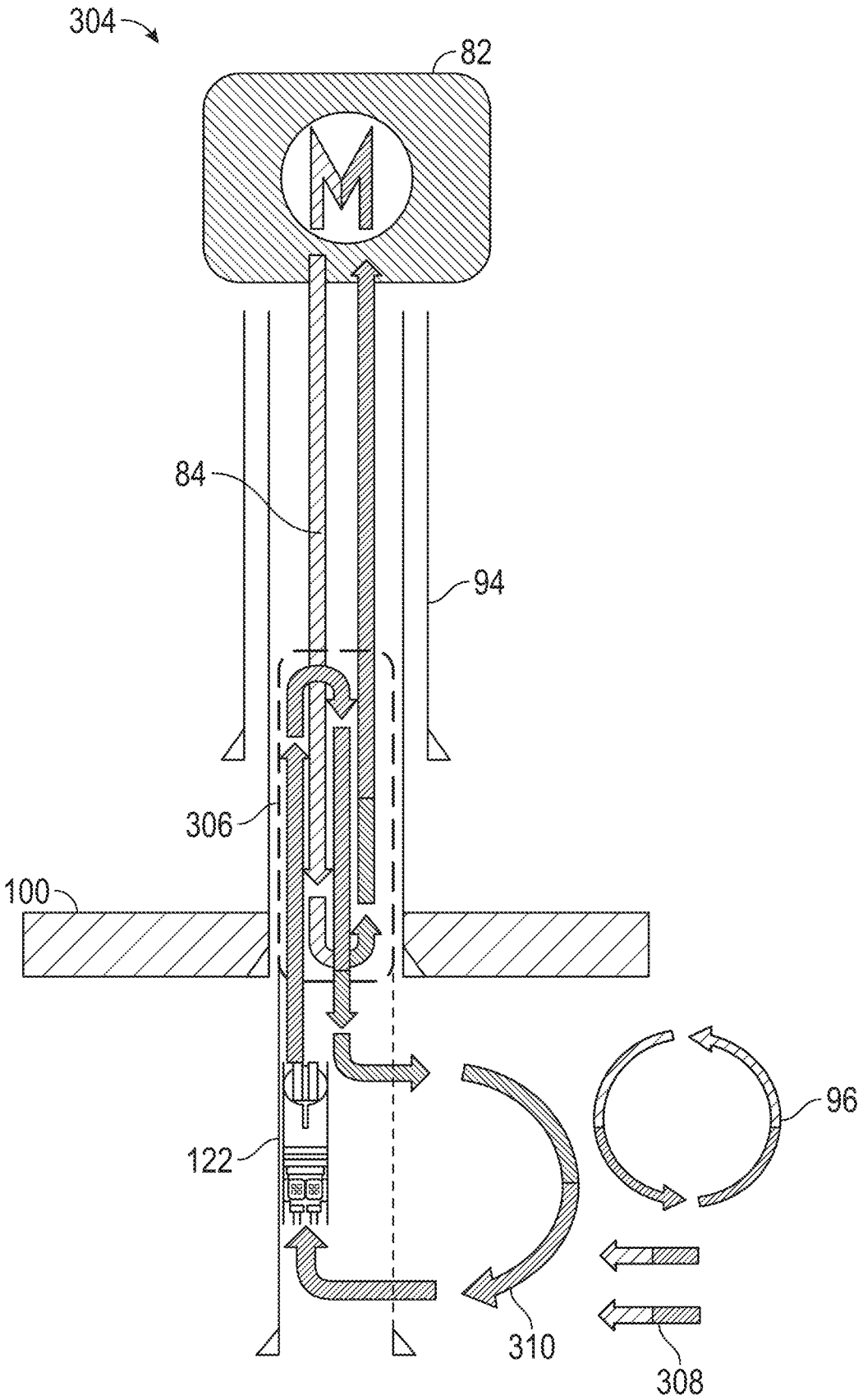
FIG. 14 is a diagram showing a geothermal heating system comprising a forced geothermal circuit, according to an embodiment of the present invention.

FIG. 14 shows geothermal heating system comprising a forced geothermal circuit comprising heat exchanger 82, thermal circulation system 84, well bore 94, FGC with pump 122, and WBPHX 306. Thermal circulation system 84 is disposed in well bore 94 and comprises conduits for transporting heated and non-heated fluid. Bottom hole heat exchanger 98 is disposed below surface 100 and is in contact with an aquifer fluid. Fluid flows through thermal circulation system 84 disposed in well bore 94 and enters bottom hole heat exchanger 98. Reservoir heat 308 is transferred to fluid disposed in bottom hole heat exchanger 98. Reservoir heat is transferred to the fluid disposed in bottom hole heat exchanger 98 via convection cycle 96 produced by the aquifer fluid.

Figure 15:
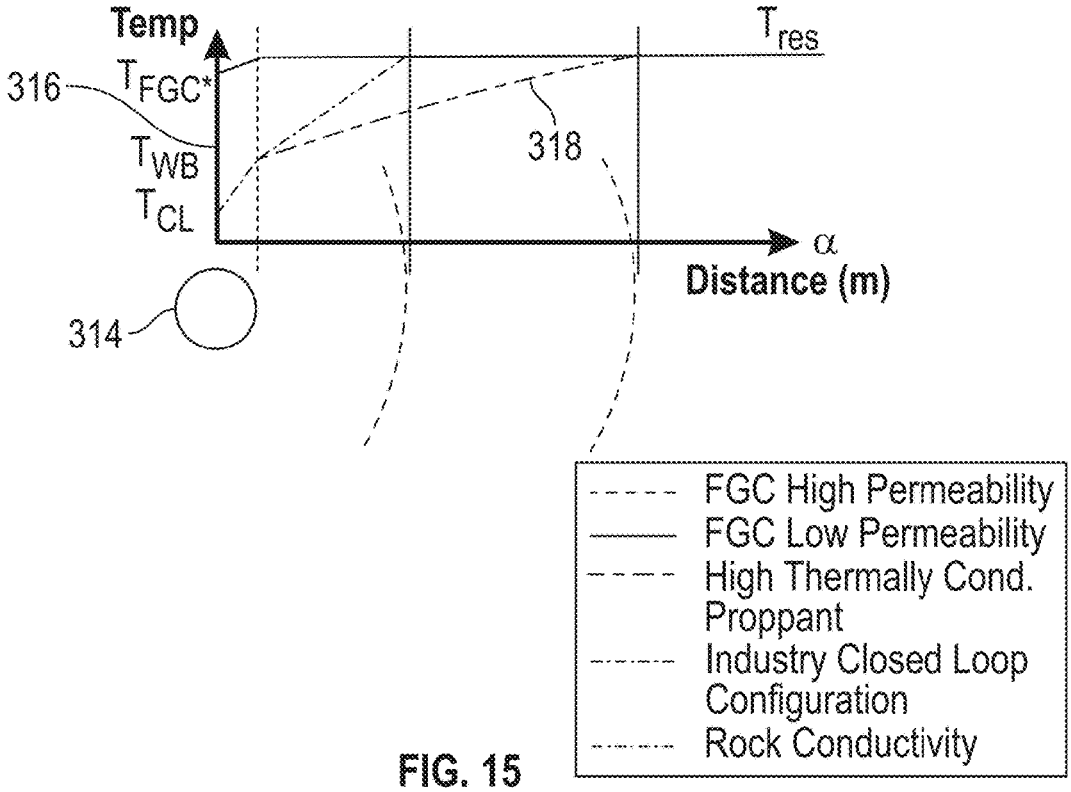
FIG. 15 is a graph showing temperature against distance from a wellbore, according to an embodiment of the present invention.

FIG. 15 shows temperature against distance from a wellbore 314. FGC system in a low permeability material 316 shows the highest temperature over the greatest distance followed by high-thermally conductive proppant 318.

Figure 16:
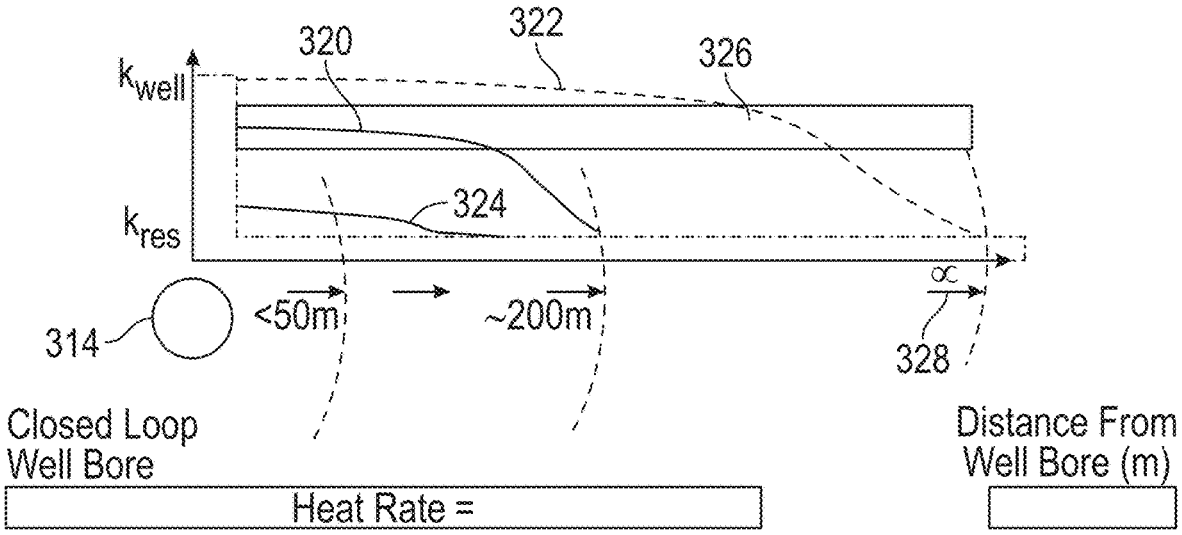
FIG. 16 is a diagram showing thermal conductivity against distance from a wellbore, according to an embodiment of the present invention.

FIG. 16 shows thermal conductivity against distance from wellbore 314. Effective thermal conductivity from FGC convection in low permeability 320 shows thermal conductivity up to about 200 meters. Effective conductivity in high permeability and fractured reservoirs 322 shows thermal conductivity up to distance 328. Enhanced thermal conductivity from high conductive proppant 324 shows thermal conductivity between 50 meters and 200 meters. Effective thermal conductivity of open loop and or binary systems is shown by region 326.

Figure 17:
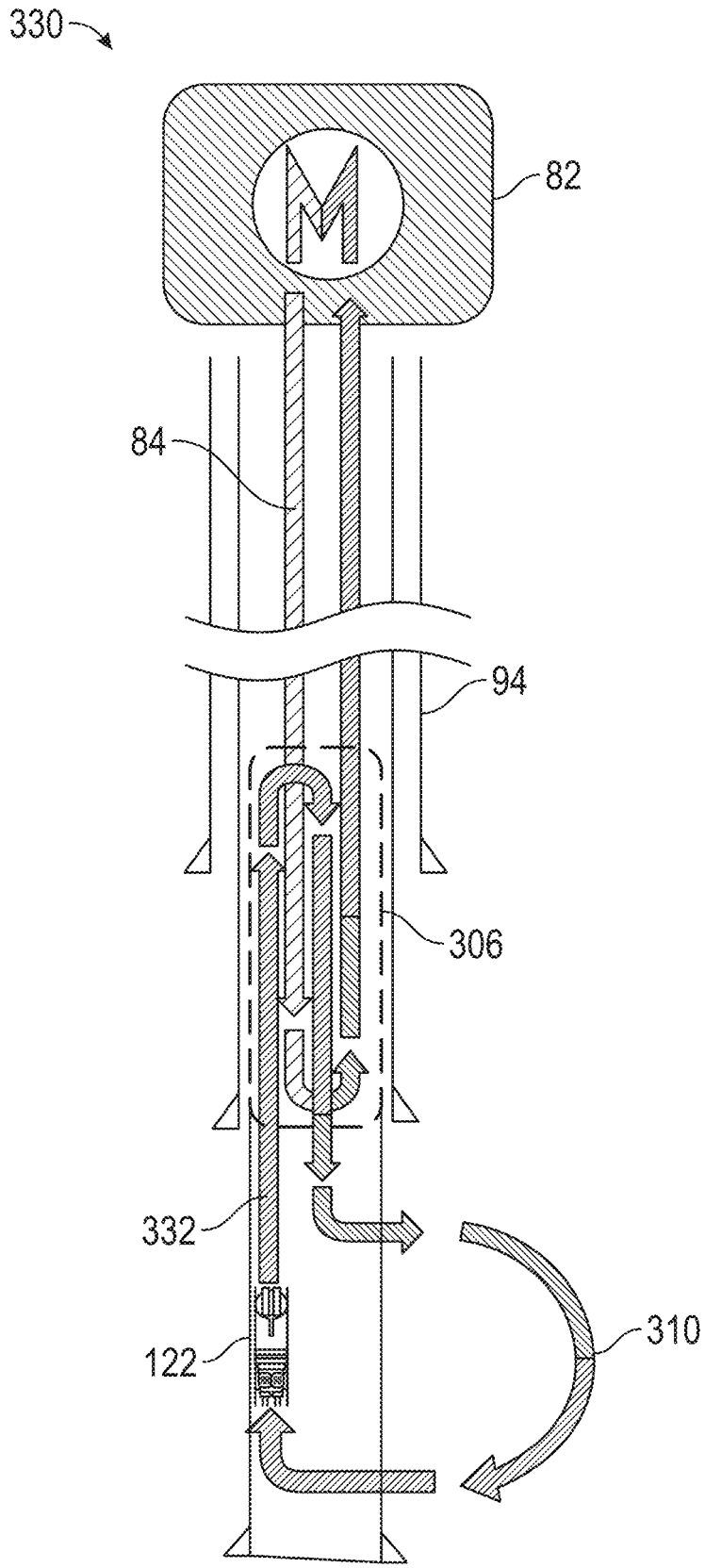
FIG. 17 is a diagram showing a geothermal heating system, according to an embodiment of the present invention.

FIG. 17 shows geothermal heating system 330 comprising heat exchanger 82, thermal circulation system 84, well bore 94, WBPHX 306, FGC 332, and pump 122. Heat exchanger 82 extracts energy for commercial application. Pump 122 provides fluid isolation and heat transfer between the surface and a subsurface geothermal fluid. WBPHX 306 is located proximate to the geothermal production zone down the well bore. Reservoir heat 310 is transferred via conduction and convection or direct fluid exchange mechanisms.

Figure 18:
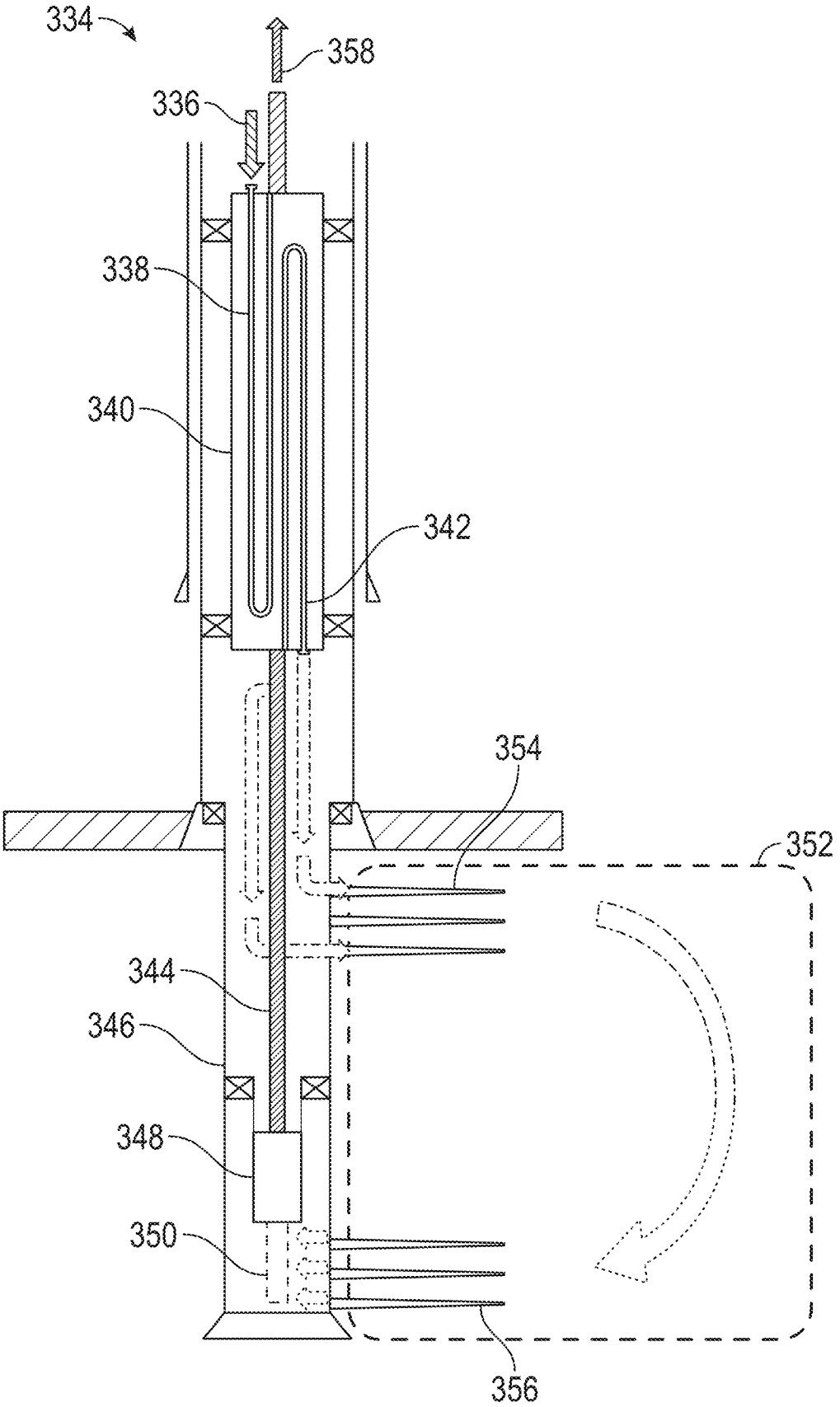
FIG. 18 is a diagram showing a geothermal heating system comprising a well bore performance heat exchanger ("WBPHX"), according to an embodiment of the present invention.

FIG. 18 shows geothermal heating system comprising a well bore performance heat exchanger ("WBPHX") 334 comprising cold return annulus 336, surface geothermal loop flow path 338, well bore performance heat exchanger 340, FGC subsurface flow loop path 342, FGC well bore 346, pump 348, slotted liner 350, injection perforations 354, and pump intake perforations 356. Cold fluid enters cold return annulus 336 and flows through well bore performance heat exchanger 340. Fluid enters stimulation region 352 through injection perforations 354 and enters pump intake perforations 356. Fluid flows through pump 348 and exits as hot stream VIT 344 and exits geothermal heating system comprising a well bore performance heat exchanger ("WBPHX") 334 as hot stream VIT to surface 358.

Figure 19:
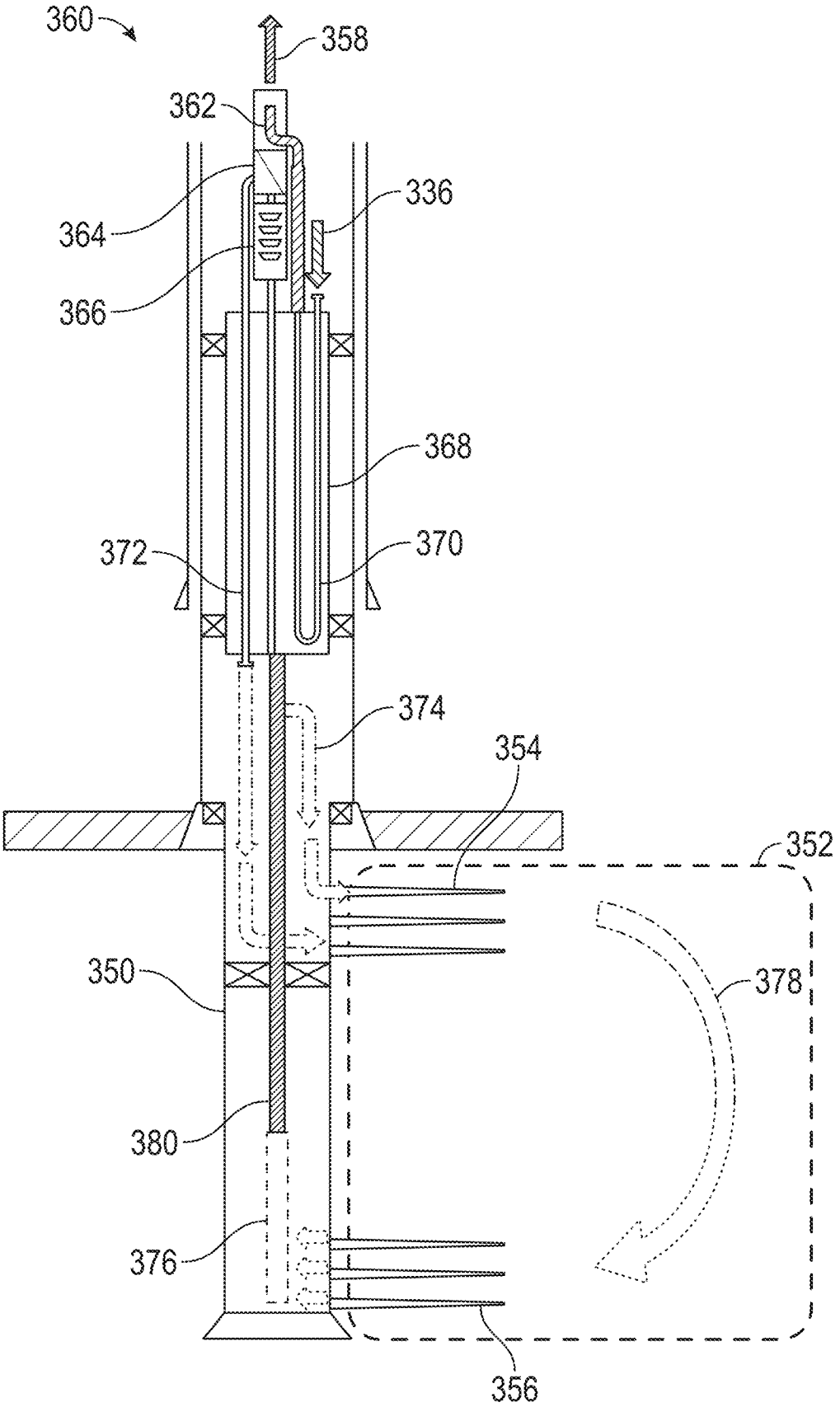
FIG. 19 is a diagram showing a geothermal heating system comprising a WBPHX and WBPHX outlet, according to an embodiment of the present invention.

FIG. 19 shows a geothermal heating system comprising a WBPHX and WBPHX outlet 360 comprising duel completion joint 362, sliding sleeve valve 364, pump 366, well bore performance heat exchanger 368, surface geothermal loop flow path 370, FGC subsurface flow loop path 372, slotted liner 350, inlet screen 376, injection perforations 354, and pump intake perforations 356. Duel completion joint 362 accommodates a single bore VIT completion to surface and to accommodate greater flexibility and easier retrieval of pump 366 for maintenance. Sliding sleeve valve 364 diverts pump 366 flow and accommodate pump 366 being located at the top of the WBPHX unit for maintenance and performance requirements. Optionally, slotted liner 350 may be configured in multiple orientations including but not limited to vertical, deviated, or horizontal to provide sufficient rock volume contact area. The number and size of injection perforations 354 depends on flow configuration. The number and size of pump intake perforations 356 depend on flow configurations. Optionally, pump intake perforations 356 may be located at the toe and heal of the well or at multiple locations along the well bore to facilitate efficient and effective enthalpy recover. well bore performance heat exchanger 368 comprises. Cold return annulus 336 returns from the surface geothermal energy recovery facility via the to the WBPHX which also provides cooling for pump 366. WBPHX outlet 374 directs reservoir fluid to return to the reservoir through injection perforations 354. Reservoir fluid enter stimulated region 352 and circulating according to path 378 before entering pump intake perforations 356. Pump 366 pumps fluid through VIT inlet tubing 380, which conveys hot reservoir fluid to be exchanged with the geothermal loop for heat recovery.

Figure 20:
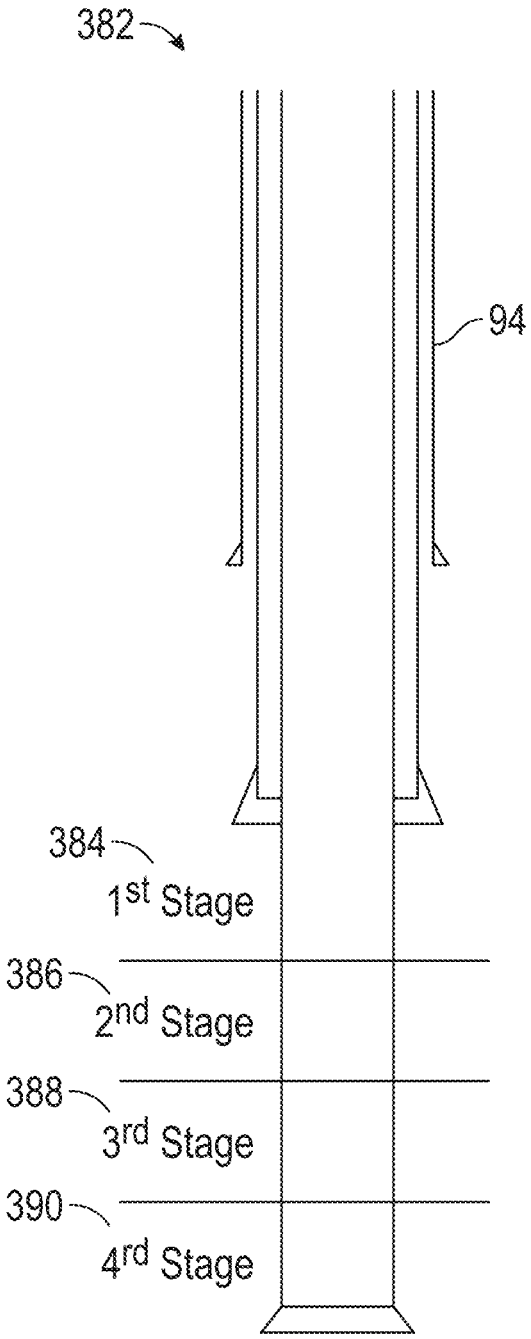
FIG. 20 is a diagram showing a multi-stage geothermal well bore, according to an embodiment of the present invention.

FIG. 20 shows multi-stage geothermal well bore 382 comprising well bore 94. Well bore 94 comprises first stage region 384, second stage region 386, third stage region 388, and fourth stage region 390. Stimulation fluid (not shown) may exit well bore 94 at any stage.

Figure 21:
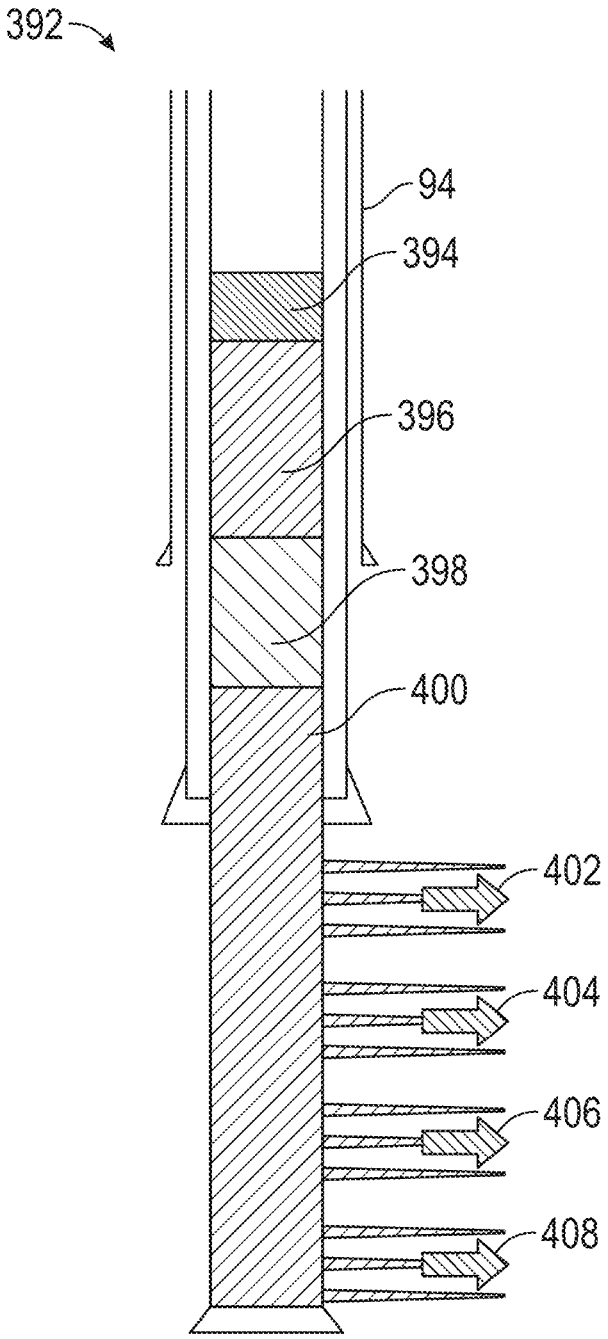
FIG. 21 is a diagram showing a multi-stage geothermal well bore with stimulation fluids, according to an embodiment of the present invention.

FIG. 21 shows multi-stage geothermal well bore with stimulation fluids 392 comprising well bore 94. Initiation fluid 400 is disposed below high-thermal conductive proppant 398. High-thermal conductive proppant 398 is disposed below high-flow proppant 396. High-flow proppant 396 is disposed below low-permeability proppant 394. Initiation fluid 400, high-thermal conductive proppant 398, and/or high-flow proppant 396 exits through fissures and/or capillaries 402 and/or 408. Initiation fluid 400, high-thermal conductive proppant 398, high-flow proppant 396, and/or low-permeability proppant 394 exits through fissures and/or capillaries 404 and/or 406.

Figure 22:
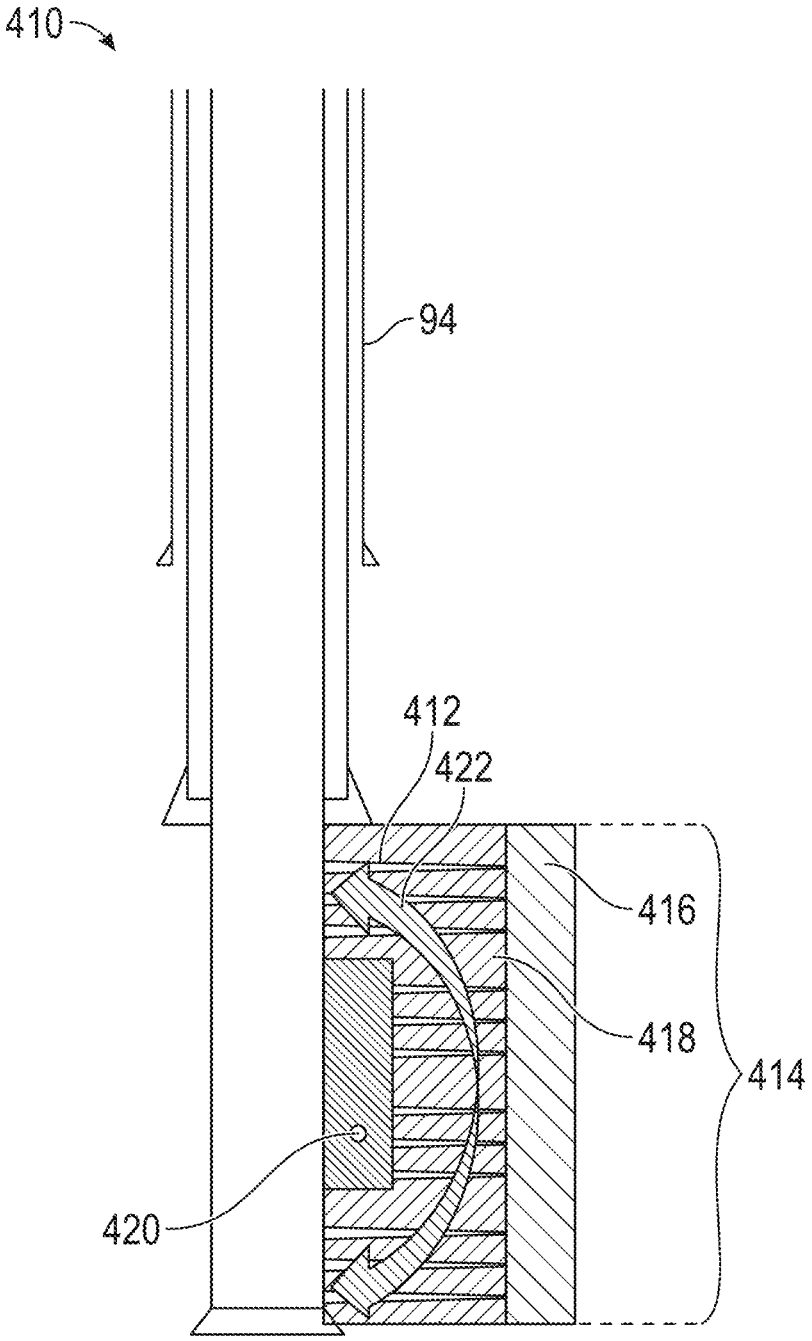
FIG. 22 is a diagram showing a multi-stage FGC stimulation configuration, according to an embodiment of the present invention.

FIG. 22 shows multi-stage FGC stimulation configuration 410 comprising well bore 94. Stimulation fluids exiting well bore 94 through fissures and/or capillaries 412 form region 414 comprising high thermal conduction layer 416, high permeability region 418, low permeability region 420. FGC fluid flows through region 414 according to path 422.

Figure 23:
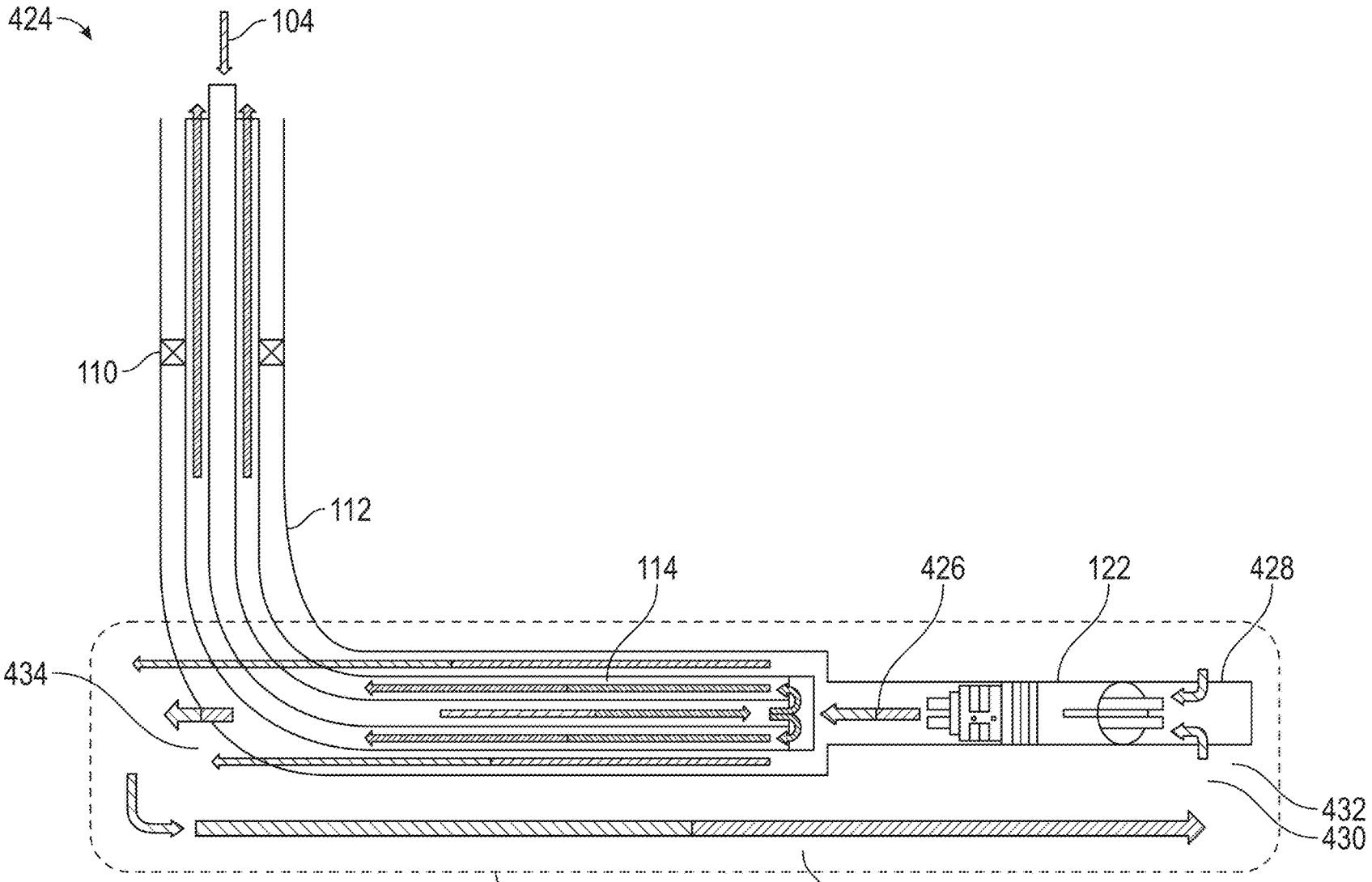
FIG. 23 is a diagram showing a geothermal heating system comprising an FGC mono-bore, according to an embodiment of the present invention.

FIG. 23 shows geothermal heating system comprising an FGC mono-bore 424 comprising vertical geothermal well bore 110, WBHX well bore 112, WBHX 114, pump 122, well foot 428, ingress point 430, and side-track borehole 432. Geothermal circulation fluid 104 enters vertical geothermal well bore 110, WBHX well bore 112, and WBHX 114 where it heated by circulated reservoir fluid 132. Circulated reservoir fluid 132 exits WBHX 114 along path 434 through geothermal reservoir rock matrix 92 and enters well foot 428 by side-track borehole 432. Non-circulated reservoir fluid also enters side-track borehole 432 through ingress point 430. Pump 122 flows circulated reservoir fluid 132 and non-circulated reservoir fluid into WBHX 114 via flow 426.

Figure 24:
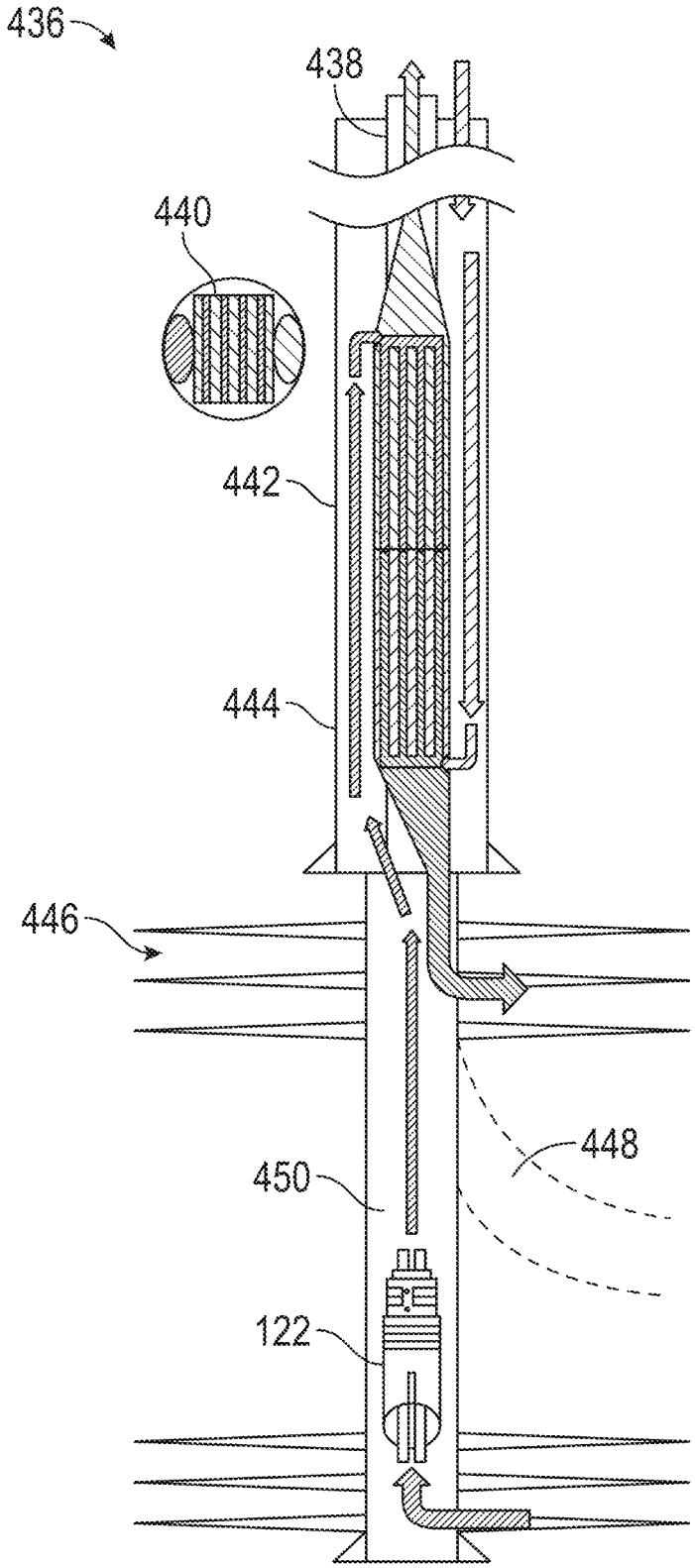
FIG. 24 is a diagram showing a geothermal heating system comprising a well bore heat exchanger ("WBHX"), according to an embodiment of the present invention.

FIG. 24 shows geothermal heating system 436 comprising VIT tubing 438, single pass heat exchanger 442, well bore heat exchanger ("WBHX") 444, reinjection point 446, FGC leg 448, slim hole section 450, and pump 122. Optionally, the single pass heat exchanger 442 may comprise plate configuration 440 to maximize surface area. WBHX 444 is the component within geothermal heating system 436, located in a well bore, that facilitates enthalpy transfer between the reservoir fluid, vapor, or rock surface and geothermal heating system 436 medium. Geothermal heating system 436 circulates fluid between WBHX 444 and the surface and allows the geothermal energy to be recovered for various purposes at the surface. VIT tubing 438 delivers hot fluid to the surface. Single pass heat exchanger 442 provides minimized approach temperature, e.g., 5° C., that maximizes surface temps and energy extraction. Disposing of WBHX 444 to well heal/vertical section minimizes VIT and allows for a larger WBHX 444. Reinjection point 446 are located at well heal or geothermal reservoir caprock. Potential horizontal/deviated FGC leg 448 minimizes draw down and maximizes energy recovery. Slim hole section 450 penetrates the geothermal zone with VIT supply fluid to WBHX 444. Pump 122 is located at well shoe for maximum depth and distance from reinjection point 446. The reservoir fluid is circulated via thermosiphon effect and is boosted by pump 122 between WBHX 444 and the reservoir matrix. Depending on the reservoir conditions and geothermal energy recovery goals, pump 122 may draw from the reservoir and convey through WBHX 444 or the fluid may be drawn through WBHX 444 and pumped back into the reservoir matrix. Enthalpy is recovered to surface via a secondary loop that flows from the surface through WBHX 444, separated from the reservoir fluid, and returns to the surface via VIT tubing 438. The operation of the surface loop is driven by process equipment at surface depending on the energy recovery goals.

Figure 25:
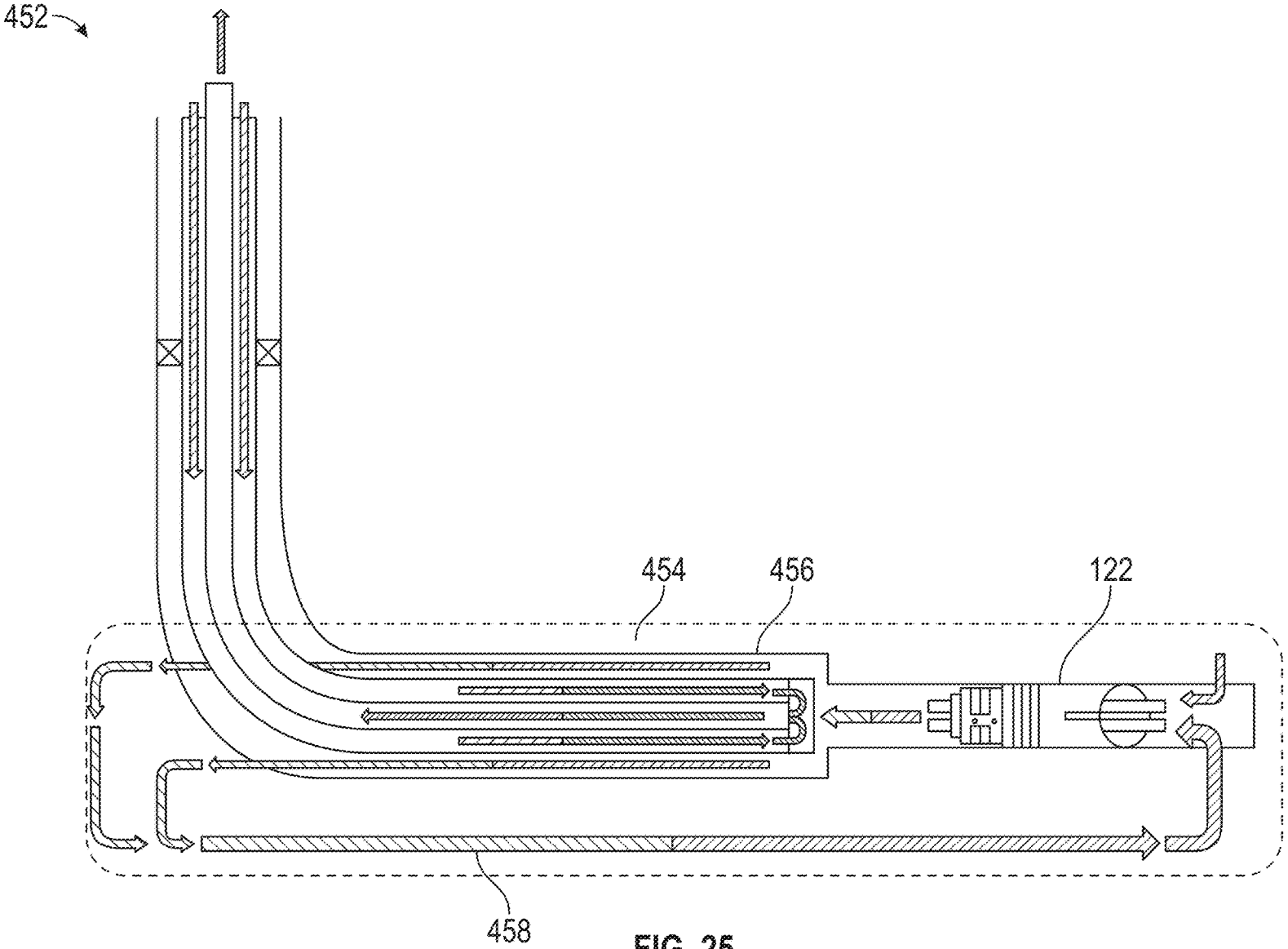
FIG. 25 is a diagram showing geothermal heating system comprising an FGC mono-bore with a horizontal alignment, according to an embodiment of the present invention.

FIG. 25 shows geothermal heating system comprising an FGC mono-bore with a horizontal alignment 452 comprising horizontal leg 454, closed loop geothermal heat exchanger 456, and pump 122. Horizontal leg 454 may have a length of at least about 1000 meters, about 1000 meters to about 10000 meters, about 2000 meters to about 9000 meters, about 3000 meters to about 8000 meters, about 4000 meters to about 7000 meters, about 5000 meters to about 6000 meters, or about 10000 meters. Heated fluid is recirculated along path 458 from horizontal leg 454 to pump 122 before reentering closed loop geothermal heat exchanger 456.

Figure 26:
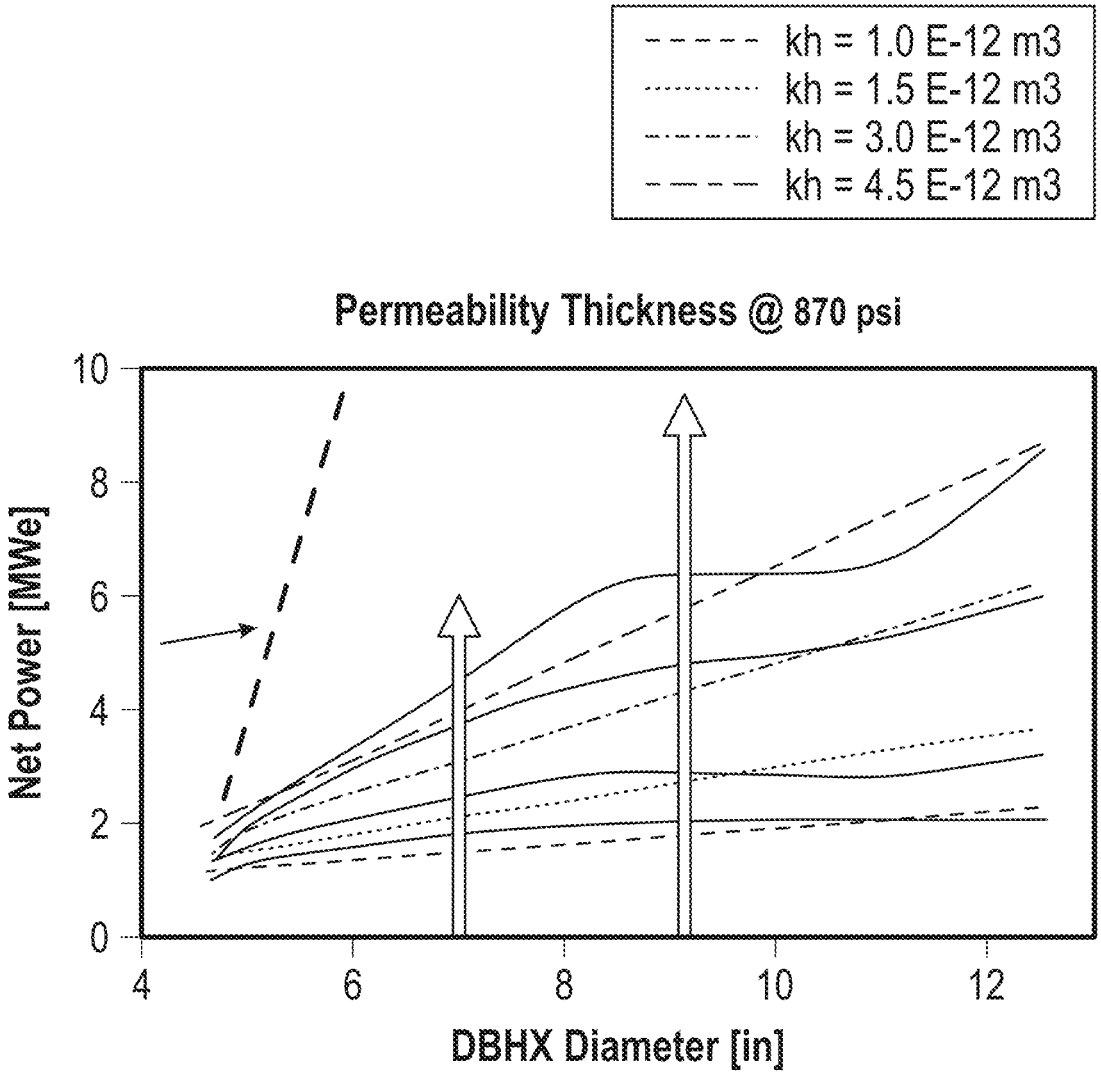
FIG. 26 is a graph showing permeability thickness, according to an embodiment of the present invention.

FIG. 26 shows permeability thickness at 870 pounds per square inch ("psi"). The dotted line shows the estimated Kh ranges 30 e-12 to 500 e-12 due to longer laterals, forced circulation, and enhanced permeability.

Figure 27:
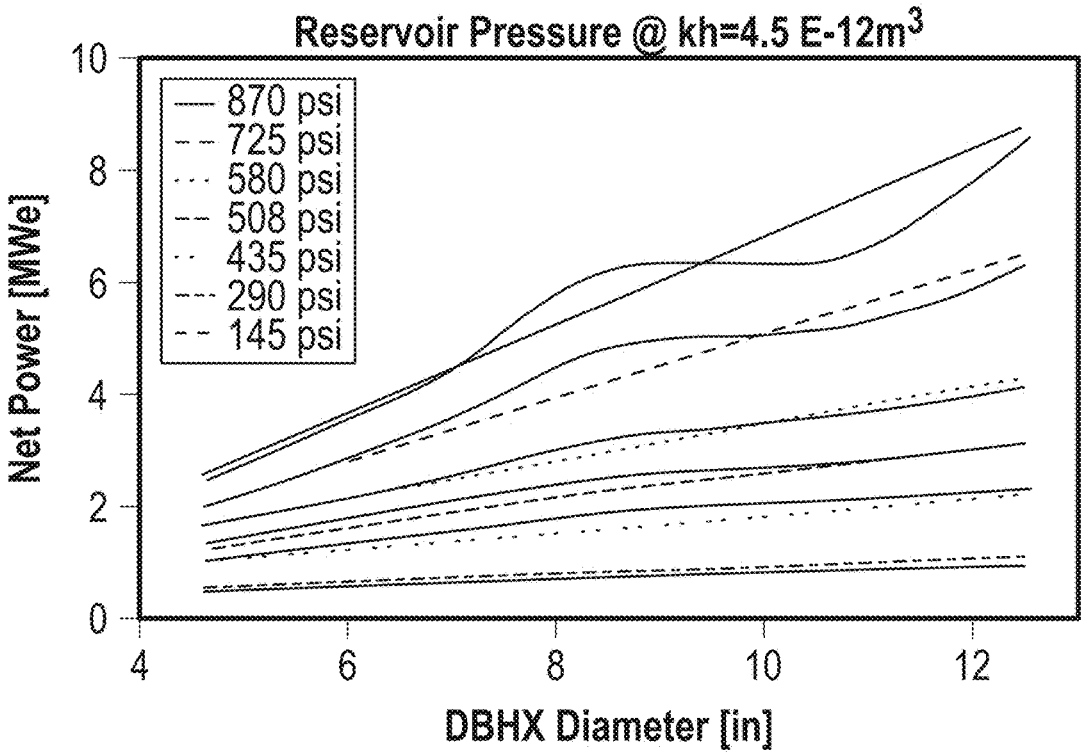
FIG. 27 is a graph showing reservoir pressure, according to an embodiment of the present invention.

FIG. 27 shows prior art reservoir pressure values at a kh value of 4.5 E-12 $m^3$ for a down bore heat exchanger ("DBHX"). Net power increases with increasing diameter at all pressures. The DBHX is a closed loop geothermal heat exchanger configuration. The design of a DBHX is a pipe in pipe configuration with an outer casing and inner vacuum insulated tubing. The bottom of the DBHX, located at the bottom of the well, is closed to the reservoir. However, the VIT within the casing is not sealed so fluid that flows in the casing annular space down the DBHX can return up the VIT or vice versa. The outer casing also provides surface area for heat exchange and enthalpy recovery from the surrounding reservoir fluid and or rock matrix.

Figure 28:
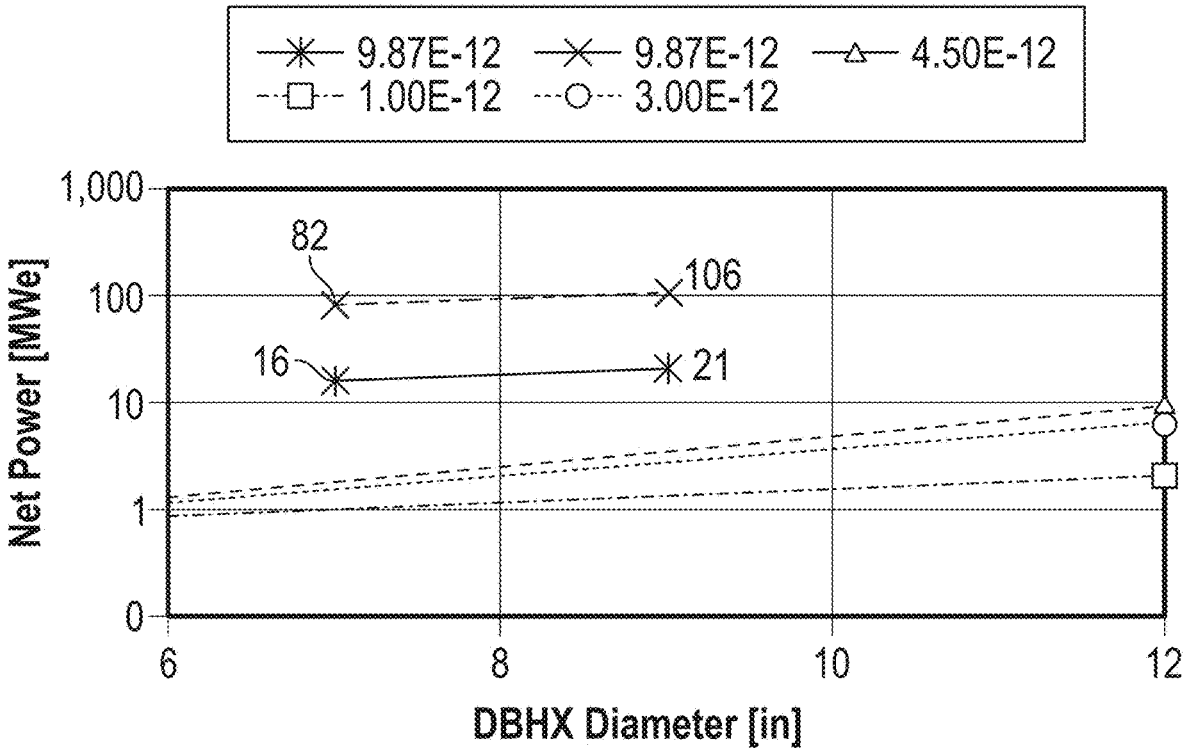
FIG. 28 is a graph showing permeability thickness, according to an embodiment of the present invention.

FIG. 28 shows permeability thickness at 870 psi. Net power increases with increasing WBHX diameter at all permeability thicknesses.

Figure 29:
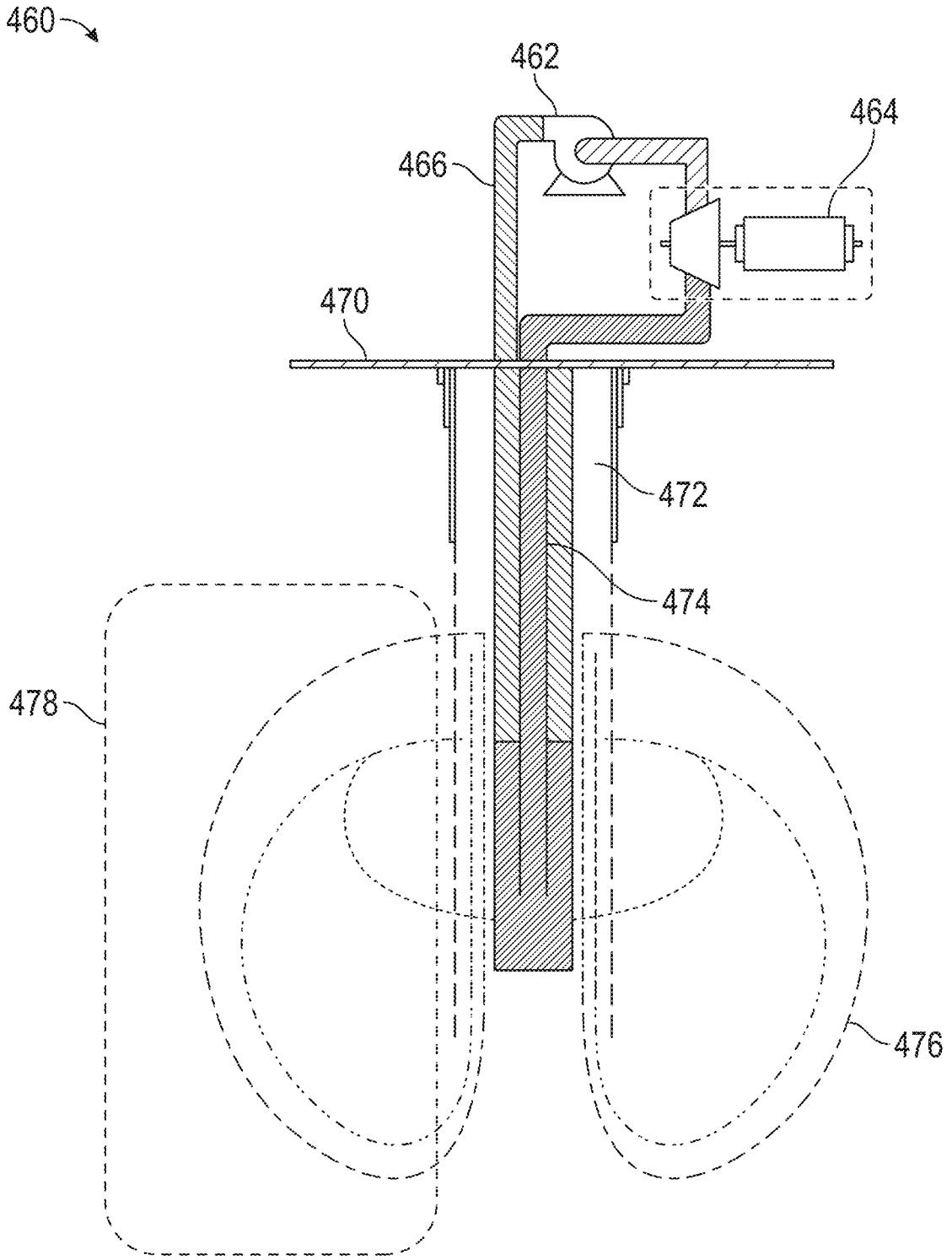
FIG. 29 is a diagram showing a geothermal heating system comprising a Down Bore Heat Exchanger ("DBHX"), according to an embodiment of the present invention.

FIG. 29 shows a geothermal heating system 460 comprising a down bore heat exchanger ("DBHX") comprising tube-in-tube heat exchanger 474, well bore casing 472, cold fluid conduit 466, pump 462, heat extractor 464, and well bore casing 472. Tube-in-tube heat exchanger 474 well bore casing 472 are disposed below surface 470, with tube-in-tube heat exchanger 474 dispose within well bore casing 472. Tube-in-tube heat exchanger 474 and heat extractor 464 are in communication with a hot fluid conduit and cold fluid conduit 466. Hot fluid enters heat extractor 464 from tube-in-tube heat exchanger 474 and cold fluid enters cold fluid conduit 466 where it conveyed by pump 462 into tube-in-tube heat exchanger 474. Condensation in reservoir 478 that descends to the bottom of geothermal heating system 460, forms heat cycle 476.

Figure 30B:
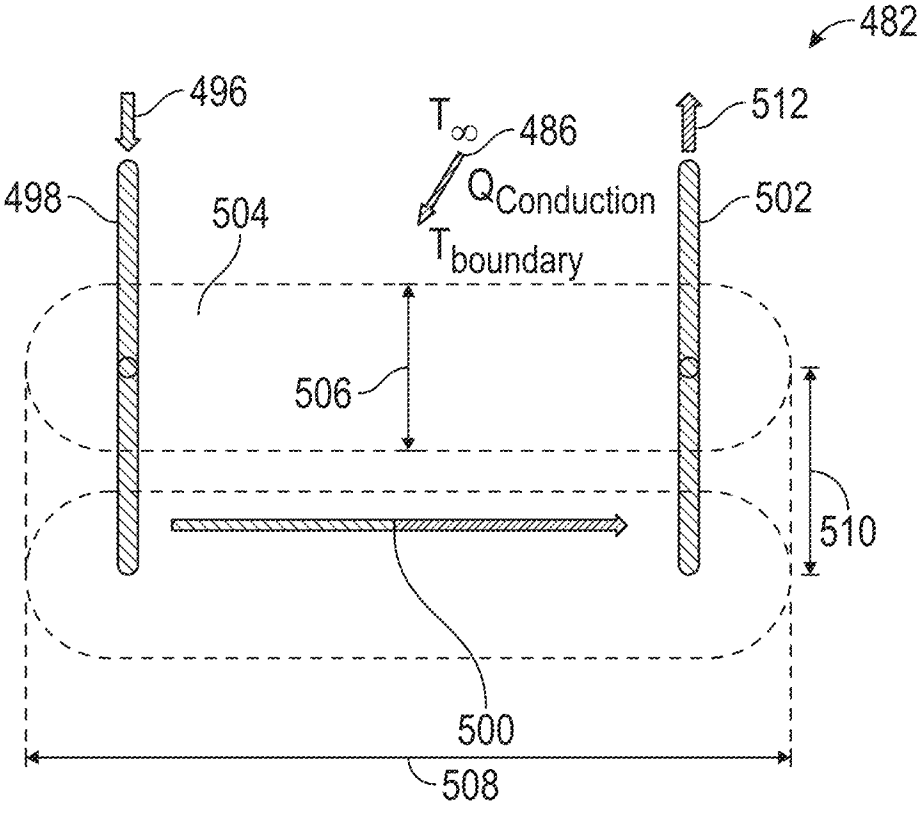
FIGS. 30A and FIG. 30B are diagrams showing enthalpy flows for open loop geothermal heating systems, according to an embodiment of the present invention.
Figure 30A:
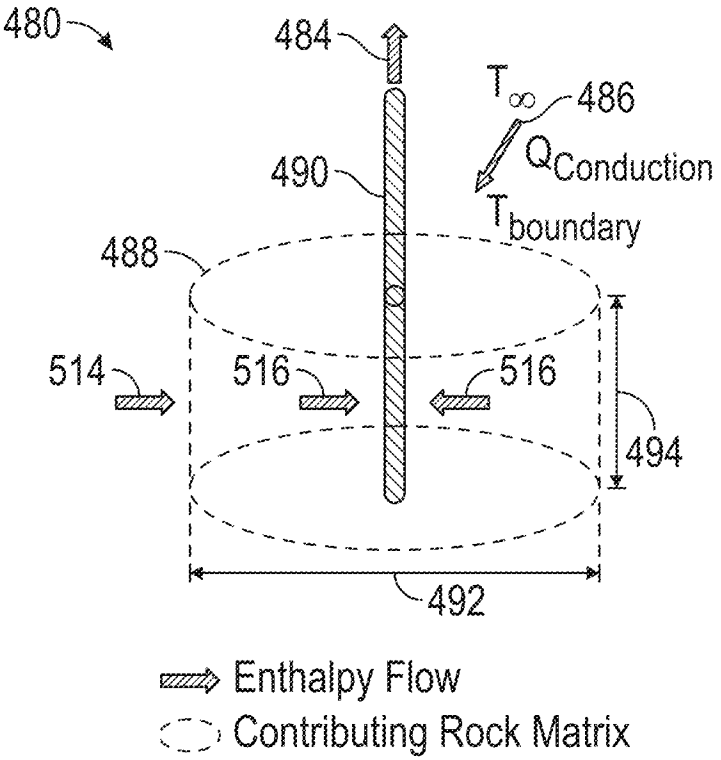

FIGS. 30A and 30B show enthalpy flows for open loop geothermal heating systems 480 and 482. Open loop geothermal heating system 480 is a binary/open loop system comprising well bore 490 and contributing rock matrix 488. Contributing rock matrix 488 comprises diameter 492 and height 494. Enthalpy flows 514 and 486 enter contributing rock matrix 488. Enthalpy flows 516 within contributing rock matrix 488 enter well bore 490. Enthalpy flow 484 exits well bore 490 towards a surface. Open loop geothermal heating system 482 is an enhanced geothermal system comprising well bores 498 and 502, and contributing rock matrix 504. Contributing rock matrix 504 comprises length 508, width 506, and height 510. Low-value enthalpy flow 496 enters well bore 498. Enthalpy flow 486 also enters contributing rock matrix 504. Enthalpy flow 500 traverses from well bore 498 to well bore 502 while increasing in value before entering well bore 502. High-value enthalpy flow 512 exits well bore 502.

Figure 31B:
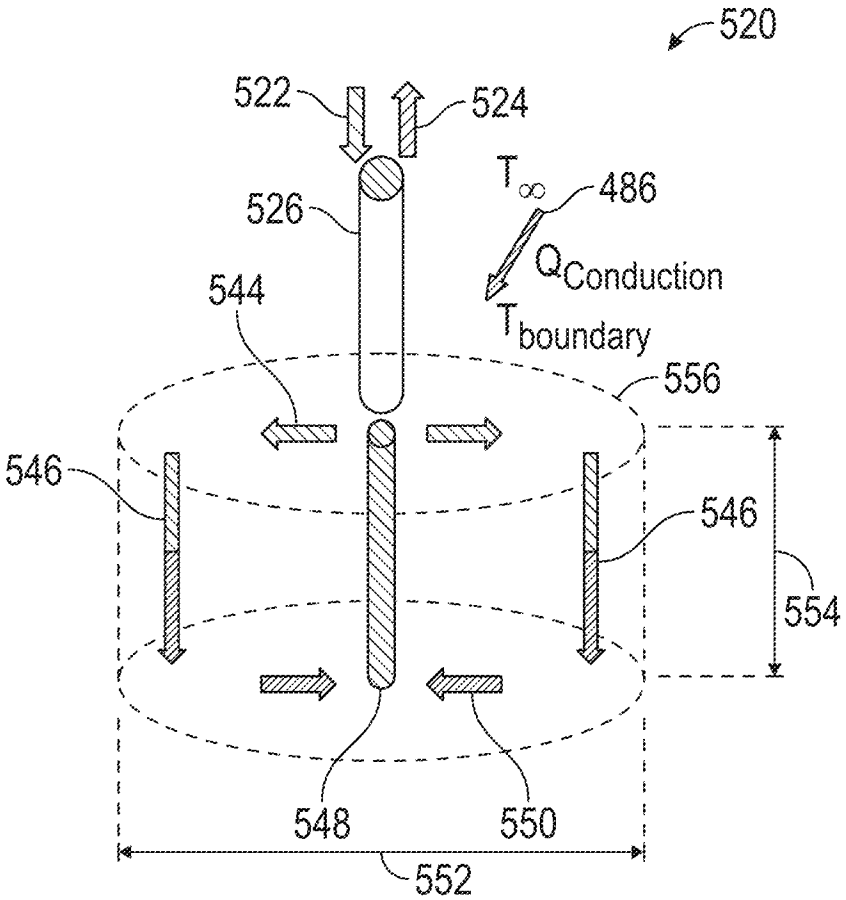
FIGS. 31A and FIG. 31B are diagrams showing loosed loop geothermal heating systems, according to an embodiment of the present invention.
Figure 31A:
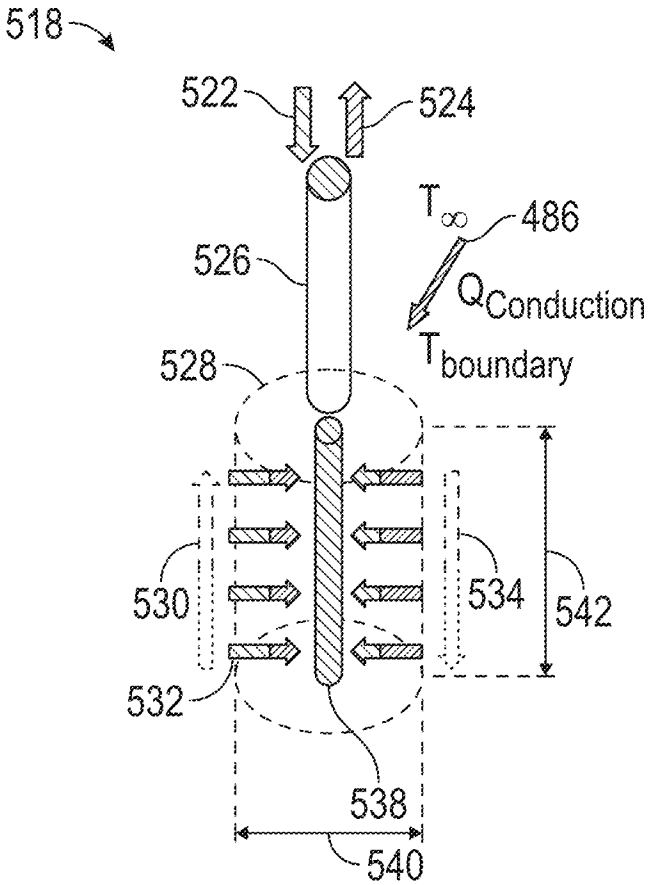

FIGS. 31A and 31B show loosed loop geothermal heating systems 518 and 520. Loosed loop geothermal heating system 518 is a closed loop conduction and natural convection system. Loosed loop geothermal heating system 520 is a forced geothermal circuit. Loosed loop geothermal heating system 518 comprises conduit 526, well bore 538, and contributing rock formation 528. Contributing rock formation 528 comprises diameter 540 and height 542. Enthalpy flow 486 enters contributing rock formation 528. Enthalpy flows 532 enter well bore 538 and conduit 526. Enthalpy flows 532 may have values that increase or decrease with increasing well bore depth as shown by gradients 530 and 534. Loosed loop geothermal heating system 520 comprises conduit 526, well bore 548, and contributing rock formation 556. Contributing rock formation 556 comprises diameter 552 and height 554. Enthalpy flow 486 enters contributing rock formation 556. Enthalpy flows 546 increase in value with decreasing height 554. Low-value enthalpy flows 544 move away from well bore 548 and high-value enthalpy flows 550 move towards well bore 548. Cold fluid 522 enters conduit 526 and hot fluid 524 exits conduits 526 in loosed loop geothermal heating systems 518 and 520.

Figure 32:
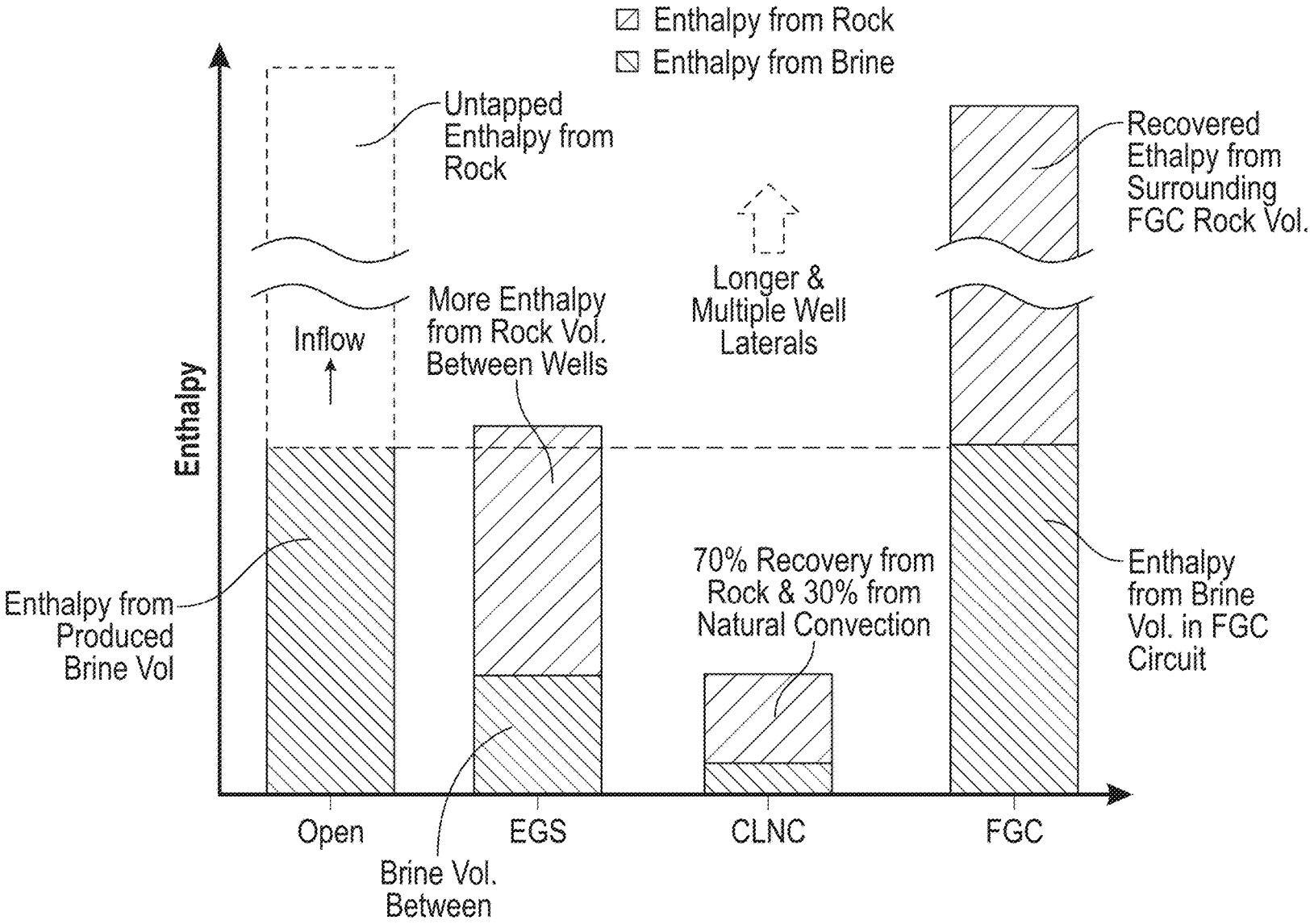
FIG. 32 is a graph showing enthalpy recover per well, according to an embodiment of the present invention.

FIG. 32 shows enthalpy recover per well for an Open Loop System ("Open"), an Enhanced Geothermal System ("EGS"), a Closed Loop Natural Convection ("CLNC"), and a forced geothermal circuit ("FGC").

Figure 33:
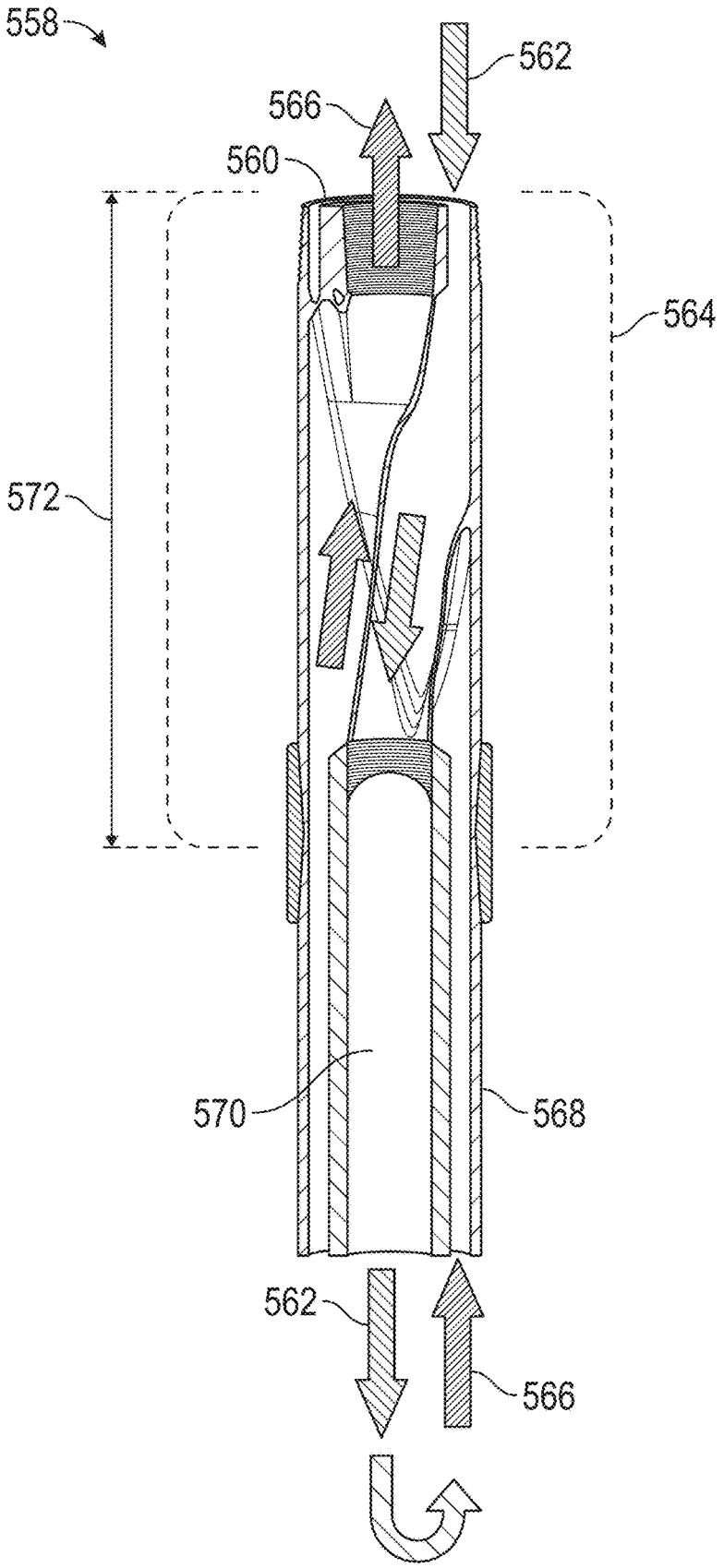
FIG. 33 is a diagram showing a geothermal heating system comprising a counter-current flux co-inverter ("FC"), according to an embodiment of the present invention.

FIG. 33 shows geothermal heating system 558 comprising counter-current Flux Co-inverter ("FC") 564. FC 564 is disposed along length 572 of geothermal heating system 558. Optionally, length 572 may be up to 500 mm. Geothermal heating system 558 also comprises vacuum-insulated tubing ("VIT") 560, internal tubing 570, and casing 568. Cold fluid 562 enters FC 564, exits internal tubing 570, and is converted to hot fluid 566 which exits FC 564.

Figure 34:
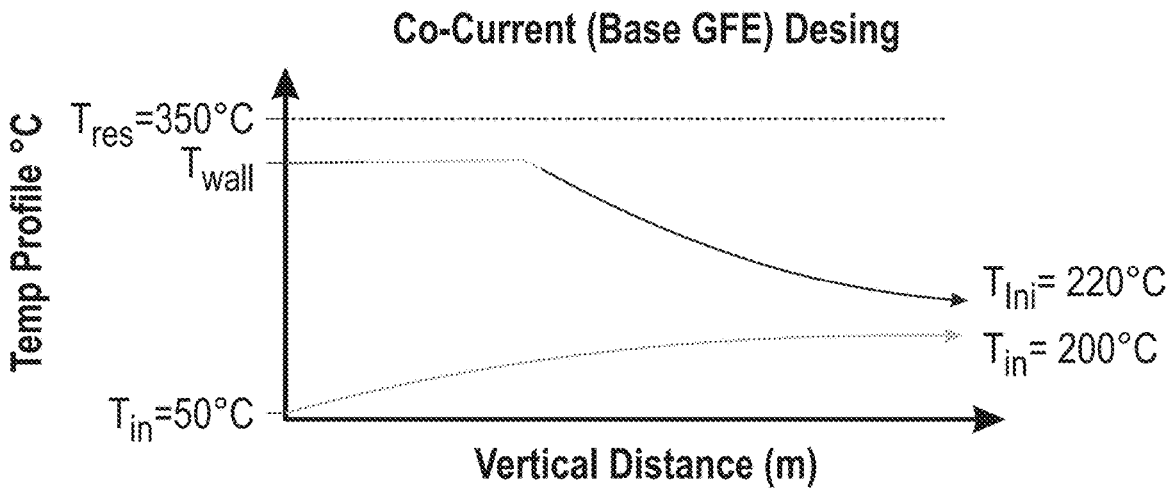
FIG. 34 is a graph showing a temperature profile for a co-current geothermal heating system, according to an embodiment of the present invention.

FIG. 34 shows a temperature profile for a co-current geothermal heating system, where temperature converges as vertical distance increases.

Figure 35:
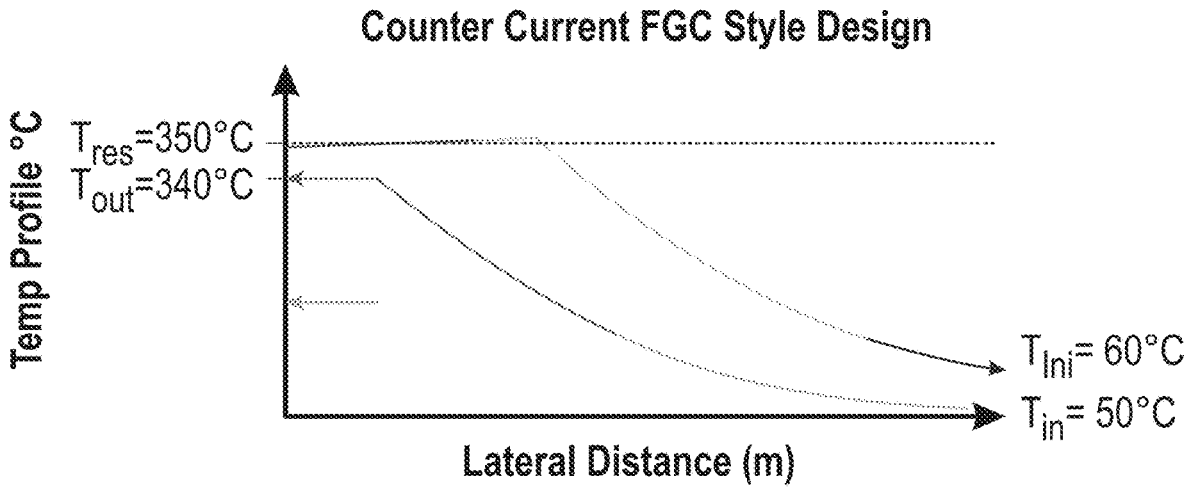
FIG. 35 is a graph showing temperature profile for a co-current geothermal heating system, according to an embodiment of the present invention.

FIG. 35 shows a temperature profile for a co-current geothermal heating system, where temperature decreases as lateral distance increases.

Figure 36:
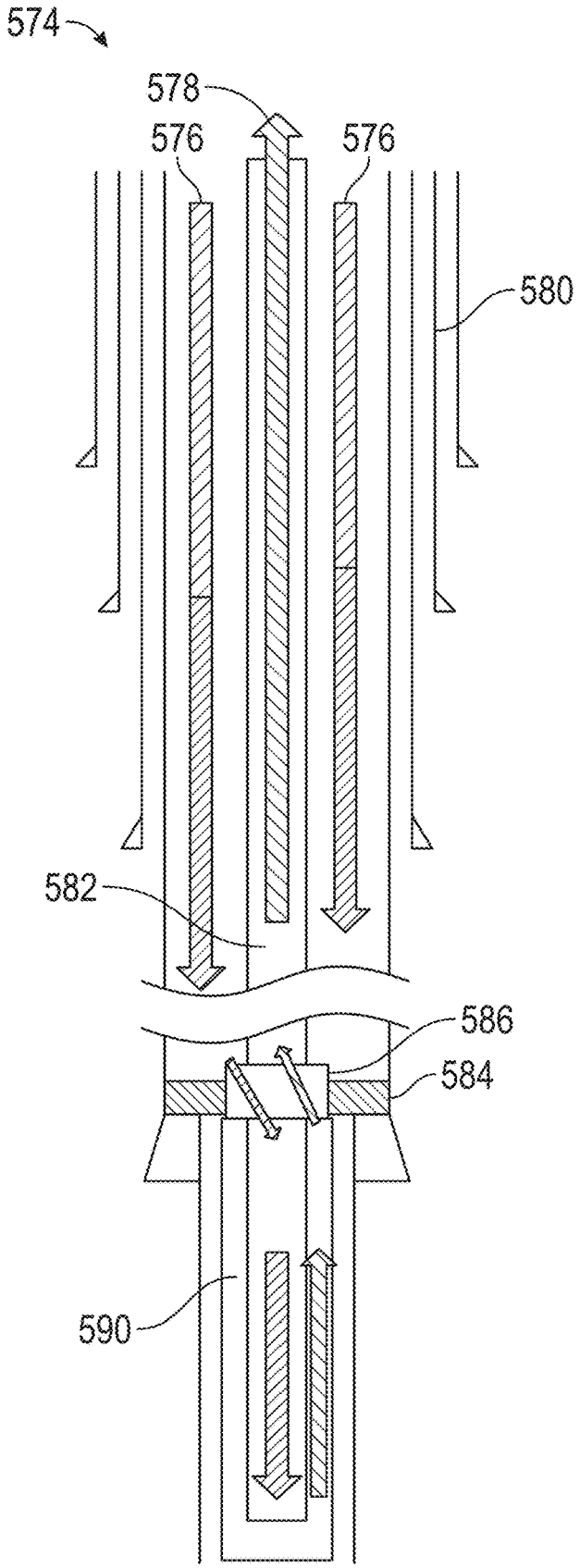
FIG. 36 is a diagram showing a geothermal heating system comprising a flux co-inverter and a packer material, according to an embodiment of the present invention.

FIG. 36 shows geothermal heating system 574 comprising Flux Co-inverter 586 and packer material 584. Geothermal heating system 574 also comprises well bore casing 580, upper FGC 582, and lower DBHX 590. Packer material 584 seals the upper FGC 582 and separates it from lower DBHX 590. Cold fluid flows 576 enter well bore casing 580, are heated by lower DBHX 590 to become hot fluid flow 578, which exits upper FGC 582.

Figure 37:
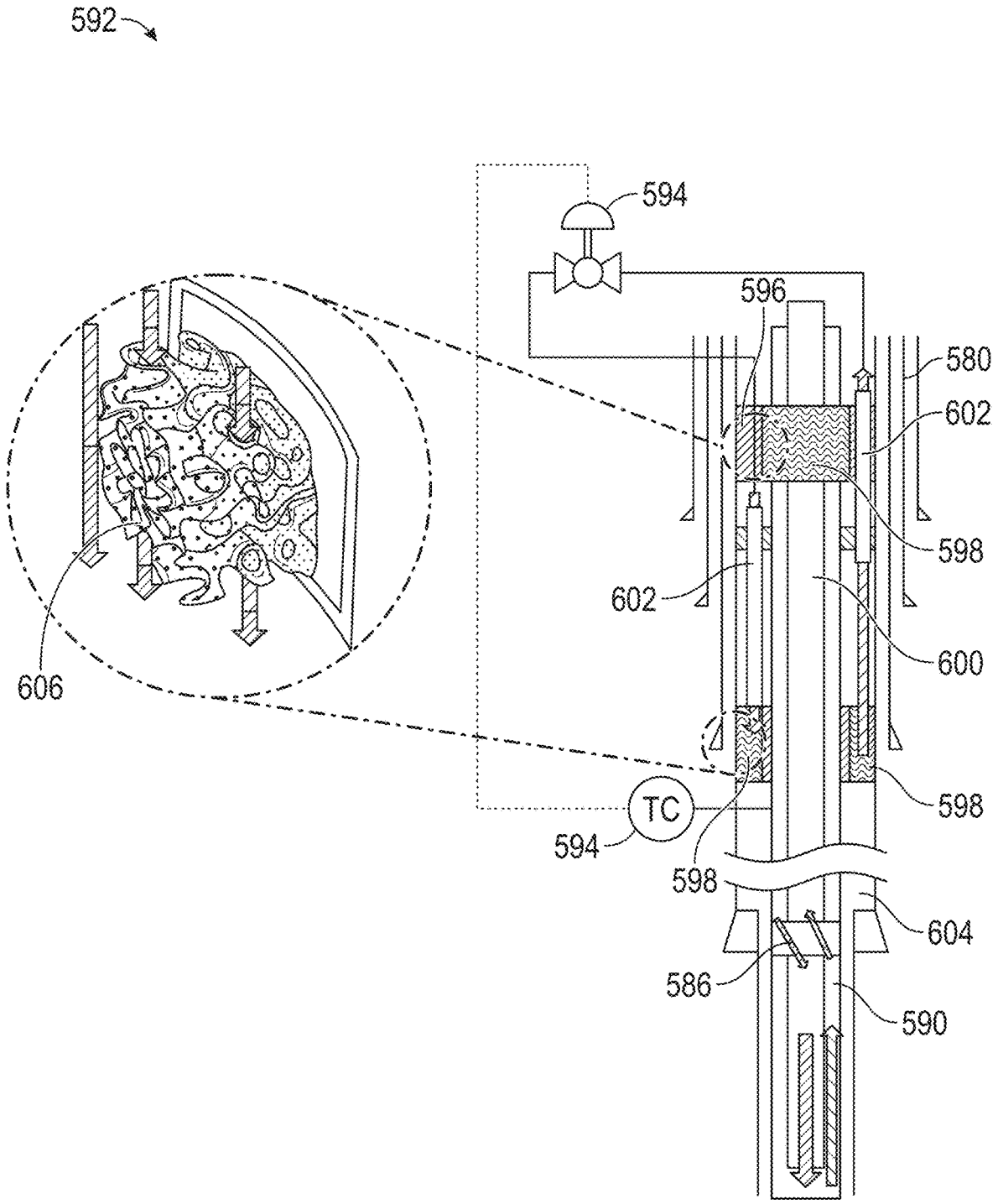
FIG. 37 is a diagram showing a geothermal heating system comprising a flux co-inverter and a triple propagating minimal structures ("TPMS"), according to an embodiment of the present invention.

FIG. 37 shows geothermal heating system 592 comprising flux co-inverter 586, triple propagating minimal structures ("TPMS") 598. Geothermal heating system 592 also comprises well bore casing 580 forming cavity 604, upper FGC 600, lower DBHX 590, insulation 596, insulated small bore tubing 602, and temperature control valves 594. TPMS 598 comprises multichannel passive heating element 606, which heats the FC and allows for a siphon flow. TPMS 598 disposed along upper FGC 600 to drive upper FGC 600 thermosiphon. TPMS 598 is attached to, and insulated from, well bore casing 580 with insulation 596. TPMS 598 is used to increase well bore casing 580 heat transfer. Temperature control valves 594 prevent excessive cooling and maintain the target temperature between well bore casing 580 and upper FGC 600.

Figure 38:
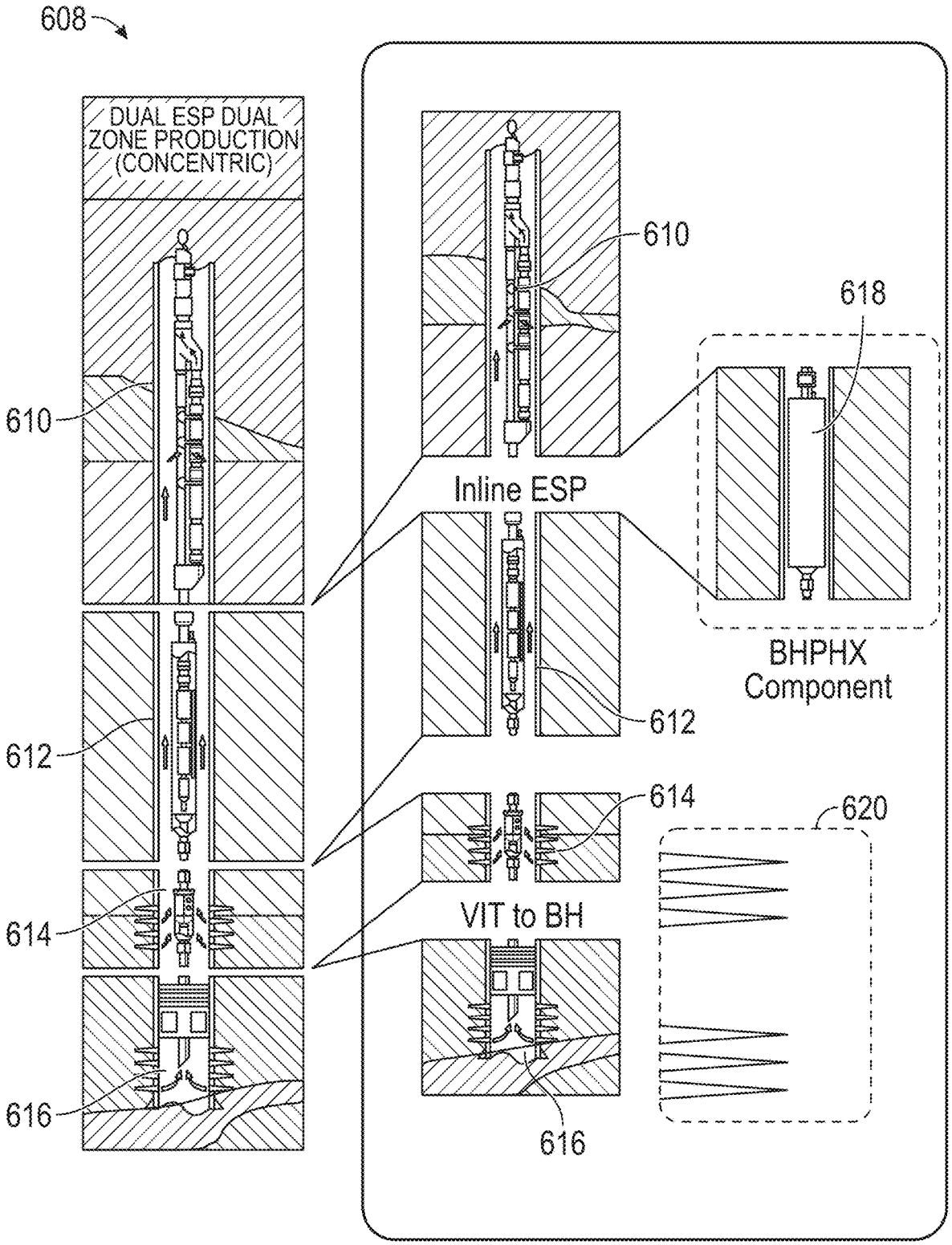
FIG. 38 is a diagram showing a geothermal heating system comprising an electrical submersible pump and configured for an oil and gas extraction application, according to an embodiment of the present invention.
Figures 39A, 39B, 39C, 39D:
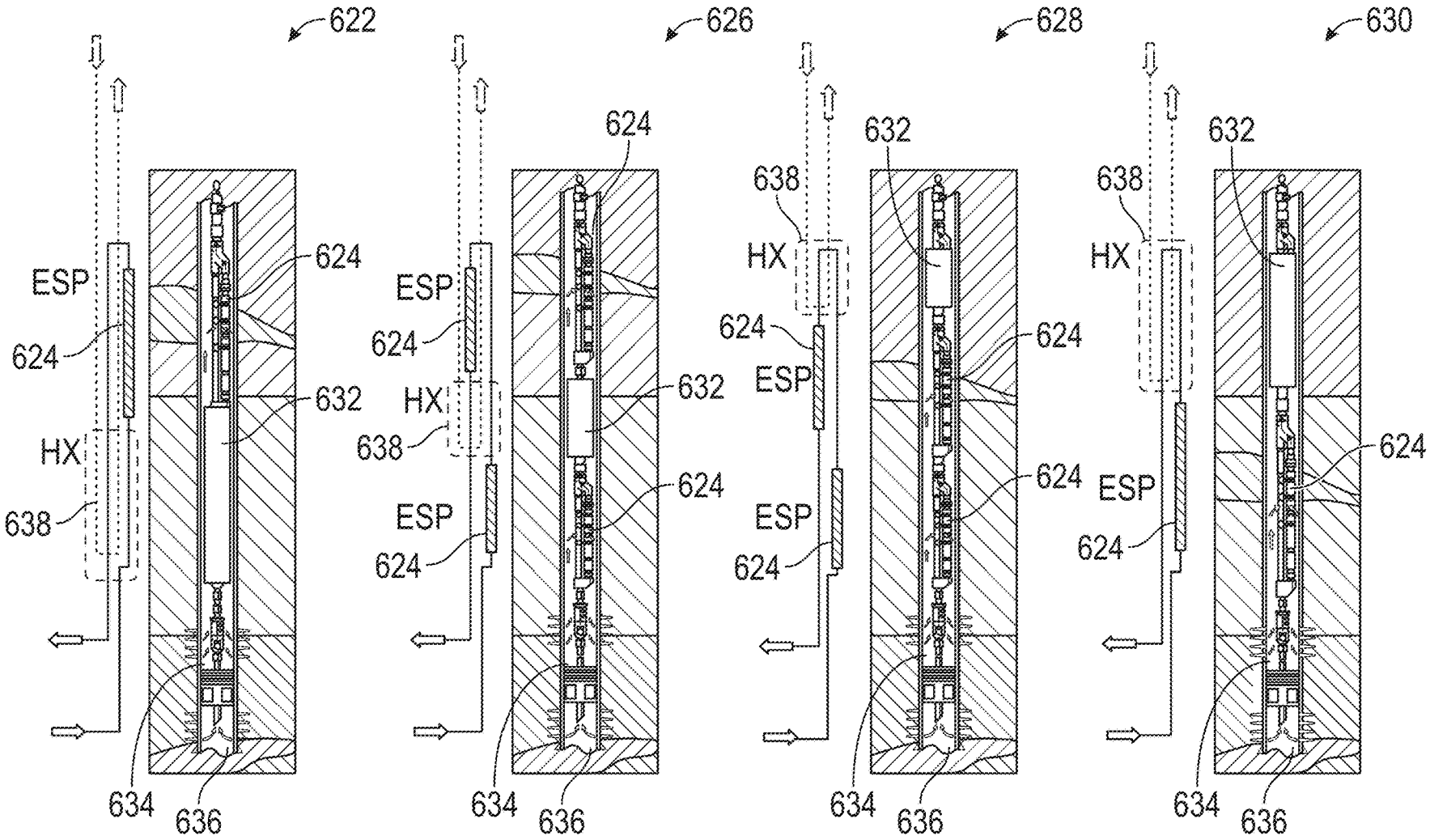
FIGS. 39A, 39B, 39C, and 39D are diagrams showing different designs of a geothermal heating system comprising an electrical submersible pump ("ESP") and configured for an oil and gas extraction application, according to an embodiment of the present invention.

FIG. 38 shows geothermal heating system 608 comprising electrical submersible pump 610 and 612 and configured for an oil and gas extraction application. Geothermal heating system 608 also comprises inflow ports 614 and 616, region 620, and bottom hole performance heat exchanger ("BHPHX") 618.

FIGS. 39A, 39B, 39C, and 39D show geothermal heating systems 622, 626, 628, and 630 configured for an oil and gas extraction application and comprising ESPs 624, heat exchangers 632, and inflow regions 634 and 636.

Figure 40:
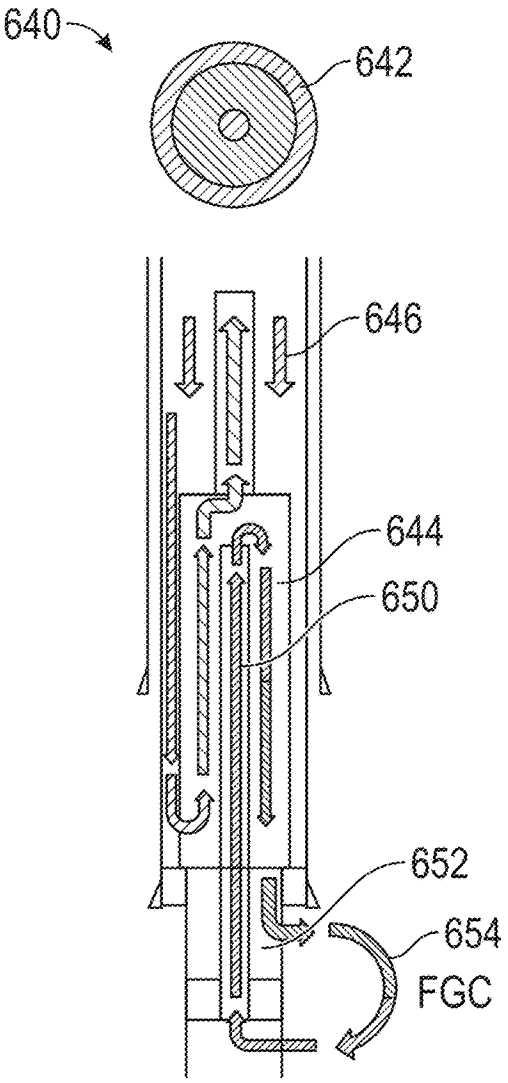
FIG. 40 is a diagram showing a geothermal heating system comprising a single pass counter current FGC configuration, according to an embodiment of the present invention.

FIG. 40 shows geothermal heating system 640 comprising a single pass counter current FGC configuration. Geothermal heating system 640 (top down view shown by diagram 642) comprises concentric configuration with flow around a heat exchanger and with flow entering at the bottom of geothermal heating system 640. Flows 646 and 654 circulate through geothermal heating system 640. Geothermal heating system 640 also comprises TPMS 644, FGC 652, and central channel 650.

Figure 41:
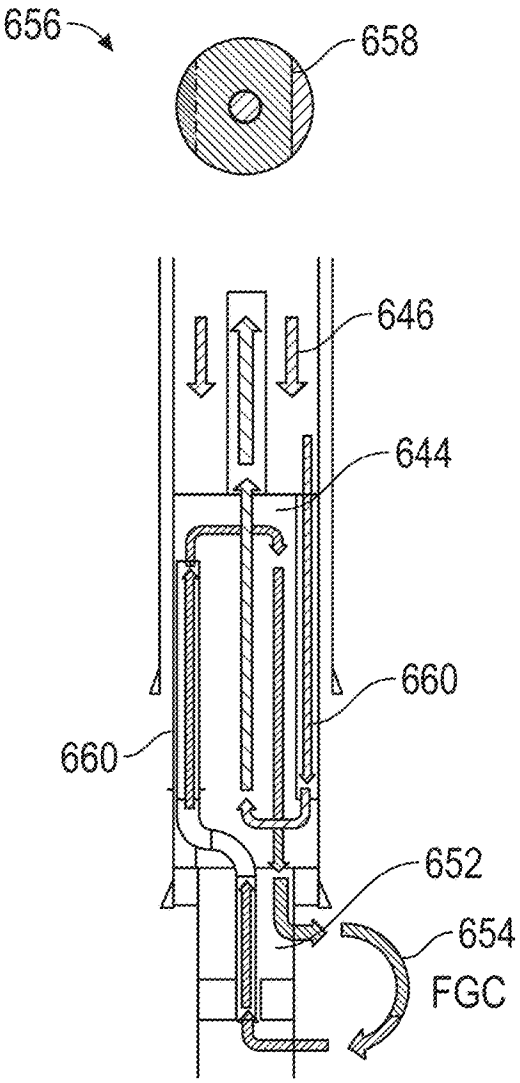
FIG. 41 is a diagram showing a geothermal heating system comprising a single pass counter current FGC configuration with a side channel, according to an embodiment of the present invention.

FIG. 41 shows geothermal heating system 656 comprising a single pass counter current FGC configuration with a side channel. Geothermal heating system 656 (top down view shown by diagram 658) comprises a concentric design with heat exchanger being the diameter of the well bore with the green and FGC loop entering via side channels of geothermal heating system 656. Flows 646 and 654 circulate through geothermal heating system 656. Geothermal heating system 656 also comprises TPMS 644, FGC 652, and side channels 660.

Figure 42:
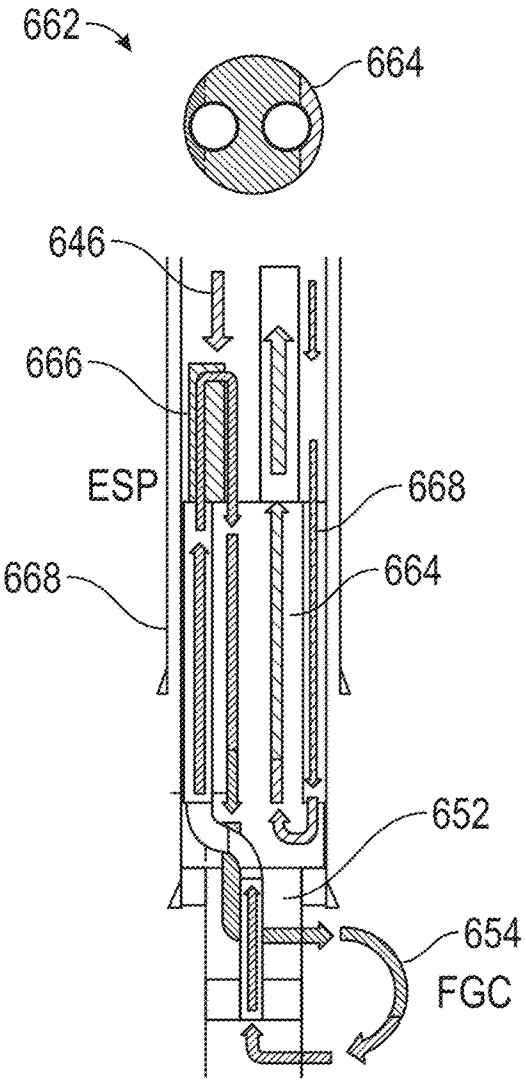
FIG. 42 is a diagram showing a geothermal heating system comprising a single pass counter current FGC configuration with an ESP, according to an embodiment of the present invention.

FIG. 42 shows geothermal heating system 662 comprising a single pass counter current FGC configuration with an ESP. Geothermal heating system 656 (top down view shown by diagram 664) comprises a side channel entry with electrical submersible pump 666 driving the bottom heat circuit. Flows 646 and 654 circulate through geothermal heating system 662. Geothermal heating system 662 also comprises TPMS 644, FGC 652, and side channels 668.

Figure 43:
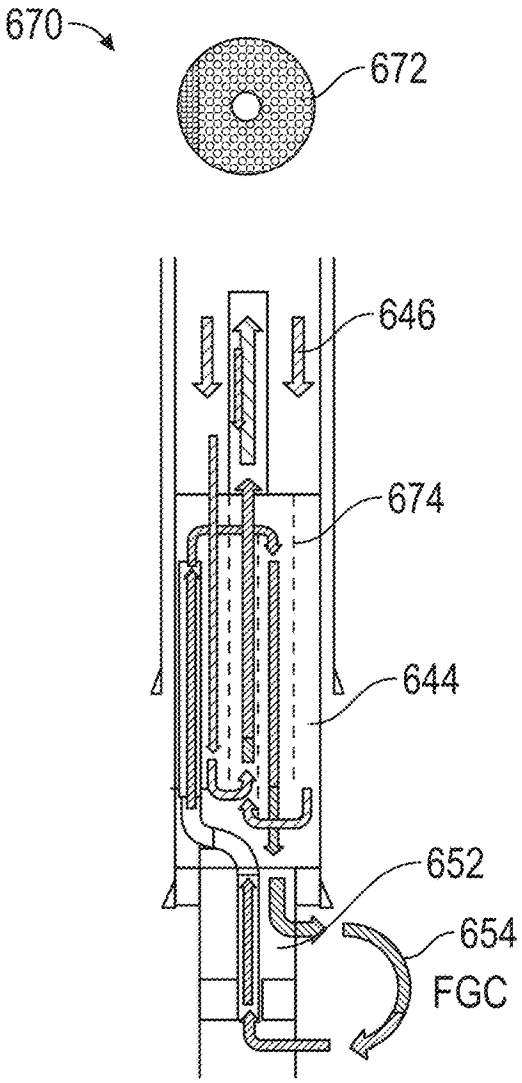
FIG. 43 is a diagram showing a geothermal heating system comprising a single pass counter current FGC configuration with an internal baffle, according to an embodiment of the present invention.

FIG. 43 shows geothermal heating system 670 comprising a single pass counter current FGC configuration with an internal baffle. Geothermal heating system 656 (top down view shown by diagram 672) comprises concentric design with a heat exchanger the diameter of the well bore internal baffles for double pass on the loop single pass FGC. Flows 646 and 654 circulate through geothermal heating system 670. Geothermal heating system 670 also comprises TPMS 644, FGC 652, and internal baffles 674.

Figure 44:
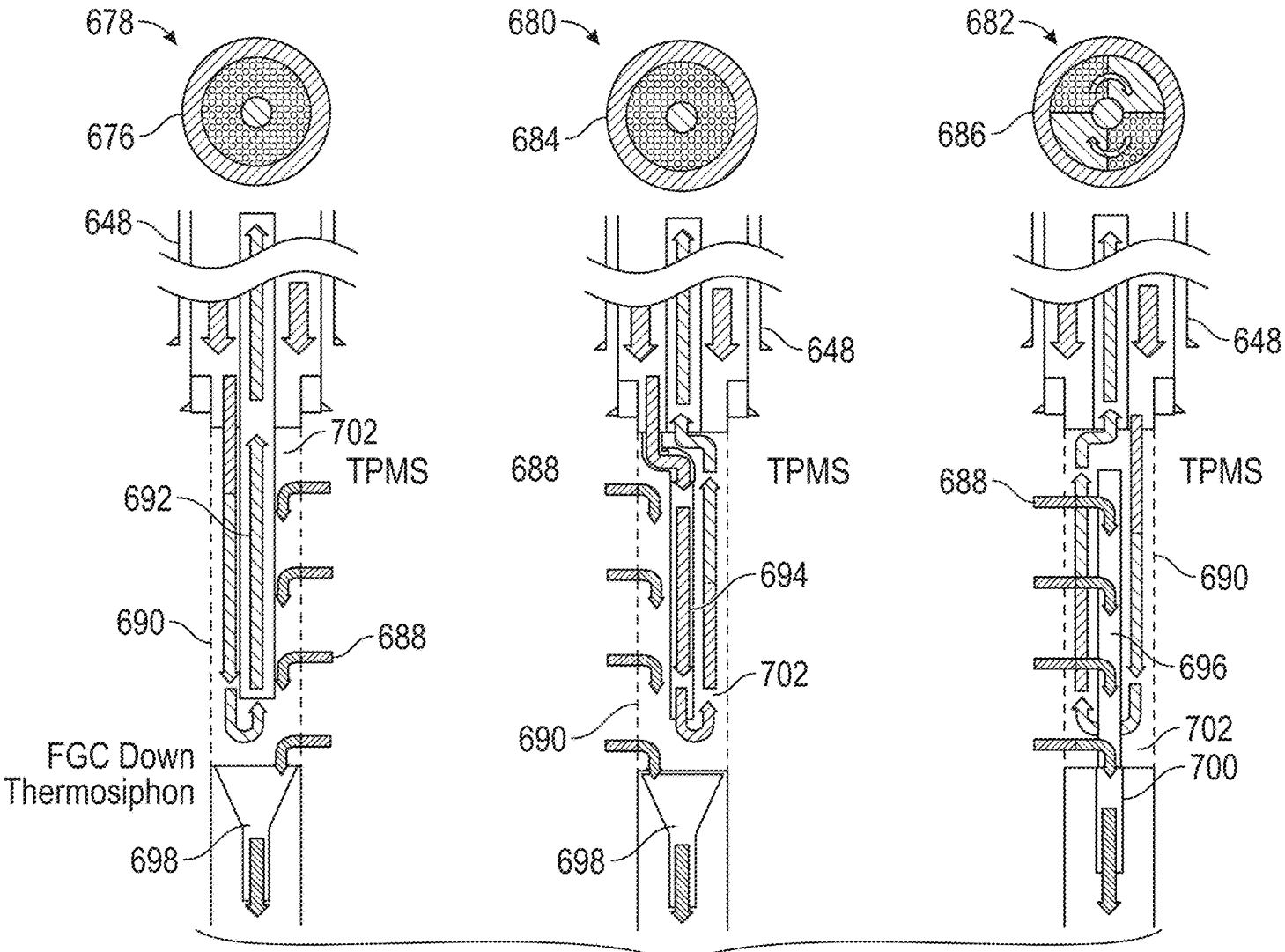
FIG. 44 is a series of diagrams showing geothermal heating systems comprising a falling film thermosiphon, according to an embodiment of the present invention.

FIG. 44 shows geothermal heating systems 704 comprising a falling film thermosiphon. Geothermal heating system 678 is a multi pass loop/single pass FGC co/counter current configuration (top down view shown by diagram 676) comprising casing 648, TPMS 702, FGC down thermosiphon 698, casing with side holes 690, and insulated core and/or tubing 692. Flow 688 enters TPMS 702 through casing with side holes 690. Geothermal heating system 680 is a multi pass loop/single pass FGC co/counter current configuration (top down view shown by diagram 684) comprising casing 648, TPMS 702, FGC down thermosiphon 698, casing with side holes 690, and central channel 694. Flow 688 enters TPMS 702 through casing with side holes 690. Geothermal heating system 682 is a multi pass loop/single pass FGC co/counter current configuration (top down view shown by diagram 686) comprising casing 648, TPMS 702, FGC down thermosiphon 698, casing with side holes 690, central channel 696, and single/multiple baffled flow loops 700.

Figure 45:
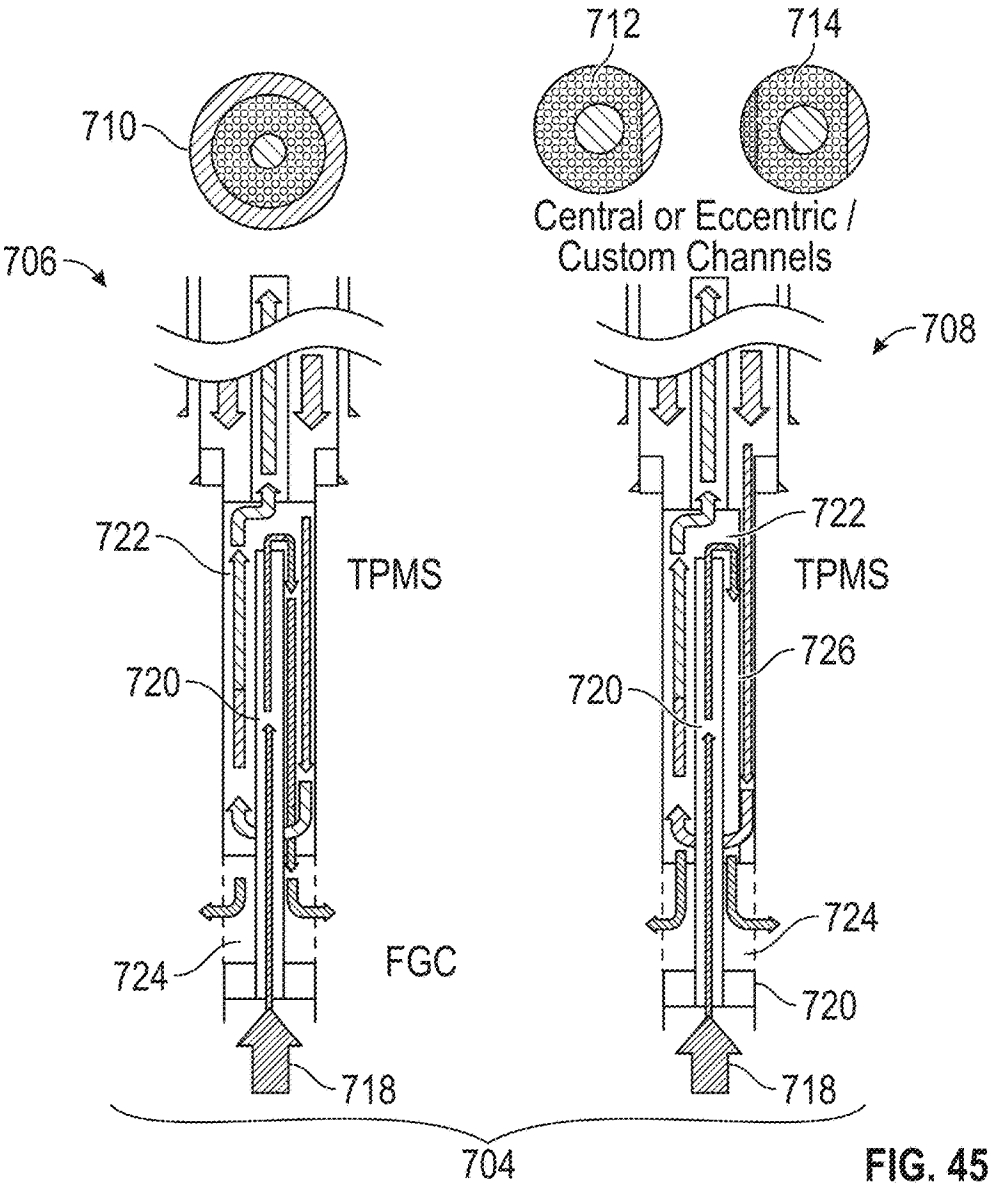
FIG. 45 is a diagram showing geothermal heating systems comprising an FGC thermosiphon, according to an embodiment of the present invention.

FIG. 45 shows geothermal heating systems 716 comprising FGC thermosiphons 724. Geothermal heating system 706 comprises central channel 720, TPMS 722, and thermosiphon 724 drawing up flow 718. Geothermal heating system 708 comprises central channel 720, side channel 726, TPMS 722, and thermosiphon 724 drawing up flow 718. Geothermal heating system 708 may operate as a bottom up or top down thermosiphon and flows fluid in a counter current up configuration. In geothermal heating systems 716, thermosiphon 724 draws up lower water and passes it through TPMS 722 and then draining back into a rock formation (not shown). Diagram 710 shows the top down view of geothermal heating system 706. Diagrams 712 and 714 show the top down view of geothermal heating system 708.

Figure 46:
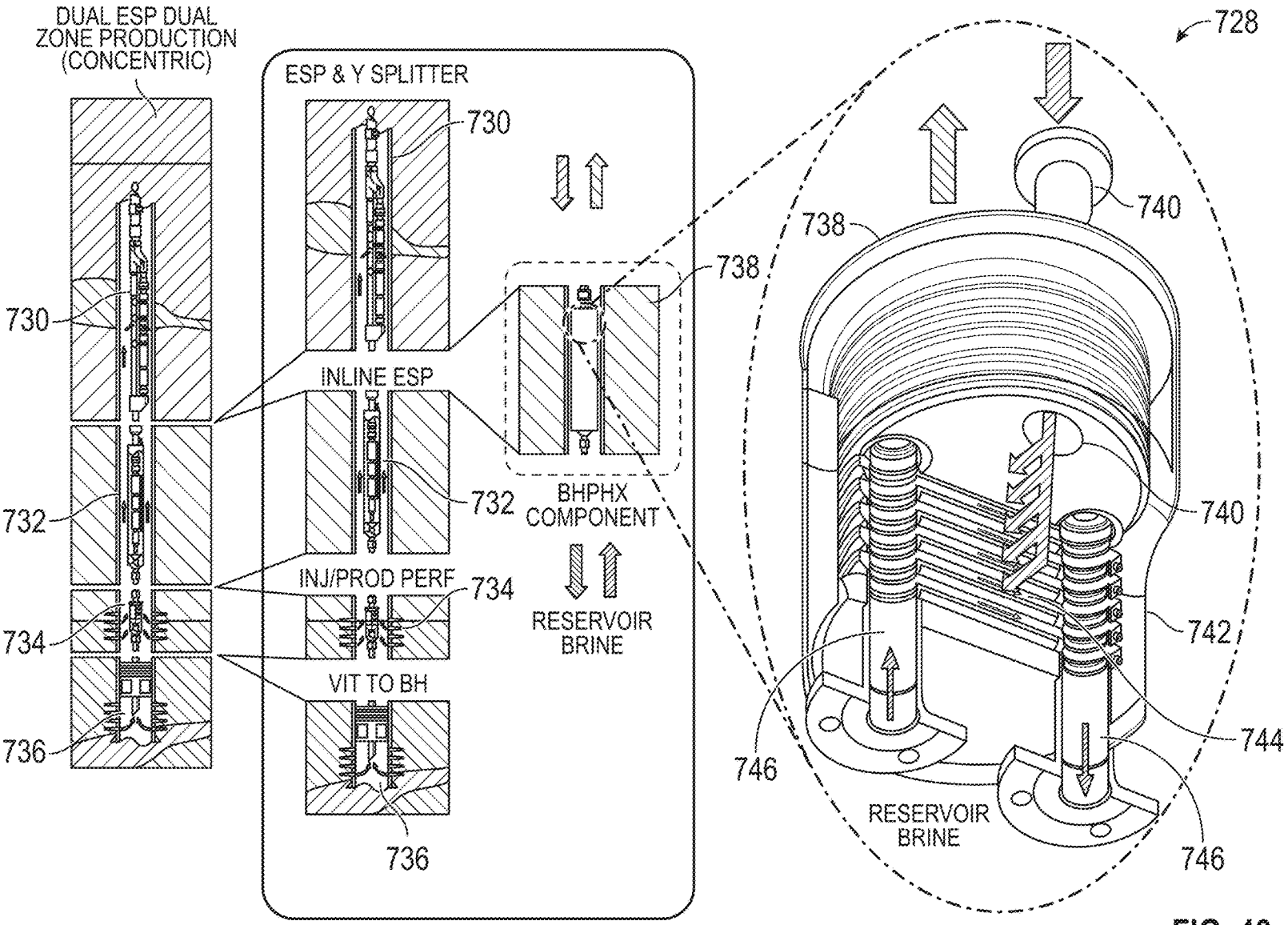
FIG. 46 is a diagram showing a geothermal heating system comprising a well bore performance heat exchanger, according to an embodiment of the present invention.

FIG. 46 shows geothermal heating system 728 comprising well bore performance heat exchanger 738. Geothermal heating system 728 also comprises ESP 730 and 732 and inflow regions 734 and 736. Well bore performance heat exchanger 738 comprises inlet 740, heat exchange surface 744, housing 742, and reservoir fluid conduits 746.

Figure 47:
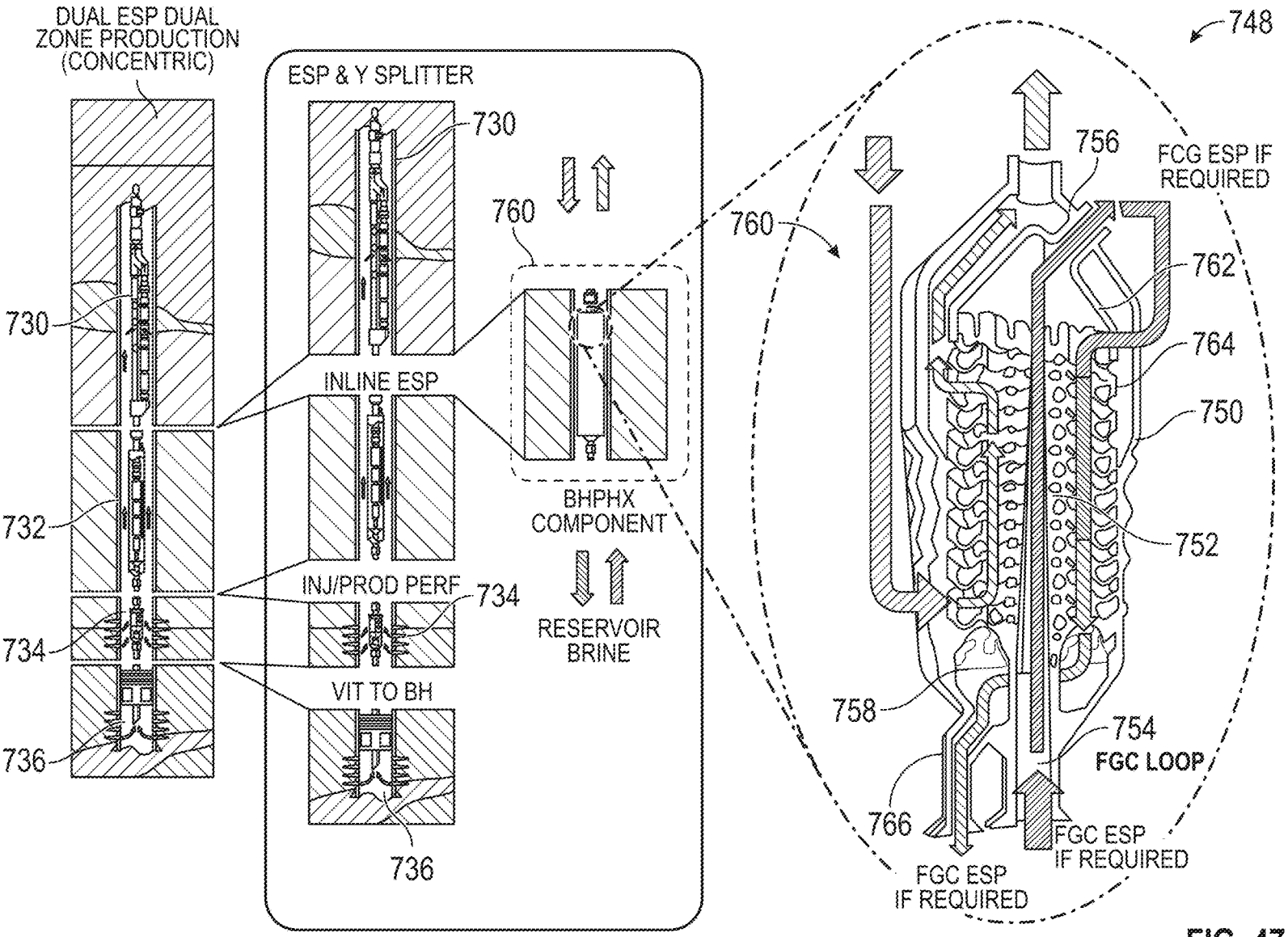
FIG. 47 is a diagram showing a geothermal heating system comprising a down bore performance heat exchanger, according to an embodiment of the present invention.

FIG. 47 shows geothermal heating system 748 comprising down bore performance heat exchanger 760. Geothermal heating system 748 also comprises ESP 730 and 732 and inflow regions 734 and 736. Well bore performance heat exchanger 760 comprises housing 750, interior housing 762, inlet 754, outlet 756 and outlet 766. Housing 750 and interior housing 762 form cavities 758 and 764. TPMS 752 is disposed within interior housing 762.

Figure 48:
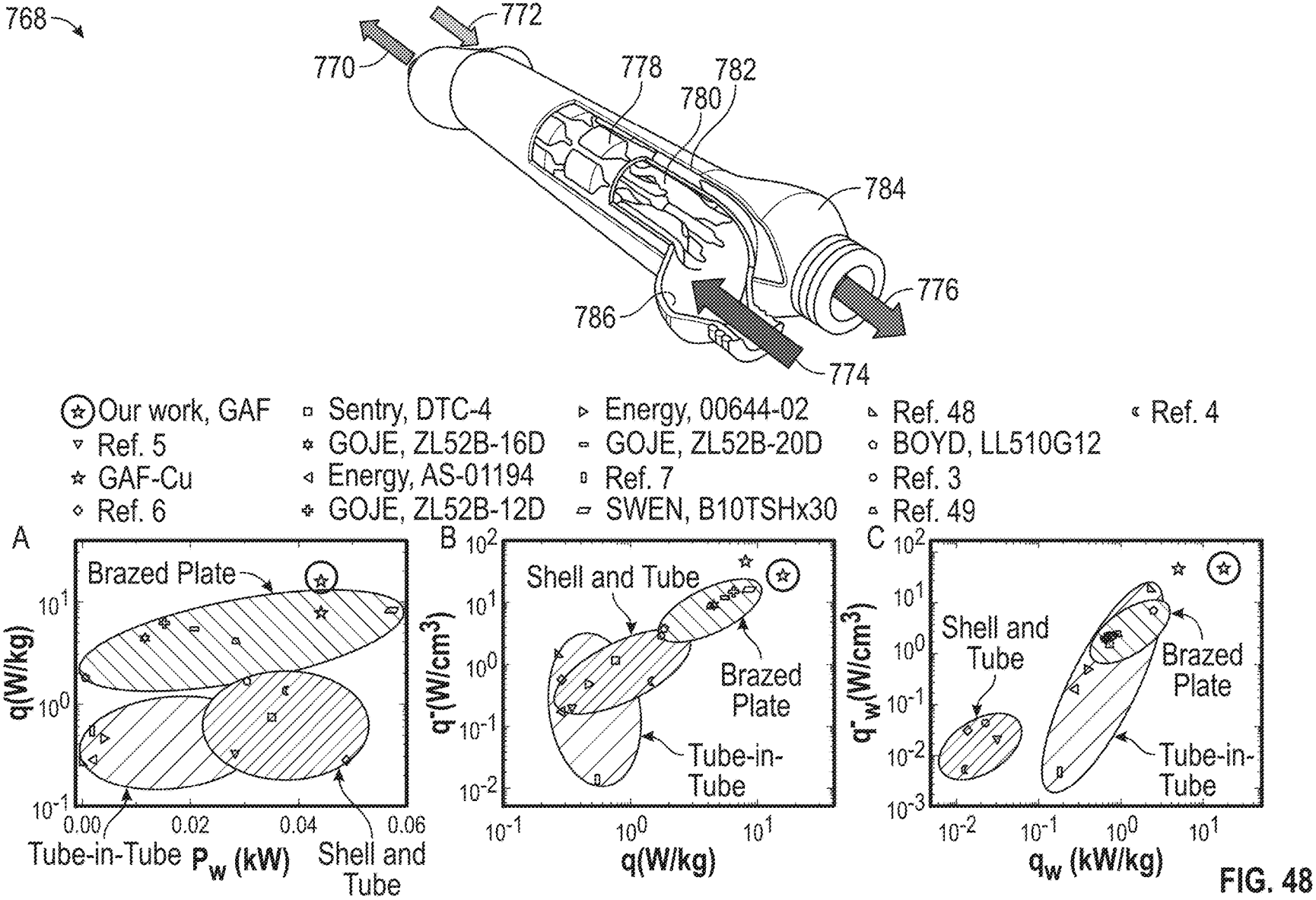
FIG. 48 is a diagram showing a geothermal heating system comprising a 3-D printed heat exchanger, according to an embodiment of the present invention.

FIG. 48 shows a geothermal heating system comprising a 3-D printed heat exchanger 768. 3-D printed heat exchanger 768 comprises housing 784, chamber 786, and chamber 782. Chamber 786 forms cold flow 780 and chamber 782 forms flow pattern 778. Fluid flow 774 enters chamber 786 and exits as flow fluid 770. Fluid flow 772 enters chamber 782 and exits as flow 776.

Figure 49:
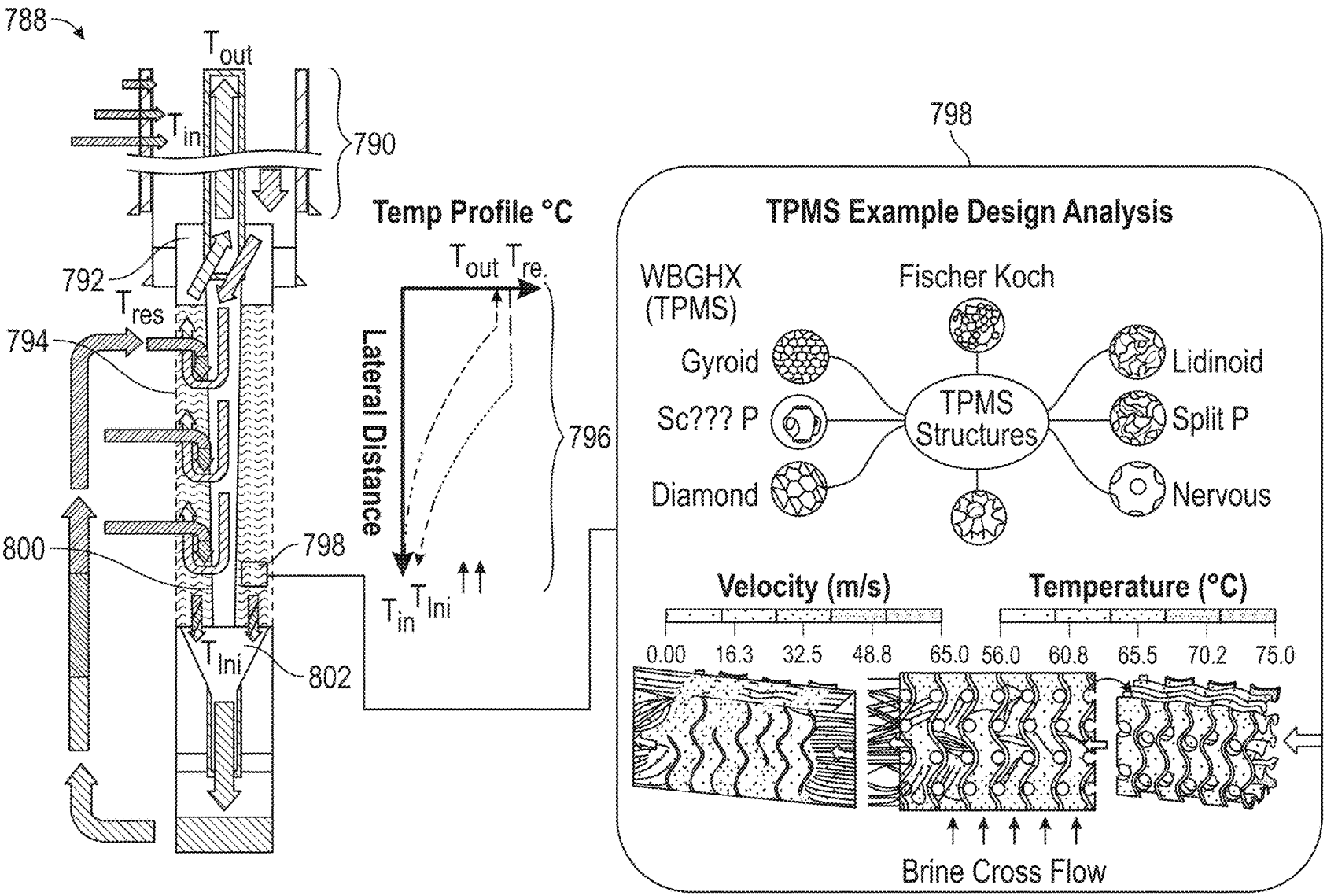
FIG. 49 is a diagram showing a geothermal heating system comprising an FGC and a down thermosiphon and a well bore gyroid heat exchanger ("WBGHX"), according to an embodiment of the present invention.

FIG. 49 shows geothermal heating system 788 comprising FGC 790 and a down thermosiphon and Well Bore Gyroid Heat Exchanger ("WBGHX") 796. Geothermal heating system 788 also comprises permeable casing 794, FC 792, central channel 800, and thermosiphon 802. WBGHX 796 comprises TPMS 798. Increased flow path area in WBGHX 796 is due to TPMS 798, reducing the parasitic load (reduced to ~2%-5%) or enabling two to four times more circulation rate. WBGHX 796 is 160-200 times more efficient than a standard DBHX exchange (~1 m of WBGHX 796 is 160 m-200 m of 7" liner), thereby reducing the amount of vacuum insulated tubing required by 20-40% per well and increasing energy recover. Counter current flow pattern increases the surface temp to within 5° C. of virgin reservoir temperature and gives up to 20%-100% increase in energy recovery multiplying the effects of increased circulation rates. Thermosiphon 802 funnel and VIT tubing, with a high void space WBGHX 796, allows mass flow independent of surface or reservoir pressure at rates equal or higher to binary production wells. The siphon system is self-controlling, the higher the rate, the more drawdown is generated. An ESP may be leveraged to enhance and manage drawdown efficiently. Mass flow into WBGHX 796 and within the reservoir allows enthalpy to be recovered from the surrounding reservoir matrix increasing the total productivity of the well.

Figure 50:
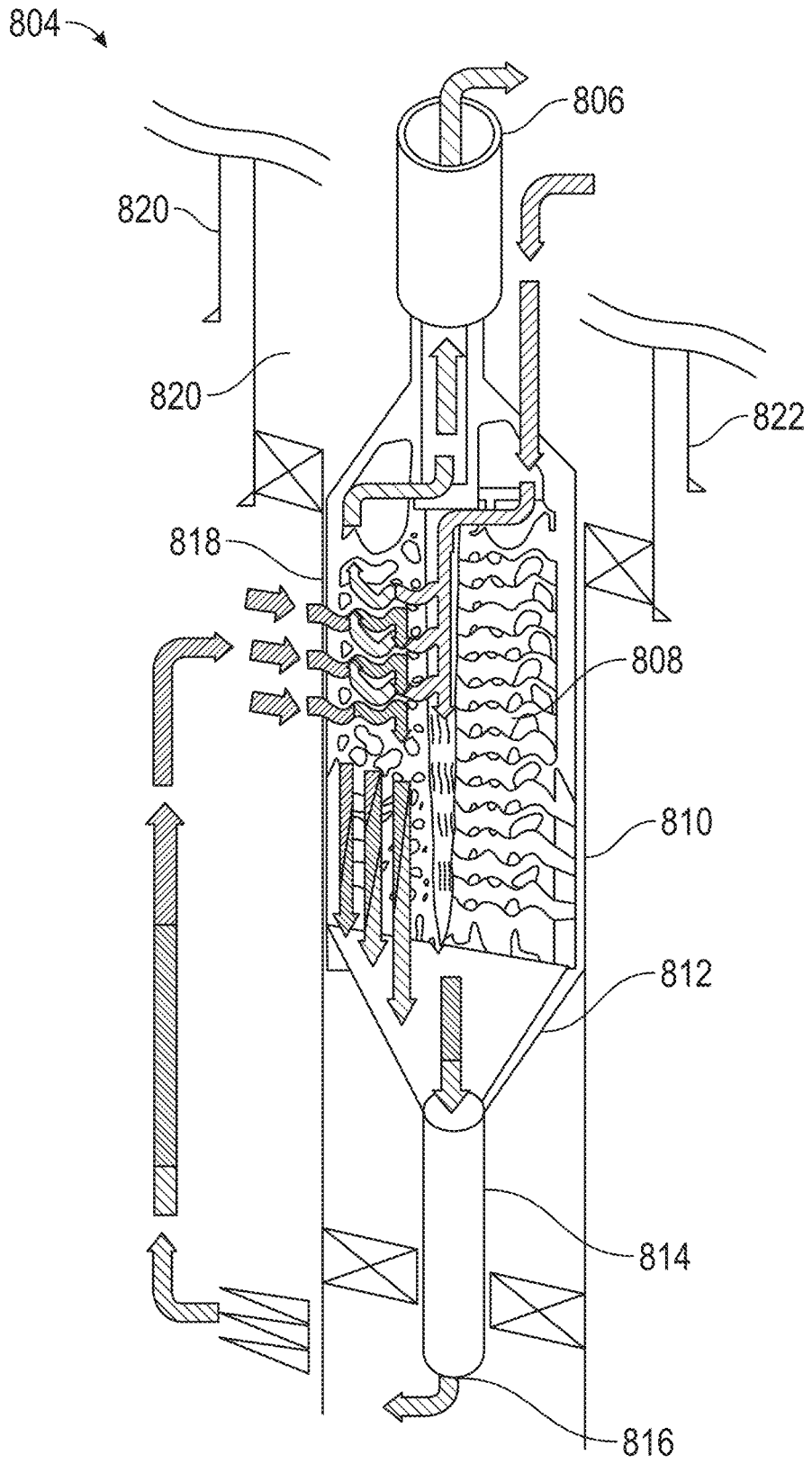
FIG. 50 is a diagram showing a geothermal heating system comprising a WBGHX and a thermosiphon generator, according to an embodiment of the present invention.

FIG. 50 shows geothermal heating system 804 comprising WBHX 808 and thermosiphon generator 812. WBHX 808 comprises a radial channel design optimized for minimum pressure drop and counter current heat exchange. Thermosiphon generator 812 provides reservoir drawdown and cross flow. Geothermal heating system 804 also comprises annulus 822, open hole and/or perforation with WBGHX side porting 818, insulate tubing 806, WBGHX porting and internal configuration 810, tubing 814, and bottom hole perforations 816. Annulus 822 comprises a high heat transfer fluid (not shown). Annulus 822 forms cavity 820 that allows for the flow of cold fluid. Open hole and/or perforation with WBGHX side porting 818 allow cross and/or counter current heat exchange. Tubing 814 may be VIT tubing for efficient drawdown. Coiled tubing may be used where well space and low drawdown rates permit. Bottom hole perforations 816 are used for injection of cooled brine. Temperature controlled by the circulation rate. Sufficient vertical space enables head pressure to inject brine (about 120% of drawdown pressure).

Figure 51:
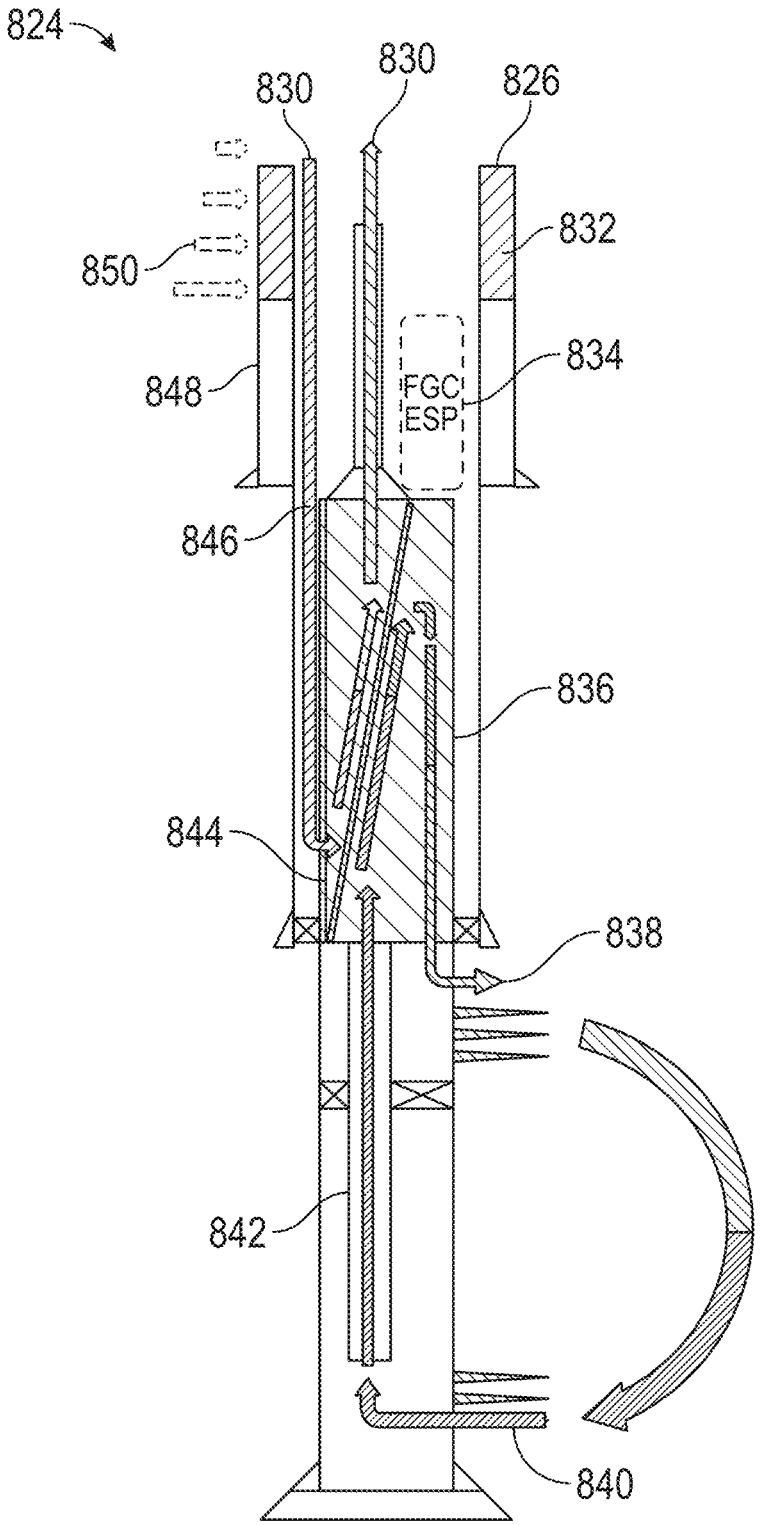
FIG. 51 is a diagram showing a geothermal heating system comprising an FGC and thermosiphon, according to an embodiment of the present invention.

FIG. 51 shows geothermal heating system 824 comprising FGC and thermosiphons 842. Geothermal heating system 824 also comprises surface injection inlet 830, fluid outlet 828, annulus 826, conductive fluid 832, casing 848, barrier 844, and DBGHX inlet 846. Optionally, geothermal heating system 824 may comprise ESP 834. Flows 850 enter casing 848 increasing ambient heat transfer (up to two times increase in energy recovery). Cold injection 838 exits geothermal heating system 824 and contacts reservoir fluid to enter geothermal heating system 824 as hot production 840.

Figure 52:
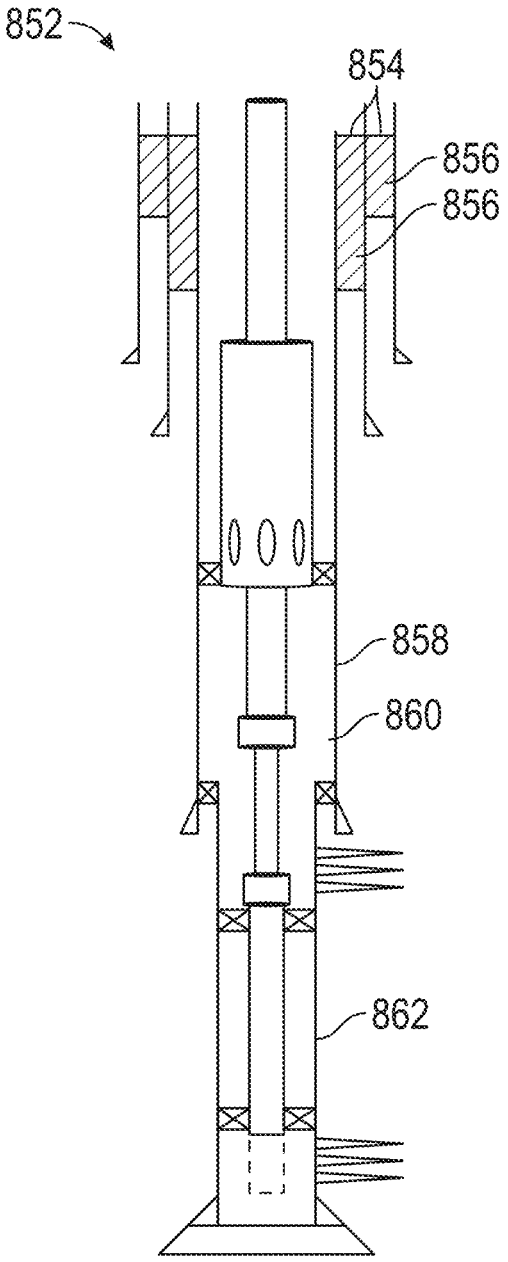
FIG. 52 is a diagram showing a geothermal heating system comprising an FGC with side track window, according to an embodiment of the present invention.

FIG. 52 shows geothermal heating system 852 comprising FGC with side track window 860. Geothermal heating system 852 also comprises nitrogen blanket gas 854, high heat transfer fluid 856, casing 858, and liner 862.

Figure 53:
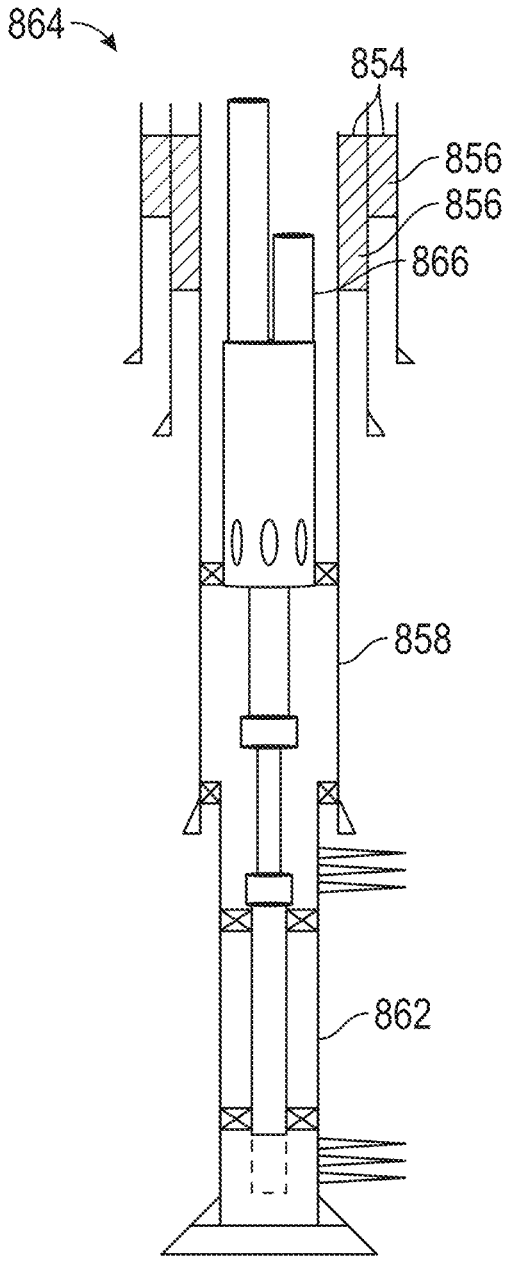
FIG. 53 is a diagram showing a geothermal heating system comprising an FGC, with side track window and ESP mount, according to an embodiment of the present invention.

FIG. 53 shows geothermal heating system 864 comprising FGC, thermosiphon, and ESP mount 866. Geothermal heating system 864 also comprises nitrogen blanket gas 854, high heat transfer fluid 856, casing 858, and liner 862.

Figure 54:
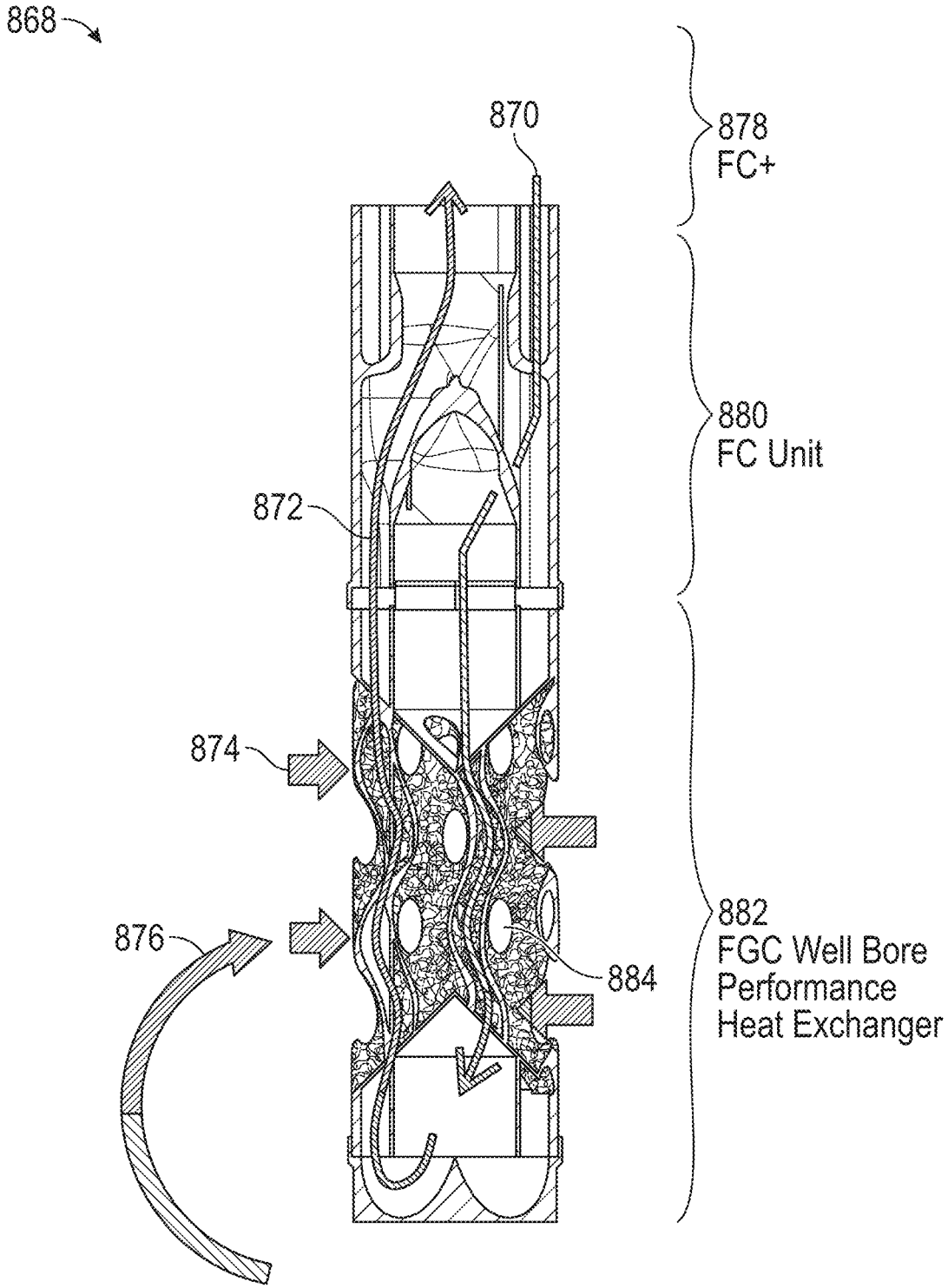
FIG. 54 is a diagram showing a geothermal heating system comprising an FGC with well bore performance heat exchanger, an FC, and an FC+ unit, according to an embodiment of the present invention.

FIG. 54 shows geothermal heating system 868 comprising an FGC with well bore performance heat exchanger, an FC, and an FC+ unit. Geothermal heating system 868 comprises FC+ 878, FC 880, FGC well bore performance heat exchanger 882. FGC well bore performance heat exchanger 882 comprises TPMS 884. Cold fluid flow 870 passes through FC+ 878, FC 880 and TPMS 884 to contact hot fluid flows 874 and 876. Hot fluid return flow 872 passes through FC+ 878 and FC 880 to exit geothermal heating system 868.

Figure 55:
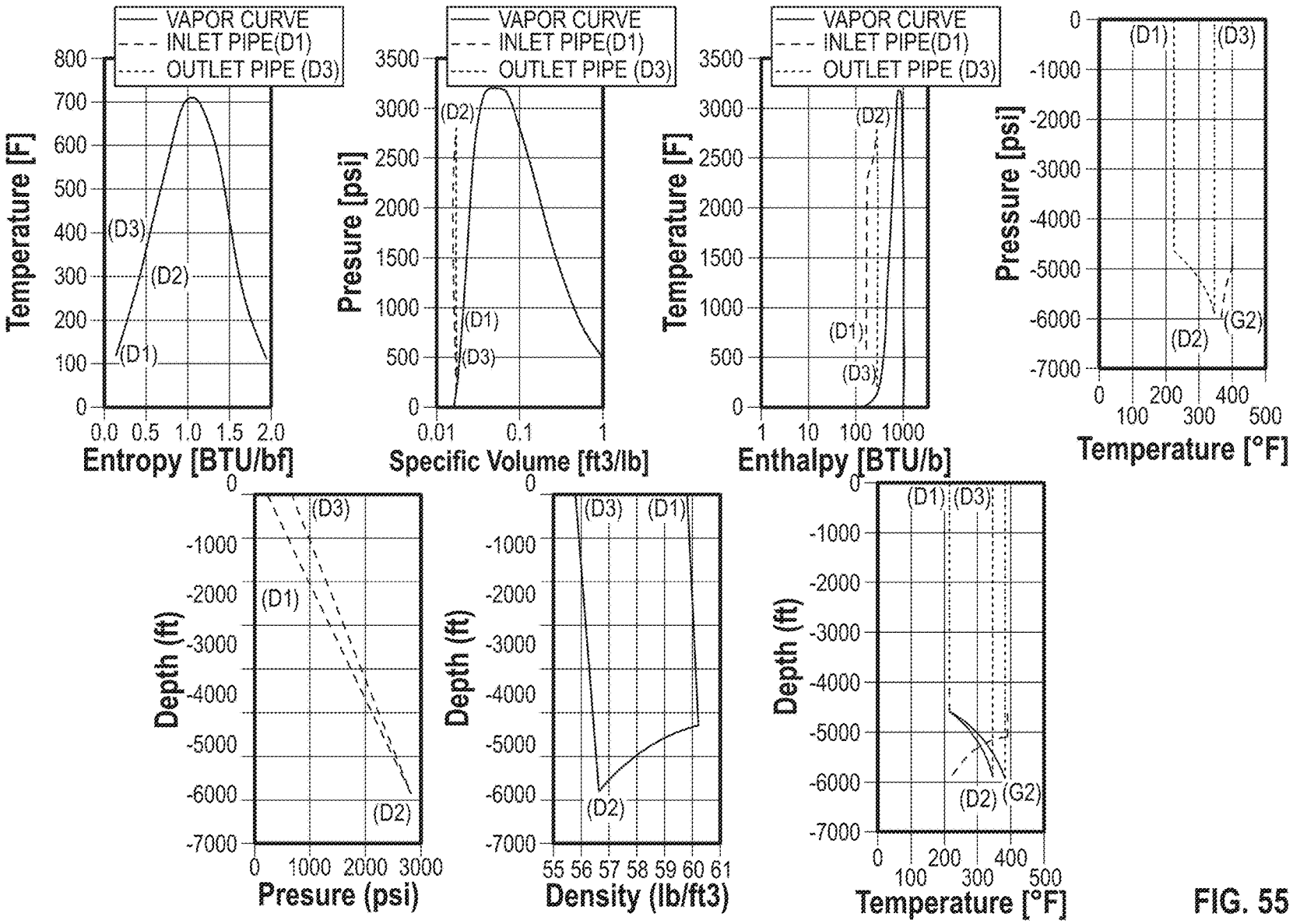
FIG. 55 is a series of graphs showing thermodynamic properties for a DBHX, according to an embodiment of the present invention.

FIG. 55 shows thermodynamic properties for a DBHX where (D1), (D2), (D3) and (G2) are the physical locations representing the surface injection point in the DBHX, the bottom of the VIT within the closed loop, the VIT outlet at surface, and the fluid temperature in the geothermal reservoir outside of the closed loop respectively.

Figure 56:
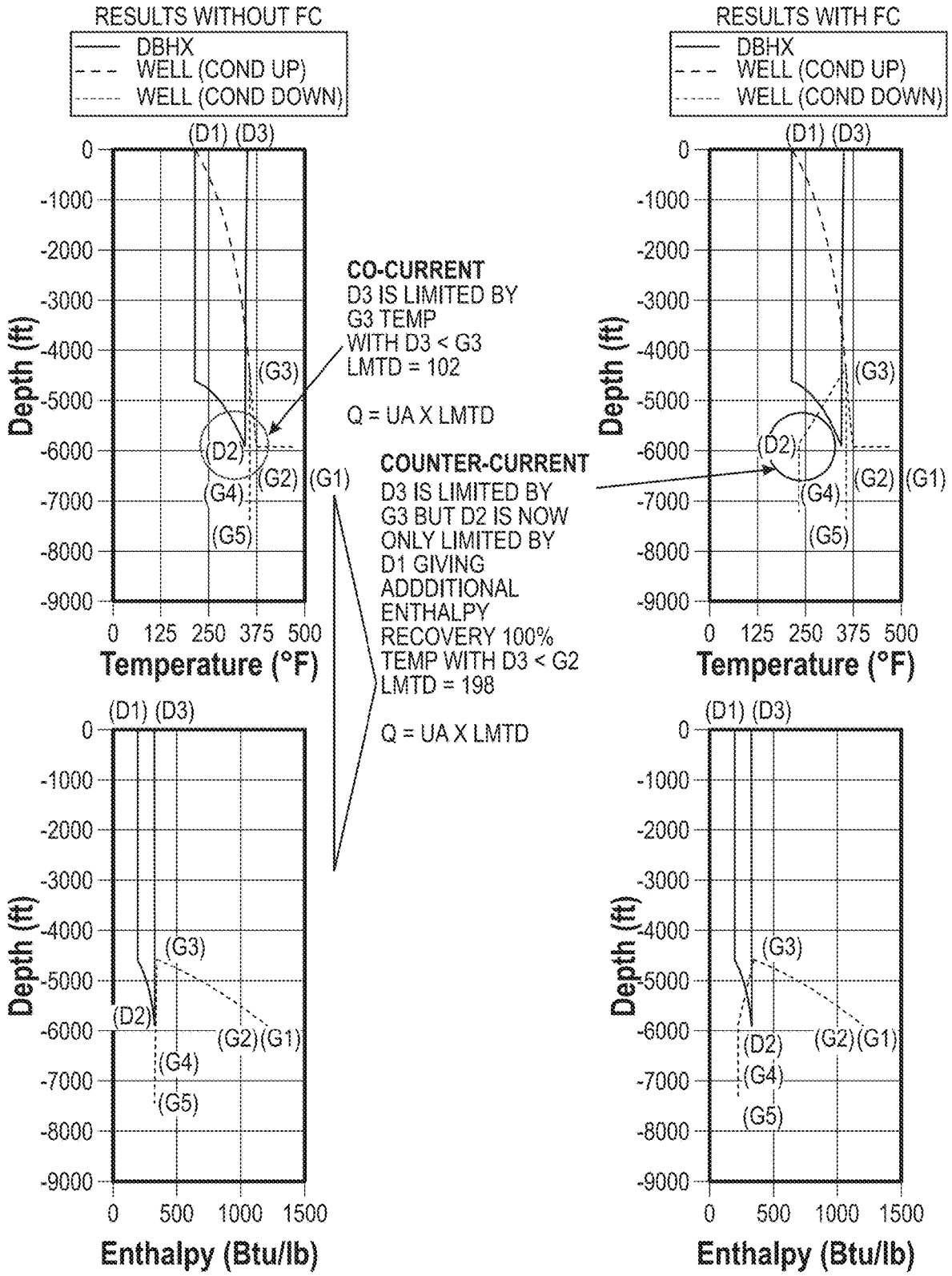
FIG. 56 is a series of graphs showing a temperature and enthalpy versus depth comparison for geothermal heating systems without and with and FC, according to an embodiment of the present invention.

FIG. 56 shows a temperature and enthalpy versus depth comparison for geothermal heating systems without and with and FC. Enthalpy recover is increased and achieved at lower temperatures relative with an FC relative to without an FC.

Figure 57:
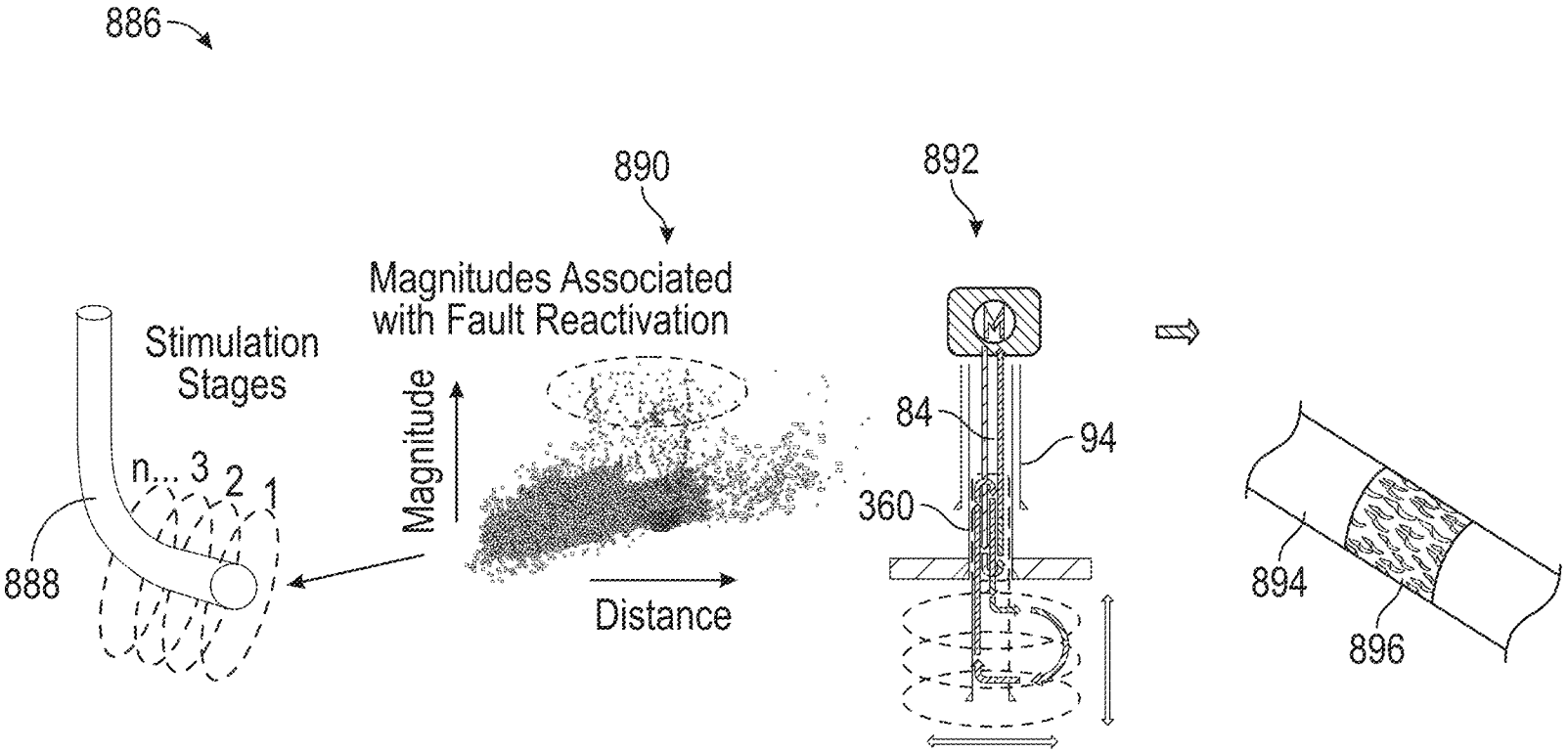
FIG. 57 is a series of graphs showing a retrofitting process for an unconventional depleted gas well to a geothermal asset, according to an embodiment of the present invention.

FIG. 57 shows retrofitting process 886 for an unconventional depleted gas well to a geothermal asset. Retrofitting process 886 shows horizontal geothermal well 888, reservoir fracture network simulation 890, and geothermal heating system 892. Geothermal heating system 892 comprises thermal circulation system 84 disposed in well bore 94, and WBPHX 306. Fluid 896 flows through geothermal heating system 892 casing 894.

Figure 58:
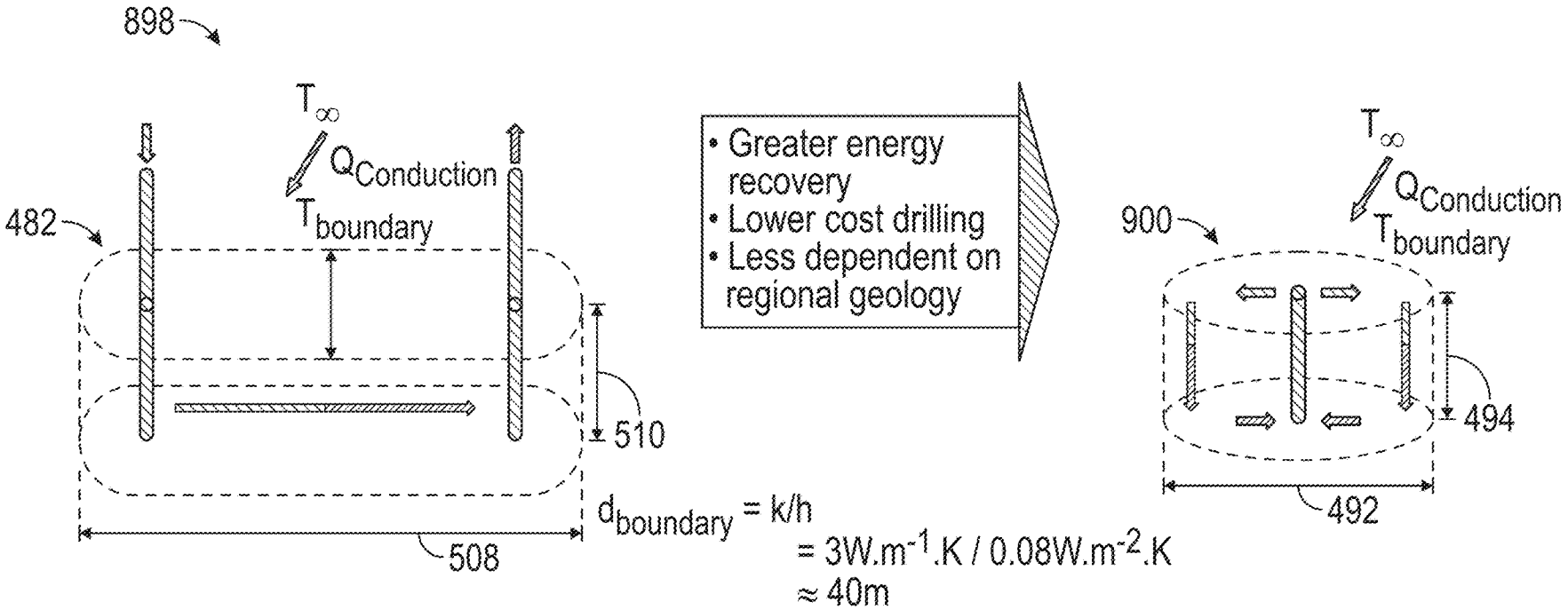
FIG. 58 is a series of diagrams and graphs showing a comparison of the physics of a conventional geothermal heating system compared to a geothermal heating system comprising an FGC, according to an embodiment of the present invention.

FIG. 58 shows a comparison 898 of the physics of open loop geothermal heating system 482 compared to geothermal heating system comprising an FGC 900. Open loop geothermal heating system 482 comprises length 508 and height 510. Geothermal heating system comprising an FGC 900 comprises diameter 492 and height 494.

Figure 59:
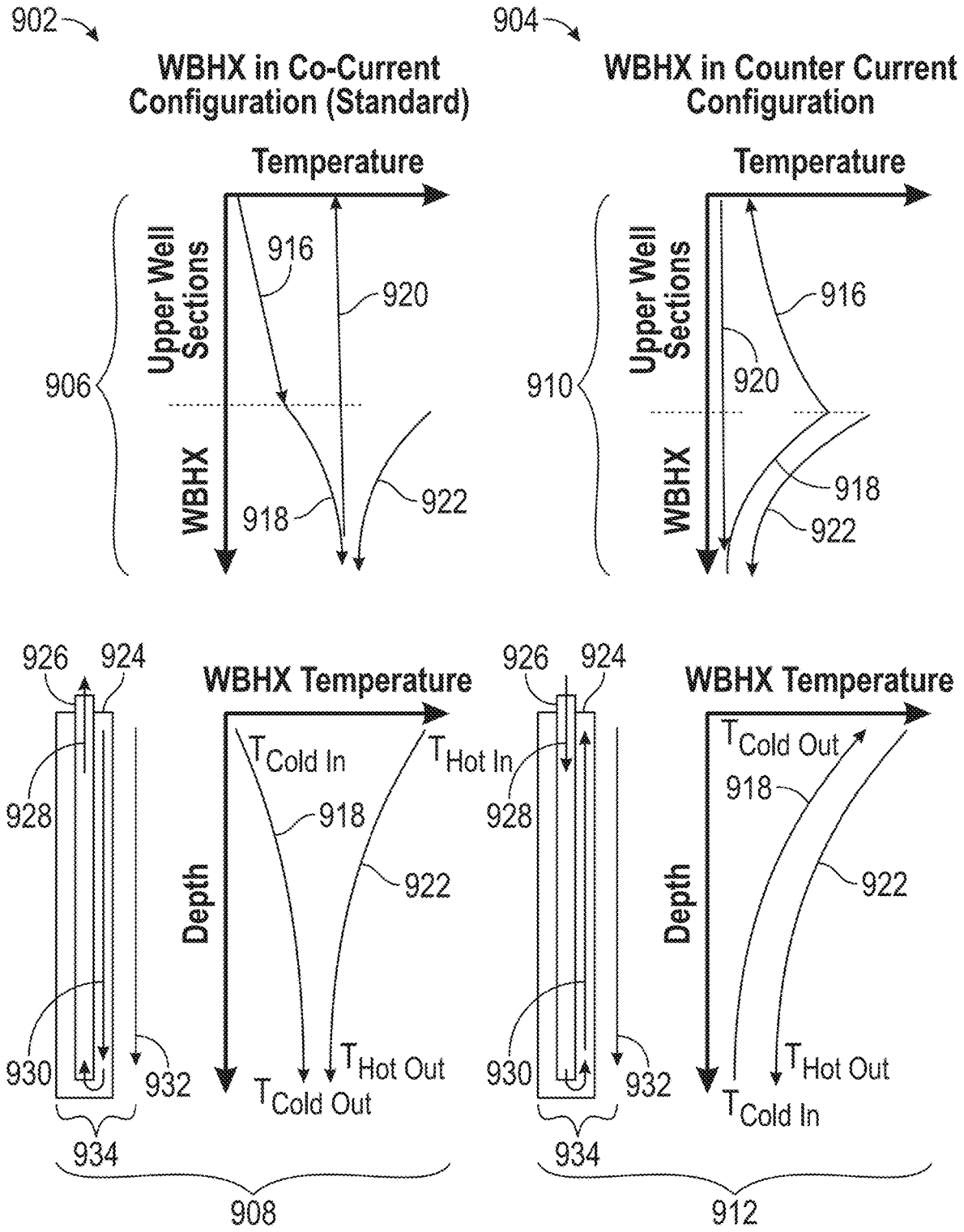
FIG. 59 is a series of graphs showing a comparison of a WBHX in co-current configuration to a WBHX in counter current configuration, according to an embodiment of the present invention.

FIG. 59 shows a comparison of WBHX in co-current configuration 902 to WBHX in counter current configuration 904. Graphs 906 and 910 show curves for high heat transfer from outer casing 916, low heat transfer from VIT 920, closed loop temperature profile 918, and reservoir medium temperature profile 922. Graphs 908 and 912 show curves for reservoir medium temperature profile 922 and closed loop temperature profile 918 compared to geothermal heating systems 934 comprising vacuum insulated tubing 926, WBHX outer casing 924 disposed along depth 932, closed loop circulation fluid 928, and cooling reservoir medium 930.

Figure 60A:
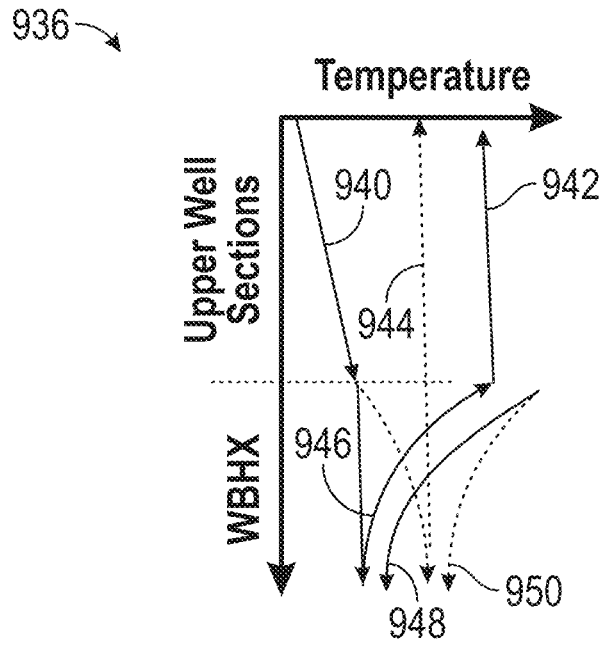
FIGS. 60A and 60B are a graph and diagram, respectively, showing the temperature profiles for upper well sections and a WBHX, according to an embodiment of the present invention.
Figure 60B:
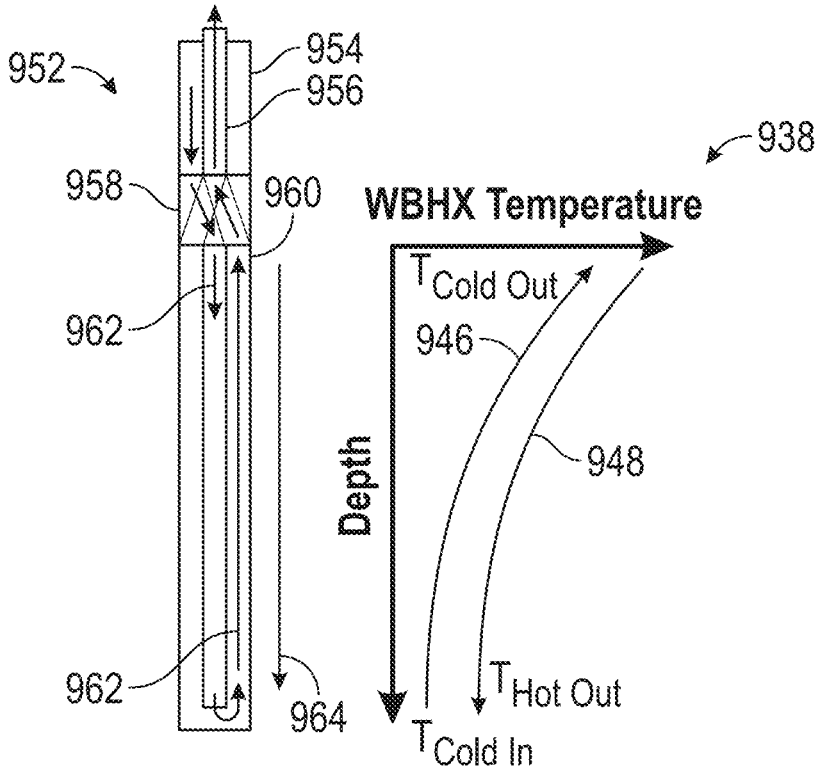

FIGS. 60A and 60B showing the temperature profiles 936 and 938 for upper well sections and a WBHX. Temperature profile 936 shows closed loop temperature profile 946, reservoir medium temperature profile 948, high heat transfer from outer casing 940, low heat transfer from VIT 942, co-current performance from known technology 950, and FC 944. Temperature profile 938 shows closed loop temperature profile 946 and reservoir medium temperature profile 948 compared to geothermal heating system 952 comprising upper well section 954, vacuum insulated tubing 956, outer casing 960 disposed along depth 964, FC 958, and closed loop circulation fluid 962.

Figure 61A:
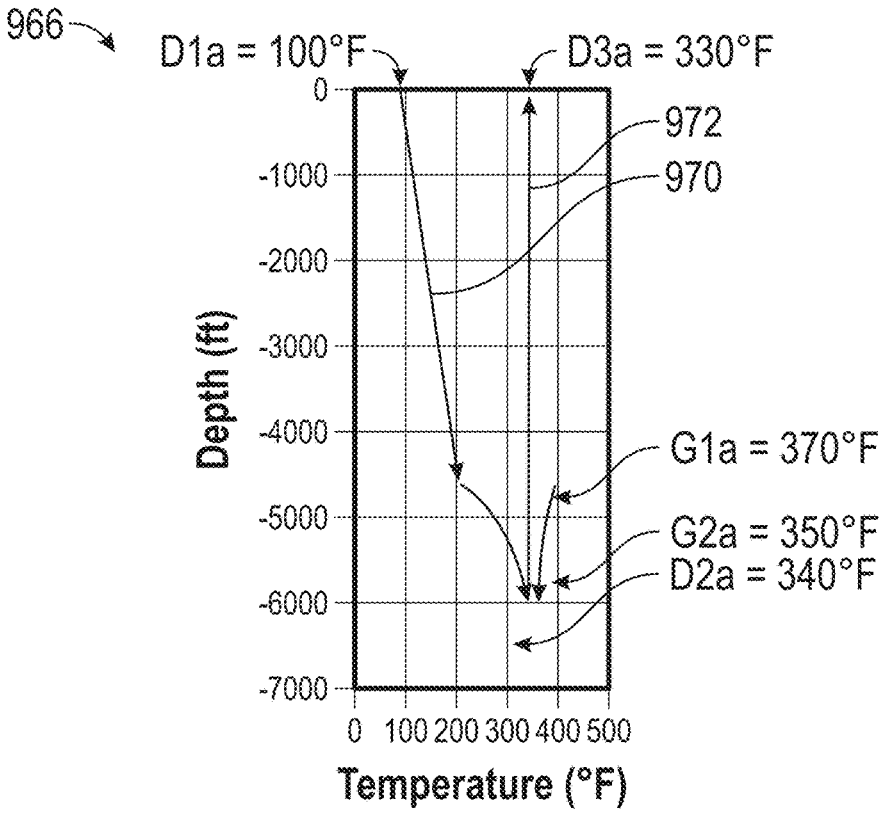
FIGS. 61A and 61B are graphs showing the temperature profiles for a closed loop co-current geothermal heating system and a WBHX flux crossover counter current geothermal heating system, respectively, according to an embodiment of the present invention.
Figure 61B:
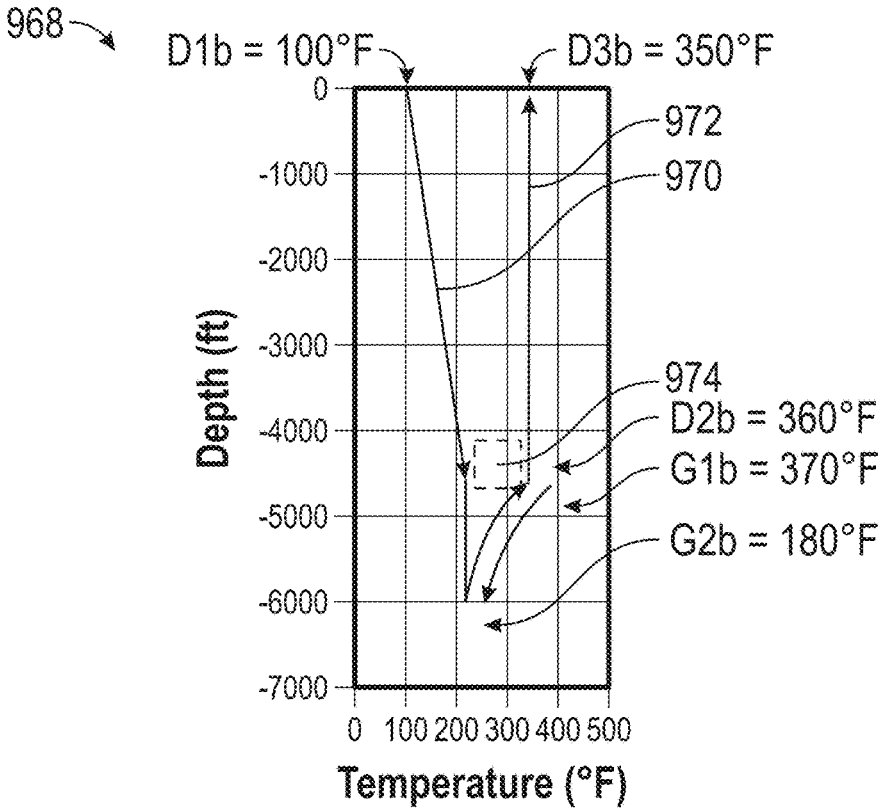

FIGS. 61A and 61B show temperature profiles 966 and 968, for a closed loop co-current geothermal heating system and a WBHX flux crossover counter current geothermal heating system, respectively. Temperature profile 966 shows cold annulus stream WBHX 970 and hot VIT to surface stream 972, wherein G1a. is reservoir temperature, G2a. cooled reservoir fluid temperature, D1a. co-current annulus flow to WBHX inlet temperature, D2a. co-current bottom of the WBHX VIT inlet return to surface temperature, and D3a. VIT outlet from the WBHX temperature at the surface. Temperature profile 968 shows cold annulus stream WBHX 970, hot VIT to surface stream 972, and inline FC cell (to enable counter current flow) 974, wherein G1a. is reservoir temperature, G2a. cooled reservoir fluid temperature, D1a. co-current annulus flow to WBHX inlet temperature, D2a. co-current bottom of the WBHX VIT inlet return to surface temperature, and D3a.

Figure 62:
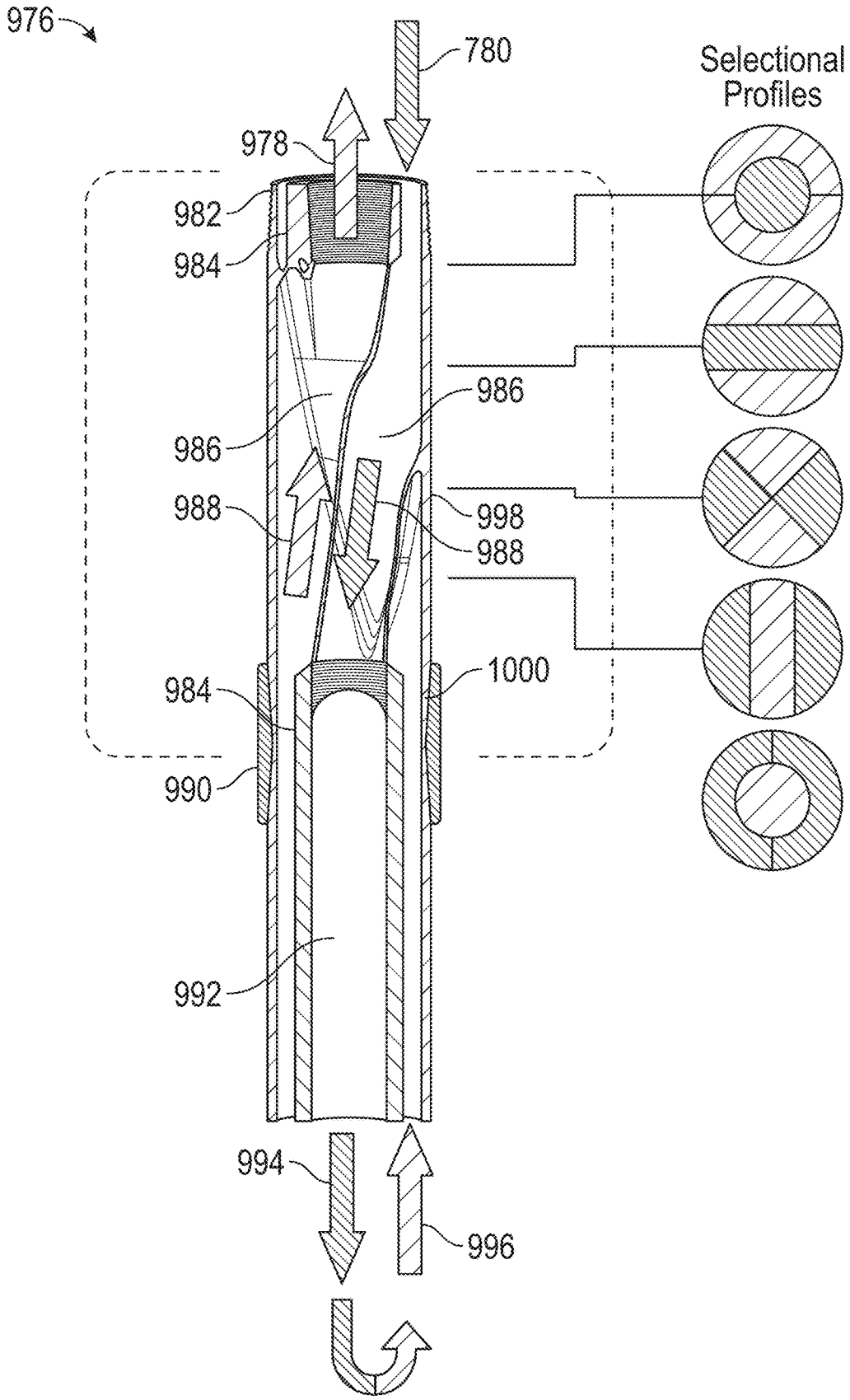
FIG. 62 is a series of graphs showing an FC cell design, according to an embodiment of the present invention.

FIG. 62 shows FC cell design 976 comprising FC casing wall 998, closed loop inner VIT 992, casing connecting collar 990, FC internals 986, FC VIT connection 984, FC outer casing connection 1000, cold flow path 994, hot flow path 996, and FC flow path to divert anulus to core flow and vis versa 988. Cold flow 780 enters FC cell design 976 while hot flow 978 exits FC cell design 976.

Figure 63:
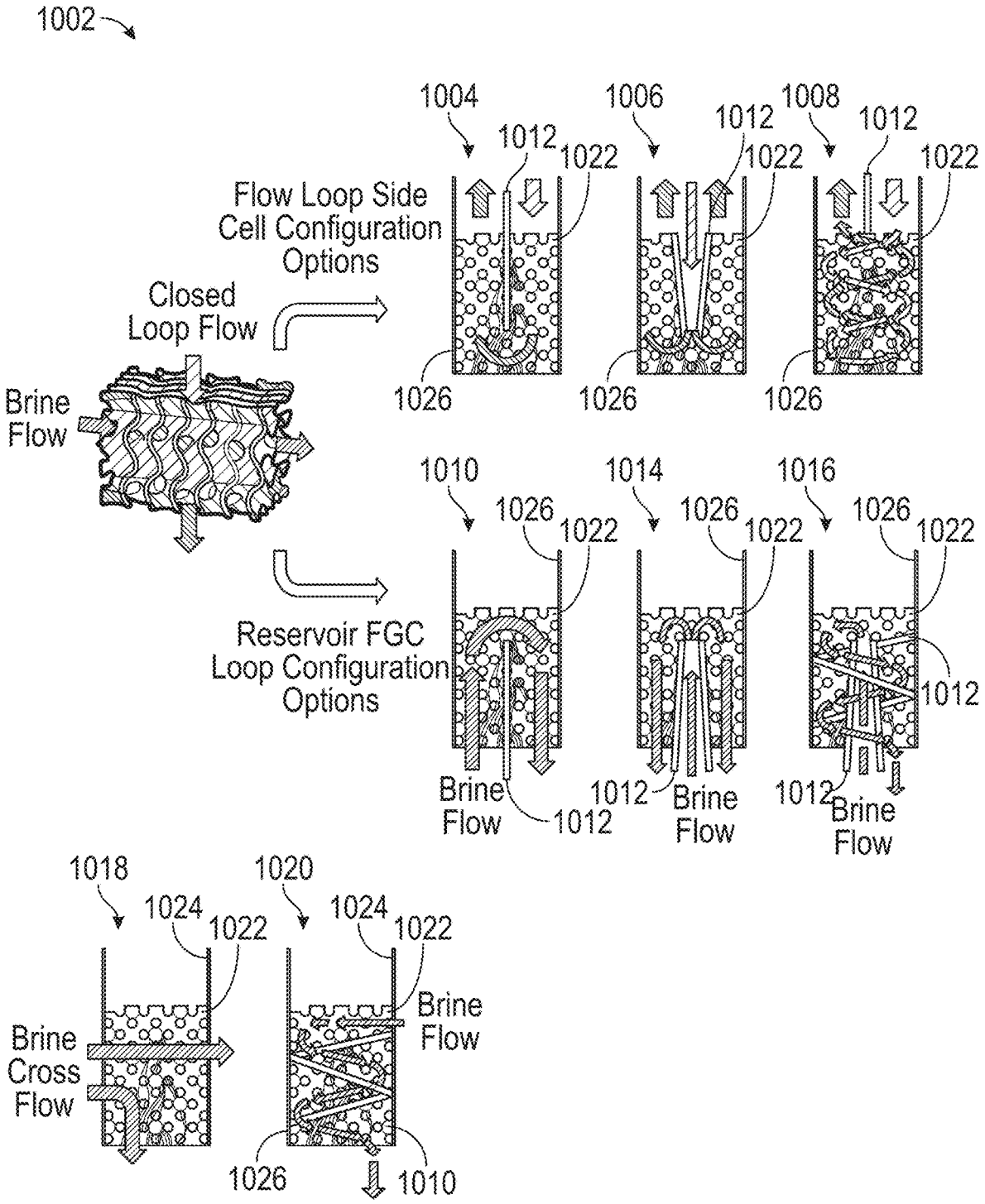
FIG. 63 is a diagram showing TPMS flow channel configurations, according to an embodiment of the present invention.

FIG. 63 shows TPMS flow channel configurations 1002. TPMS flow channel configurations 1002 show plainer split flow barrier for a closed loop path 1004; annular or planar split flow barrier for closed loop path 1006; single or double helical flow path at 20-70° pitch angle 1008; planar split flow barrier for reservoir flow 1010; annular flow channel for reservoir fluid 1014; double helical flow path at about 20° to about 70° pitch angle 1016; reservoir cross flow in with vertical flow path exit 1018; and single helical flow path at about 20° to about 70° pitch angle 1020. Each TPMS flow channel configuration 1002 comprises TPMS cell structure 1012; internal TPMS flow baffling 1022, permeable casing sidewall 1024, and housing 1026. Housing 1026 may be a well, WBHX, WBPHX casing, open hole, production screen, or a combination thereof.

Figure 64:
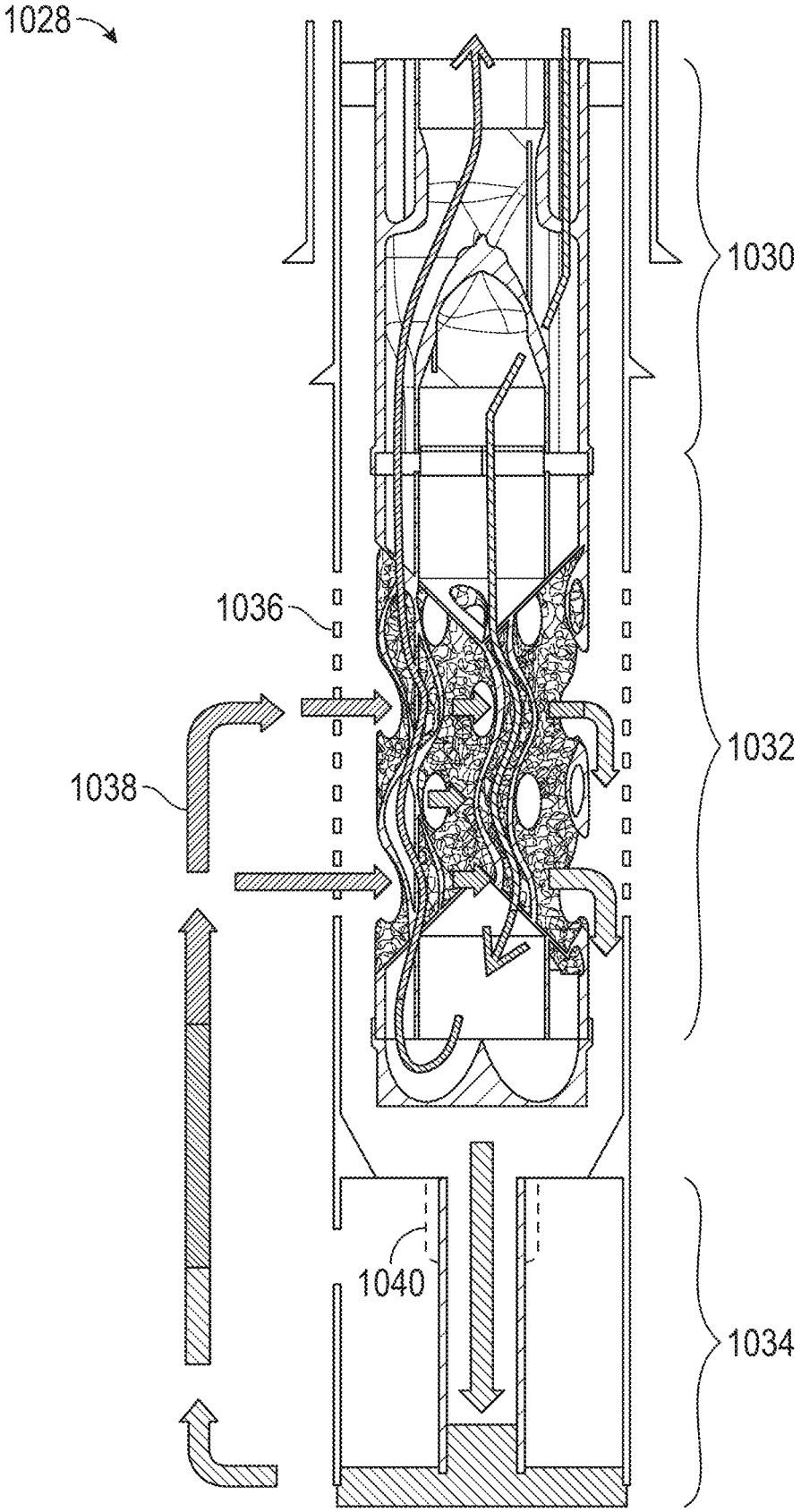
FIG. 64 is a series of diagrams showing a geothermal heating system comprising an FC cell, according to an embodiment of the present invention.

FIG. 64 shows geothermal heating system 1028 comprising an FC cell. Geothermal heating system 1028 comprising: FC cell component 1030, TPMS WBHX section design component 1032, FGC thermosiphon configuration 1034, reservoir FGC showing reservoir brine or steam flow path (may be in either direction) and assisted with reservoir cross flow 1038, potential ESP location to drive FGC circuit in addition to thermosiphon 1040, and slotted or perforated liner to allow reservoir fluid cross flow into the WBPHX 1036.

Figure 65:
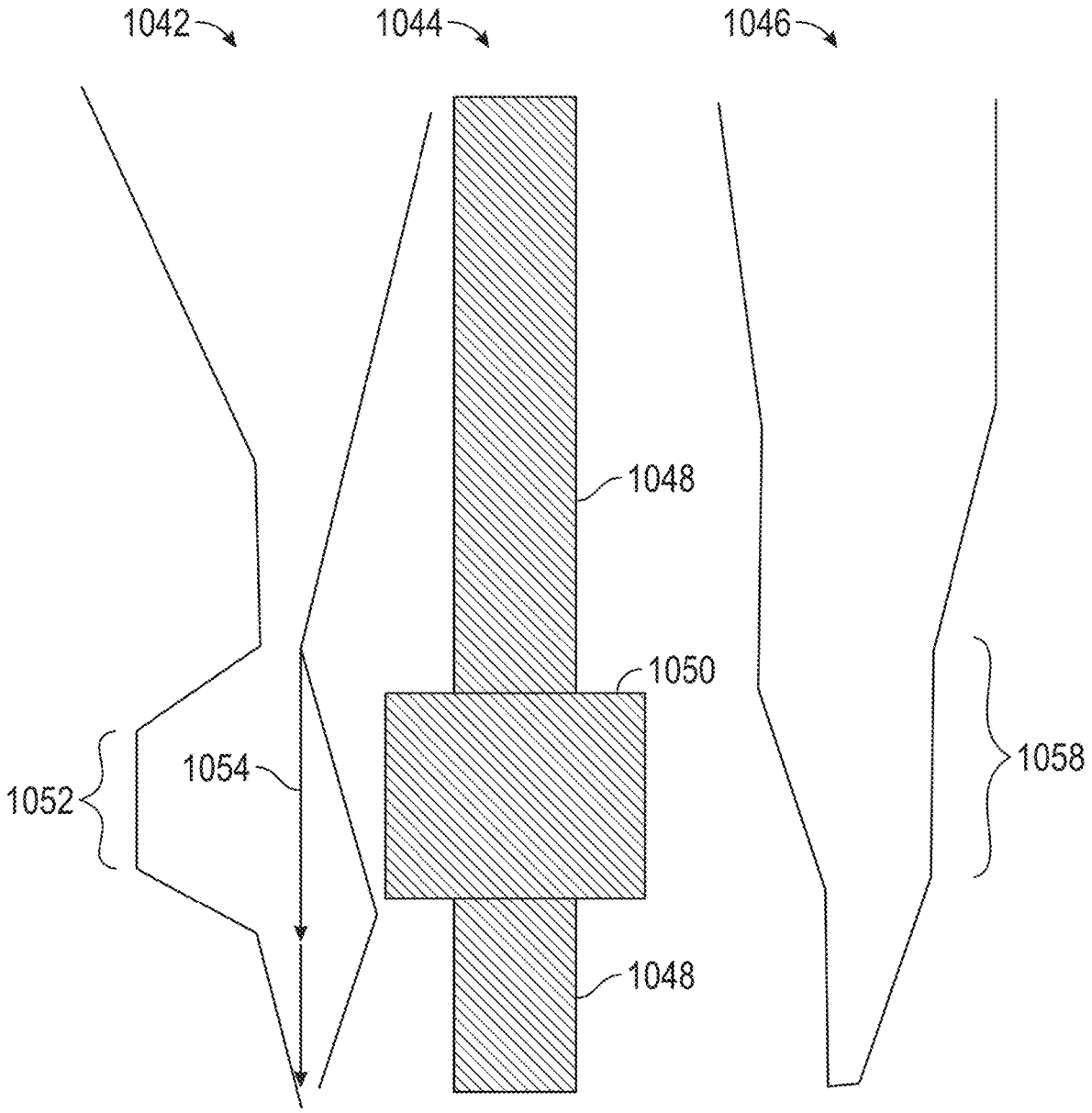
FIG. 65 are graphs and a diagrams showing a comparison of temperature profiles for a standard geothermal heating system and a geothermal heating system comprising a TPMS, according to an embodiment of the present invention.
Figure 66D:
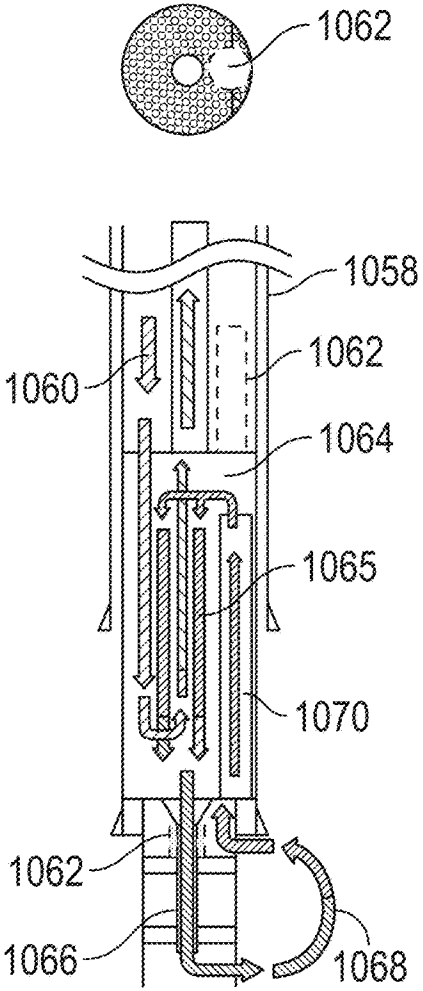
FIGS. 66A, 66B, 66C, and 66D are a series of diagrams showing configurations of geothermal heating systems comprising an FGC disposed around a heat exchanger, a heat exchanger along the diameter of the well bore, a side channel with an ESP, and internal baffles, according to an embodiment of the present invention.
Figure 66C:
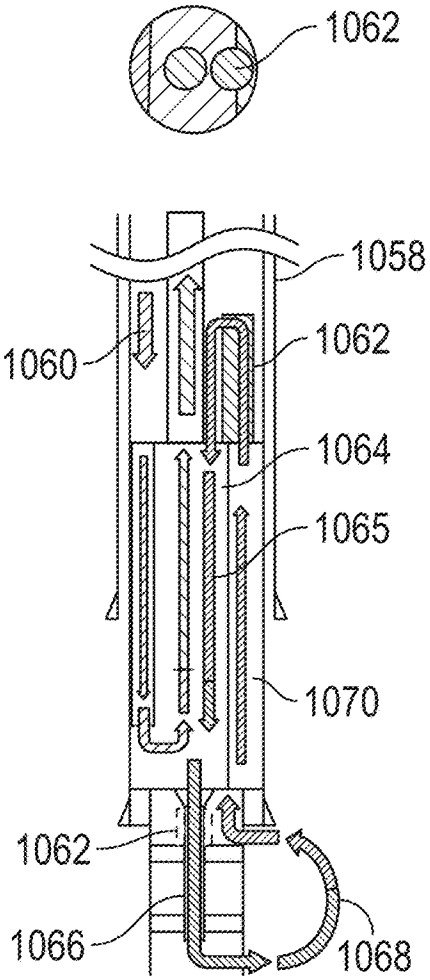
Figure 66B:
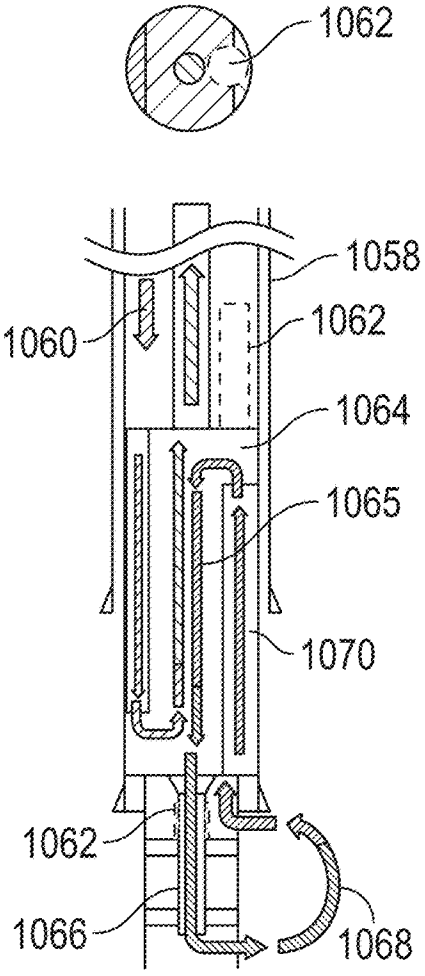
Figure 66A:
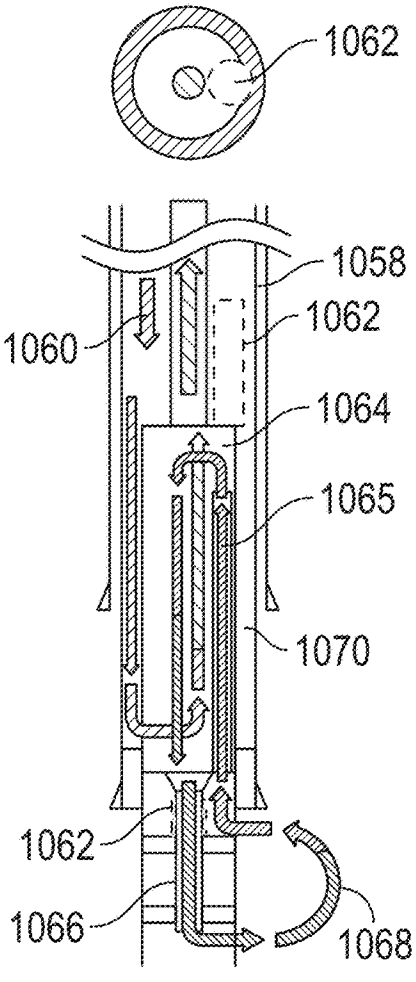
Figures 67A, 67B, 67C, 67D:
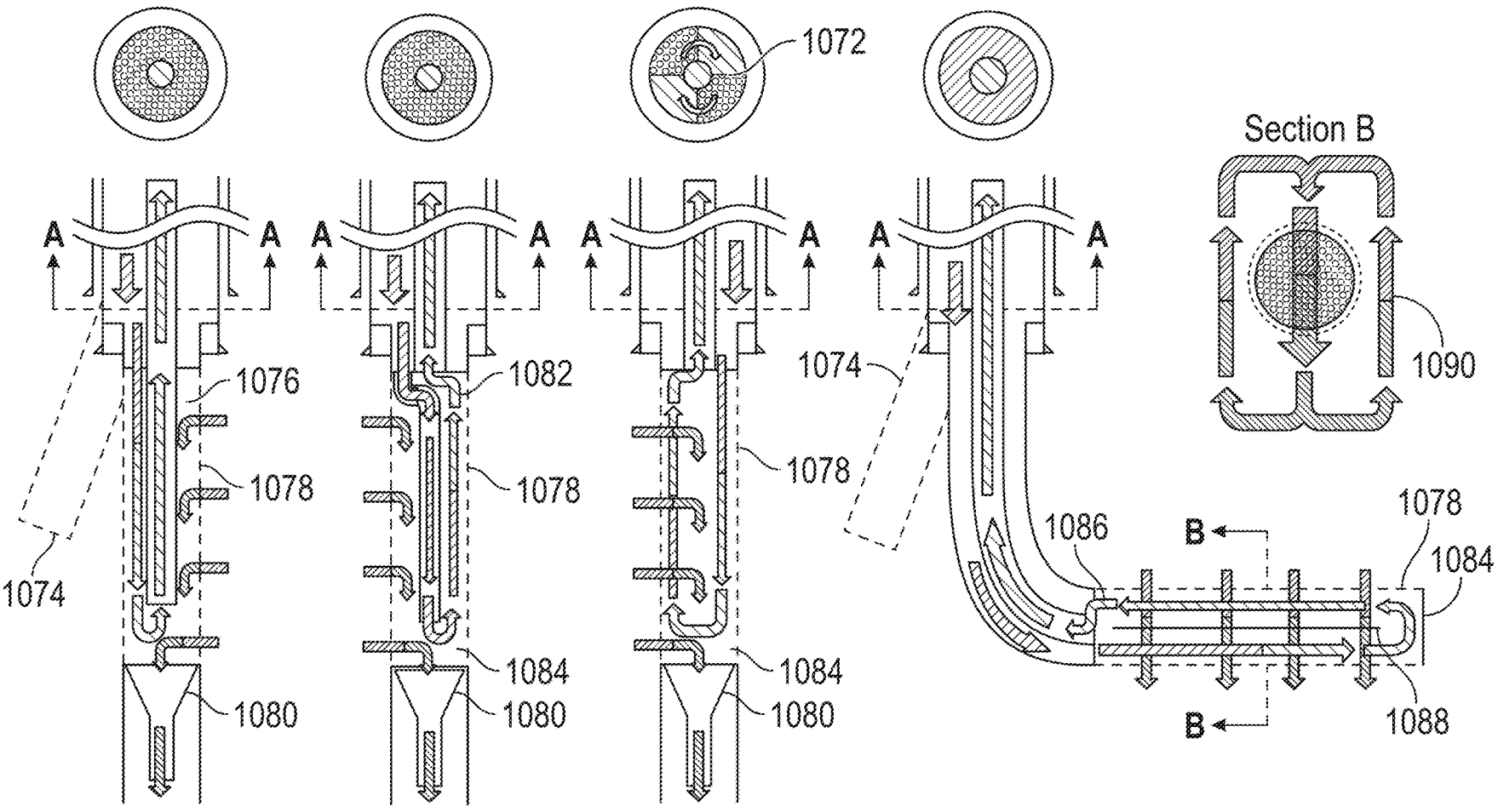
FIGS. 67A, 67B, 67C, and 67D are a series of diagrams showing configurations of geothermal heating systems comprising a kickoff point, a FGC thermosiphon tube, vertical flow compartments in a TPMS structure, and a horizontal well bore with a TPMS structure, according to an embodiment of the present invention.

FIG. 65 shows a comparison of temperature profiles for geothermal heating system and a geothermal heating system 1042 comprising a TPMS 1046. Geothermal heating system 1044 comprises core 1048 and heat exchange region 1050. Regions 1052 and 1056 indicate the different temperature profiles along heat exchange region 1050. Line 1054 indicates the temperature profile if heat exchange region 1050 is insulated.

FIGS. 66A, 66B, 66C, and 66D shows configurations of geothermal heating systems comprising an FGC disposed around a heat exchanger, a heat exchanger along the diameter of the well bore, a side channel with an ESP, and internal baffles. FIGS. 67A, 67B, 67C, and 67D show geothermal heating systems comprising upper well casing 1060, potential ESP locations 1062, WBHX Cell Sections located above the reservoir production zone in larger casing section 1064, production liner tubing configuration for FGC thermosiphon drive 1066, and FGC circulation in the reservoir showing from the toe of the well to the heal 1068. Flow direction can be reversed and well orientation can range from vertical, deviated too horizontal. FIGS. 67A, 67B, 67C, and 67D show geothermal heating systems also comprising surface closed loop circulation with hot medium in the central VIT and the cold return in the annulus space 1070. An FC may be added separately above the WBHX or incorporated in the flow channeling of the WBHX itself. FIGS. 67A, 67B, 67C, and 67D show concentric design with green loop flowing around HX and entering at the bottom; a concentric design with HX the diameter of the well bore with the green and FGC loop entering via side channels; a side channel entry with an ESP driving the bottom heat circuit; and a concentric design with HX the diameter of the well bore internal baffles for double pass on a loop single pass FGC, respectively.

FIGS. 67A, 67B, 67C, and 67D shows configurations of geothermal heating systems comprising a kickoff point, a FGC thermosiphon tube, vertical flow compartments in a TPMS structure, and a horizontal well bore with a TPMS structure. FIGS. 68A, 68B, 68C, and 68D show geothermal heating systems comprising, TPMS cell structure 1076, production liner 1084, open hole or screen section against the reservoir rock 1078 (where the well bore may be oriented vertically, deviated, or horizontally), potential kickoff point for multilateral and duplication of bottom hole section 1074, FGC thermosiphon tubing configuration 1080 (which may include an ESP to enhanced FGC performance), FC channeling built in to the TPMS structure 1082, vertical flow compartments in the TPMS structure 1072 (for the surface loop to provide two multi pass channels), split core TPMS structure 1088 (to establish a vertical convection cell at each frac stage in a horizontal stimulated well), cross-section of an FGC convection cell established in a horizontal well 1090 with outflow 1086. FIGS. 68A, 68B, 68C, and 68D are multi pass surface loops with single pass FGC co/counter current configurations.

Figure 68:
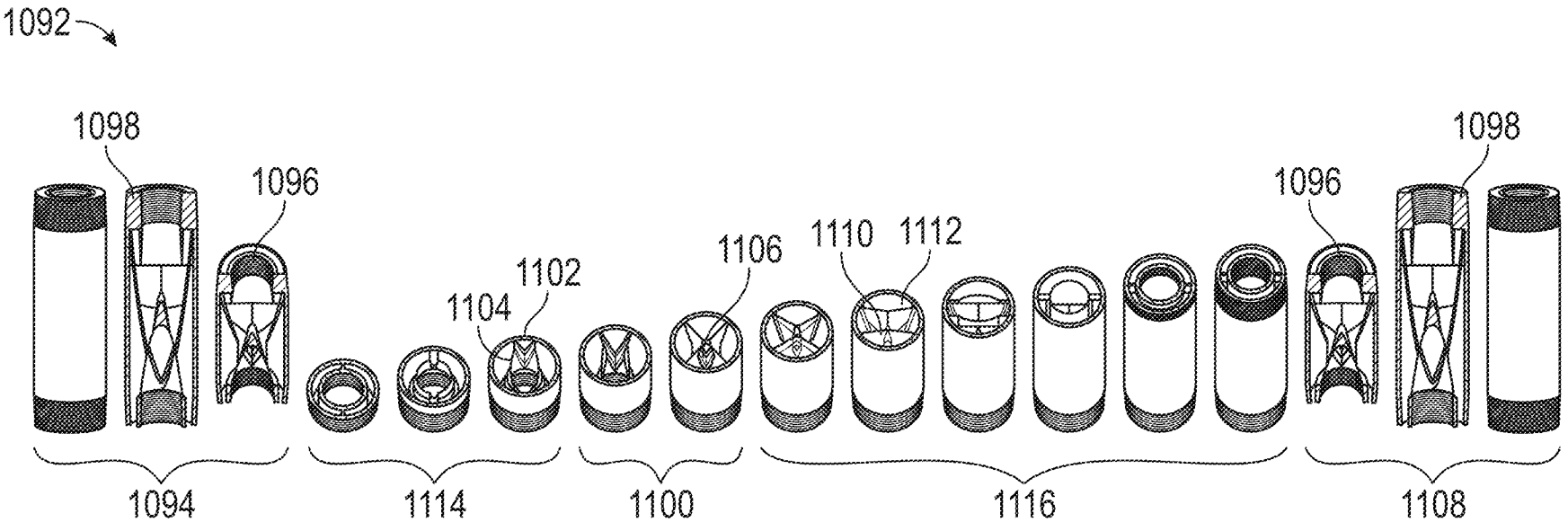
FIG. 68 is a series of diagrams showing cross sections of an FC, according to an embodiment of the present invention.

FIG. 68 shows sequential cross sections of FC 1092. End section 1094 and 1108 show central and concentric channels 1096 and 1098. Sections 1114 show the collapse of surfaces 1102 and 1104 into "X" pattern 1106 shown in sections 1100. Sections 1116 show the separation of surfaces 1110 and 1112 into concentric channels 1096 and 1098.

Figure 69:
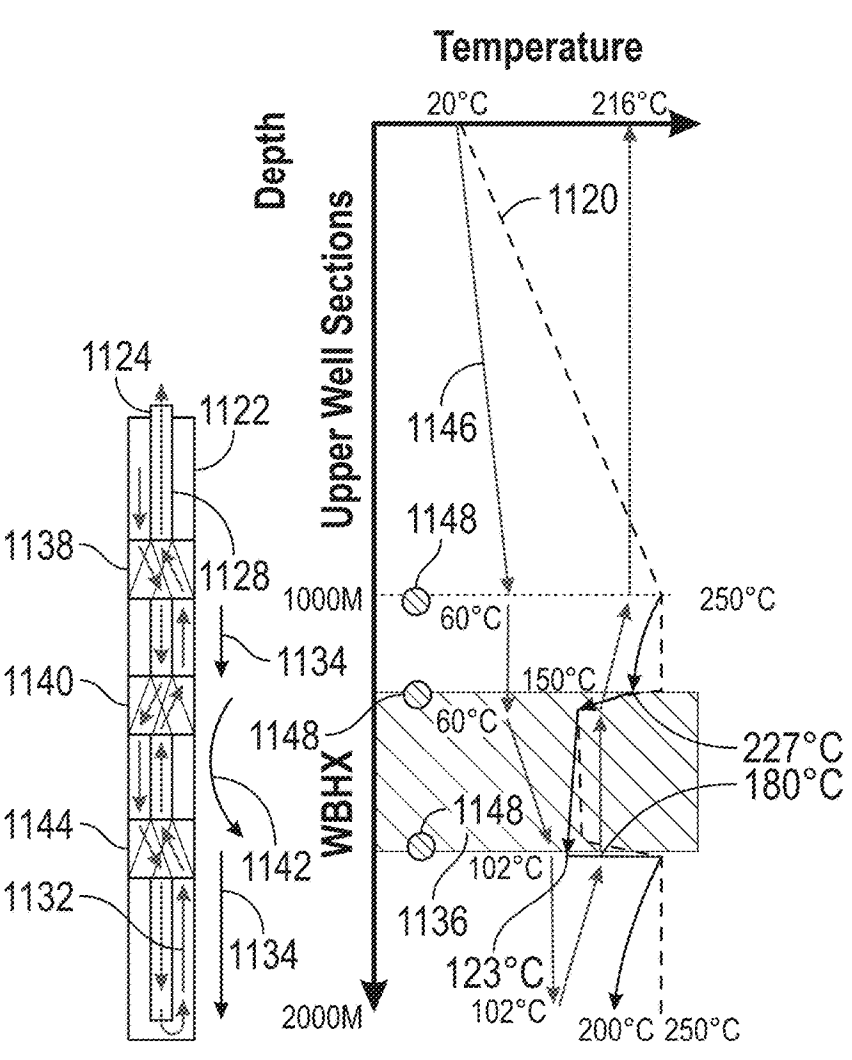
FIG. 69 is a series of graphs and diagrams showing temperature profiles for a co-current well bore and FC counter current well bore, according to an embodiment of the present invention.
Figure 69:
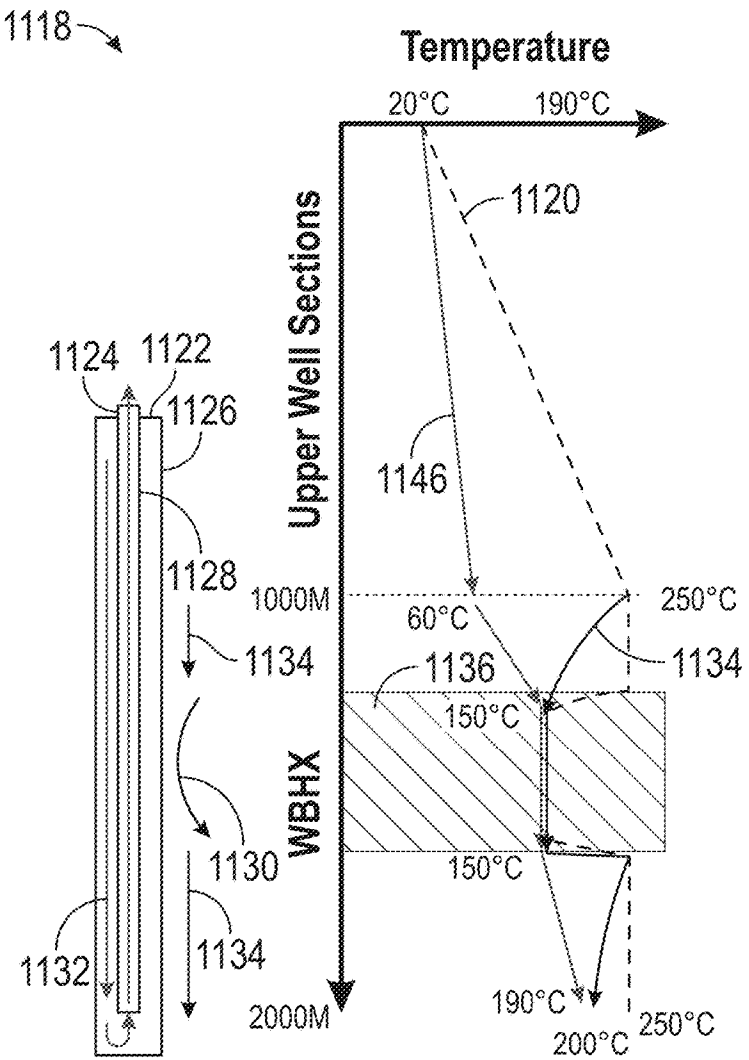

FIG. 69 shows temperature profiles 1118 for a co-current well bore and FC counter current well bore where temperature profiles 1118 show WBHX temperature profile 1146, reservoir temperature profile 1120, near wellbore reservoir fluid temperature profile from WBHX 1136, cold reservoir inflow section 1130, FC location 1148, surface loop circulating fluid 1132, VIT casing to surface 1124 and WBHX outer casing 1128. Well bore outer casing 1122 encompasses WBHX outer casing 1128 to create cavity 1126. Temperature profiles 1142 and 1134 are formed by FC counter current well bore region 1138, 1140, and 1144.

Figure 70:
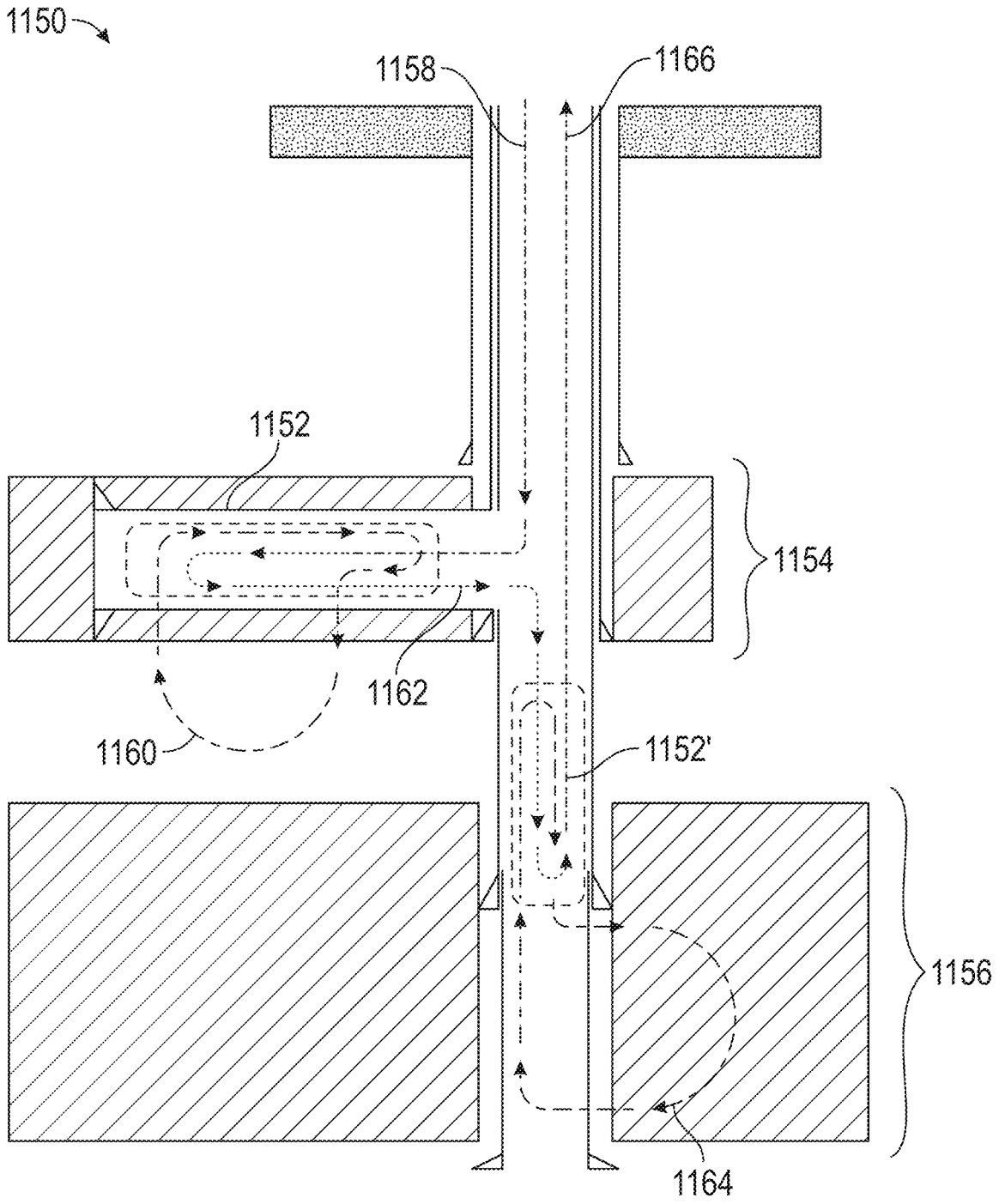
FIG. 70 is a diagram showing geothermal heating system comprising a lateral closed loop, according to an embodiment of the invention.

FIG. 70 shows geothermal heating system 1150 comprising heat exchangers 1152 and 1152'. Heating zones 1154 and 1156 show stacked heating wherein heating zone 1154 is at a lower temperature than heating zone 1156. Cold circulation fluid 1158 (25° C.) enters geothermal heating system 1150 and flows into heat exchanger 1152 disposed within heating zone 1154. Cold circulation fluid 1158 (25° C.) is heated in by reservoir fluid 1160 (160° C.) to form heated circulation fluid 1162 (140° C.). Heated circulation fluid 1162 (140° C.) enters heat exchanger 1152' dispose heating zone 1156 where heated circulation fluid 1162 (140° C.) is heated by reservoir fluid 1164 (240° C.) to form hot circulation fluid 1166 (240° C.).

Figure 71:
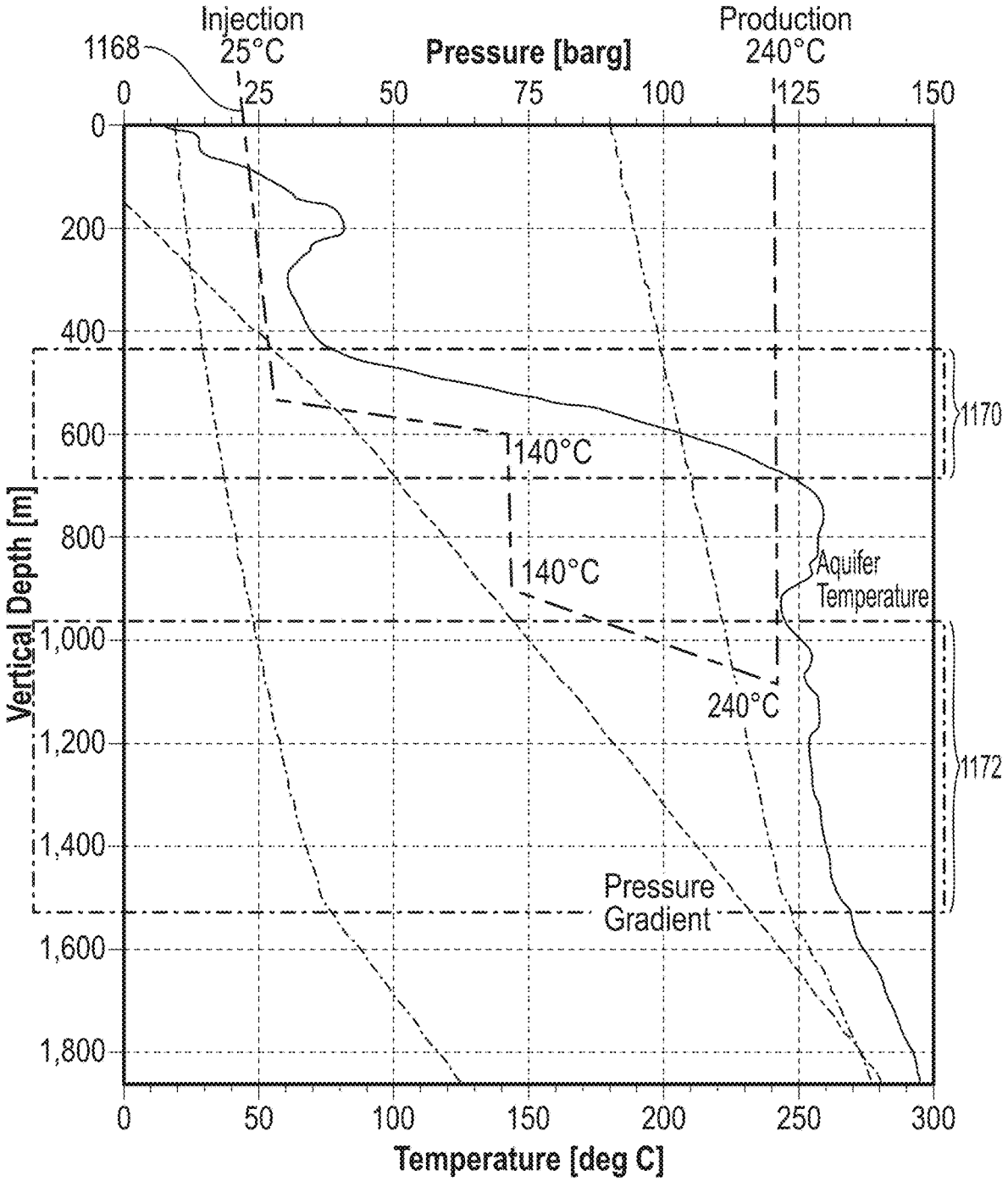
FIG. 71 is a graph showing the temperature and pressure profiles for a closed loop multilateral design for the FGC system, according to an embodiment of the invention.

FIG. 71 shows a flowing temperature and pressure profile for a geothermal heating system. Circulation fluid temperature 1168 increases with depth and sequentially increases in temperature in heating zones 1170 and 1172.

Figure 72:
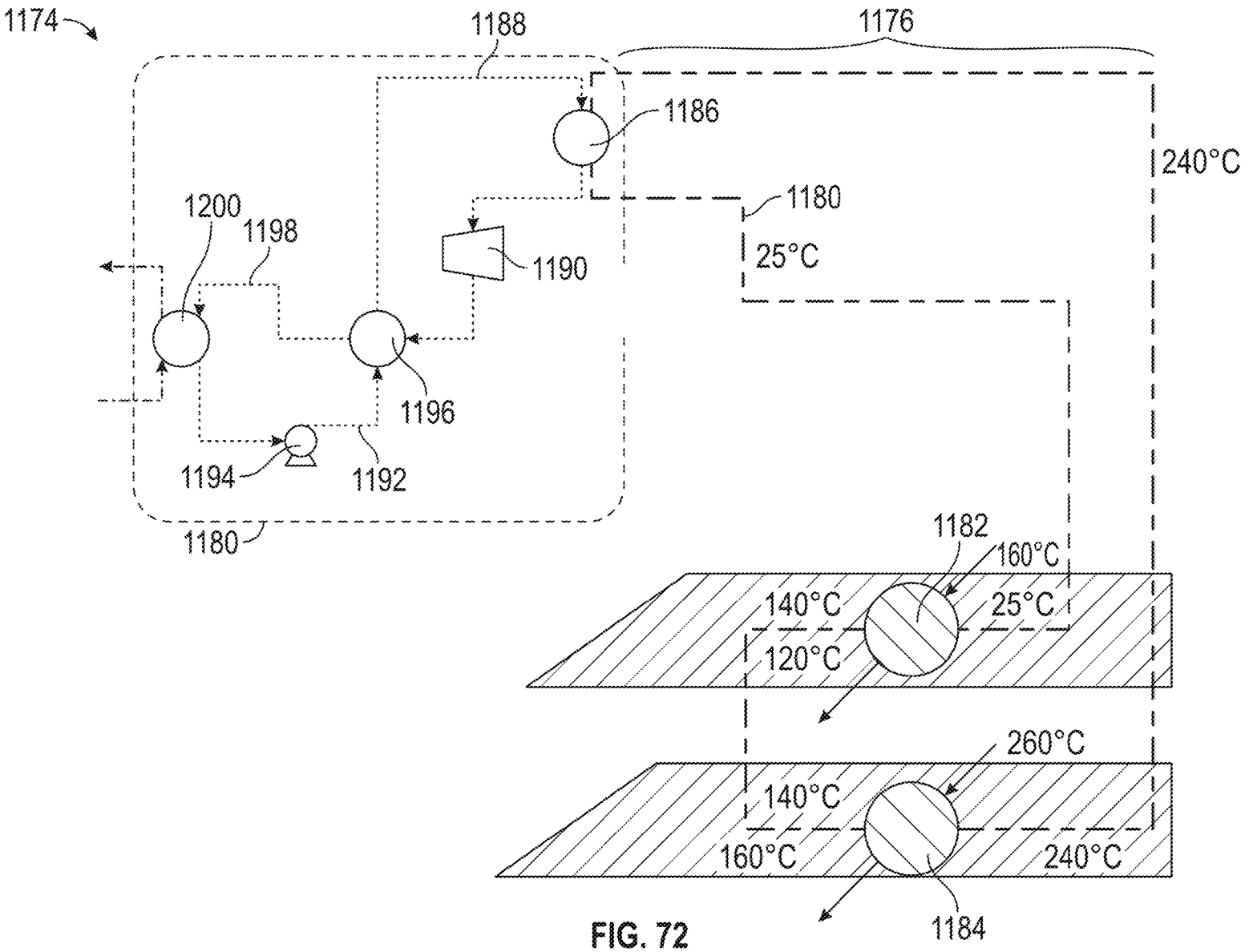
FIG. 72 is a diagram showing a stack loop recovery process using a geothermal heating system, according to an embodiment of the invention.
Figure 73A:
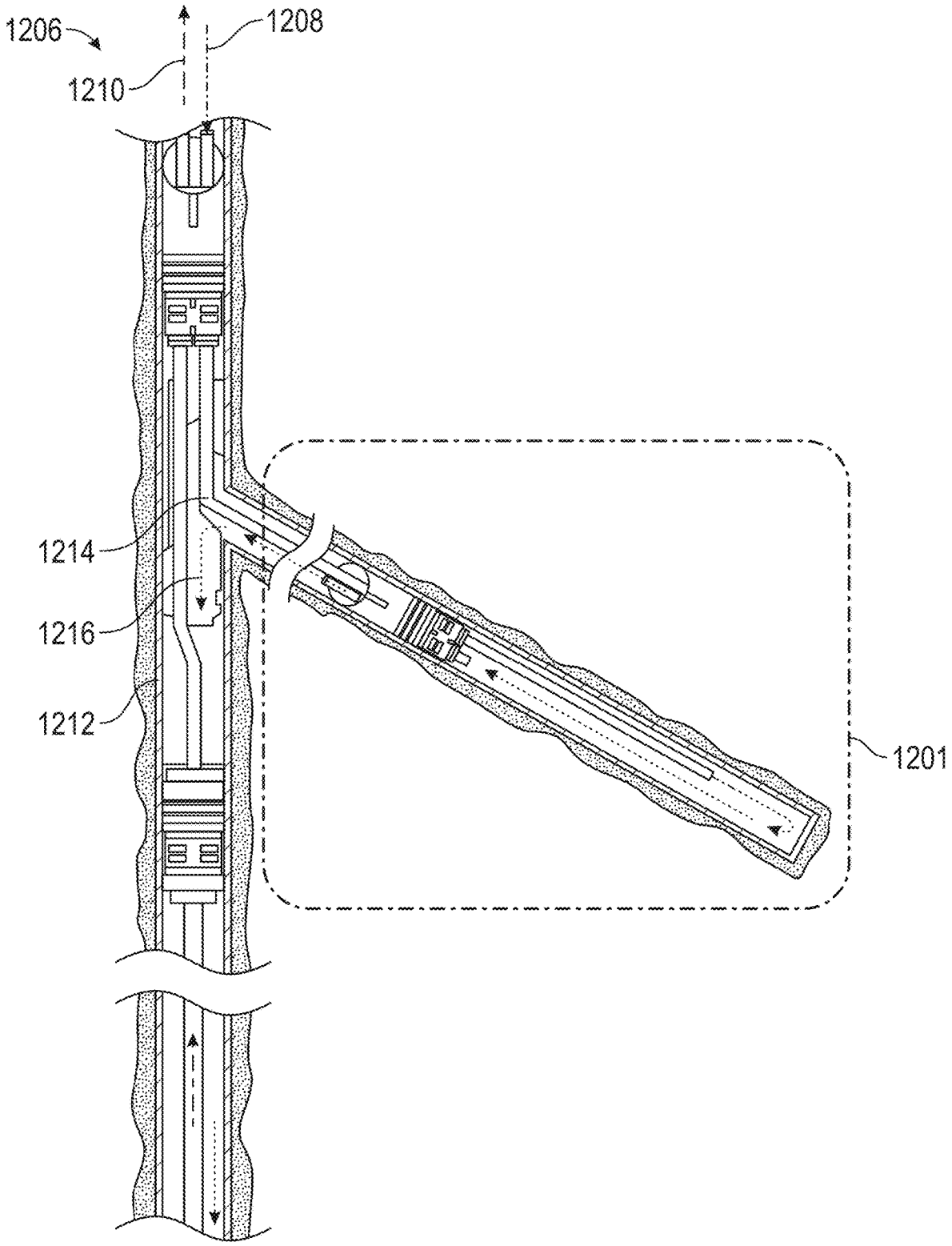
FIGS. 73A, 73B, 73C, and 73D are diagrams showing multilateral channel casing designs for a geothermal heating system, according to an embodiment of the current invention.
Figure 73B:
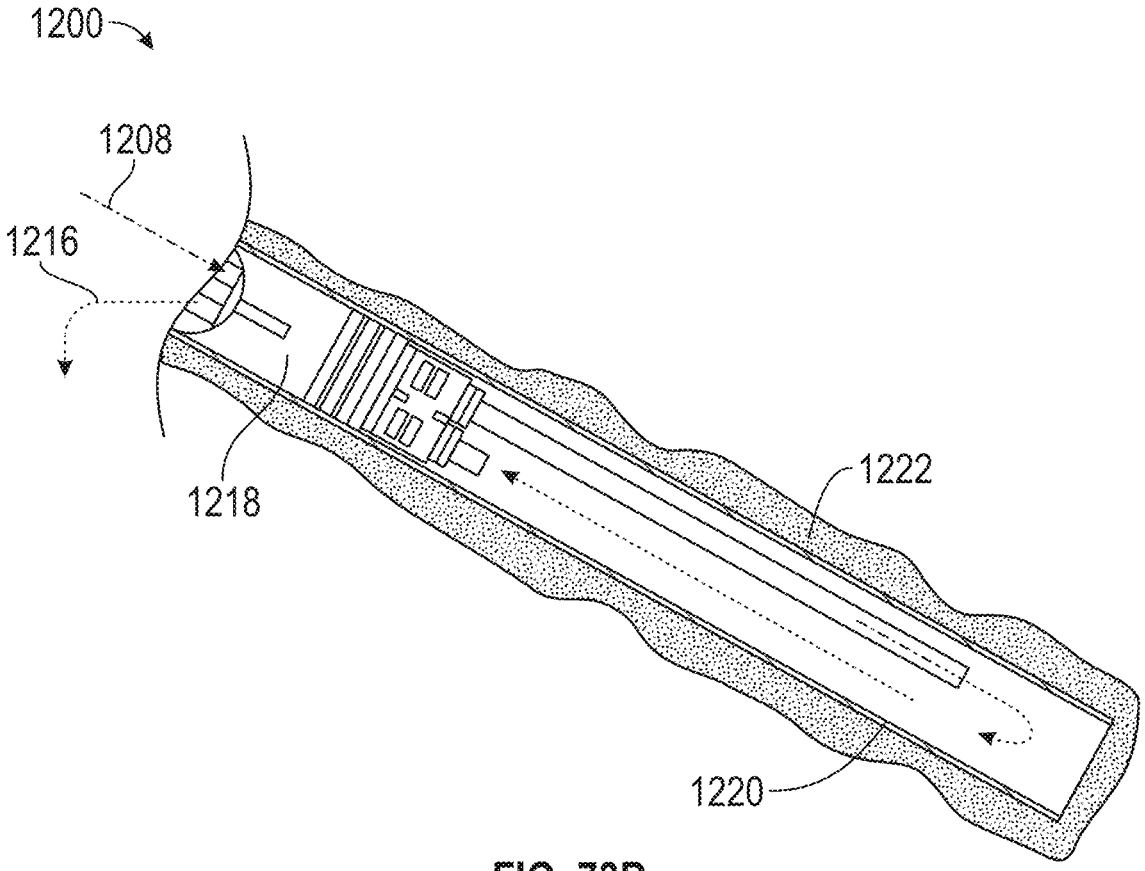
Figure 73C:
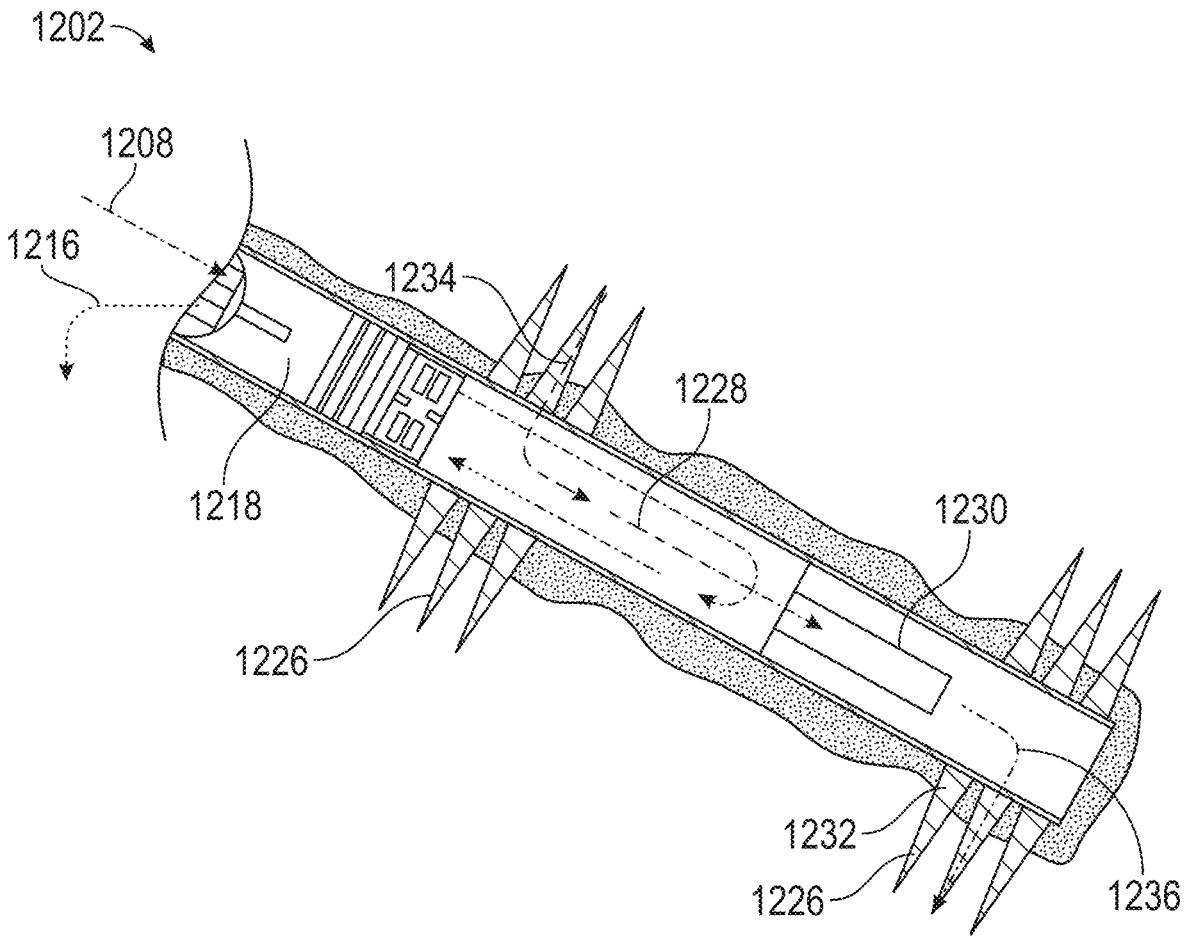
Figure 73D:
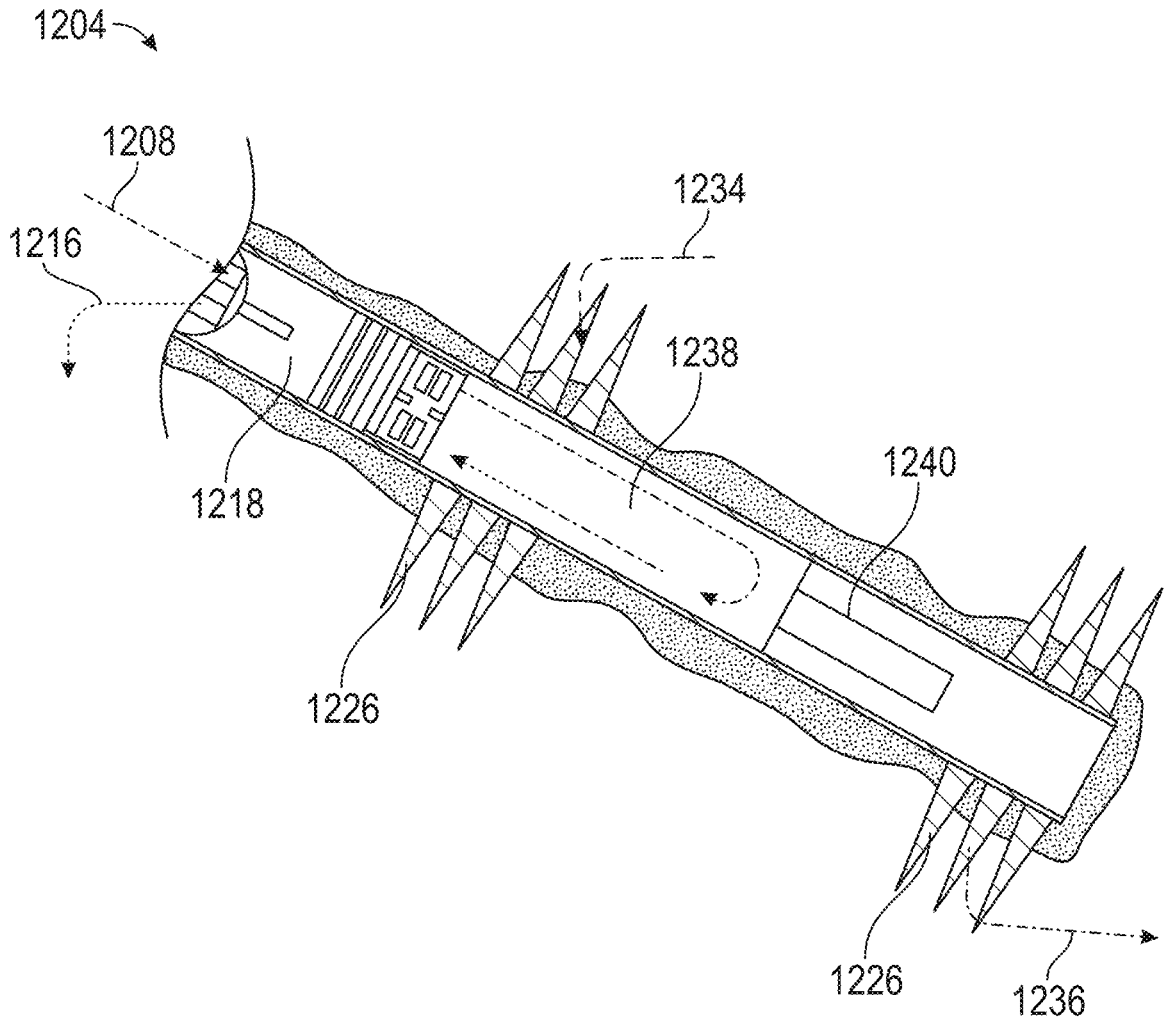

FIG. 72 shows stack loop recovery process 1174 using geothermal heating system 1176 and organic Rankine cycle ("ORC") 1178. Circulation fluid 1180 in geothermal heating system 1176 is sequentially heated to higher temperatures by heat exchangers 1182 and 1184 before entering evaporator 1186 and heating liquid flow 1188. Liquid flow 1188 enters evaporator 1186 to form a gas to power turbine 1190. Fluid flow 1192 is conveyed via pump 1194 to regenerator 1196 to form heated fluid flow 1198. Heated fluid flow is cooled by heat exchanger 1200. Spent gas from turbine 1190 enters regenerator 1196 to cool into a liquid and return to evaporator 1186. Circulation fluid 1180 is returned to geothermal heating system 1176 after passing out of evaporator 1186. Optionally stack loop recovery process 1174 may be a loop recovery process if sequential heating is not performed.

FIGS. 73A, 73B, 73C, and 73D show multilateral channel casing designs 1201, 1202, and 1204 for geothermal heating system 1206. Geothermal heating system 1206 comprises cold circulation fluid 1208, hot circulation fluid 1210, well bore 1212, multilateral channel 1214, and warmed circulation fluid 1216. Multilateral channel 1214 recovers energy from a reservoir. Multilateral channel 1214 may be configured for casing designs 1201, 1202, and 1204 for a passive loop multilateral channel, an active thermosyphon multilateral channel, and a pump-driven multilateral channel, respectively.

Casing designs 1200, 1202, and 1204 allow surface closed loop fluid 805 to pass to and/or from a multilateral channel. Casing design 1200 comprises multilateral packer 1218, casing and sealed lateral 1220, and high thermal conductive cement and/or proppant 1222. Casing design 1200 is configured to case and seal the reservoir. Multilateral packer 1218 forms an annulus core flow pattern. Casing design 1200 is configured to allow reservoir interaction between hot reservoir fluid 1234 and cold circulation fluid 1208 at the end of conductive cement and/or proppant 1222 to form warmed circulation fluid 1216. The thermal transfer mechanism is a coaxial pipe-in-pipe surface loop incorporating conduction and induced convection or direct reservoir cross flow. Casing design 1200 may be used in shallow reservoir s lacking integrity for enhanced or driven circulation or in hot dry rock zones.

Casing design 1202 comprises multilateral packer 1218, reservoir inlet 1224, perforations 1226, WBGHX for thermosiphon 1228, insulated tubing 1230, and reservoir outlet 1232. Casing design 1202 is configured to allow reservoir interaction within WBGHX for thermosiphon 1228 between hot reservoir fluid 1234 and cold circulation fluid 1208 to form warmed circulation fluid 1216 and cold reservoir fluid 1236 which exits perforations 1226. The thermal transfer mechanism is a WBGHX with multi-flow paths for the surface loop and reservoir fluid for efficient energy exchange.

Casing design 1204 comprises multilateral packer 1218, perforations 1126, WBGHX 1238, and pump 1240. Casing design 1204 is configured to case and seal the reservoir. Multilateral packer 1218 creates an annulus core flow pattern. Casing design 1204 is configured to allow reservoir interaction within WBGHX 1238 between hot reservoir fluid 1234 and cold circulation fluid 1208 to form warmed circulation fluid 1216 and cold reservoir fluid 1236 which exits perforations 1226. The thermal transfer mechanism is WBGHX 1238 with multi flow paths for surface loop and reservoir fluid for efficient energy exchange. Integrated pump 1240 drives reservoir fluid for kick off and/or ongoing operation.

Figure 74:
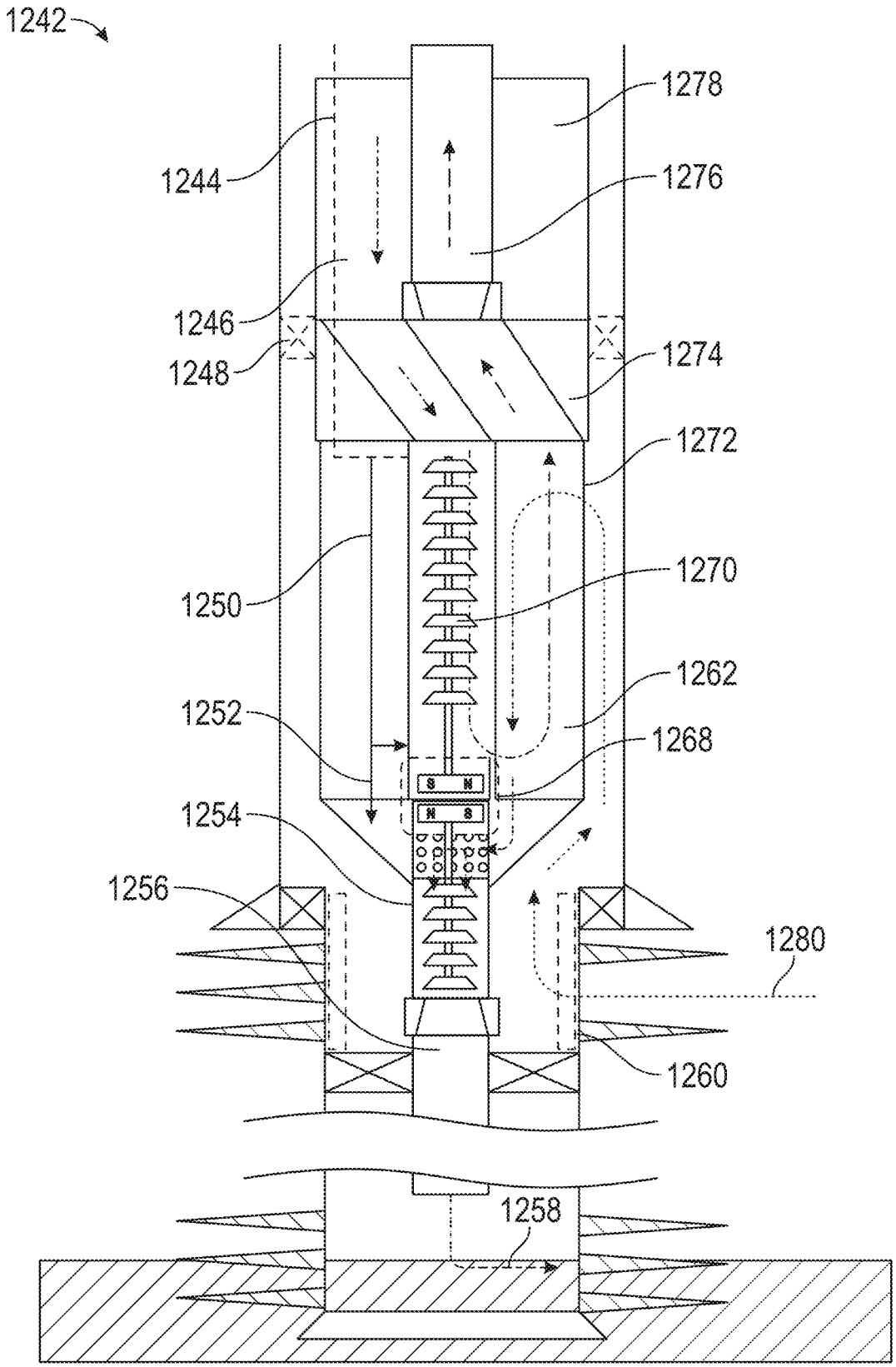
FIG. 74 is a diagram showing a geothermal heating system comprising a hydraulic driver; according to an embodiment of the current invention.

FIG. 74 shows geothermal heating system 1242 comprising surface control umbilical 1244, cold surface loop circulation fluid 1246, production casing 1248, hydraulic pump bypass port 1250, hydraulic pump reservoir reject port 1252, lower FGC pump assembly 1254, lower FGC tubing 1256, injection perforations 1258, slotted liner 1260, WBGHX 1262, hydraulic pump cooling and thrust bearing assembly 1264, hydraulic motor 1270, reservoir intake 1272, in-line flux cross over connection 1274, insulated tubing 1370, and surface loop casing 1278. Surface control umbilical 1244 maintains pump speed, torque, and/or reservoir injection. Hot reservoir fluid 1284 circulates to transport thermal energy as well as provide hydraulic driving force in place of an electrical submersible pump. Production casing 1248 fixes the WBGHX to the surface. Hydraulic pump bypass port 1250 control lower FGC pump assembly 1254 or compressor assembly to maintain target speed and torque. Hydraulic pump reservoir reject port 1252 for the circulation fluid assists with reservoir pressure and convection cycle mass flow. Where the circulation fluid is $CO_2$ the discharge port allows the FGC well to also provide function as a carbon sequestration asset. The $CO_2$ enhances reservoir convection, including with dry rock geology, and expands the operating envelop for the FGC system. Water makeup may also be provided to the reservoir to assist with a pump startup and or to assist with reservoir pressure maintenance. Lower FGC pump assembly 1254 generates the reservoir convection circuit. Optionally, lower FGC pump assembly 1254 is a pump for hydraulic systems or a compressor for dry rock geology. Lower FGC tubing 1256 reduces short circuiting of the reservoir fluid and to generate thermosiphon effects to minimize injection energy requirements. Injection perforations 1258 allow reservoir fluid to be returned to the reservoir. The direction may be toe to heal or heal to toe depending on design requirements. Slotted liner 1260 allows inflow and maintain reservoir integrity. Optionally, slotted liner 1260 may be replaced with a gravel pack, or open hole, depending on well bore requirements. Hydraulic pump cooling and thrust bearing assembly 12638 transfers power to the pump or compressor subassembly to drive the forced geothermal convection in the reservoir. Coupling may take the form of magnetic, hydraulic, or mechanical mechanism transform the shaft power to match required rotation speed and torque needs. Hydraulic motor 1270 is powered by the surface loop circulation fluid to drive a pump or compressor subassembly on WBGHX 1262. Reservoir intake 1272 is in communication with WBGHX 1262. WBGHX 1262 is connected via casing thread to the upper loop casing. A packer can be used to provide additional support for landing to WBGHX 1262. Insulated tubing 1276 return working medium to the surface. The insulation may be a vacuum or closed cell insulation. Surface loop casing 1287 is used for low-loss higher pressure circulation of circulation fluid.

Figure 75:
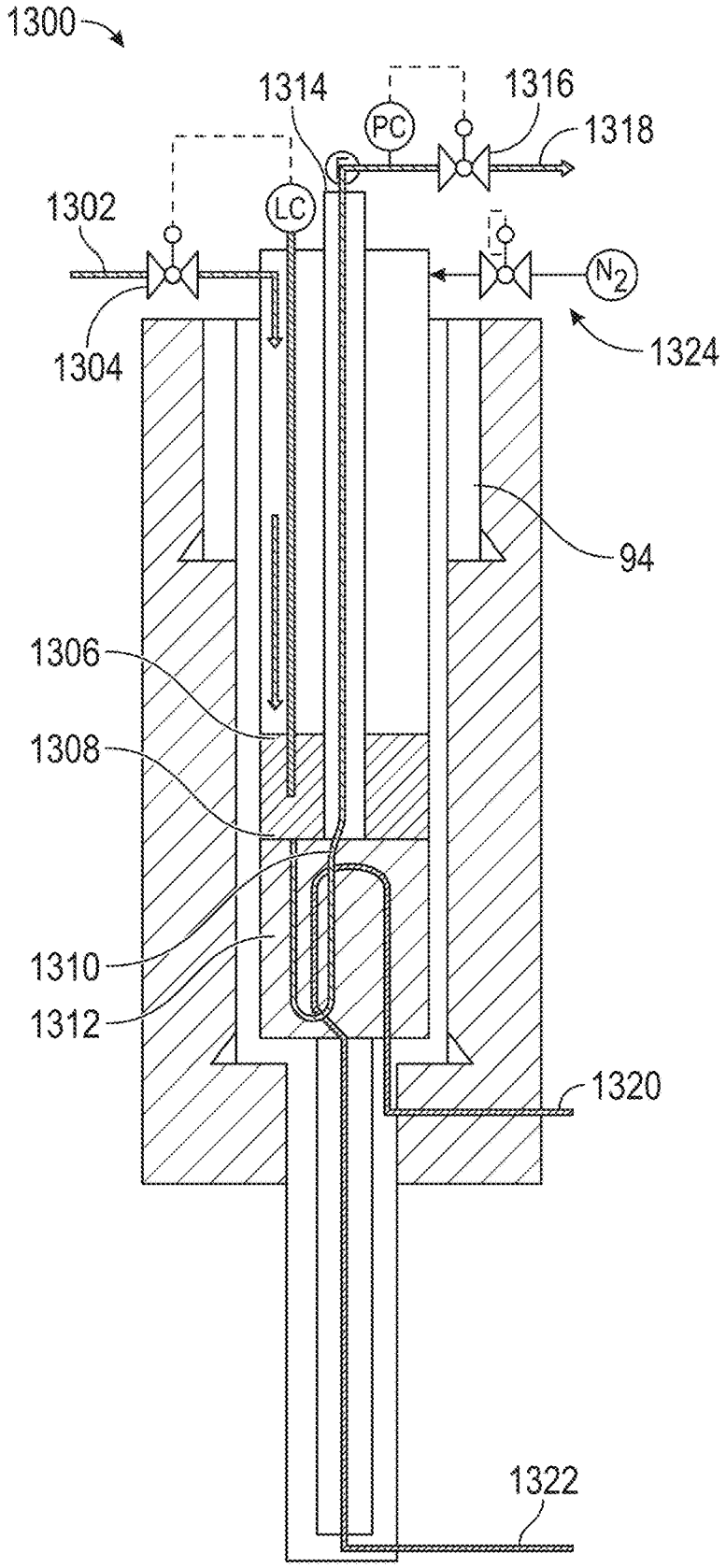
FIG. 75 is a diagram showing an enthalpy transport geothermal heating system, according to an embodiment of the present invention.

FIG. 75 shows enthalpy transport geothermal heating system 1300 comprising well bore 94, inlet working fluid 1302, level control 1304, fluid level 1306, well bore heat exchanger ("WBHX") inlet 1308, outlet working fluid 1310, WBHX 1312, well head outlet 1314, pressure control 1316, flash plant working fluid 1318, reservoir inlet fluid 1320, reservoir outlet fluid 1322, and inert gas 1324. Inlet working fluid 1302 enters enthalpy transport geothermal heating system 1300 via level control 1304 and a series of valves. Inlet working fluid 1302 collect within enthalpy transport geothermal heating system 1300 before conveying through WBHX inlet 1308 into WBHX 1312 as outlet working fluid 1310. Fluid levels of inlet working fluid 1302 collected within enthalpy transport geothermal heating system 1300 are measured with fluid level 1306. Reservoir inlet fluid 1320 enters WBHX 1312 and thermally conducts with outlet working fluid 1310. Expended reservoir inlet fluid 1320 exits WBHX 1312 as reservoir outlet fluid 1322. Outlet working fluid 1310 exits enthalpy transport geothermal heating system 1300 via well head outlet 1314 as flash plant working fluid 1318. Pressure control 1316 comprises a valve that controls the pressure in enthalpy transport geothermal heating system 1300. Inert gas 1324 is conveyed into enthalpy transport geothermal heating system 1300 to pressurize enthalpy transport geothermal heating system 1300.

Inlet working fluid 1302 preferably enters WBHX 1312 at a temperature that is lower than the temperature that outlet working fluid 1310 exits WBHX 1312. Because inlet working fluid 1302 and reservoir inlet fluid 1320 thermally conduct with one another, reservoir outlet fluid 1322 exits WBHX 1312 at a temperature that is lower than the temperature of reservoir inlet fluid 1320.

Figure 76:
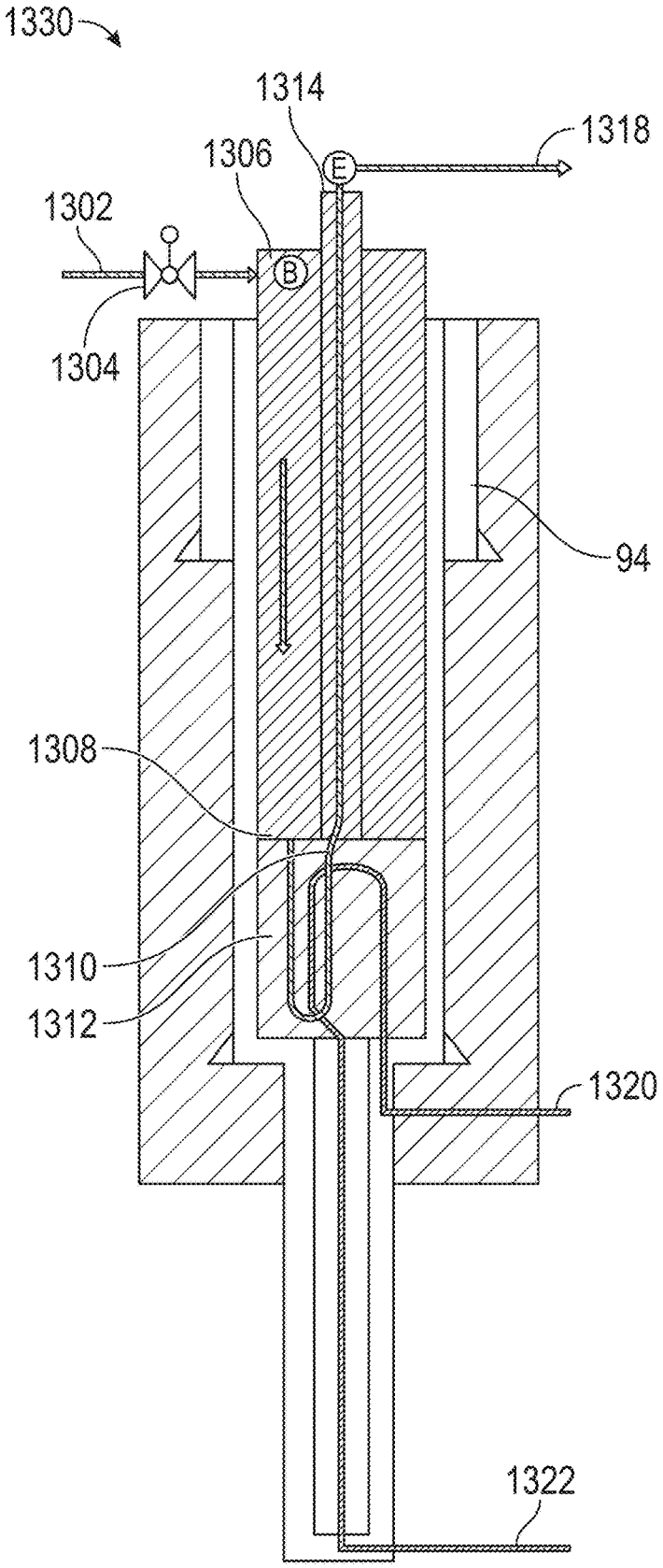
FIG. 76 is a diagram showing a geothermal closed loop working fluid circuit, according to an embodiment of the present invention.

FIG. 76 shows geothermal closed loop working fluid circuit 1330 comprising well bore 94, inlet working fluid 1302, level control 1304, fluid level 1306, well bore heat exchanger ("WBHX") inlet 1308, outlet working fluid 1310, WBHX 1312, well head outlet 1314, flash plant working fluid 1318, reservoir inlet fluid 1320, and reservoir outlet fluid 1322. Inlet working fluid 1302 may enter geothermal closed loop working fluid circuit 1330 via level control 1304 and a series of valves. Inlet working fluid 1302 may then collect within geothermal closed loop working fluid circuit 1330 before conveying through WBHX inlet 1308 into WBHX 1312 as outlet working fluid 1310. Fluid levels of inlet working fluid 1302 collected within geothermal closed loop working fluid circuit 1330 may be measured with fluid level 1306. Reservoir inlet fluid 1320 may enter WBHX 1312 and thermally conduct with outlet working fluid 1310. Expended reservoir inlet fluid 1320 exits WBHX 1312 as reservoir outlet fluid 1322. Outlet working fluid 1310 exits geothermal closed loop working fluid circuit 1330 via well head outlet 1314 as flash plant working fluid 1318.

In geothermal closed loop working fluid circuit 1330, inlet working fluid 1302 is filled such that there are no air pockets or gas cavities. Pressure control 1316 and inert gas 1324 are no longer needed as pressure is controlled via inlet working fluid 1302.

Level control 1304 comprises an annulus liquid level control to control static head pressure of well bore heat exchanger 1312. Pressure control 1316 comprises working fluid pressure control to control the operating pressure of well bore heat exchanger 1312. Inert gas 1324 comprises a nitrogen gas purge supply to maintain positive annulus pressure from liquid level changes.

Figure 77:
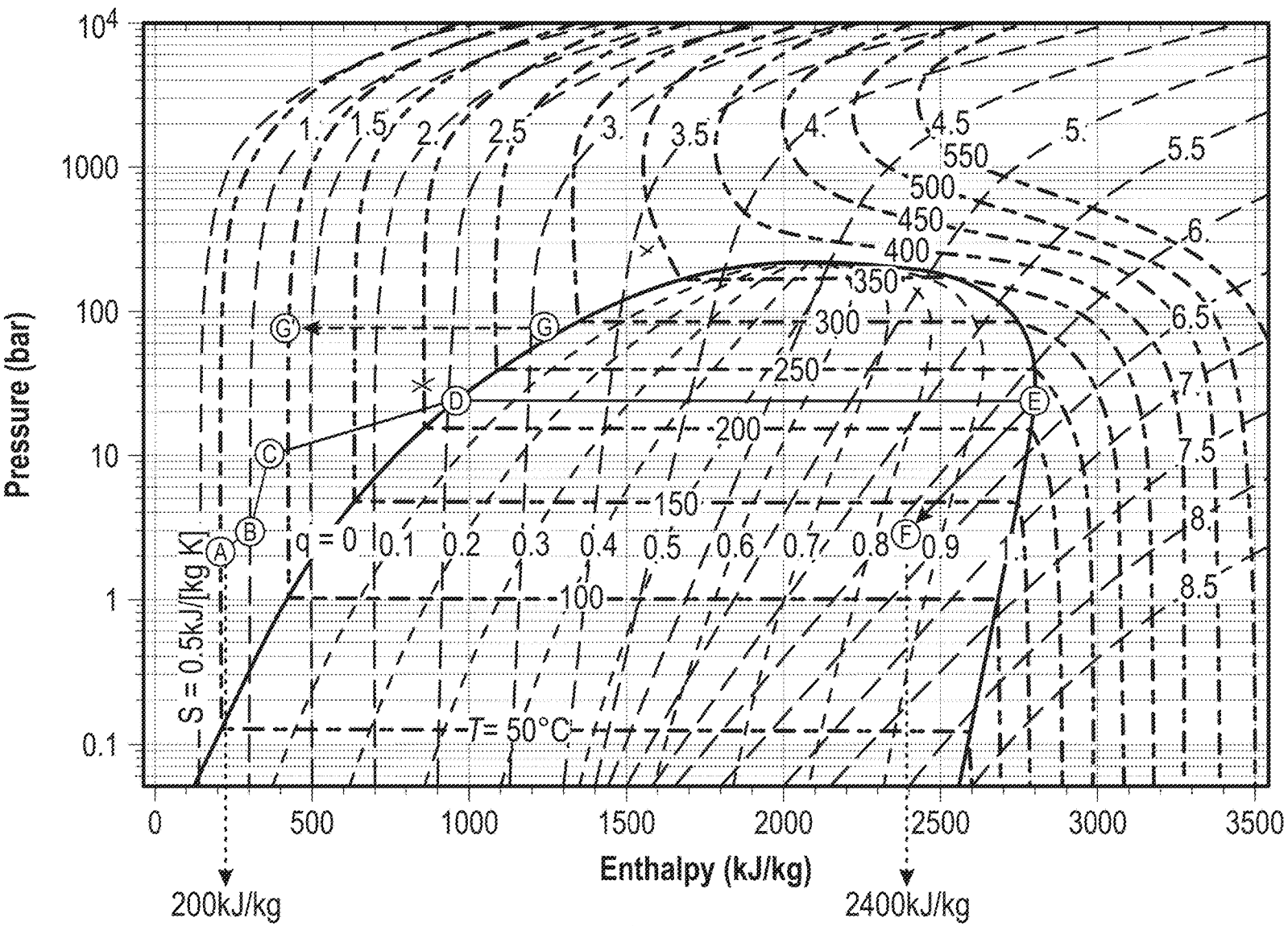
FIG. 77 is a graph showing the enthalpy (KJ/kg) versus pressure (bar) for an enthalpy transport geothermal heating system, according to an embodiment of the present invention.

FIG. 77 shows the enthalpy (KJ/kg) versus pressure (bar) for enthalpy transport geothermal heating system 1300 (see FIG. 75). Inlet working fluid 1302 (see FIG. 75) enters enthalpy transport geothermal heating system 1300 (see FIG. 75) at 200 KJ/kg, and flash plant working fluid 1318 (see FIG. 75) exits enthalpy transport geothermal heating system 1300 (see FIG. 75) at 2400 KJ/kg.

Figure 78:
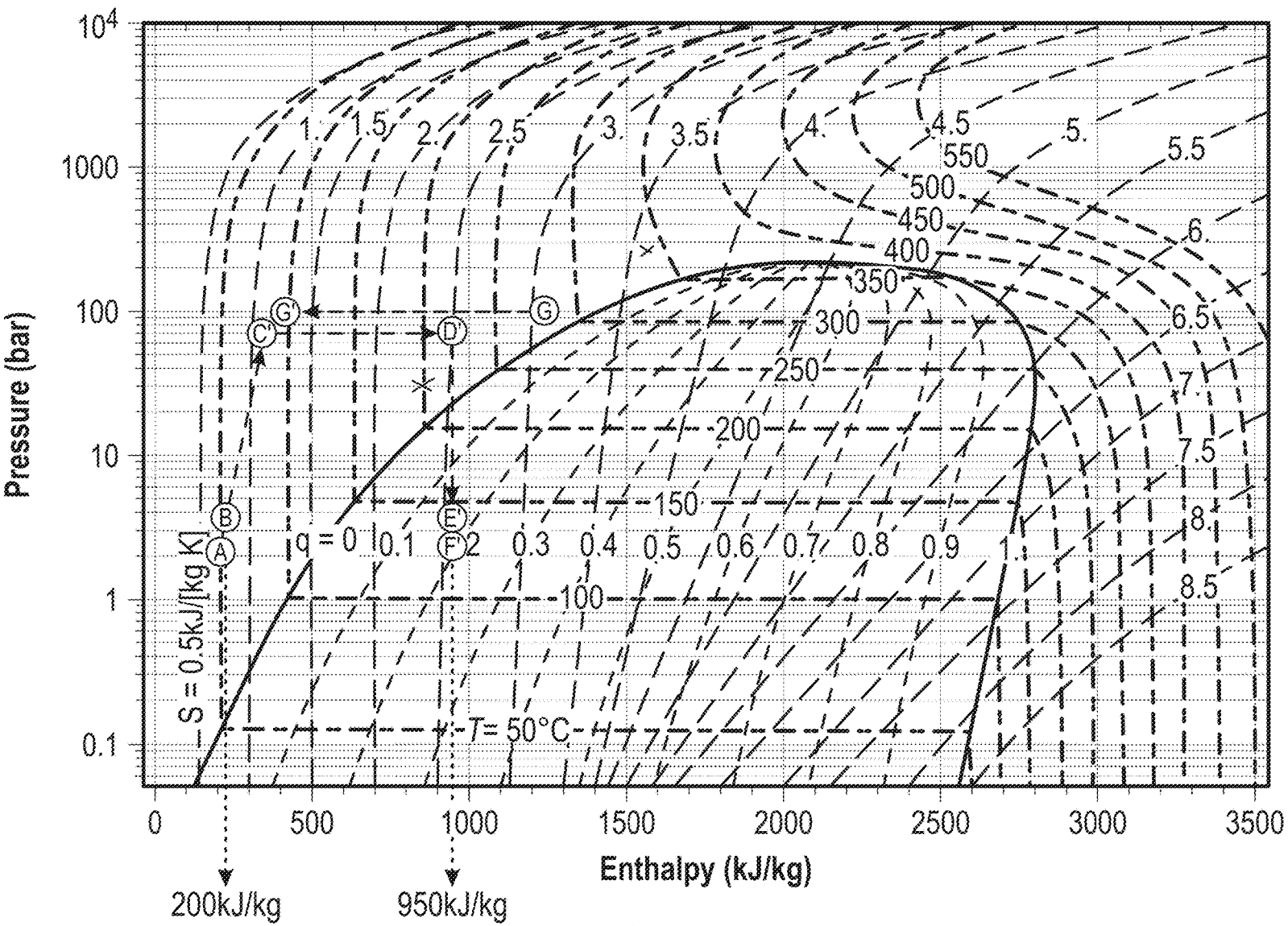
FIG. 78 is a graph showing the enthalpy (KJ/kg) versus pressure (bar) for a geothermal closed loop working fluid circuit, according to an embodiment of the present invention.

FIG. 78 shows the enthalpy (KJ/kg) versus pressure (bar) for geothermal closed loop working fluid circuit 1330 (see FIG. 76). Inlet working fluid 1302 (see FIG. 76) enters geothermal closed loop working fluid circuit 1330 (see FIG. 76) at 200 KJ/kg, and flash plant working fluid 1318 exits geothermal closed loop working fluid circuit 1330 (see FIG. 76) at 950 KJ/kg.

Figure 79:
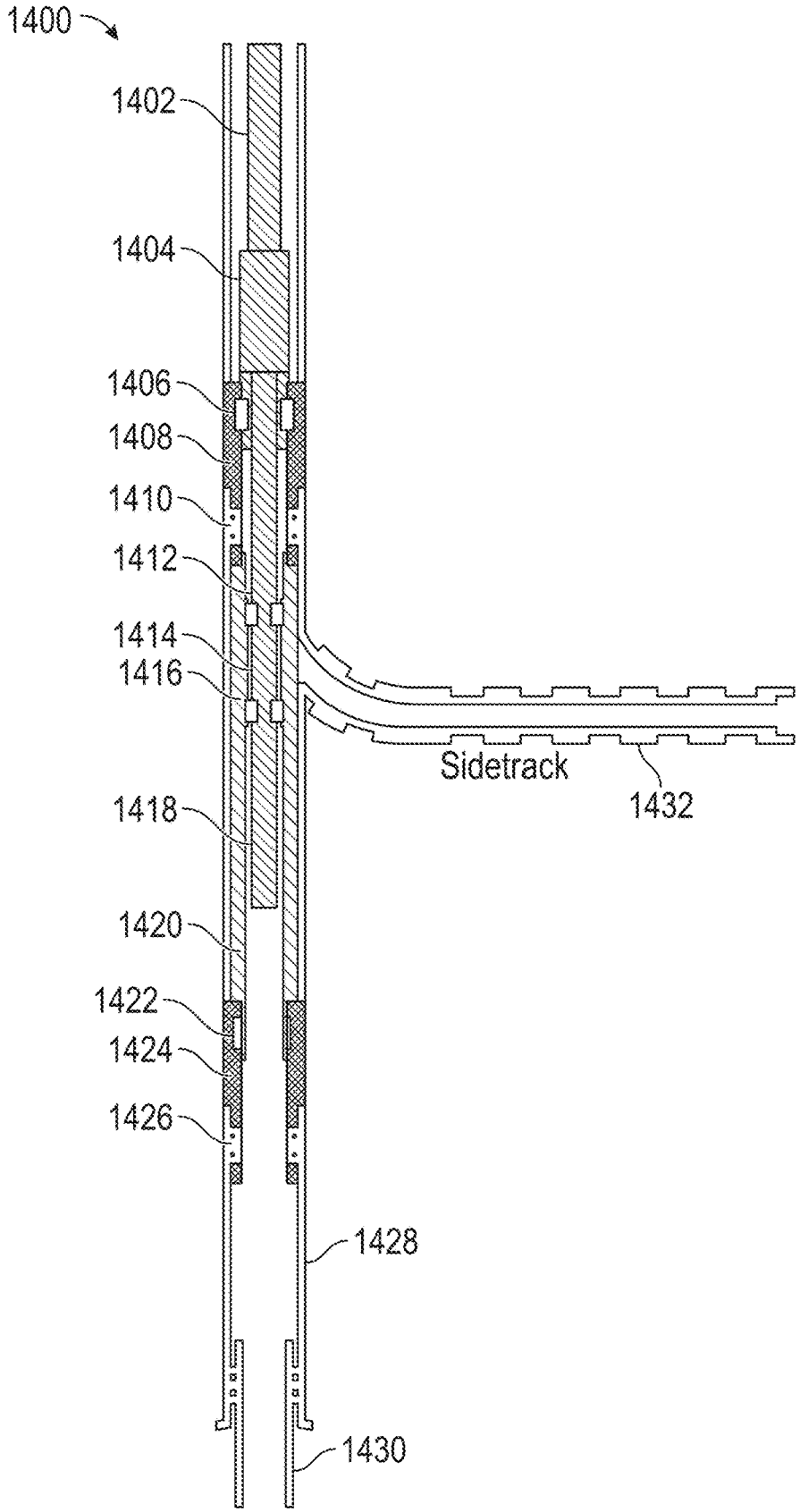
FIG. 79 is a diagram showing a geothermal heating system comprising FGC technology, according to an embodiment of the present invention.

FIG. 79 shows geothermal heating system 1400 comprising an FGC. Geothermal heating system 1400 comprises vacuum insulated tubing ("VIT") 1402, heat exchanger 1404, first landed seal assembly 1406, first polished bore receptacle ("PBR") 1408, first permanent packer 1410, pump 1412, pump intake 1414, flow diverter 1416, motor 1418, casing pup 1420, second landed seal assembly 1422, second PBR 1424, second permanent packer 1426, intermediate casing 1428, production liner 1430, and sidetrack 1432.

VIT 1402 may be in communication with the surface. Pump 1412 may comprise an ESP. Motor 1418 may comprise an ESP motor. First permanent packer 1410, second permanent packer 1426, and intermediate casing 1428 may each comprise a diameter of about 9 and ⅝ inches. Flow diverter 1416 may comprise a 5" diameter seal bore. First PBR 1408, second PBR 1424, and production liner 1430 may each be 7" inches in thickness. First permanent packer 1410 and first PBR 1408 may be set below sidetrack 1432.

Figure 80:
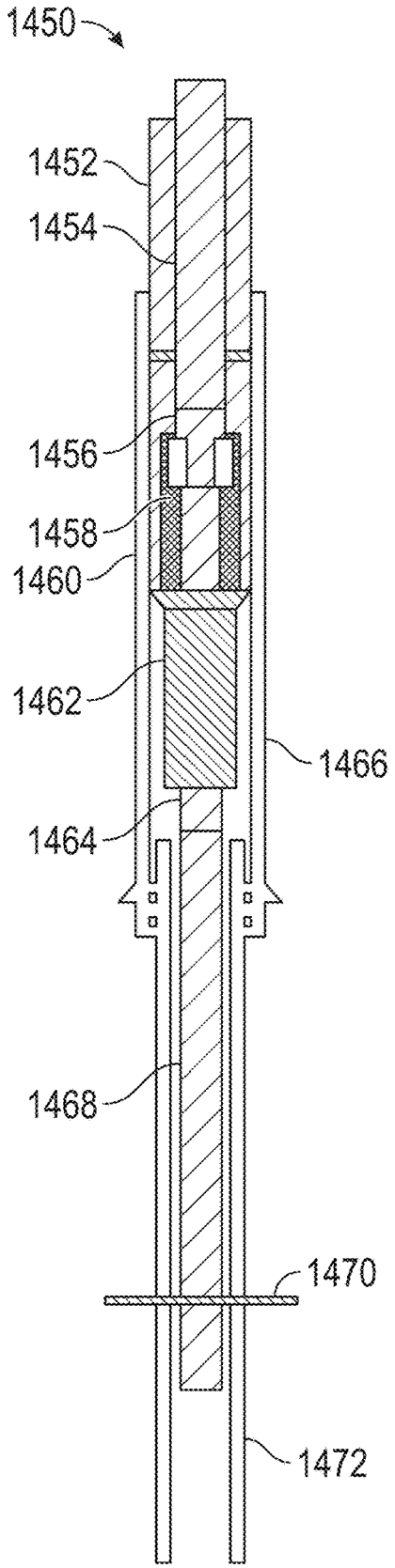
FIG. 80 is a diagram showing a thermosiphon geothermal heating system, according to an embodiment of the present invention.

FIG. 80 shows thermosiphon geothermal heating system 1450. Thermosiphon geothermal heating system 1450 comprises casing 1452, first vacuum insulated tubing ("VIT") 1454, landed seal assembly 1456, polished bore receptacle ("PBR") 1458, casing pup 1460, heat exchanger 1462, tubing pup 1464, intermediate casing 1466, second VIT 1468, reservoir fluid level 1470, and slotted production liner 1472. First VIT 1454 leads to the surface. Second VIT 1468 is suspended into slotted production liner 1472 below reservoir fluid level 1470. Reservoir fluid level 1470 may comprise the fluid level of an aquifer.

Add Disclosure

The geothermal heating system may comprise a high efficiency gyroid heat exchanger (i.e., the WBGHX) disposed within a production casing just above a geothermal reservoir. The geothermal well configuration may comprise a sealed closed-loop working fluid circuit with an annulus for up or downflow injection of a working fluid, and a central insulated production tubing for up or downward return, respectively.

A fluid-handling electric submersible pump may be positioned below the heat exchanger or gyroid heat exchanger. The fluid-handling electric submersible pump may recirculate geothermal reservoir fluid from the reservoir through the heat exchanger or gyroid heat exchanger and back to the reservoir. A control scheme for modulating (i.e., adjusting) the annulus liquid level, which sets the static pressure on the heat exchanger, thereby controlling the boiling point and phase behavior (e.g., boiling point) of the working fluid may be used. Adjusting the annulus level may control the boiling point of the working fluid.

The geothermal heating system may dynamically optimize the depth at which the heat exchanger or gyroid heat exchanger is installed. Installation may be based on well depth, temperature gradient, and expected reservoir phase conditions, or a combination thereof. Optimized installation depth may maximize thermal energy recovery and/or surface power generation.

The geothermal heating system may comprise a high enthalpy density working fluid by allowing two-phase flow in a heat exchanger or gyroid heat exchanger under optimized pressure settings. Two-phase working fluid flow in a heat exchanger or gyroid heat exchanger may maximize recovery from a reservoir fluid and/or a steam cap reservoir using the same infrastructure; enhance thermal efficiency by minimizing surface thermal losses and matching working fluid operating pressure to static head; adapt to a binary organic Rankine cycle ("ORC"); direct flash turbine systems depending on the working fluid return quality; or a combination thereof.

The geothermal heating system may comprise a vertical geothermal well that is completed with a production casing, within which is housed a high-surface-area gyroid heat exchanger. The working fluid may be injected via the annulus and returned via insulated tubing to surface. The gyroid heat exchanger may be placed above the reservoir, taking advantage of static head pressure to elevate the boiling point of the working fluid.

The gyroid heat exchanger may comprise of a triply periodic minimal surface ("TPMS") lattice. The TPMS may provide a high U-value (e.g., at least about 6,000 $W/m^2 \cdot K$, about 6,000 $W/m^2 \cdot K$ to about 20,000 $W/m^2 \cdot K$, about 8,000 $W/m^2 \cdot K$ to about 18,000 $W/m^2 \cdot K$, about 10,000 $W/m^2 \cdot K$ to about 16,000 $W/m^2 \cdot K$, about 12,000 $W/m^2 \cdot K$ to about 14,000 $W/m^2 \cdot K$, or about 20,000 $W/m^2 \cdot K$) and/or low pressure drop for brine and working fluid circulation. The reservoir fluid (which may be at a temperature of at least about 120° C., about 120° C. to about 300° C., about 140° C. to about 280° C., about 160° C. to about 260° C., about 180° C. to about 240° C., about 200° C. to about 220° C., or about 300° C.) may be pumped upward into the gyroid heat exchanger by an ESP located below. The fluid may be pumped at a rate of about least about 20 kilograms per second ("kg/s"), about 20 kg/s to about 70 kg/s, about 25 kg/s to about 65 kg/s, about 30 kg/s to about 60 kg/s, about 35 kg/s to about 55 kg/s, about 40 kg/s to about 50 kg/s, or about 70 kg/s. An at least about 5°, about 5° C. to about 30° C., about 10° C. to about 25° C., about 15° C. to about 20° C., or about 30° C. approach temperature may be maintained across the gyroid heat exchanger to ensure high heat transfer.

The pressure of the closed loop working fluid circuit may be controlled by adjusting the annulus liquid level (with optional gas blanket pressure control), which sets the boiling point for phase change. The working fluid may be under pressure and/or be pressurized. The working fluid may comprise a liquid phase, single phase, mixed-phase, dry phase, dry steam phase, or a combination thereof. Three operating modes may be defined as follows: a single-phase liquid return (i.e., an ORC), a mixed-phase return (two-phase to separator or hybrid turbine), and a dry steam return (for direct flash turbine use). The operating mode may be selected based on the optimal balance of enthalpy density, recoverable thermal energy, surface conversion efficiency, or a combination thereof.

A map of thermal recovery potential vs. heat exchanger depth and reservoir temperature may be used to select installation depth. For steam cap reservoirs, additional control may enabled by matching the required enthalpy input (e.g., reservoir temperature) to available steam rates.

Figure 81:
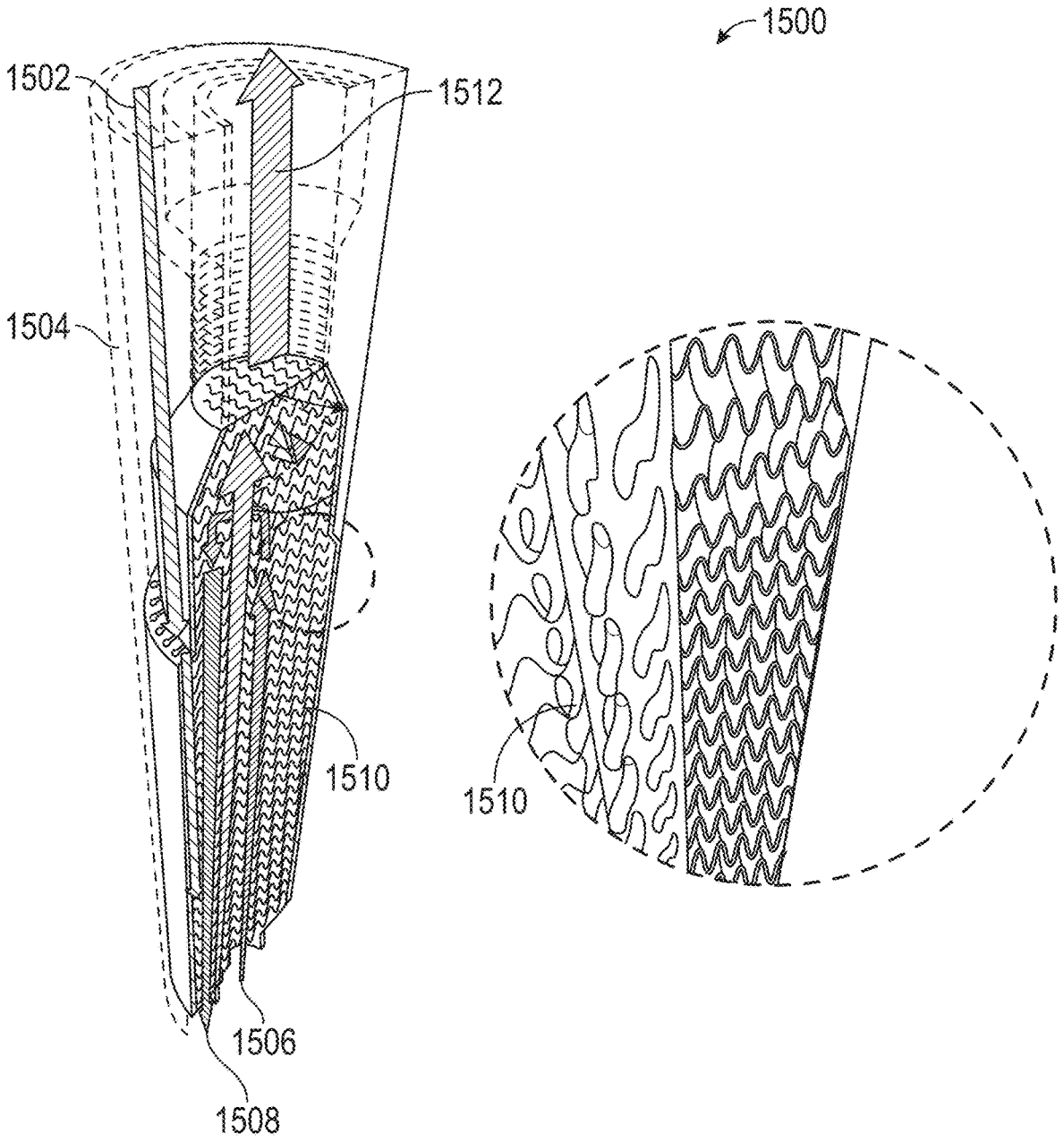
FIG. 81 is a diagram that shows an enthalpy upgraded FGC for mercury applications, according to an embodiment of the present invention.

The geothermal heating system may comprise an FGC enthalpy upgraded approach for mercury applications. FIG. 81 shows enthalpy upgraded FGC 1500. Enthalpy upgraded FGC 1500 may comprise passing a working fluid through surface loop annulus inlet 1502. The working fluid may be conveyed through well production casing 1504 and TPMS flow baffling 1510. Similarly, hot inlet fluid 1506 may be conveyed through TPMS flow baffling 1510. Hot inlet fluid 1506 may be conveyed from a pump, which may comprise an electric submersible pump. The working fluid and hot inlet fluid 1506 may thermally interact with one another as they are conveyed through TPMS flow baffling 1510. Hot inlet fluid 1506 exits TPMS flow baffling 1510 as cold reservoir return fluid 1508. The working fluid exits TPMS flow baffling 1510 as surface loop hot return fluid 1512.

Figure 82A:
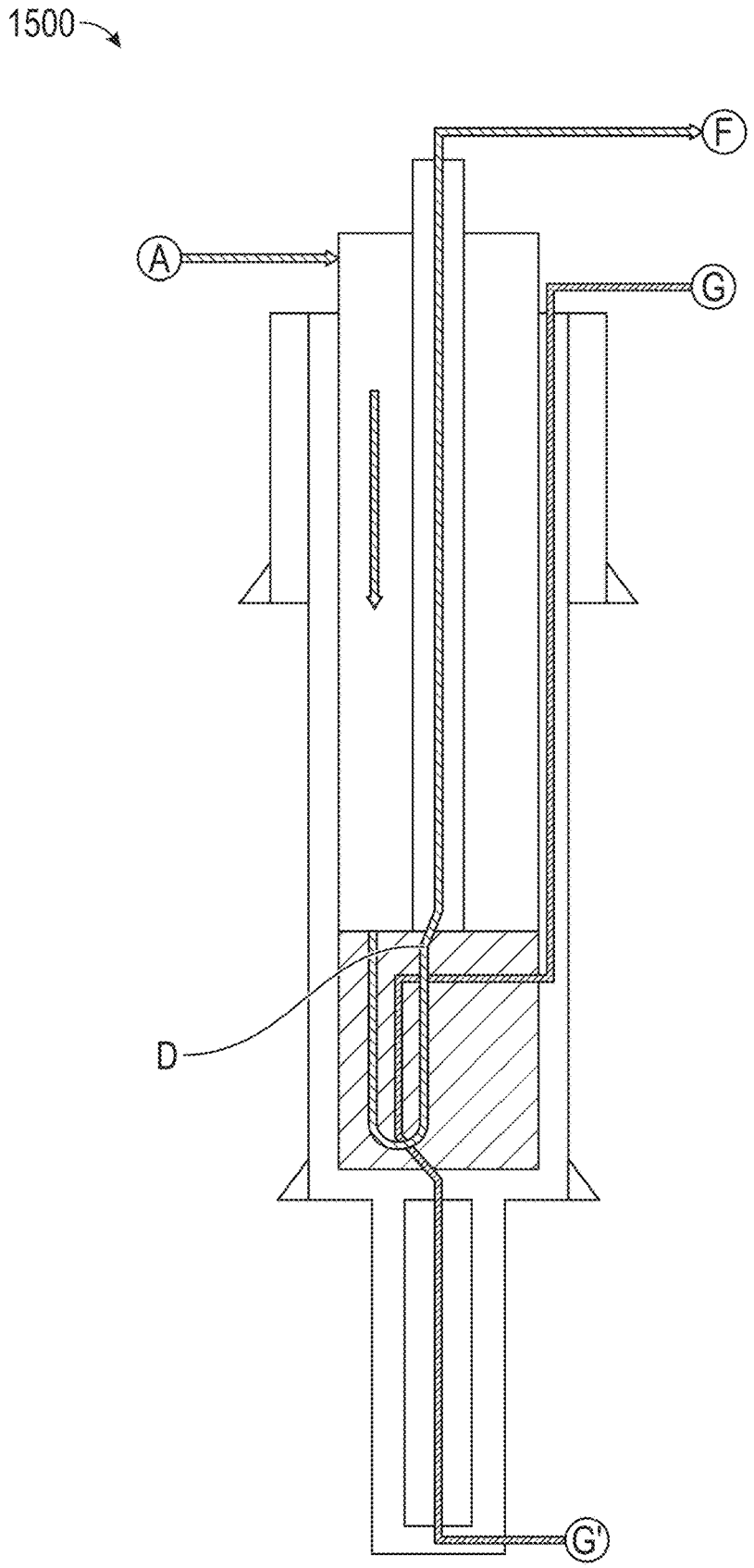
FIG. 82A and FIG. 82B are diagrams that each show different fluid property measurement points of an enthalpy upgraded FGC, according to an embodiment of the present invention.
Figure 82B:
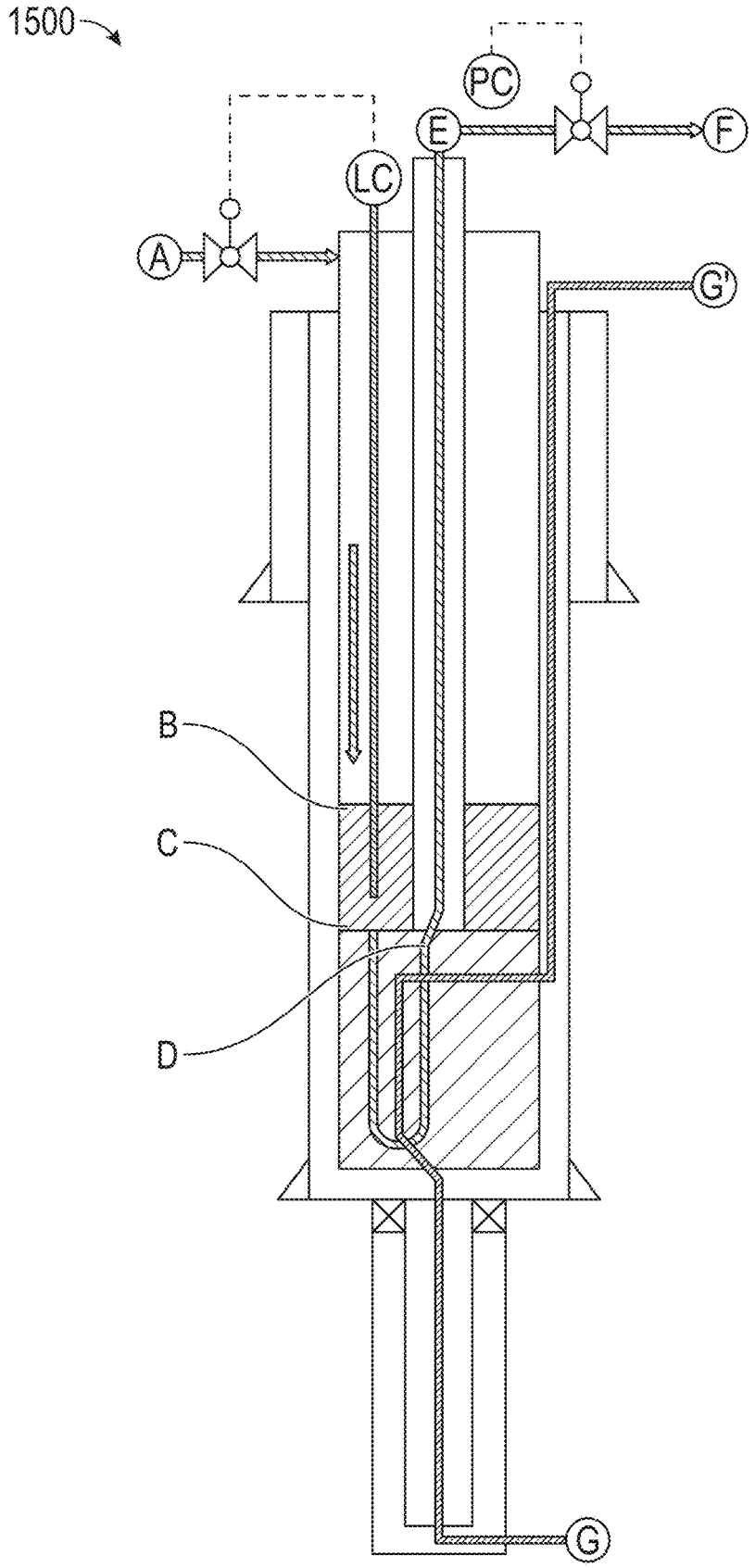

FIG. 82A and FIG. 82B show the fluid property measurement points of enthalpy upgraded FGC 1500, specifically, points A, B, C, D, E, F, G, and G'.

Figure 82C:
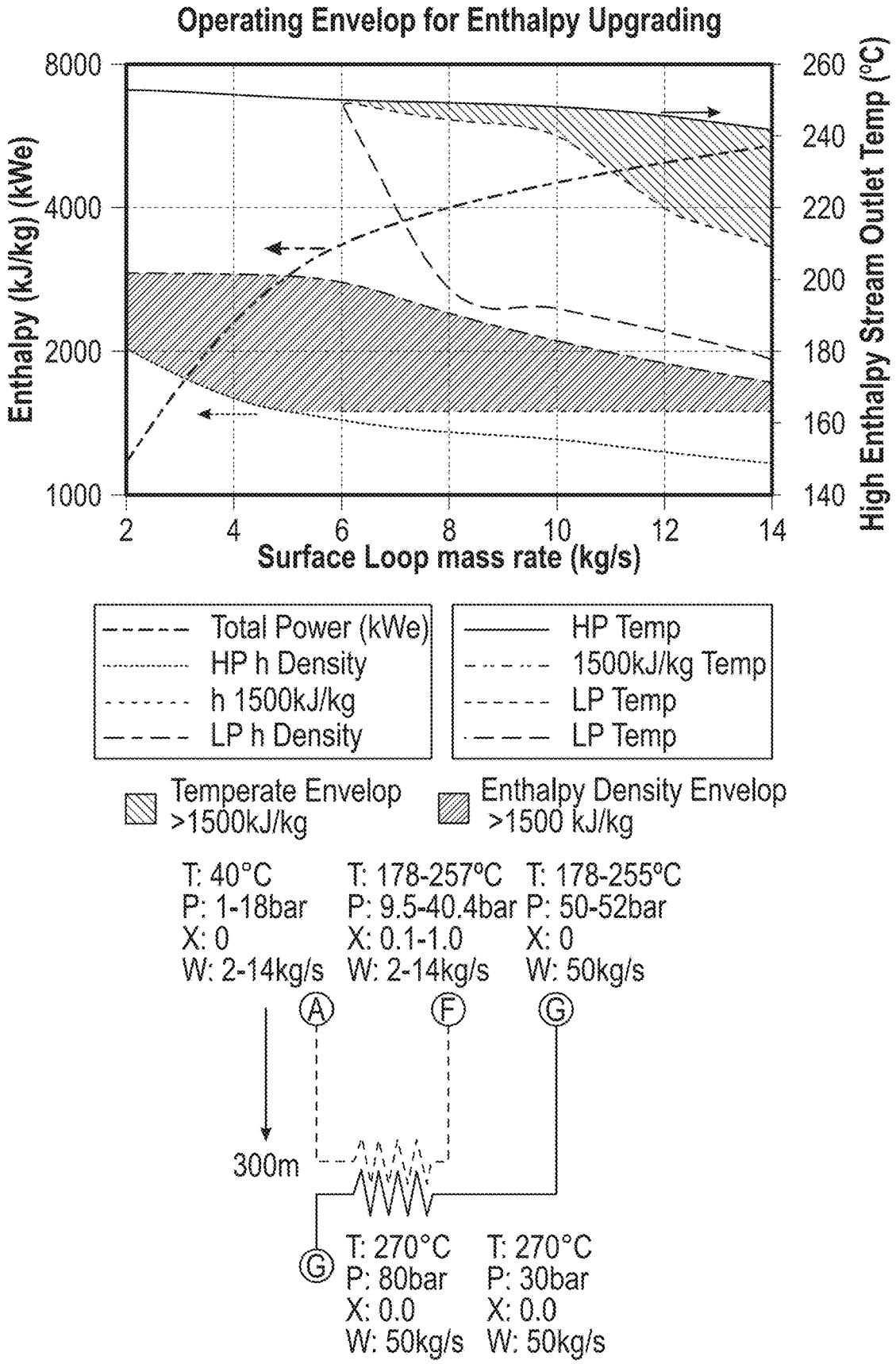
FIG. 82C is a graph that shows the operating envelop for enthalpy upgrading and a diagram that shows fluid properties measured at different measurement points in the enthalpy upgraded FGC, according to an embodiment of the present invention.
Figure 82D:
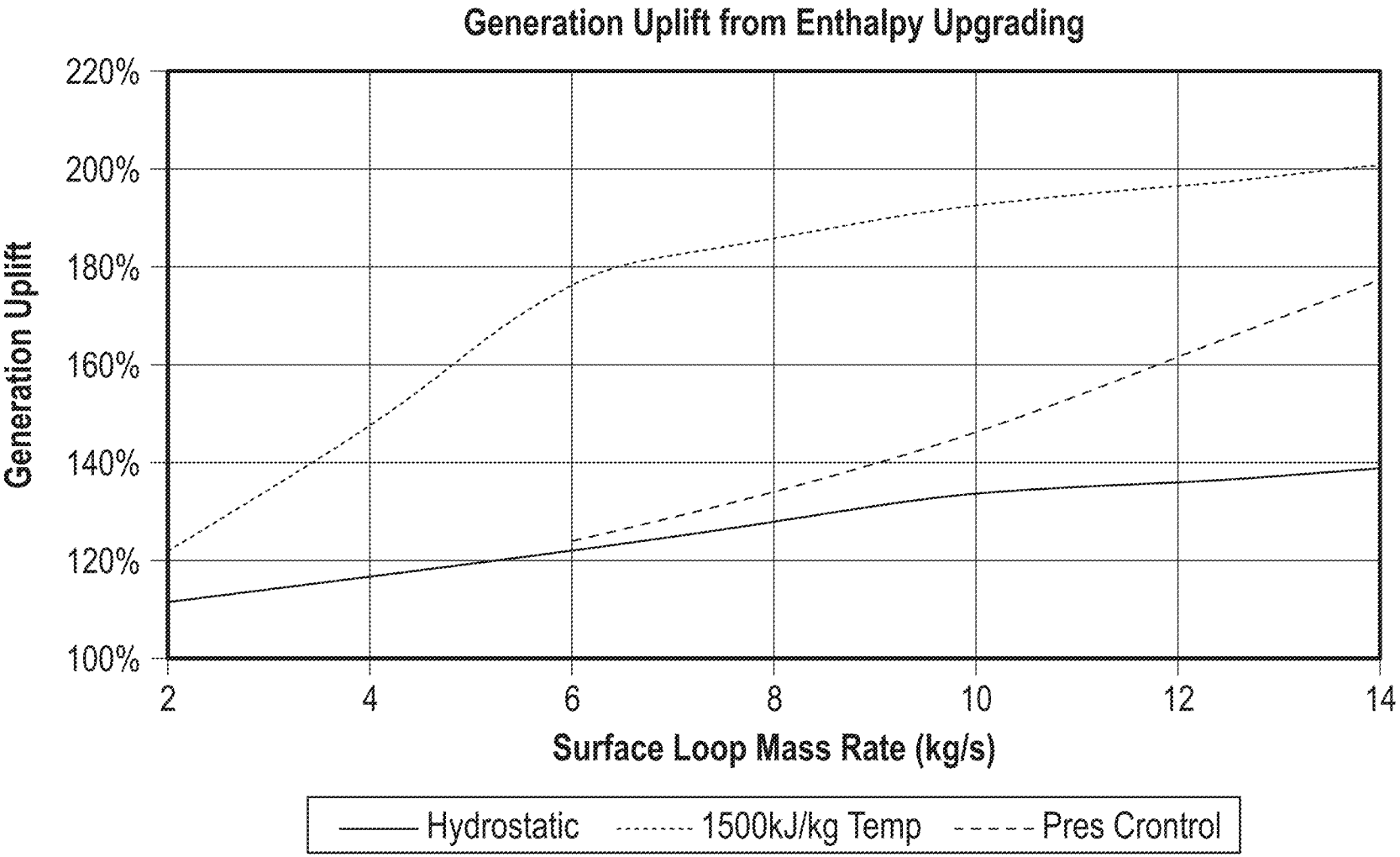
FIG. 82D is a graph that shows the generation uplift from enthalpy upgrading, according to an embodiment of the present invention.

FIG. 82C shows fluid properties measured at each measurement point in enthalpy upgraded FGC 1500 (See FIGS. 82A and 82B). FIG. 82D also shows the operating envelop for enthalpy upgrading by plotting surface loop mass rate (kg/s) against enthalpy (KJ/kg) (kWe). Also shown are the total power, density, mass flow rate, temperature, and specific heat capacity for various operating conditions of enthalpy upgraded FGC 1500 (See FIGS. 82A and 82B).

FIG. 82D shows the generation uplift enthalpy grading for hydrostatic, 1500 KJ/kg Temp specific heat capacity, and pressure control operating conditions of enthalpy upgraded FGC 1500 (See FIGS. 82A and 82B).

Figure 82E:
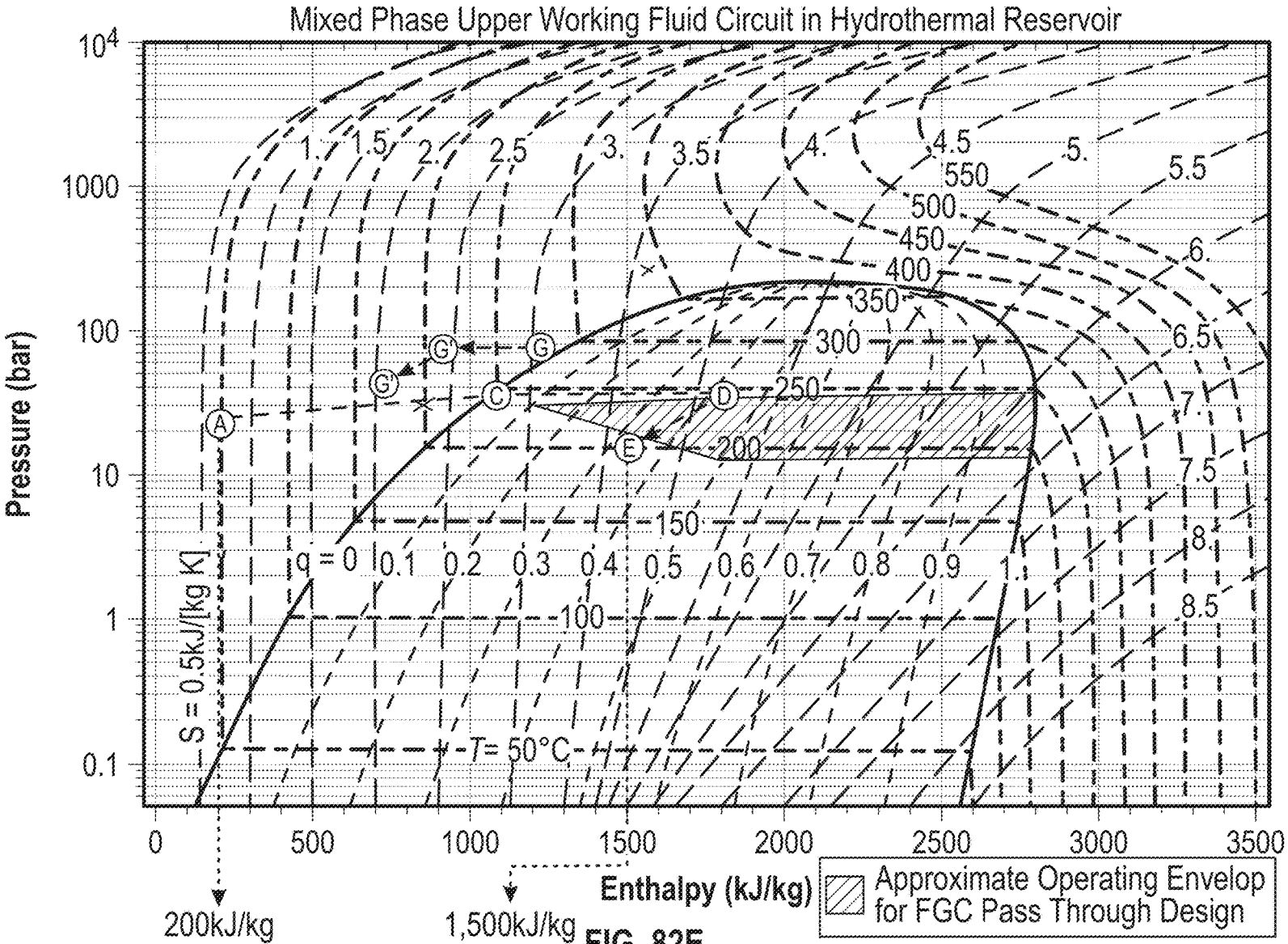
FIG. 82E is a graph that shows the enthalpy versus pressure for a mixed phase upper working fluid circuit in a hydrothermal reservoir, according to an embodiment of the present invention.

FIG. 82E shows the enthalpy versus pressure of a mixed phase upper working fluid circuit in a hydrothermal reservoir. Conditions at fluid property points A, C, D, E, G, and G' can be seen. Also shown is the approximate operating envelop for the FGC pass through.

Figure 83:
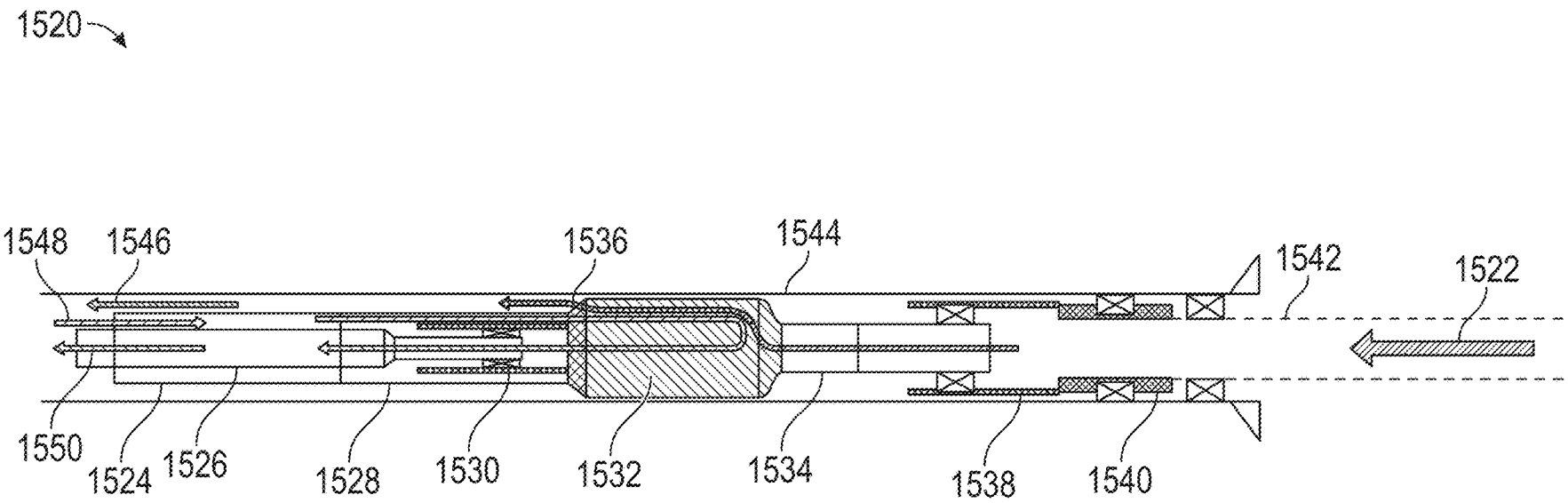
FIG. 83 is a schematic that shows an enthalpy upgraded well, according to an embodiment of the present invention.

FIG. 83 shows enthalpy upgraded geothermal heating system 1520. Enthalpy upgraded geothermal heating system 1520 may include heated fluid 1522, annulus drift casing 1524, VIT 1526, casing pup 1528, PBR 1530, heat exchanger 1532, tubing pup 1534, cold fluid outlet 1536, PBR 1538, permanent packer 1540, slotted production liner 1542, intermediate casing 1544, cooled fluid 1546, cold working fluid 1548, and hot working fluid 1550. Heated fluid 1522 flows through slotted production liner 1542 into enthalpy upgraded geothermal heating system 1520. Heated fluid 1522 transfers thermal energy to cold working fluid 1548 in heat exchanger 1532, and vice versa. Heated fluid 1522 is cooled into cooled fluid 1546 in heat exchanger 1532. Cold working fluid 1548 is heated into hot working fluid 1550 in heat exchanger 1532.

Optionally, VIT 1526 may be directed towards the surface.

Heated fluid 1522 may comprise, but is not limited to, a brine. Cooled fluid 1546 may comprise, but is not limited to, a brine.

The geothermal heating system may generate electricity from suspended geothermal wells and/or new greenfield geothermal developments, including those seeking to access shallow aquifers or reserved aquifers. The geothermal heating system may be configured for reservoir operating modes wherein hydrothermal brine is pumped through an FGC heat exchanger and a steam is condensed with a thermosyphon. The geothermal heating system may also provide means for upper loop working fluid to be operated at pressures independently of the reservoir conditions to optimize the quality of enthalpy recovered. geothermal heating system may comprise a liquid phase working fluid loop that leverages high mass circulation rates with lower enthalpy density. The geothermal heating system may comprise a controlled lower FGC heat exchanger with pressure that allows mixed-to-dry steam production at lower circulation rates but higher enthalpy density production.

The geothermal heating system of the present invention may comprise an FGC comprising a well bore, e.g., leg, proximate to an WBHX comprising an annulus. The distance between the WBHX and the FGC may form a circulation loop. The distance between the WBHX and the FGC may be at least about 1 meter, about 1 meters to about 300 meters, about 10 meters to about 275 meters, about 25 meters to about 250 meters, about 50 meters to about 225 meters, about 75 meters to about 200 meters, about 100 meters to about 175 meters, or about 250 meters. The well bore may comprise a sidetrack disposed proximate to the WBHX. The WBHX may comprise a thermal circulation system, a heat exchanger, a well bore, a fluid conduit, or a combination thereof. The WBHX may comprise a casing and may be screened for wellbore stability. The FGC and WBHX may be oriented into a horizontal well configuration; a deviated well configuration; a vertical well configuration; or a combination thereof.

The geothermal heating system may be installed into any sub-surface formation including, but not limited to rock including, but not limited to, granite, basalt, sandstone, limestone, shale, marble, schist, gneiss, quartz, volcanic rock, or a combination thereof; igneous, metamorphic, mineral, hydrothermal, sedimentary, glacial, fluvial, lacustrine, marine, volcanic (lava flows and volcanic breccias) formations, or a combination thereof; wind-blown deposits; organic deposits; oil sands; clay beds coal seams; or a combination thereof. The sub-surface formation may be at least partially disposed around the WBHX. The sub-surface formation may be highly permeable.

The geothermal heating system may comprise a pump, including but not limited to, an electric pump, a centrifugal pump, a rotary vane pump, an axial-flow pump, a piston pump, a screw pump, a peristaltic pump, a submersible pump, a lobe pump, a reciprocating pump, a progressing cavity pump, a plunger pump, a hydraulic pump, a radial piston pump, a flexible impeller, a turbine pump, or a combination thereof.

The geothermal heating system may also comprise a means to pump fluid between the annulus of the WBHX and the FGC leg. The means to pump fluid may be at least partially disposed in the well bore and/or well bore sidetrack, the WBHX wellbore, or at the surface. The means to pump fluid may comprise a pump.

The geothermal heating system may comprise a flow path between the FGC and the WBHX well bore through the reservoir rock. The flow path may be naturally occurring and/or artificially-produced. An artificial flow path may be formed by a proppant. The proppant may maintain connectivity and may include, but is not limited to, a sand, a ceramic, a gel, a foam, or a combination thereof.

The geothermal heating system may comprise energy extraction equipment. The energy extraction equipment may comprise a dry steam power plant or a component thereof; a flash steam power plant or a component thereof; a binary cycle power plant or a component thereof; energy extraction technology; or a combination thereof.

The geothermal heating system may comprise a heat transfer fluid or medium, e.g., a circulation fluid. The heat transfer fluid or medium in the reservoir rock may be circulated between the FGC and the WBHX. The medium and/or circulation fluid may comprise reservoir brine; produced water; salt water; hydrocarbon fluid, including but not limited to reservoir brine, diesel, or condensate; a gas, including but not limited to, nitrogen, carbon dioxide, a super critical gas, or combination thereof; a polymer, including but not limited to acrylamide, and polyacrylamide; propylene glycol; R-410A refrigerant; other mixtures to optimize energy recovery of the system; or a combination thereof. The geothermal heating system may comprise a well bore in communication with a surface to circulate the heat transfer fluid or medium from the WBHX to the energy extraction equipment.

The FGC may comprise a plurality of well bores and sidetracks. Each well bore or sidetrack may be a closed cycle geothermal system and may be a WBHX. The FGC may comprise a forced circulation loop between the FGC components and the WBHX. Fluid from the reservoir, or fluid that is introduced and maintained within the geothermal heating system, may be circulated via a pump to increase the rate and efficiency of energy extraction. The circulated fluid may also extract in situ hydrocarbons or minerals. The FGC may comprise a mono-bore. A pump may disposed within the mono-bore above, below, and/or besides the WBHX.

A pump may be installed in either the WBHX or FGC leg. The pump may reduce and/or minimize flashing of the reservoir fluid and/or reduce scaling or silicate formation. The pump may also reduce and/or eliminate GHG emissions that may occur with circulating reservoir fluid to the surface via a separate FGC wellbore. The pump may be disposed above, below, around, within, and/or beside the WBHX or FGC leg.

The geothermal heating system may comprise pump intake and/or return perforations that may be separated using deviated or horizontal drilling techniques to increase the energy recovery and take advantage of fracture networks for increased performance.

Separate FGC wellbores may be drilled. Drilling a secondary FGC well may be directed to the intersection of previously stimulated reservoir zones associated with the primary geothermal well. The previously stimulated reservoir zone may be naturally-occurring or may have been developed as part of the well completion process. Drilling a secondary FGC may convert a shale hydrocarbon wells to a geothermal closed cycle system or a hybrid hydrocarbon geothermal extraction systems. The FGC may be used to simultaneously extract hydrocarbons and circulate fluid to enhance geothermal energy recovery.

The heat transfer coefficient ("h") may be increased along with the rate of heat transfer from heat conduction and convection mechanisms by inducing a forced circulation of fluid between the WBHX and the FGC leg. The conductive and convective heat transfer rates may be increased by at least about 300%, about 300% to about 1,100%, about 400% to about 1,000%, about 500% to about 900%, about 600% to about 800%, or about 1,100% compared to a base closed loop design. The limiting factor for geothermal heat recovery may be shifted from the reservoir to the WBHX and associated FGC.

The direction of circulation may be from the FGC leg to WBHX or from the WBHX to the FGC leg. The need for a thermal gradient to drive energy transfer may be reduced or eliminated by flowing fluid from the FGC leg to the WBHX anulus. The temperature of the fluid contacting the WBHX increases to the temperature of the reservoir fluid. The WBHX temperature may be increased by at least about 5° C., about 5° C. to about 55° C., about 10° C. to about 50° C., about 15° C. to about 45° C., about 20° C. to about 40° C., about 25° C. to about 35° C., or about 55° C., over other geothermal heating designs. Energy extraction efficiency may be increased at the surface by at least about 5%, about 5% to about 50%, about 10% to about 45%, about 15% to about 40%, about 20% to about 35%, about 25% to about 30%, or about 50% compared to other geothermal heating designs. The layout configuration of the FGC leg relative to the WBHX leg may be optimized based on the reservoir properties to balance pumping requirements and the rate of circulation between the WBHX and the FGC.

The entirety of the latent heat energy of the reservoir may be extracted within the flow path between the FGC and the WBHX by reducing or eliminating the requirement for a driving temperature. This available latent heat energy for the system may be at least 10%, about 10% to about 100%, about 20% to about 90%, about 30% to about 80%, about 40% to about 70%, about 50% to about 60%, or about 100% above the increases in energy recovery from conduction and convection mechanisms. The circulation flow path may be expanded to increasing the total available volume of the reservoir for energy extraction. The circulation flow path may be expanded by increasing the dimensions of the FGC leg or by adding additional legs.

The same dynamic between thermal resistance and heat transfer coefficient ($r_2$) may exist for any number of the FGC legs. The flow requirements for fluid circulation in the FGC may be approximately modelled using Darcy's law derived for a radial flow pattern according to Equation 12.

$$q_o = \frac{2\pi \cdot K \cdot L_w (P_2 - P_1)}{\mu \cdot \phi \cdot \ln\left(\frac{r_2}{r_1}\right)} \tag{12}$$

Wherein:

$q_o$ is the flow rate in meters cubed per second ($m^3/s$);

$P_1$ is the pressure at the WBHX outer annulus (Pa); and $P_2$ is the pressure at distance $r_2$ the effective drainage radius (Pa).

The circulation rate from the FGC well, or sidetrack, may be a function of the pressure differential provided to the system; the reservoir properties; the dimensions of the FGC well or sidetrack; or a combination thereof. The length, diameter, and number of the FGC legs may be optimized to maximize the heat recovery capacity of the WBHX and the associated heat medium circulation system.

The FGC may comprise a well bore performance heat exchanger ("WBPHX"). The WBPHX may comprise at least about three, about three to ten, about four to nine, about five to eight, about six to seven, or about ten times more surface area per linear meter in the pipe in pipe and/or direct casing heat exchange designs. The WBPHX may allows for closer approach temperatures and therefore more energy recovery. The closer approach temperatures may be at least 3° C., about 3° C. to about 10° C., about 4° C. to about 9° C., about 5° C. to about 8° C., about 6° C. to about 7° C., or about 10° C.

The WBPHX may eliminate the constraint on current closed loop systems that requires the area intersected with the reservoir to provide heat exchange with the geothermal loop. The WBPHX may reduce the amount of intersecting reservoir area for the well bore, reduce drilling and well casing costs, and/or increase the amount of recoverable energy.

Lower well bore sections below the WBPHX may be downsized to reduce drilling cost. The lower leg may hold the inlet tubing and a screen to prevent ingress of debris. The tubing may comprise vacuum-insulated tubing ("VIT"). The WBPHX location may be optimized to minimize the energy requirements of the surface pump and the FGC pump.

The WBPHX may comprise an overall heat transfer coefficient between at least about 1000 Watts per meter squared Kelvin ("$W/m^2 \cdot K$"), about 1000 $W/m^2 \cdot K$ to about 4000 $W/m^2 \cdot K$, about 1500 $W/m^2 \cdot K$ to about 3500 $W/m^2 \cdot K$, about 2000 $W/m^2 \cdot K$ to about 3000 $W/m^2 \cdot K$, or about 4000 $W/m^2 \cdot K$. The WBPHX may comprise a utilize plate and/or a tube configurations with a plurality of counter and co-counter flow combinations to match the pressure drop and heat transfer requirements of the system.

Reservoir fluid in the FGC may be a single pass or multi pass configuration in the WBPHX with the feed or discharge of the pump being included in the circuit at the inlet, intermediary, or the outlet of the WBPHX. In the case of being at the inlet or outlet, the feed may be via a bypass of the WBPHX. A bypass may be required to accommodate the reservoir rock and fluid characteristics to avoid the potential for scaling or precipitation leading to fouling and/or plugging in the WBPHX.

The WBPHX may comprise a plurality of modules connected to provide the required sizing of the WBPHX. A pump may be configured to be located at the inline, intermediate stage, or outlet of the WBPHX to accommodate the subsurface requirements.

The FGC may comprise a down bore heat exchanger ("DBHX"). The DBHX may be configured to be least partially disposed within the well bore or a close loop circuit casing. The DBHX may a plurality of flow channels for the reservoir brine, medium, closed loop fluid medium, and/or other fluid to pass each other without mixing and allow for heat to transfer from the reservoir medium to the closed loop. The channels may be configured to generate cross and or counter flow patterns and minimize less efficient co-current flow patterns. The DBHX may comprise a sheet plate with patterns stamped to enhance heat transfer in a stacked configuration such that they may create alternating flow channels for a plurality of fluids to flow.

The geothermal heating system may comprise a triple propagating minimal structure ("TPMS"). The TPMS may form a compact flow channel with high surface area to volume ratios of at least about 200 $m^2/m^3$, about 200 $m^2/m^3$ to about 700 $m^2/m^3$, about 250 $m^2/m^3$ to about 650 $m^2/m^3$, about 300 $m^2/m^3$ to about 600 $m^2/m^3$, about 350 $m^2/m^3$ to about 550 $m^2/m^3$, about 400 $m^2/m^3$ to about 500 $m^2/m^3$, or about 700 $m^2/m^3$. TPMS structures may comprise a cell. The cell may comprise a matrix, radial, and/or geometric form. The cell may be configured with a height to width aspect ratio ranging from at least about 0.25, about 0.25 to about 4.0, about 0.5 to about 3.5, about 1.0 to about 3.0, about 1.5 to about 2.5, or about 4.0, with 1.0 representing an equally-dimensioned cube. A cell distortion may applied to match design criteria for pressure drop, area, or a combination thereof. Matching cells may be used to fit within the outer geometry boundaries of a WBHX. The WBHX with TPMS structures may have open side walls to allow direct cross flow from the reservoir matrix in to the WBHX or may be encased to direct the reservoir or closed loop media to improve pressure drop, heat exchange, direct flow, or a combination thereof.

The DBHX may comprise a thermosiphon and an open and/or closed sidewall. The sidewall may be used in combination with cell geometry to allow liquid hold up in the reservoir medium to enhance heat transfer. The liquid holdup may generate a thermosiphon effect with channeling at the base of the DBHX. The thermosiphon effect may create a draw down pressure across the sidewall of the bore hole producing additional acquirer fluid or steam. This flow may be enhanced with the use of an electrical submersible pump. The DBHX may be at least partially disposed above the reservoir zone where heat energy is being recovered. Reservoir fluid and/or steam may channeled to the DBHX via ESP or via a thermosiphon effect. The height difference between the DBHX and the reservoir allows for increase head to be generated with the cooled reservoir medium to improve injectivity. Injection or production of the reservoir fluid may be driven by thermosiphon or by ESP depending on the reservoir permeability and porosity properties and the desired enthalpy recovery rates.

The geothermal heating system may comprise a multi-stage stimulation configuration. The multi-stage stimulation configuration may comprise a well bore containing at least two stimulation fluids. The stimulation fluid may include, but is not limited to, a low-permeability proppant, a high-flow proppant, a high-thermal conductive proppant, an initiation fluid, or a combination thereof. The initiation fluid, which may comprise water and/or an aqueous solution, may expand a subsurface fissure and may form capillaries and/or fissures. The high-flow proppant may be a high-flow spherical proppant. The stimulation fluids may exit the well bore in any order. For example, the initiation fluid may exit the well bore first, the high-thermal conductive proppant may exit the well bore second, the high-flow proppant may exit the well bore third, and the a low-permeability proppant may exit the well bore fourth. The stimulation fluids may be disposed on top of one another within the well bore. The high-thermal conductive proppant may form a high thermal conduction layer created in capillary fissures and increasing the effective surface area. The high-flow proppant may form a high permeability zone to enhance convection heat transfer from a high conductive capillary layer. The low-permeability proppant may form a low permeability zone at the root of fissures to avoid short circuiting and improve overall convection heat transfer with the reservoir.

| | Proppant Type | Industry Name | Thermal Conductivity (W/m · K) | Metal Content | Compressive Strength (psi) | Flow Conductivity | Flow Productivity ($m^3$/day/bar) | Roundness | Porosity (%) | Permeability (mD) | Description |
|---|---|---|---|---|---|---|---|---|---|---|---|
| High Thermal Conductivity | Metal Proppants | High-Density Metal | ~200-300 | Very High | 30,000+ | Very High | 10 | 0.8 | 5-10 | 300-700 | Heavy proppants providing strength and conductivity in fractures. |
| | Metalized Proppants | Metalized Proppants | ~150-200 | High | 10,000-20,000 | Low | 1 | 0.7 | 5-10 | 100-200 | Proppants coated with metal for enhanced thermal conductivity and strength. |
| | Graphite-Based | Graphite Proppants | ~100-200 | High | 10,000-25,000 | Very High | 8.6 | 0.8 | 10-20 | 150-400 | Offers high thermal conductivity and flow characteristics. |
| | Silicon Carbide | SiCProppant | ~100 | Medium | 15,000+ | Very High | 7.6 | 0.9 | 10-15 | 200-600 | Extremely strong and thermally conductive, ideal for demanding applications. |
| High Permeability/ Flow Proppants | Metal Proppants | High-Density Metal | ~200-300 | Very High | 30,000+ | Very High | 10 | 0.8 | 5-10 | 300-700 | Heavy proppants providing strength and conductivity in fractures. |
| | Graphite-Based | Graphite Proppants | ~100-200 | High | 10,000-25,000 | Very High | 8.6 | 0.8 | 10-20 | 150-400 | Offers high thermal conductivity and flow characteristics. |

-continued

| | Proppant Type | Industry Name | Thermal Conductivity (W/m · K) | Metal Content | Compressive Strength (psi) | Flow Conductivity | Flow Productivity ($m^3$/day/bar) | Roundness | Porosity (%) | Permeability (mD) | Description |
|---|---|---|---|---|---|---|---|---|---|---|---|
| | Silicon Carbide | SiCProppant | ~100 | Medium | 15,000+ | Very High | 7.6 | 0.9 | 10-15 | 200-600 | Extremely strong and thermally conductive, ideal for demanding applications. |
| | Alumina-Based | Alu-Pro ™ | ~2.5 | Medium | 10,000-30,000 | Very High | 7.2 | 0.7-0.9 | 10-15 | 300-800 | High-strength proppant suitable for high-pressure environments. |
| | Ceramic Proppant | Tertiar ™ | ~1.0 | Low | 8,000-20,000 | High | 6 | 0.8-1.0 | 15-20 | 100-500 | Engineered for high strength and excellent flow characteristics. |
| | Resin-Coated Sand | Hybrid ™ | ~0.6 | Low | 7,500-12,000 | High | 3.6 | 0.5-0.9 | 20-25 | 100-300 | Sand coated with resin to improve conductivity and reduce fines. |
| | Silica Sand | Northern White Sand | ~0.6 | Low | 5,000-10,000 | Moderate | 2.4 | 0.5-0.8 | 25-30 | 50-100 | Commonly used proppant with good availability and moderate strength. |
| Low Flow/ Shutoff | Clay Proppants | Cay-Based Proppants | ~0.5 | Low | 2000-5,000 | Low | 0.3 | N/A | 15-30 | 10-50 | Generally lower strength and conductivity, suitable for specific applications. |
| | Water Shutoff Polymers | Various | ~1.0 | Low | 5,000-15,000 | Low | 0.2 | N/A | 5-15 | 1-10 | Used to seal off water-producing zones, enhancing production efficiency. |
| | Cement | Various | ~1.0-1.5 | Low | 3,000-6,000 | Low | 0.5 | N/A | 5-10 | 1-10 | Used for stability but offers low flow characteristics. |
| Reservoir | Sandstone | Sandstone Reservoir | ~1.0-1.5 | Low | 5,000-15,000 | Moderate | 5 | N/A | 15-25 | 50-300 | Common reservoir rock with moderate porosity and permeability. |
| | Shale | Shale Reservoir | ~0.5-1.0 | Low | 5,000-10,000 | Low | 0.3 | N/A | 5-15 | 1-50 | Fine-grained rock often with low permeability, can act as a seal. |

The geothermal heating system may comprise injection and/or production points that may be controlled with sliding sleeves to manage thermal recovery and reservoir temperatures, preventing scale or precipitation in the rock matrix.

The geothermal heating system may comprise a flux co-inverter ("FC"). The FC may comprise a cylindrical body with a plurality of interior channels separated by interior surfaces forming a cross sectional shape. A first channel may circular and be concentric with the cylindrical body, and a second and third channel maybe semi-circular around the first channel and be separated from each other and the first channel by a continuous surface (the first, second, and third channel configuration). A portion of the continuous surface may be in shapes of two semicircles. The two semicircles of the continuous surface may contract inwardly toward the center of the cylindrical body to form and "X" pattern and form four channels joined at a midpoint separated by the arms of the "X" pattern. The midpoint may separate with the upper and lower "X" patter arms separating and expanding outwardly toward the cylindrical body to reform the first, second, and third channel configuration perpendicular to the beginning first, second, and third channel configuration.

The FC may invert a coaxial flow. The FC may invert the outer annulus to the inner core and vice versa without mixing. The FC may change the DBHX into a counter-current flow. The hot and cold flows proceed opposite directions in a counter-current flow. The FC may increases the heat exchange efficiency by at least about 15%, about 15% to about 100%, about 20% to about 95%, about 30% to about 90%, about 40% to about 80%, about 50% to about 70%, or about 100%. The FC may allow the temperature difference in the closed loop for the same area to be increases by at least about 10%, about 10% to about 100%, about 20% to about 90%, about 30% to about 80%, about 40% to about 70%, about 50% to about 60%, or about 100%. The FC may allow net power to be increased by at least about 10%, about 10% to about 100%, about 20% to about 90%, about 30% to about 80%, about 40% to about 70%, about 50% to about 60%, or about 100%.

The counter current flow may allow for a smaller heat exchanger to be used, lowing the cost. The area of the DBHX may be reduce to least about 5%, about 5% to about 50%, about 10% to about 45%, about 15% to about 40%, about 20% to about 35%, about 25% to about 30%, or about 50%.

The FC unit may allow increased enthalpy extraction from the reservoir and for the configuration of the casing to be optimized. Reservoir cross flow regions my result in "cold" zones in the well bore relative to the geothermal profile. These cooler zones, can result in reversal of thermal energy transfer from the reservoir to the closed loop and with it a loss of overall potential thermal recovery. Using one or more FC units within the DBHX to invert the flow pattern from the core to the annulus in the proximity to the cross flow zone(s) may ensure the temperature difference between the reservoir and the DBHX is always such that the DBHX continues to recover enthalpy over the entire length. Similarly, the FC unit may also be applied when the cross flow reservoir horizons are hotter than the average geothermal profile in the well to ensure the efficiency of the DBHX is maximized.

The geothermal heating system comprising an FC may be completely in line with tubing. The geothermal heating system comprising an FC may be configured to avoid use a system of packers and set bypasses. A closed loop casing may be thread and run along the FC.

Net heat transfer Q is calculated by Equation 12:

$$Q = UA\,LMTD \tag{12}$$

Wherein:

U is the overall heat transfer coefficient measured in Watts per meters squared Kelvin ("$W/m^2 \cdot K$");

A is the area of the heat exchanger, measured is meters squared ($m^2$);

LMTD is the Log Mean Temperature Difference;

T1 is the reservoir hot temperature into the heat exchanger, measured in Kelvin ("K");

T2 is the reservoir cold temperature out of the heat exchanger, measured in Kelvin ("K");

Ta is the closed loop hot temperature exiting the heat exchanger for the fluid returning to the surface, measured in Kelvin ("K"); and Tb is the closed loop cold temperature of the fluid entering into the heat exchanger from the surface, measured in Kelvin ("K").

The Log Mean Temperature Difference is determined by Equation 13.

$$LMTD = (dT1 - dT2)/\ln(dT1/dT2) \tag{13}$$

Co-current temperature difference is represented by Equations 14 and 15.

$$dT1 = \text{Reservoir hot fluid temperature in}\,(T1) - \text{Closed Loop cold fluid temperature in}\,(Tb) \tag{14}$$

$$dT2 = \text{Reservoir cold fluid temperature out}\,(T2) - \text{Closed Loop hot fluid temperature out}\,(Ta) \tag{15}$$

Counter-current temperature difference is represented by equations 16 and 17.

$$dT1 = \text{Reservoir hot fluid temperature in}\,(T1) - \text{Closed Loop hot fluid temperature out}\,(Ta) \tag{16}$$

$$dT2 = \text{Reservoir cold fluid temperature out}\,(T2) - \text{Closed Loop cold fluid temperature in}\,(Tb) \tag{17}$$

For co-current flow, the term Ln (dT1/dT2) may be much higher than that for counter flow resulting in a lower LMTD. Therefore, less heat will be exchanged for the same area. The closed loop hot fluid return temperature may be limited to less than the cold reservoir fluid temperature, thus allowing more energy to be extracted.

To show, an exemplary system may have a reservoir fluid temperature (T1) of 240° C., a reservoir cold fluid temperature (T2) of 200° C., a closed loop cold fluid temperature (Tb) of 60° C., and a closed loop hot fluid temperature (Ta) of 190° C. Temperature Ta must be lower than the reservoir cold fluid temperature (T2) in a co-current heat system limiting the surface return temperature (Ta). of 190° C. assuming a 10° C. approach temperature. In the case of a counter current configuration, the surface return temperature of the closed loop is limited by the reservoir temperature (T1) and therefore the surface temperature (Ta) may be increased up to 230° C. in this configuration. The exemplary system may have an co-current LMTD of 58.8 and counter current LMTD of 87.4 (49.3 with a closed loop hot fluid temperature of 230° C.). These parameters provide 49% more energy (Q=UA LMTD) for exactly the same reservoir. The closed loop hot fluid return temperature may be increased up to 230° C. to recover additional energy.

Recovered heat energy $Q_r$ is represented by Equation 18.

$$Q_r = \dot{m}Cp\,dT \tag{18}$$

Wherein:

$\dot{m}$ is the mass flow rate measured in kilograms per second ("kg/s");

Cp is the latent heat coefficient; and dT is the change in the temperature of the medium, measured in K or ° C.

The change in temperature of the medium dT, is represented by Equation 19.

$$dT = CI\ \text{Hot} - CL\ \text{Cold} \tag{19}$$

Wherein:

CL Hot is the closed loop hot fluid temperature; and

CL Cold is the closed loop cold fluid temperature.

Using the parameters in the example above, and applying Equation 19, the Co-current temperature difference is 130° C. (190° C.-60° C.), and the counter current temperature difference is 170° C. (230° C.-60° C.), allowing for 30% more energy to be recovered by changing the direction of flow and without changing any other mechanical component. Decreasing the size of the system may also achieve greater energy recovery.

Figure 84:
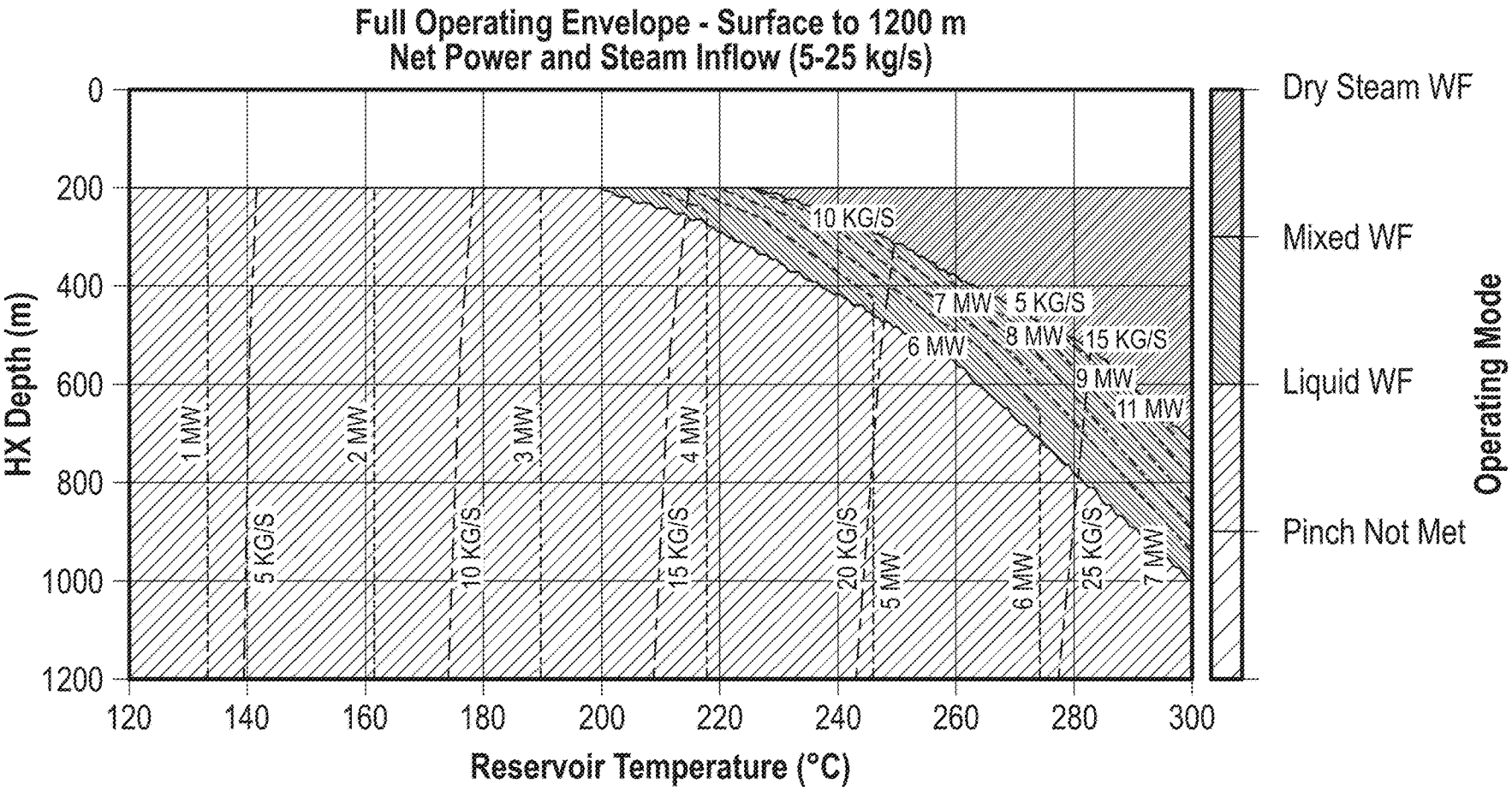
FIG. 84 is a graph showing an example full operating envelope for a geothermal heating system, according to an embodiment of the present invention.

An operating envelop for the FGC design showing where the optimum working fluid pressure for maximum and/or optimum energy recovery may be used. On cooler reservoirs and deeper wells, the working fluid generating the most enthalpy recovery may be operated in a liquid phase coupled with a binary ORC recovery plant. In hotter reservoirs, where the WBGHX could be set at shallower depths, significantly more power may be recovered. For example, a reservoir at 260° C. with a reservoir depth greater than 550 meters would have the potential to produce 5.5 Megawatt electrical ("Mwe"); however, by positioning the WBHX further up the casing (e.g., between about 400 meters to about 550 meters) the potential power generation from the well may increase from at least about 5.5 MWe, about 5.5 MWe to about 9 MWe, about 6 MWe to about 8.5 MWe, about 6.5 MWe to about 8 MWe, about 7 MWe to about 7.5 MWe, or about 9 MWe. The WBGHX may be set by having a partially vaporized working fluid and leveraging heat of vaporization to transport greater amounts of enthalpy for energy recovery, as shown in FIG. 84.

Figure 85:
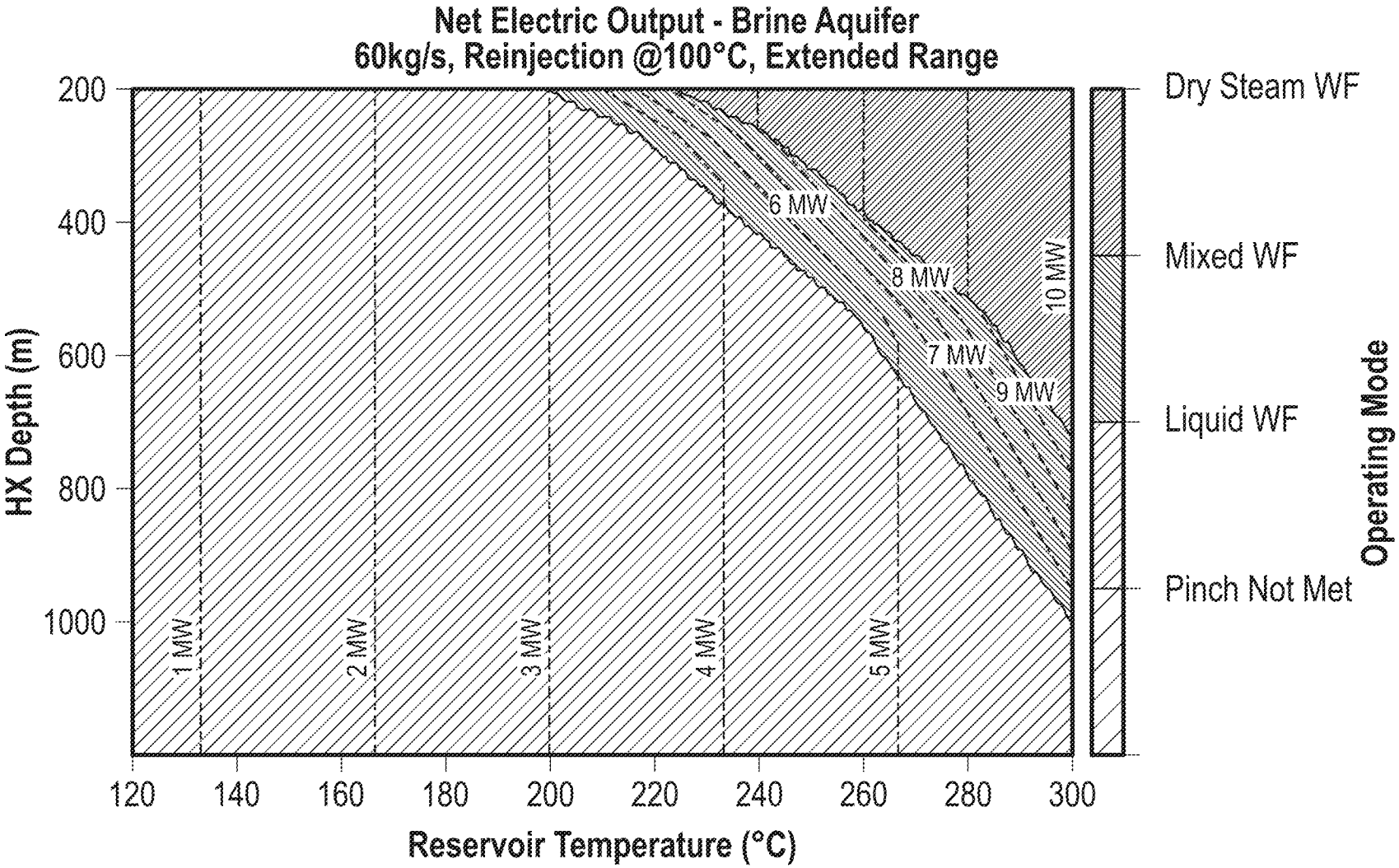
FIG. 85 is a graph showing the net electrical output for a geothermal heating system, according to an embodiment of the present invention.

For reservoirs that operate in a liquid phase, the WBGHX depth may be selected and/or adjusted. Selection and/or adjustment may maximize enthalpy recovery. The enthalpy recovery may be increased from at least about 4.5 MWe, about 4.5 MWe to about 8 MWe, about 5 MWe to about 7.5 MWe, about 5.5 MWe to about 7 MWe, about 6 MWe to about 6.5 MWe, or about 8 MWe by selection and/or adjusting the WBGHX depth to be at least about 400 meters below surface (versus being set above the reservoir), as shown in FIG. 85. This configuration may be operated if the liquid level in the well is naturally at 400 meters or less. The depth gyroid heat exchanger may be selected and/or adjusted to match the reservoir temperature and/or pressure.

Operating the FGC upper working loop pressured independently of the reservoir pressure may improves performance in certain conditions. Independent operation may result in about a 45% increase in total enthalpy per well. Enthalpy density may be higher (up to about +2 400 kilojoules per kilogram ("KJ/kg")) than liquid phase working fluid (e.g., water). Decoupling of the upper loop working pressure and the reservoir pressure may enable greater production and enthalpy upgrading.

FGC bottom hole assembly ("BHA") set depth, reservoir temperature, and intermediate casing diameters may impact the optimum total enthalpy recovery. BHA depth may be optimized and set independently of the reservoir or well depth. For hydrothermal pumped BHA configurations, the minimum depth may be limited by the liquid level in the well (it is preferably below this point). For steam cap reservoirs, the set depth for the BHA may be constrained by heat losses in the upper well bore.

The geothermal heating system may comprise a reservoir return channel. The reservoir return channel may be a multilateral channel, e.g., one or more lateral channel offshoots from a well bore. The reservoir return channel may comprise a packer, a casing, cement, a proppant, tubing, an inlet, exchanger, a liner, a thermosiphon, or a combination thereof.

The geothermal heating system may be used in combination with a system or process using an ORC. The geothermal heating system may be in communication with a condenser. The condenser may be component of a temperature regulation system.

The geothermal heating system may be used in combination with a system or process using a combined cycle thermal loop. The geothermal heating system may be in communication with a condenser receiving an input form a steam turbine or refrigeration compressor.

The geothermal heating system may comprise a hydraulic driver that is situated within, above, or below the WBGHX. The hydraulic driver may be driven by a working medium. A high-mechanical-integrity seal may be present between the surface loop and the WBGHX. The WBGHX may be set on its own casing that is installed within the production casing to form the high-mechanical-integrity seal. The hydraulic drive may reject the circulation fluid into the WBGHX where it exchanges thermal energy with the circulated reservoir medium. The hydraulic drive may be coupled with a lower assembly pump or compressor section. The coupling may take the form of a mechanical coupler with seals, a hydraulic system, and/or a magnetic coupling if a high-mechanical-integrity seal is required.

The geothermal heating system may comprise a plurality of multilateral channels. Each of the plurality of multilateral channel may having a multichannel casing design that is the same as or different another multilateral channel. A multilateral channels may be disposed above another multilateral channel or above an FGC.

The coupling mechanism may be a direct drive or geared depending on the requirements of the system. The geothermal heating system may operate in either direction depending on the reservoir characteristics and to take advantage of the geothermal gradient for greater energy transfer and minimal parasitic load for reinjection.

Embodiments of the present invention provide a technology-based solution that overcomes existing problems with the current state of the art in a technical way to satisfy an existing problem for the extraction of thermal energy or minerals. Embodiments of the present invention achieve important benefits over the current state of the art, including but not limited to improved energy and/or mineral production efficiency. Some of the unconventional steps of embodiments of the present invention include the incorporation of an FGC.

The terms, "a", "an", "the", and "said" mean "one or more" unless context explicitly dictates otherwise. Note that in the specification and claims, "about", "approximately", and/or "substantially" means within twenty percent (20%) of the amount, value, or condition given.

Embodiments of the present invention can include every combination of features that are disclosed herein independently from each other. Although the invention has been described in detail with particular reference to the disclosed embodiments, other embodiments can achieve the same results. Variations and modifications of the present invention will be obvious to those skilled in the art and this application is intended to cover, in the appended claims, all such modifications and equivalents. The entire disclosures of all references, applications, patents, and publications cited above are hereby incorporated by reference. Unless specifically stated as being "essential" above, none of the various components or the interrelationship thereof are essential to the operation of the invention. Rather, desirable results can be achieved by substituting various components and/or reconfiguring their relationships with one another.

What is claimed is:

1. A system for geothermal heating, the system comprising:

a forced geothermal circuit in communication with a well bore;

a gyroid heat exchanger;

said gyroid heat exchanger in communication with a closed loop working fluid circuit;

a thermosiphon; and a permeable casing.

2. The system of claim 1 wherein said closed-loop working fluid circuit comprises an annulus.

3. The system of claim 1 wherein said closed-loop working fluid circuit comprises insulated tubing.

4. The system of claim 1 further comprising a flux converter.

5. The system of claim 1 wherein said gyroid heat exchanger is a well bore gyroid heat exchanger.

6. The system of claim 1 further comprising a working fluid.

7. The system of claim 6 wherein said working fluid is pressurized.

8. The system of claim 6 wherein said working fluid comprises a liquid phase.

9. The system of claim 6 wherein said working fluid comprises a mixed-phase.

10. The system of claim 6 wherein said working fluid comprises a dry phase.

11. The system of claim 6 wherein said working fluid comprises a single phase.

12. The system of claim 1 further comprising a multilateral channel.

13. The system of claim 1 further comprising a central channel.

14. The system of claim 1 wherein said gyroid heat exchanger is configured to reduce parasitic load.

15. The system of claim 1 further comprising a triply periodic minimal surface lattice.

16. The system of claim 1 wherein said thermosiphon is configure to be self-controlling.

17. The system of claim 6 wherein said working fluid has a high enthalpy density.

* * * * *